US006748709B1

(12) United States Patent
Sherman et al.

(10) Patent No.: US 6,748,709 B1
(45) Date of Patent: Jun. 15, 2004

(54) CURTAIN WALL SUPPORT METHOD AND APPARATUS

(75) Inventors: Steven S. Sherman, Denver, CO (US); Richard A. Riddell, Littleton, CO (US); Paul A. Riddell, Highlands Ranch, CO (US)

(73) Assignee: Diversified Panel Systems, Inc., Denver, CO (US)

( * ) Notice: Subject to any disclaimer, the term of this patent is extended or adjusted under 35 U.S.C. 154(b) by 0 days.

(21) Appl. No.: 09/891,279

(22) Filed: Jun. 26, 2001

Related U.S. Application Data

(63) Continuation-in-part of application No. 09/483,586, filed on Jan. 14, 2000, which is a continuation-in-part of application No. 09/415,947, filed on Oct. 8, 1999, now abandoned.

(51) Int. Cl.[7] ..... E04B 2/96

(52) U.S. Cl. ..... 52/235; 52/509; 52/512

(58) Field of Search ..... 52/235, 506.01, 52/508, 509, 510, 512, 460, 461, 463, 464, 465, 468

(56) References Cited

U.S. PATENT DOCUMENTS

| | | | |
|---|---|---|---|
| 3,548,558 A | | 12/1970 | Grossman |
| 3,590,546 A | | 7/1971 | Lambert |
| 3,715,848 A | | 2/1973 | Jordan |
| 3,978,629 A | | 9/1976 | Echols, Sr. |
| 4,015,390 A | | 4/1977 | Howorth |
| 4,121,391 A | * | 10/1978 | Schroeder |
| 4,121,396 A | | 10/1978 | Oogami et al. |
| RE30,432 E | | 11/1980 | Stoakes |
| 4,302,503 A | | 11/1981 | Mattimoe |
| 4,344,267 A | | 8/1982 | Sukolics |
| 4,418,506 A | | 12/1983 | Weber et al. |
| 4,471,584 A | | 9/1984 | Dietrich |
| 4,506,484 A | | 3/1985 | Bartlett et al. |
| 4,597,235 A | | 7/1986 | Olsen |
| 4,662,136 A | | 5/1987 | Tanikawa et al. |
| 4,683,693 A | | 8/1987 | Rockar et al. |
| 4,841,700 A | | 6/1989 | Matthews |
| 4,996,809 A | | 3/1991 | Beard |
| 5,058,344 A | | 10/1991 | Biebuyck |
| 5,063,718 A | | 11/1991 | Nonis |
| 5,065,557 A | * | 11/1991 | Laplante et al. |
| 5,191,745 A | | 3/1993 | Story |

(List continued on next page.)

FOREIGN PATENT DOCUMENTS

| | | |
|---|---|---|
| DE | 11 09 345 | 6/1961 |
| EP | 0 549 215 A1 | 6/1993 |
| EP | 0 726 370 A2 | 8/1996 |
| EP | 0 844 341 A1 | 5/1998 |
| EP | 0 965 703 A2 | 12/1999 |
| GB | 2 135 355 A | 8/1984 |
| GB | 2 166 773 A | 5/1986 |

OTHER PUBLICATIONS

U.S. patent application Ser. No. 09/483,586, filed Jan. 14, 2000.

*Primary Examiner*—Michael Safavi
(74) *Attorney, Agent, or Firm*—Fitzpatrick, Cella, Harper & Scinto

(57) ABSTRACT

A curtain wall (ACM) system has vertical mullions and horizontal supports which provide a dry as well as a structural system for non-sequential construction of curtain wall exteriors. Internal gutters offer a failsafe moisture proof system. The horizontal and vertical framework members may be mounted in the reverse orientation for special exterior wall configurations. Individual panels can be replaced without sealants or tear down of neighboring panels. A face support for the thin ACM panels is provided. Thermal expansion is addressed with a floating panel on a track design. Alternate embodiment includes transition frame members having glass and metal panel integral supports, freestanding X-Y sub-frame assemblies, fiber optic outboard channels and novel methods of assembly.

13 Claims, 102 Drawing Sheets

U.S. PATENT DOCUMENTS 5,199,236 A 4/1993 Allen
5,216,858 A * 6/1993 Gilmour
5,220,759 A 6/1993 Hossli
5,226,274 A * 7/1993 Sommerstein
5,452,552 A 9/1995 Ting ..... 52/235
5,493,831 A 2/1996 Jansson
5,522,193 A * 6/1996 Sommerstein et al.
5,596,851 A 1/1997 Ting ..... 52/211
5,598,671 A 2/1997 Ting ..... 52/235
5,598,672 A 2/1997 Nawa
5,611,184 A 3/1997 Felix et al.
5,687,524 A 11/1997 Ting ..... 52/461

* cited by examiner

CURTAIN WALL SUPPORT METHOD AND APPARATUS

CROSS REFERENCED PATENTS

This application is a continuation in part of U.S. application Ser. No. 09/483,586 filed Jan. 14, 2000, which was a continuation in part of U.S. application Ser. No. 09/415,947 filed Oct. 8, 1999, now abandoned.

BACKGROUND OF THE INVENTION

1. Field of Invention

The present invention relates to building exteriors, and interior wall and ceiling covering using curtain wall systems; said systems having box top shaped composite panels hung on the exterior building sheathing or other framework.

2. Background of the Invention

There are two basic types of systems for the curtain wall aluminum composite material (ACM) market. They are a wet and a dry system. A wet system uses a sealant as its primary seal against moisture. A dry system uses a gasket as its primary seal against moisture.

Most patented curtain wall systems pertain to flat glass panel type curtain wall panels. A brief summary of this flat glass panel support structure art follows below.

U.S. Pat. No. 3,548,558 (1970) to Grossman discloses a mullion system (vertical members between window lights) for a curtain wall exterior. An anchor 101 supports a plate which supports a mullion column having segments 107.

U.S. Pat. No. 3,978,629 (1976) to Echols Sr. discloses a glass panel thermal barrier vertical mullion. Each mullion has an exterior member with a track for maintenance conveyances and has an interior metal member, and has a insulating foam layer therebetween.

U.S. Pat. No. 4,015,390 (1977) to Howorth discloses a glazing structure for a glass panel/curtain wall building.

U.S. Pat. No. 4,121,396 (1978) to Oogami et al. discloses a curtain wall frame structure having channel crossings with four integral legs and backup bars.

U.S. Pat. No. 4,418,506 (1983) to Weber et al. discloses a curtain wall frame structure adding a insulating separator (56) and an insulated bolt to a known frame structure for insulation.

U.S. Pat. No. 4,471,584 (1984) to Dietrich discloses a skylight system with a unique support structure to support a curtain wall flat.

U.S. Pat. No. 4,841,700 (1989) to Matthews discloses a two-piece mullion frame for reducing the face dimension of an aluminum frame.

U.S. Pat. No. 4,996,809 (1991) to Beard discloses a flat panel skylight support frame having built in condensate gutters.

U.S. Pat. No. 5,065,557 (1991) to Laplante et al. discloses a dry gasket seal frame structure for a curtain wall which uses a flat curtain wall panel having inner and outer panel faces, and a spaced apart vertical edge therebetween. A panel can be replaced without having to dismantle any portion of the curtain wall other than the damaged panel.

U.S. Pat. No. 5,199,236 (1993) to Allen discloses a flush appearance glass panel frame structure.

U.S. Pat. No. 5,493,831 (1996) to Jansson discloses a glass panel building support frame presenting a sealed glaze edge between the glass panels.

As Laplante et al. teaches it is advantageous to be able to replace a damaged curtain wall panel using a dry seal, and further advantageous to be able to leave the horizontal and vertical support channels in place for the replacement. The present invention meets these needs in a dry ACM system.

One patented ACM system is U.S. Pat. No. 4,344,267 (1982) to Sukolics which discloses a curtain wall frame structure which allows thermal expansion of the panels to be absorbed by the joints. A vertical channel has a pair of pivotable arms to receive the sides of adjoining panels. In the present invention the exact same ACM may be used. Sukolics requires that a sheathing be installed over the support studs of the building. Then Sukolics' thin and relatively weak, non-structural mullions and horizontal supports can be mounted in a non-sequential (also called non-directional) fashion. This non-sequential erection fashion is preferred over sequential systems. Sequential systems require starting construction at the bottom of a building and progressing left to right, one row at a time, building one row on top of a lower row. Sukolics enables wall construction from the top down which is how rain hits the building during construction. Therefore, using Sukolics' system a builder can erect the frame, complete the roof, then construct the curtain walls from the top down to minimize rain damage to the exposed sheathing of the building.

The present invention provides the same non-sequential method for construction; additionally adding structural mullions and horizontal supports thereby allowing direct fastening to the frame and eliminating the sheathing if desired.

The present invention provides for thermal expansion by means of using floating curtain wall members which expand and contract in their mounting tracks located in the vertical mullions and horizontal supports.

Another prior art reference is a patent pending curtain wall apparatus trademarked RRD200™ by Elward Systems Corporation of Denver, Colo. A combination horizontal support and perimeter extrusion (corner brace) is used, made of aluminum. The top and one side of the curtain wall is firmly bolted to the building. Thus, no "flotation" of the curtain wall exists on an X-Y frame structure as is the case in the present invention. Flotation reduces stresses on the curtain wall panels during thermal and/or stresses on the curtain wall panels setting movement of the building.

Panel installation begins at the bottom with panels interleaving at the sides utilizing "male/female" joinery working left to right. Installation continues by stacking the next row on top of the first row and continuing the left to right sequence. Therefore, an individual panel cannot be removed from the center of the wall without removing adjacent panels.

While it is basically a "dry" system because of the use of wiper gaskets, exposed sealant is used in the 4-way intersections due to the male/female differences of the perimeter extrusions.

Rout and return and curtain face support is provided by the perimeter extrusions. The ACM panels are fabricated utilizing known rout and return methodology. The various perimeter extrusions for the curtain wall panels are four different extrusions making the panel "handed". The present invention uses panels which are symmetrical, facilitating installation.

The system does include a gutter, but it is not continuous and not part of a sub-system, and the gutter only exists on the horizontal member. Weep holes in the horizontal member allow water to flow out and over the curtain wall panels. No integrated X-Y gutter system exists.

The system requires 16-guage (non-standard) studs at precise locations for vertical attachment to the structure, thereby greatly adding to the building cost compared to the present invention. The system does not allow for a "jointless" appearance because it doesn't have a face cap that can be flushed or recessed from the face of the panel. The system does not allow for multiple "joint" colors.

Perimeter extrusions are not the same depth, thus requiring complex shimming; sequential, non-subsystem installation does not allow for integrated three dimensional panels to be incorporated within the system (i.e. signage or column covers, or accent bands that are not flat). The system does not allow for three dimensional joints like a rounded bullnose that would protrude away from the panel.

Another prior art system, shown in FIGS. 1–3, is the Miller-Clapperton MCP System 200-D™ (referred to herein as "the MCP system"). The MCP system employs panels made of aluminum composite material (ACM) 1000 as components of an exterior curtain wall or facade of a building. As shown in the vertical sectional view of FIG. 2, a horizontal attachment support 30' is screwed into sheathing, such as plywood, or through non-structural sheathing, such as gypsum board, into structural building members using structural screws 70'. Vertical corner clips 3' and 40' are used to attach the panel 1000 to the horizontal attachment support 30'. The clips 3' and 40' attach only to the return leg 22 of panel (i.e., the portion of the panel that is folded 90-degrees after a rout is performed so as to be perpendicular to the face 23) and provide no support to the face 23 of the panel. Raised positive return attachment rivets 9' are used to attach the clips.

A continuous inverted support channel 60' is secured by a plurality of self-drilling fasteners 5' that penetrate horizontal attachment support 30'. A continuous snap cover 80' is provided over the channel 80'. Caulking C is used as the primary seal to keep air and water from the inverted support channel 60'. Systems that use caulking as a primary seal are referred to in the industry as a "wet" system. Among the disadvantages of this design, is that failure of the caulking may result in uncontrolled water entering the building. For example, water may enter through the points at which the fasteners 5' and 70' penetrate the horizontal attachment support 30'.

As shown in the horizontal sectional view of FIG. 1, vertical attachment support 2' is screwed into sheathing, such as plywood, or through non-structural sheathing, such as gypsum board, into structural building members using structural screws 6'. Vertical corner clips 3' and 40' are used to attach the panel 1000 to the horizontal attachment support 30'. The clips 3' and 40' attach only to the return leg 22 of panel and provide no support to the face 23 of the panel. Raised positive return attachment rivets 8' are used to attach the clips. A continuous inverted support channel 4' is secured by a plurality of self-drilling fasteners 5' that penetrate vertical attachment support 2'. A continuous snap cover 7' is provided over the channel 4'. Caulking C is used as the primary seal to keep air and water from the inverted support channel 4'. As above, failure of the caulking may result in uncontrolled water entering the building. For example, water may enter through the points at which the fasteners 5' and 6' penetrate the vertical attachment support 2'.

In the MCP system, the horizontal attachment supports 30' and vertical attachment supports 2' used to support the panels 1000 do not have gutters or channels for directing moisture away from the building and do not offer a secondary or failsafe water seal. As discussed above, a disadvantage of this design is that failure of the caulking may result in uncontrolled water entering the building, such as for example through the points at which the fasteners penetrate the horizontal and vertical attachment supports.

Another disadvantage of the MCP system is that, as shown in FIG. 3, the horizontal and vertical attachment supports are not mechanically attached. To the contrary, these members merely abut one another, rather than being mechanically attached as a continuous, integrated structure. Another disadvantage of the MCP system is that each of the vertical attachment supports requires two 18 gauge metal studs for attachment, because these members do not interface mechanically. More generally, because neither the horizontal nor the vertical supports act as structural elements, these members require support from the building structure.

The MCP system uses three different extrusions (i.e., corner clips 3' and 40') to attach the panels 1000 to the horizontal and vertical supports. As shown in FIG. 1, the extrusions on the sides of the panels (3') are similar and are continuous along those edges. However, as shown in FIG. 2, the extrusion on the top of the panel (40' on the lower panel) is a clip that inserts into a channel in the horizontal attachment support 30', rather than being secured using a fastener 5', as is the extrusion on the bottom of the panel (40' on the upper panel). Accordingly, the panel has a defined top and a bottom because of these different extrusions, i.e., the orientation of the panel cannot be changed after the extrusions have been attached to the panel. Each of these three types of extrusions attach to the return leg 22 of the panel through the use of a pop rivet 8' and 9'.

One disadvantage of this configuration is that the extrusions do not provide corner support to the face 23 of the panel. This allows the return leg 22 to flex, which applies stress to the 0.020" aluminum corner (the panel 1000 is typically 3 mm, 4 mm, or 6 mm thick, but when the inside face and the polyethylene core are routed out from the back to form the return leg 22, all that remains to hold the return leg 22 to the front of the panel 23 is the 0.020" aluminum face). In addition, because the extrusions are not continuous around the panel (i.e., do not form a continuous frame around the panel), the panel receives no diaphragm support and the face of the panel can distort under stress. Moreover, the three extrusions attach directly to the aluminum subsystem without a thermal break, which allows the transfer of heat and cold through the curtain wall.

In view of the deficiencies of the prior art discussed above, the new and non-obvious enhancements to curtain wall methods and apparatus provided by the present invention include: a dry system having a built in gutter system for rain and condensate, a failsafe moisture proof system, a flexible framework enabling vertical and horizontal support structures to be interchanged (providing flexibility during construction), support braces for the face of the curtain wall, and an alignment process for curtain wall panel alignment during construction.

SUMMARY OF THE INVENTION

The main aspect of the present invention is to provide a non-sequential, dry ACM system having structural mullions which can be mounted to the raw studs of a building.

Another aspect of the present invention is to provide a built in gutter system for the vertical mullions and the horizontal supports, thereby providing a failsafe moisture prevention system.

Another aspect of the present invention is to provide a support for the face of the curtain wall panel.

Another aspect of the present invention is to provide a framework having interchangeable vertical and horizontal mounting options.

Another aspect of the present invention is to provide for symmetrical (versus "handed") panels to facilitate installation.

Another aspect of the present invention is to provide a method to align curtain wall panels during construction.

Another aspect of the present invention is to provide three curtain wall systems, wherein there exists interchangeable parts for all three systems from the curtain wall face to the bottom of the primary seal.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 16:
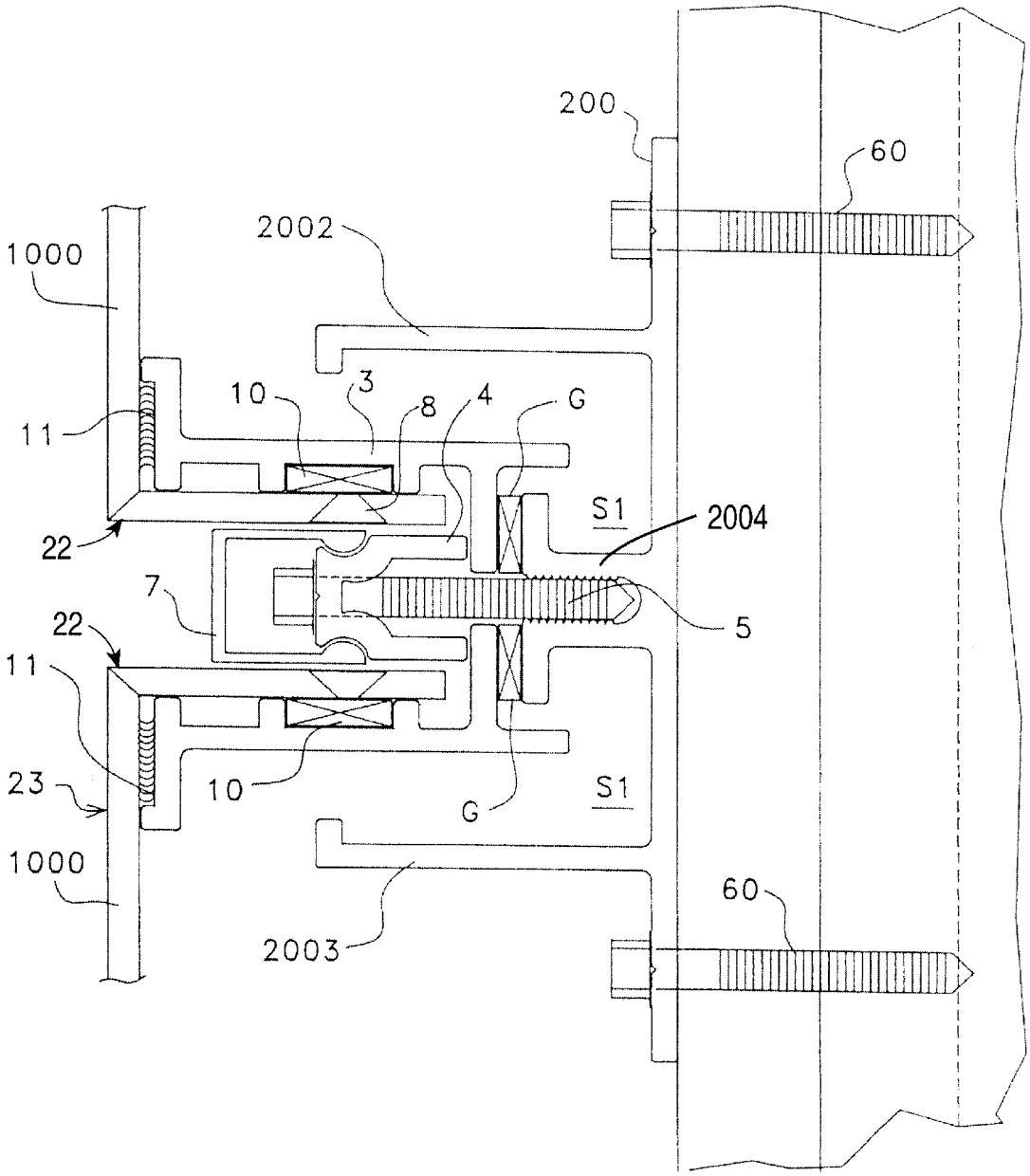
FIG. 16 is a vertical sectional view showing the horizontal support taken along line 16—16 of FIG. 10.
Figure 17:
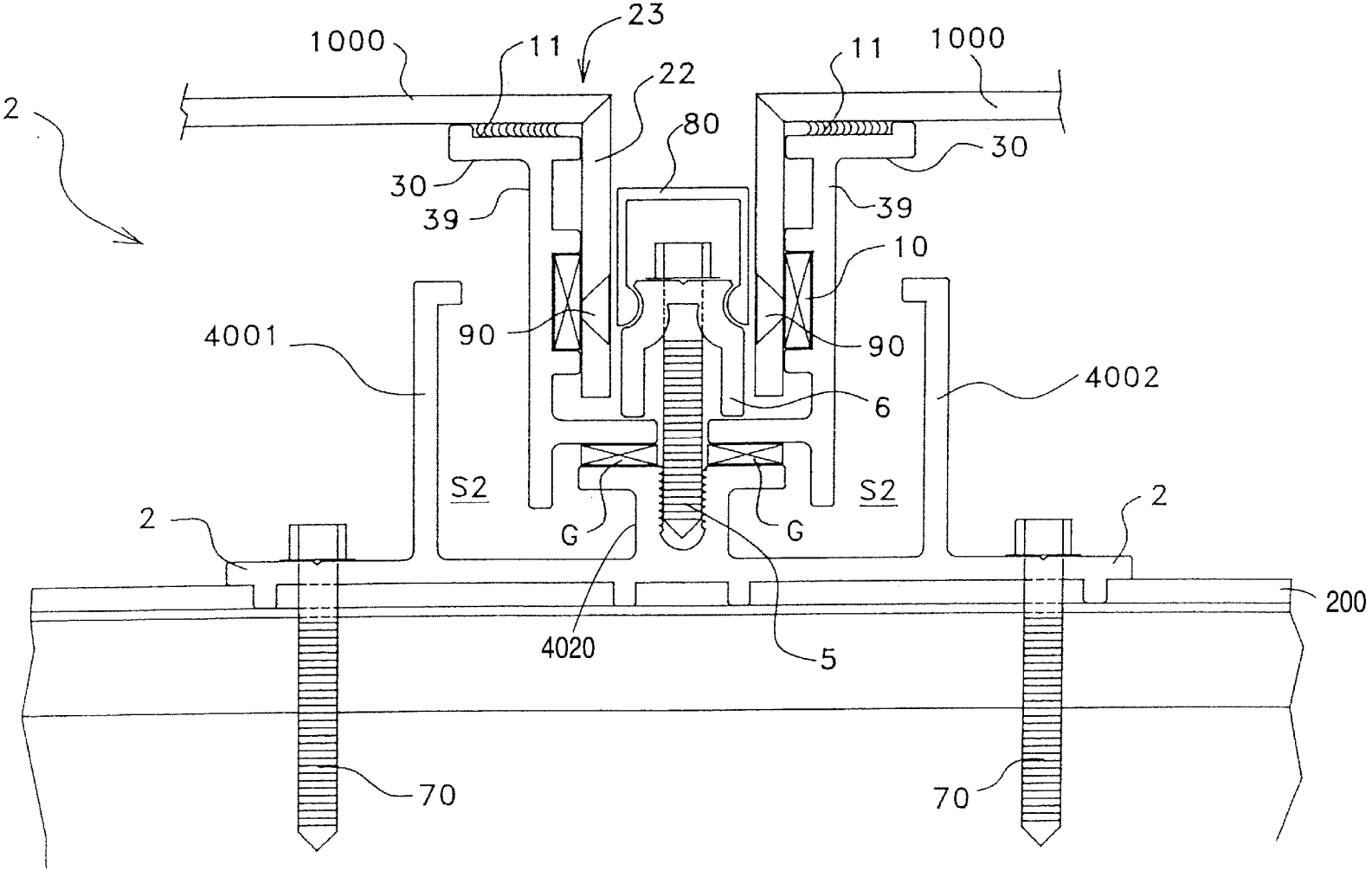
FIG. 17 is a horizontal sectional view showing the vertical mullion taken along line 17—17 of FIG. 10.

The preferred embodiment (referred to as DPS4000™) is shown, e.g., in FIGS. 16 and 17. The system employs aluminum composite material (ACM) panels 1000 as components of an exterior curtain wall or facade of a building. As shown in the vertical sectional view of FIG. 16, a horizontal gutter support 200 is screwed into sheathing (any continuous covering that is attached to the building structure, e.g., plywood, gypsum board, fiberglass board, etc.), or directly into structural building members (structural members that carry the wind load deflections of the building, e.g., structural steel, miscellaneous steel, structural studs, dimensional lumber, concrete, etc.) using structural screws 60. The structural screws 60 are located outside of the gutters S1 that on either side of the horizontal joint (i.e., the assembly that connects the panels 1000 to the horizontal gutter support 200) so that water leaking into the gutters S1 cannot seep through to the building structure.

A perimeter corner brace 3 is provided that contacts both the face 23 and the return leg 22 of the panel 1000 to provide support for the 90-degree corner. Sealant 11 is used to maintain air and water integrity and to attach the face 23 of the panel 1000 to the corner brace 3, providing diaphragm support to the face 23. A recessed positive return attachment screw 8 is used fasten the return leg 22 of the panel 1000 to the corner brace 3. The return attachment screw 8 is screwed into self-sealing butyl tape 10, which provides an air and water seal.

A dry gasket primary seal G is provided to insulate the gutter space S1 from air and water, but a failure of the gasket G merely allows water into the gutter space S1, rather than the building structure. A continuous support channel 4 is secured by a plurality of machine screws 5 without penetrating the horizontal gutter support 200, which offers a dry, watertight assembly even in the event of failure of the gasket primary seal G. A continuous snap cover 7 is provided to cover the support channel 4.

The panels 1000 are held to the sub-system by a continuous support channel 4 that is secured by a plurality of machine screws 5 into a screw boss 2004 without penetrating the horizontal gutter support 200. This configuration allows a dry, watertight assembly to be maintained, even in the event of failure of the gasket primary seal G. The pressure provided by the continuous support channel 4 forces the neoprene gasket G on the bottom of the perimeter extrusion frame 3 against the horizontal gutter support 200, thereby providing the primary seal without the use of sealants (i.e., a "dry" seal). The dry gasket primary seal G insulates the gutter space S1 from air and water, but a failure of the gasket G merely allows water into the gutter space S1, rather than the building structure. A continuous snap cover 7 is provided to cover the support channel 4.

As shown in the horizontal sectional view of FIG. 17, a vertical gutter support 2 is screwed into the horizontal gutter support 200 flanges and into the building structure using structural screws 70 to create a guttered sub-system. The structural screws 70 are located outside of the gutters S2 on either side of the vertical joint (i.e., the assembly that connects panels 1000 to the vertical gutter support 2) so that water leaking into the gutters S2 cannot seep through to the building structure.

A perimeter corner brace 3 is provided contacts both the face 23 and the return leg 22 of the panel 1000 to provide support for the 90-degree corner. As above, sealant 11 is used to maintain air and water integrity and to attach the face 23 of the panel 1000 to the corner brace 3, providing diaphragm support to the face 23. A recessed positive attachment screw 90 is screwed into self-sealing butyl tape 10, which provides an air and water seal.

The perimeter corner braces 3 are joined with the perimeter corner braces 3 of the horizontal gutter support 200 to form a perimeter extrusion frame that is placed inside the panel. Because the same type of extrusions are used on all four sides of a panel, and the extrusions on opposite sides of the panel are identical, the panel can be flipped 180 degrees and still work within the system. Thus, the panels are symmetrical, rather than having a defined orientation.

The perimeter extrusion frame is attached to the return legs 22 of the panel with countersunk fasteners 8 and 90 through non-curing butyl tape 10 that is on the inside return leg 22 to provide a watertight seal. In addition, the perimeter extrusion frame provides corner support eliminating stress to the 0.020" aluminum corner between the face 23 and return leg 22 of the panel. Thus, the perimeter extrusion frame creates a rigid box top out of the once flexible ACM panel by giving it diaphragm support. The dry gasket primary seal G is continuous around the bottom of the perimeter extrusion frame and provides a thermal break between the panels and the building structure when the frame is placed in the guttered sub-system. As discussed below, the horizontal legs of the perimeter extrusion frame (i.e., perimeter corner braces 3) may have weep holes in them to allow condensation to exit to the face of the building.

The panels 1000 are held to the sub-system by a continuous support channel 6 that is secured by a plurality of machine screws 5 into a screw boss 4020 without penetrating the vertical gutter support 2. This configuration allows a dry, watertight assembly to be maintained, even in the event of failure of the gasket primary seal G. The pressure provided by the continuous support channel 6 forces the neoprene gasket G on the bottom of the perimeter extrusion frame 3 against the vertical gutter support 2, thereby providing the primary seal without the use of sealants (i.e., a "dry" seal). The dry gasket primary seal G insulates the gutter space S2 from air and water, but a failure of the gasket G merely allows water into the gutter space S2, rather than the building structure. A continuous snap cover 80 is provided to cover the support channel 6.

Figure 13:
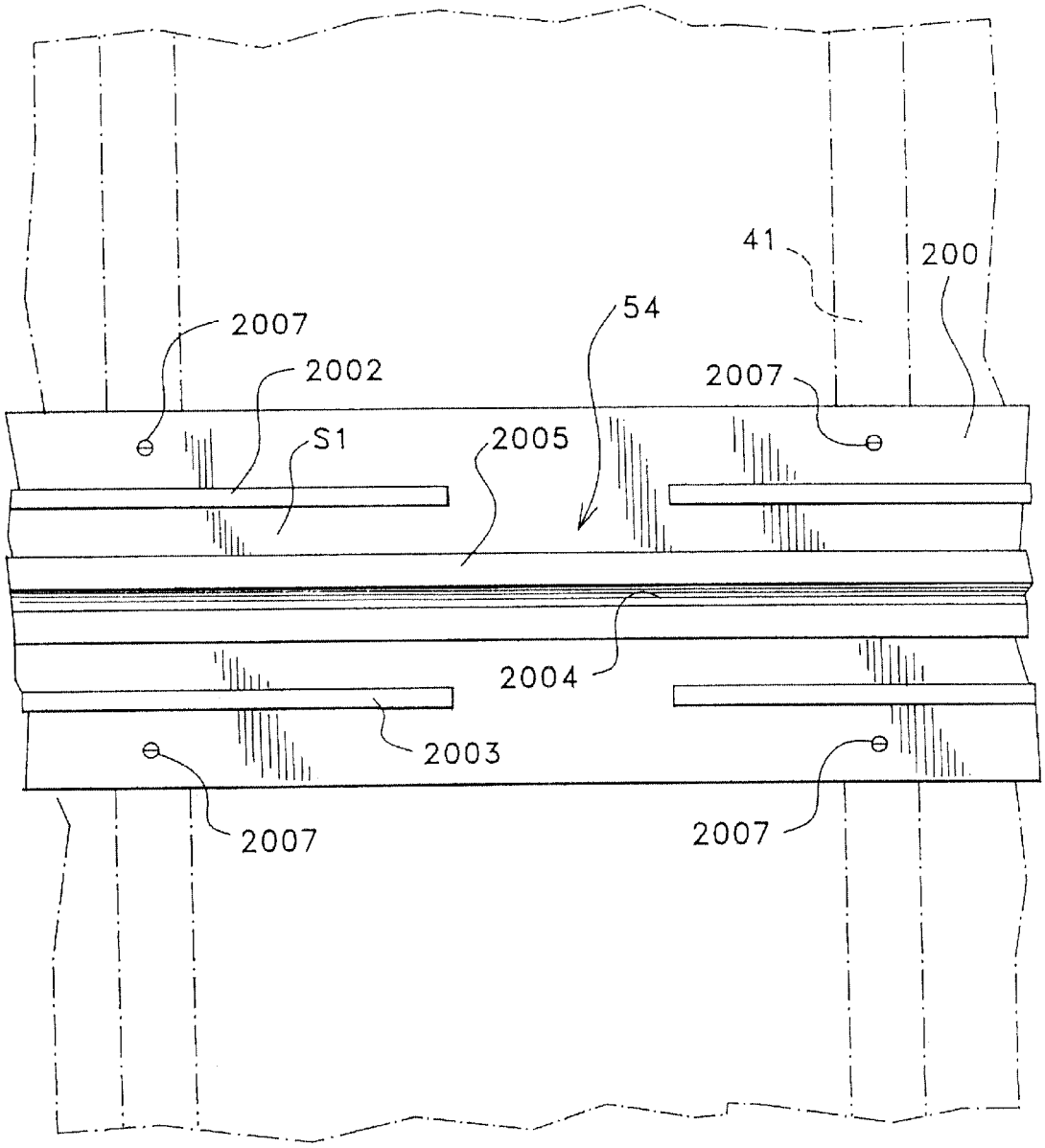
FIG. 13 is a front plan view of a horizontal support.
Figure 14:
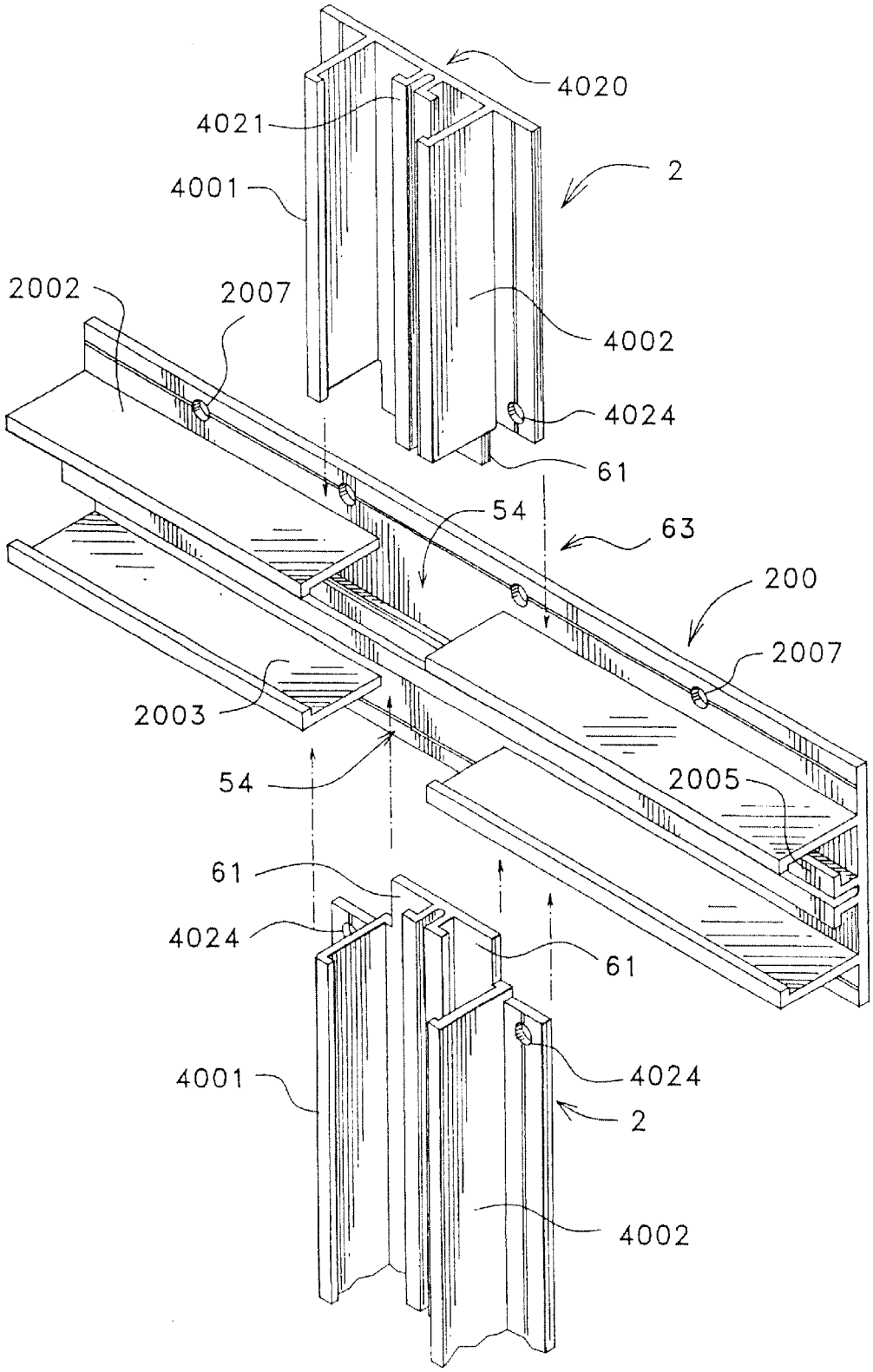
FIG. 14 is a top perspective view of vertical support(s) being joined with a horizontal support.

As shown in FIGS. 13 and 14, the DPS 4000™ embodiment has a sub-system of integrated horizontal lower gutters 200 (see FIG. 13) and vertical upper gutters 2 (see FIG. 14). In most cases, the horizontal lower gutter 200 runs horizontally and attaches to standard-spaced vertical metal studs or other elements of the building structure, allowing for a continuous horizontal gutter. The vertical upper gutter 2 interfaces with the horizontal gutter through factory-milled openings (i.e., cutouts) 54 and join together with fasteners through the overlapping flanges outside of the gutters. The gutters receive a lap sealant when joined together, and the four outside corners of the gutter intersection receive sealant to provide a secondary seal.

Figure 1:
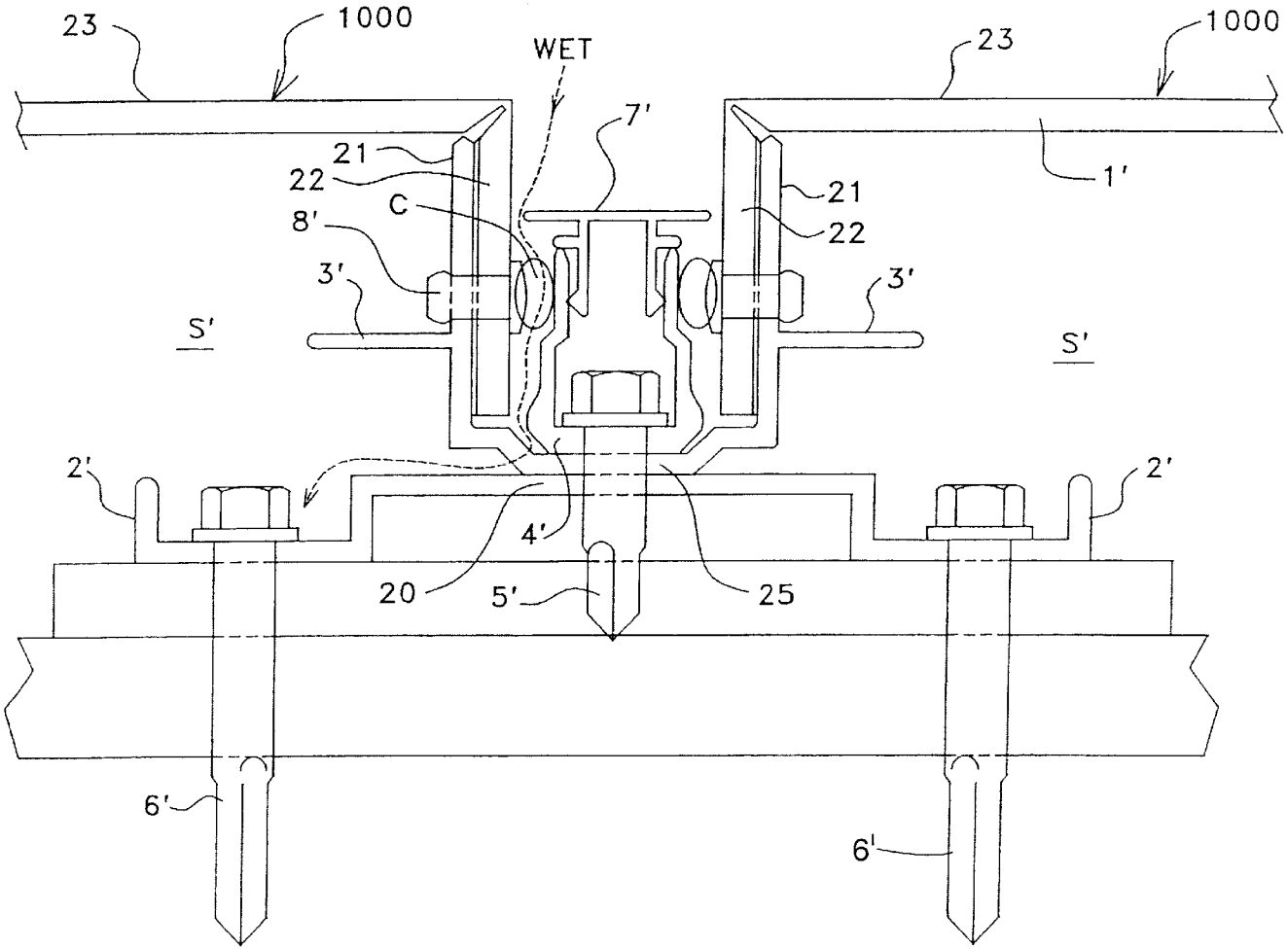
FIG. 1 (PRIOR ART)
FIG. 1 (prior art) is a horizontal sectional view of a Miller-Clapperton Partnership, Inc. (MCP)™ Austell, Ga. curtain wall system.
Figure 2:
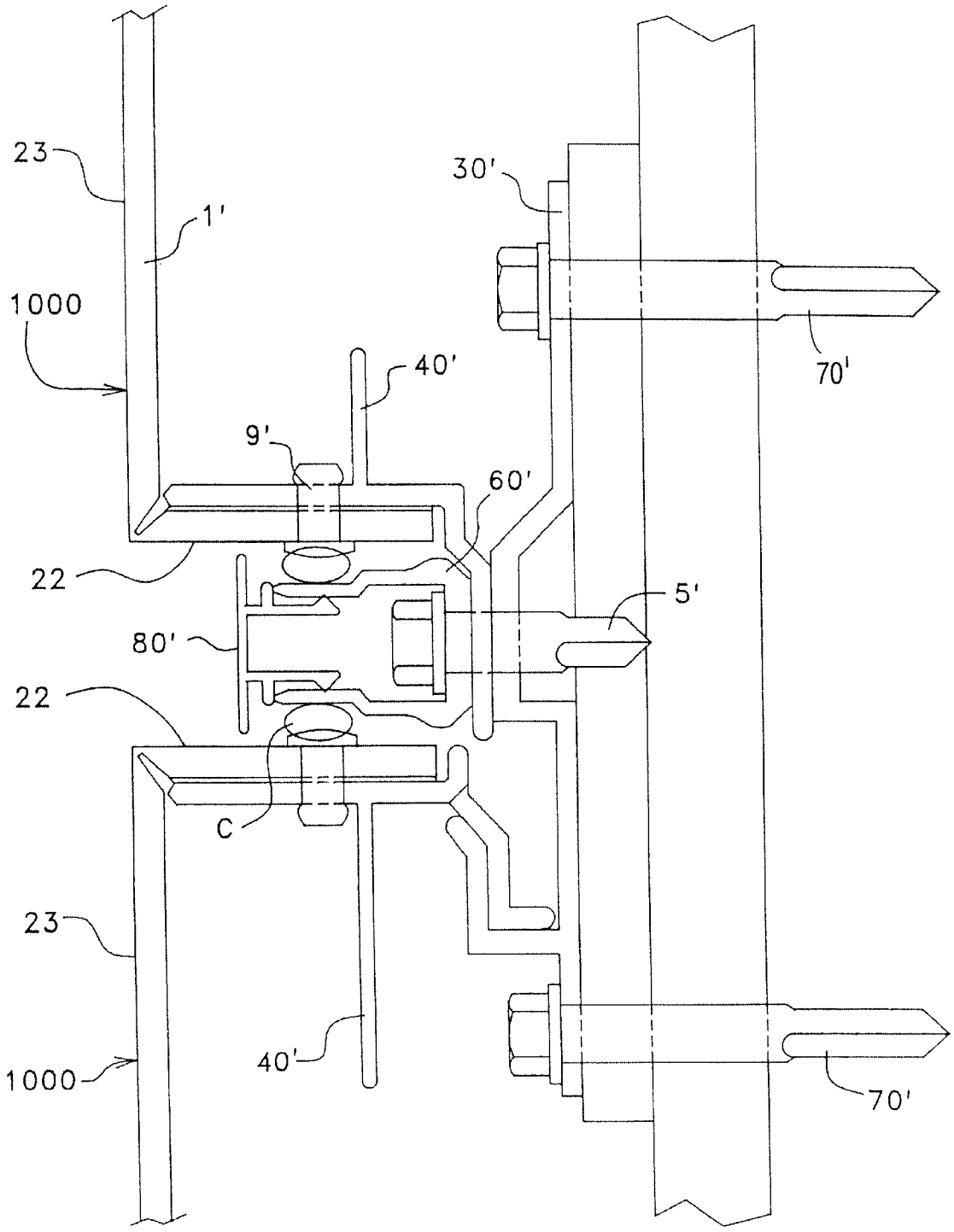
FIG. 2 (PRIOR ART)
FIG. 2 (prior art) is a vertical sectional view of the MCP™ system.
Figure 6:
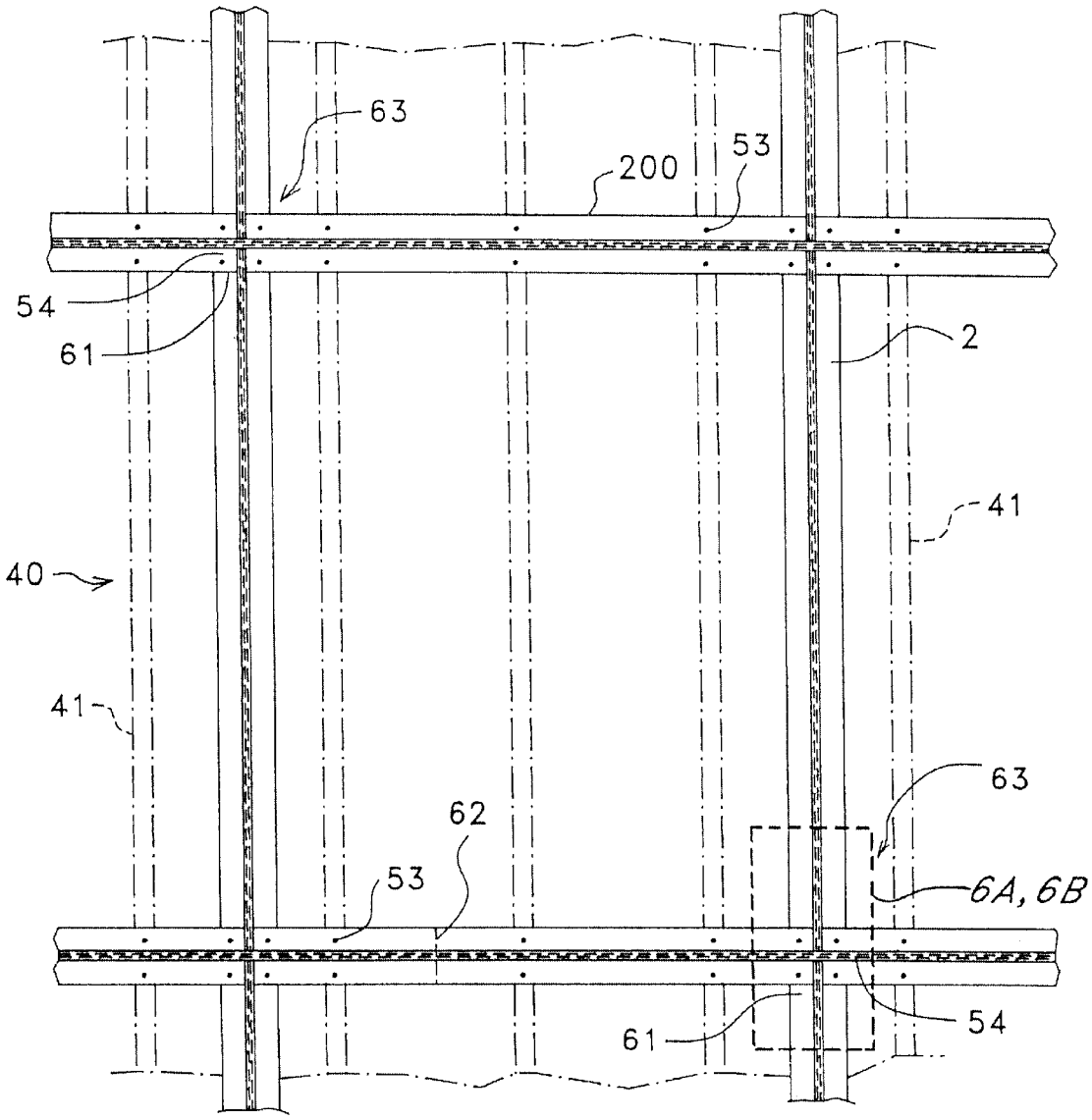
FIG. 6 is a front plan view of the framework of the preferred embodiment being assembled on the building shown in FIGS. 4 and 5.
Figure 8:
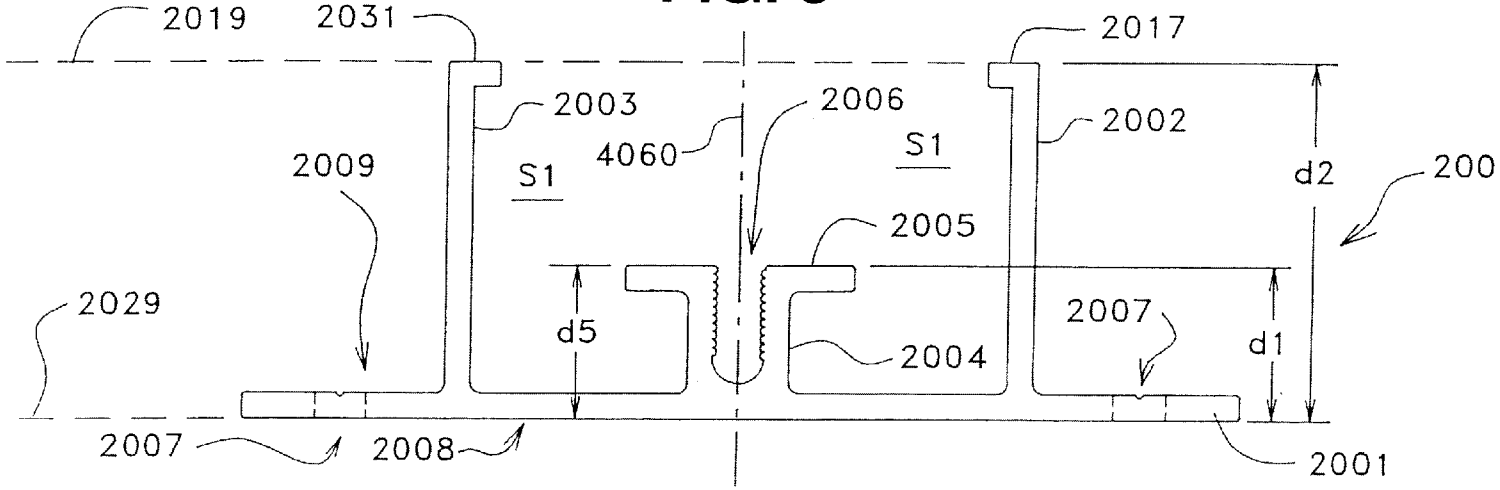
FIG. 8 is a cross sectional view of the horizontal support.

Refer to FIGS. 1 and 17 wherein each shows a vertical joint (a cross section of a vertical mullion). The prior art MCP system will allow water to reach the support bolt 6' when the wet sealant C fails as shown by arrow "WET". Overlapping arm assembly 25 of the corner brace 3' leaks. The preferred embodiment (referred to as DPS4000™) of FIG. 17 has a built in gutter S2. A failure of the gasket G only allows water to pass to the gutter S as shown by arrow failsafe. The support bolts 70 are shielded by gutter walls 4001, 4002. The MCP vertical attachment support 2' has a non-structural (meaning cannot support an intersecting horizontal support) mounting face 20. Whereas the vertical gutter support 2 of the present invention has a reinforced screw boss 4020 which is a structural component fully integrated with its intersecting horizontal support as shown in FIGS. 6 and 8.

The MCP corner brace 3' only supports the route and member 21 of the curtain wall panel 1000 and not the face 23. Whereas the corner brace 3 of the present invention supports both the face 23 and route and return member 21 of the same curtain wall panel 1000.

Figure 3:
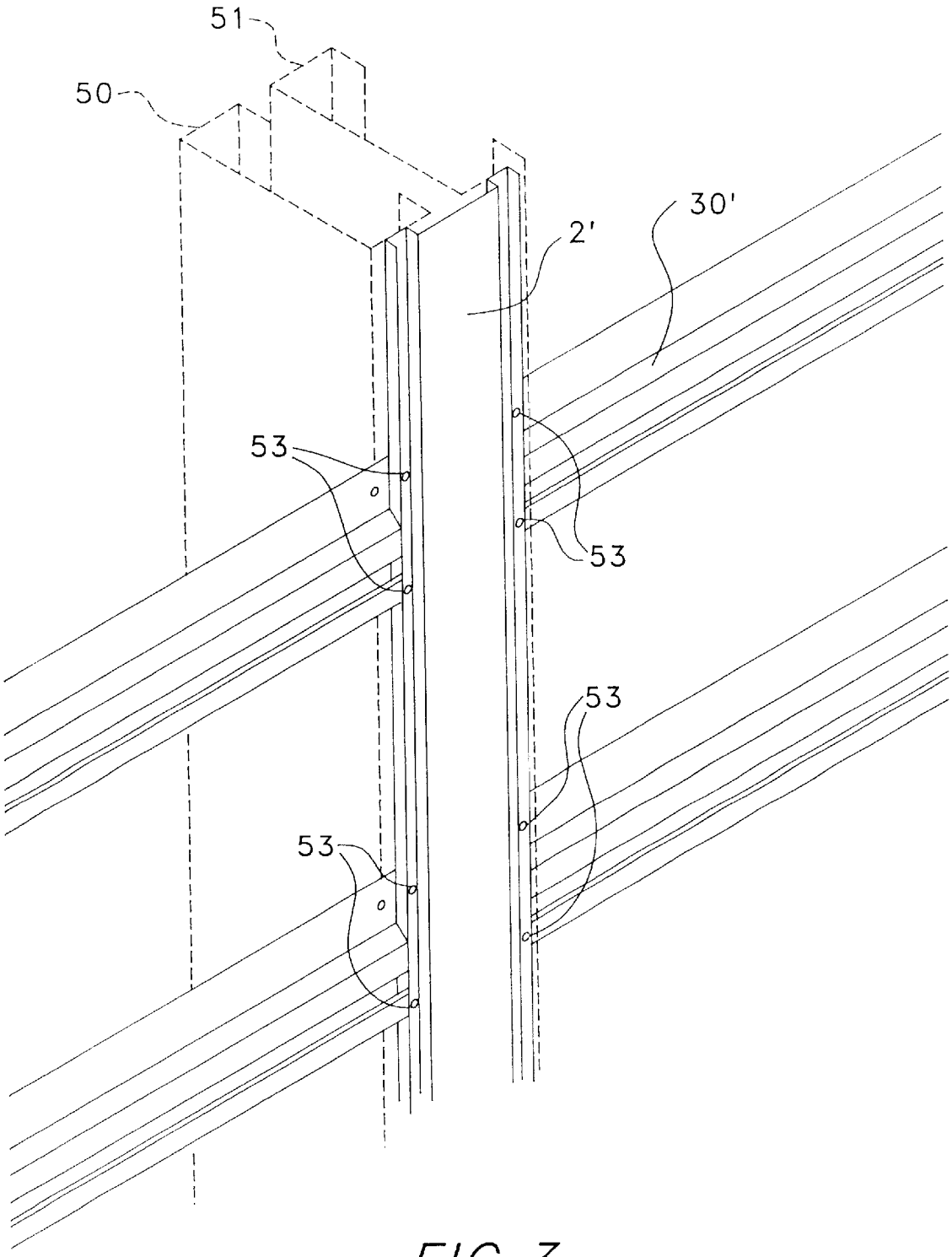
FIG. 3 (PRIOR ART)
FIG. 3 (prior art) is a top perspective view of an assembled MCP™ system.

Referring to FIG. 3 the MCP vertical attachment support 2' requires two parallel studs 50,51 to secure it to the exterior of a building via structural screws 53.

Figure 4:
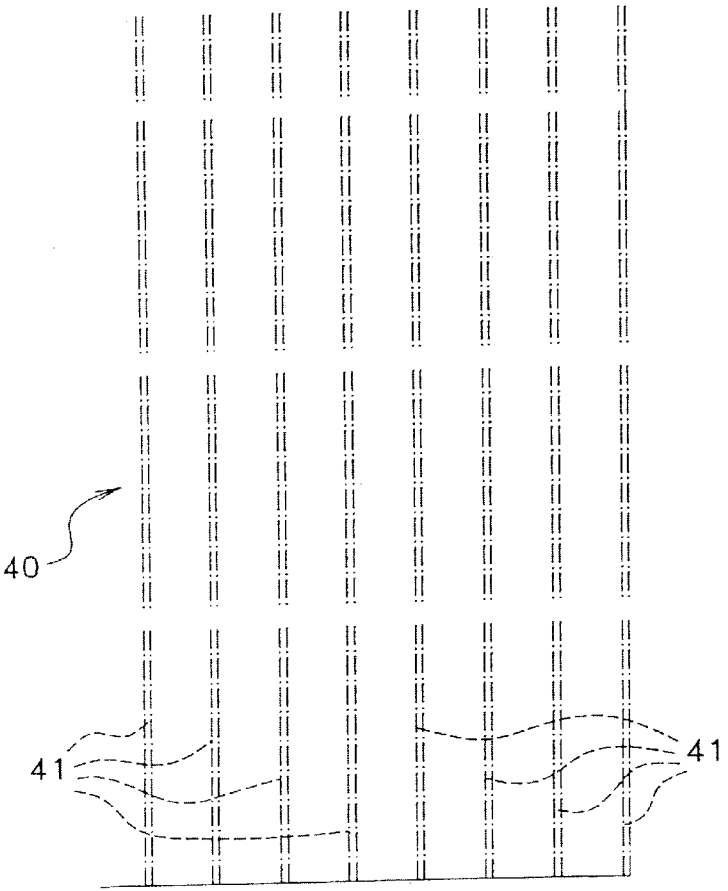
FIG. 4 (PRIOR ART)
FIG. 4 (prior art) is a front plan view of the frame of a building.

Referring to FIG. 4 the wall 40 of the building has vertical studs 41 which are typically built 16 inches on center. No double studding is required for the present invention in any of its various embodiments.

Figure 5:
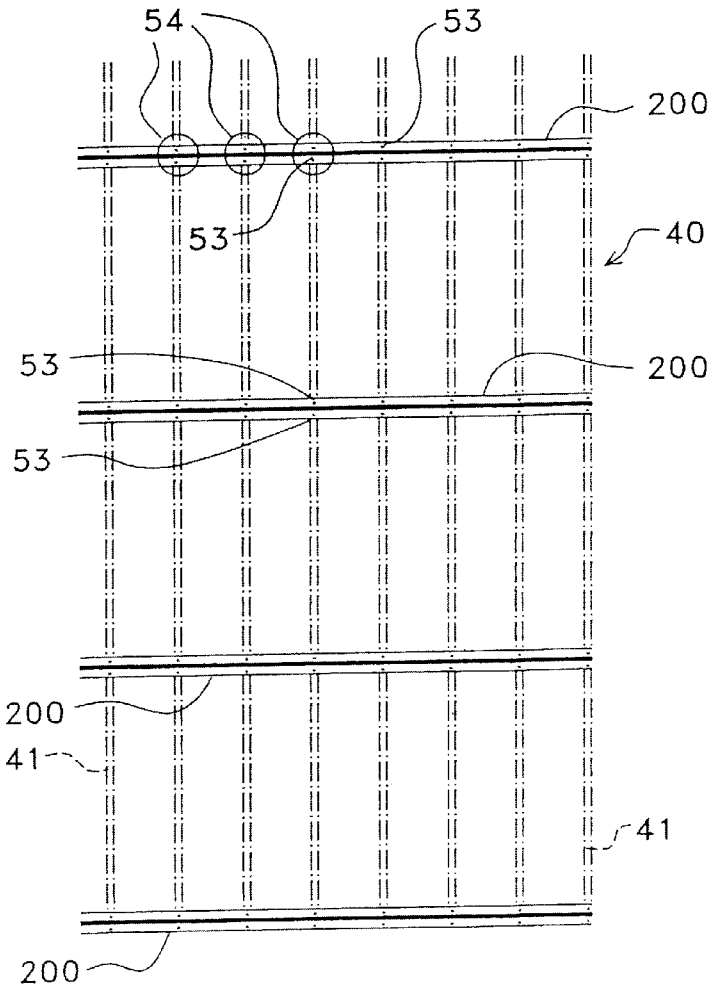
FIG. 5 is the same view as FIG. 4 with horizontal supports installed.

Referring to FIG. 5, the horizontal supports 200 for the present invention are installed. The builder can choose to install all the horizontal supports 200 before installing the vertical supports 2, or just a pair of them to build one curtain wall row at a time, either from the bottom up or from the top down. Cutouts 54 receive the flanges 61 of the vertical supports 2.

Figure 6A:
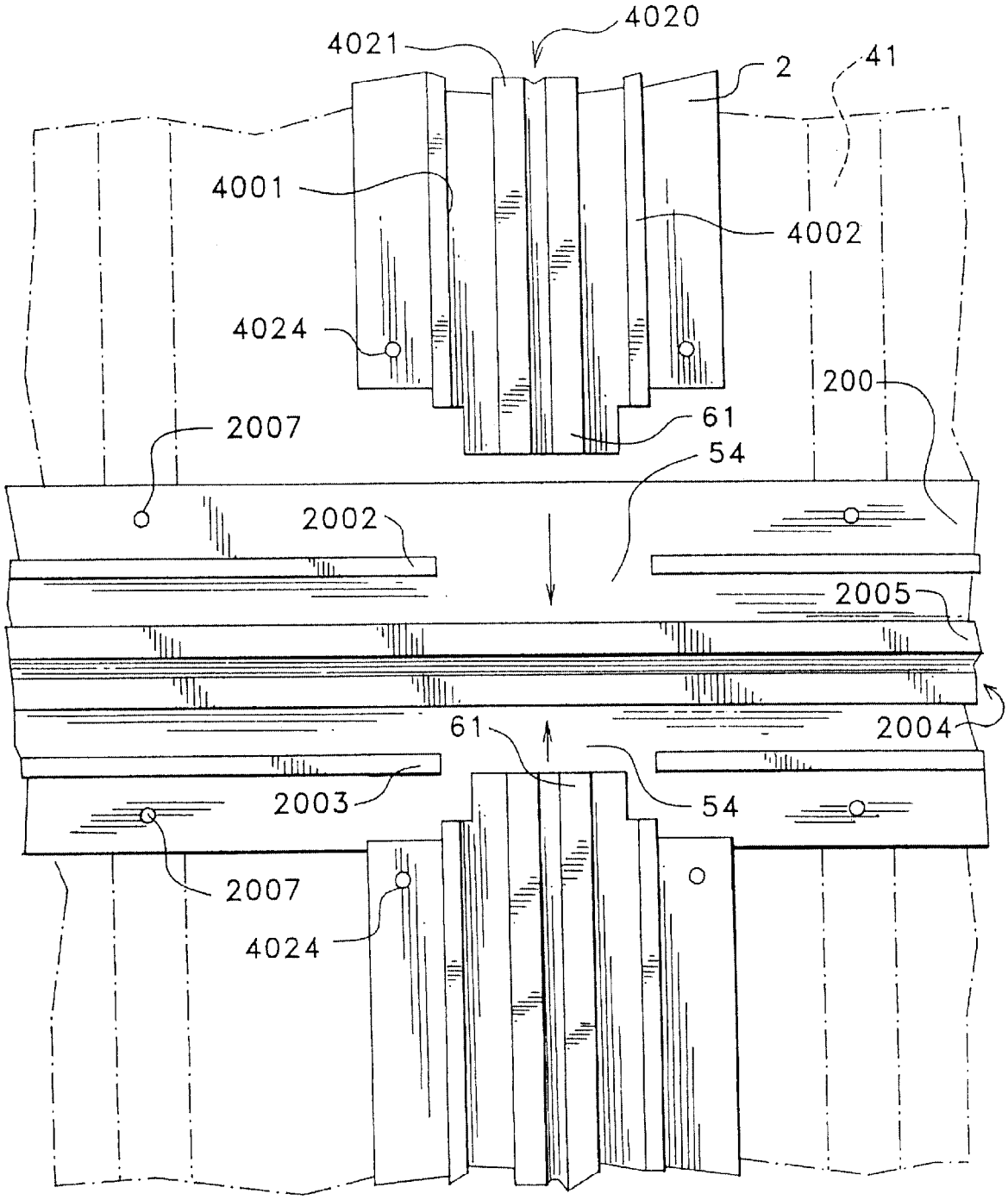
FIGS. 6A, and 6B are front plan views of the joint of the horizontal and vertical supports of FIG. 6.
Figure 6B:
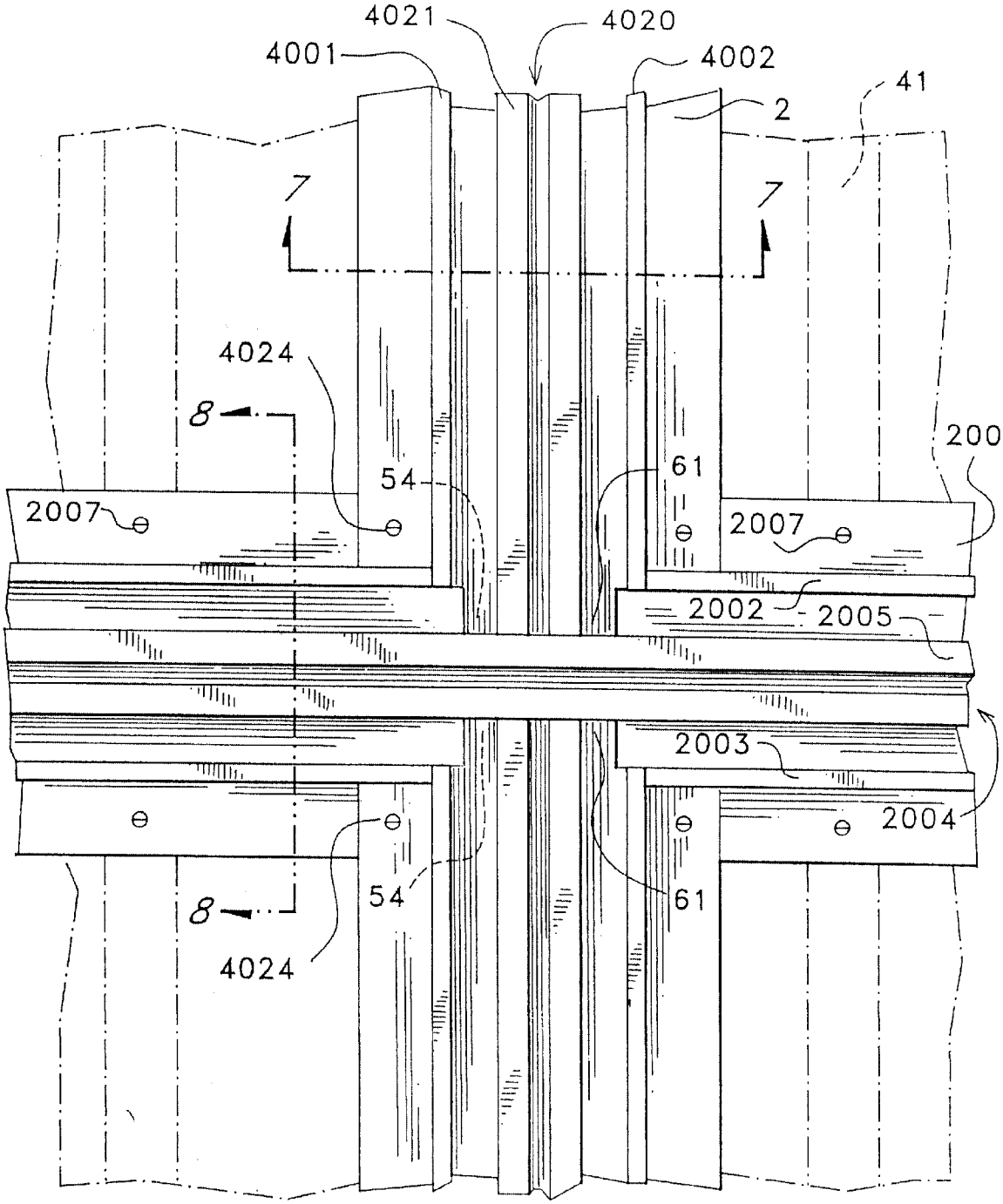

Referring to FIGS. 6, 6A, and 6B, the horizontal supports 200 fasten to standard 16 inch center studs via fasteners 53. The horizontal supports 200 may be built in sections and joined in convenient lengths such as six feet at joints 62. The vertical supports 2 have a flange 61 at each end which integrally fits into the notch 54 of the horizontal flange. A sealant FS is used at the joint(s) 53 to keep moisture away from the building.

Figure 7:
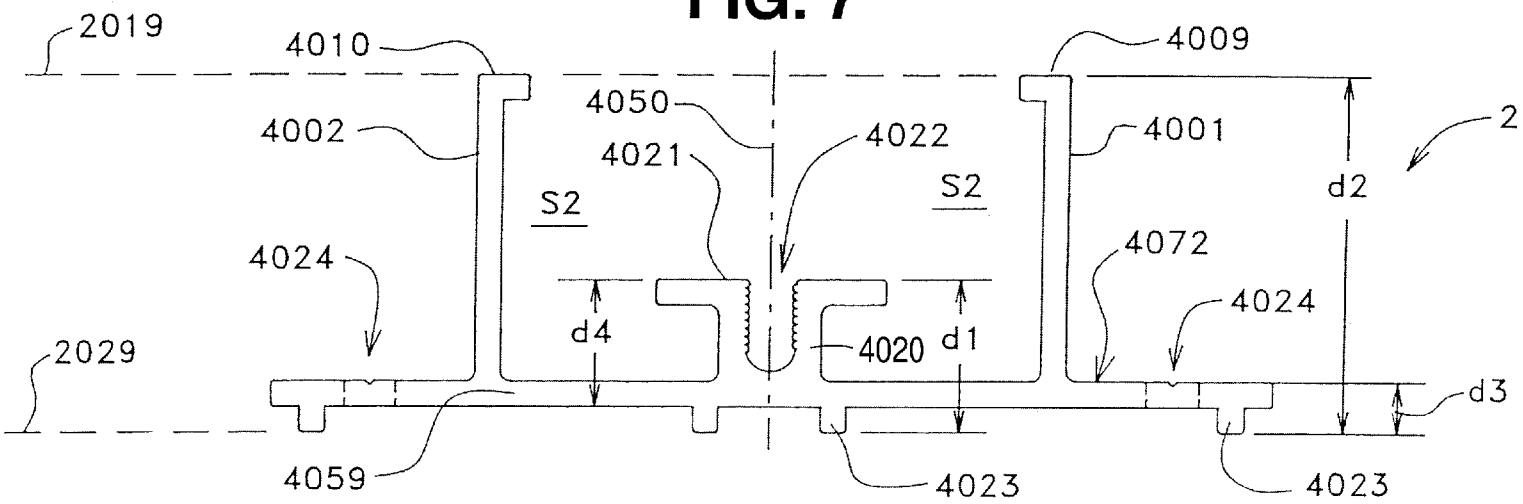
FIG. 7 is a cross sectional view of the vertical mullion.

Referring to FIG. 7, the vertical support 2 has a base 4059, a building side 4070, and a support side 4072. It must form a curtain wall plane 2019 which is the same plane as 2019 for the horizontal support 200. Feet 4023 raise the vertical support 2 a distance d3 away from the frame plane 2029 of the building, such that $d_3+d_4=d_1$ and $d_1>d_4$. The vertical support 2 has a pair of gutter walls 4001, 4002, wherein their distal ends 4009, 4010 define curtain wall plane 2019. The distal ends 2017, 2031 of the horizontal support 200 are also co-planar along plane 2019. The screw boss 4020 has a mounting flange 4021 and a threaded hole 4022. The mounting holes 4024 are located distally from the gutter walls 4009,4010.

Referring to FIG. 8, the horizontal support 200 has a base 2001 which is mounted to the building. The center longitudinal axis 4060 extends perpendicularly out of the page. The screw boss 2004 has sufficient strength to provide structural support for both the curtain wall panels and the adjoining vertical supports 2. The screw boss is located centered in the longitudinal axis. It has a central hole 2006 which is threaded. It has a mounting flange 2005 to receive the curtain wall perimeter braces 3 (see FIG. 17). The mounting holes 2007 are located distally from the gutter walls 2002, 2003. The gutter side walls 2002,2003 extend co-planar with the screw boss 2004 away from the mounting side 2008 of the base 2001, thereby forming a support side 2009 of the horizontal support 200.

Figure 10:
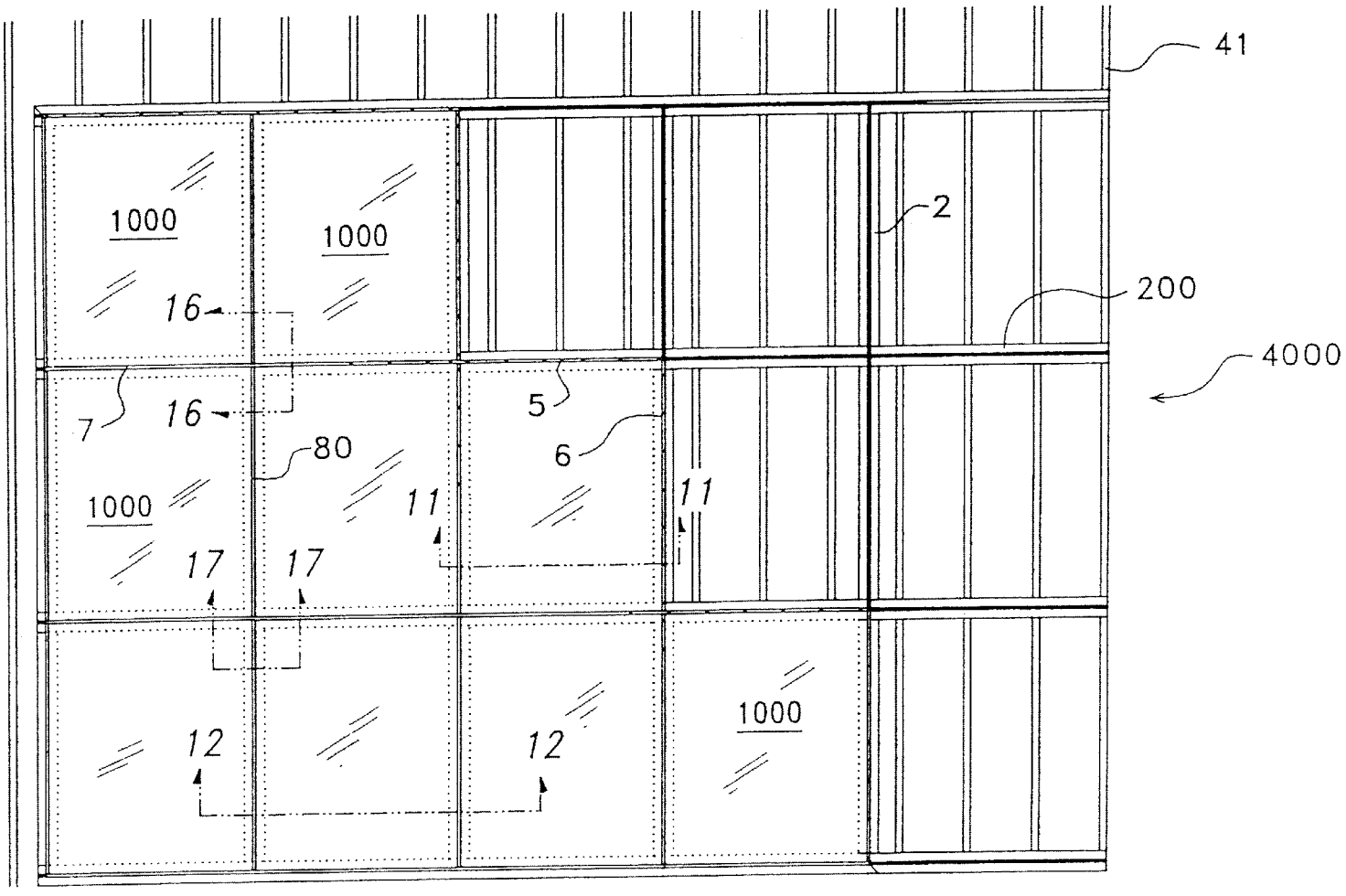
FIG. 10 is a front plan view of the building shown in FIG. 8 having curtain wall panels being mounted to the framework.

Referring to FIG. 10, the builder in this example has chosen to build the entire framework comprised of vertical and horizontal support elements 2 and 200 before installing the curtain wall panels. The builder has the choice of now hanging the curtain wall panels 1000 from the top down, thereby keeping the building as dry as possible during rain during construction.

Figure 9:
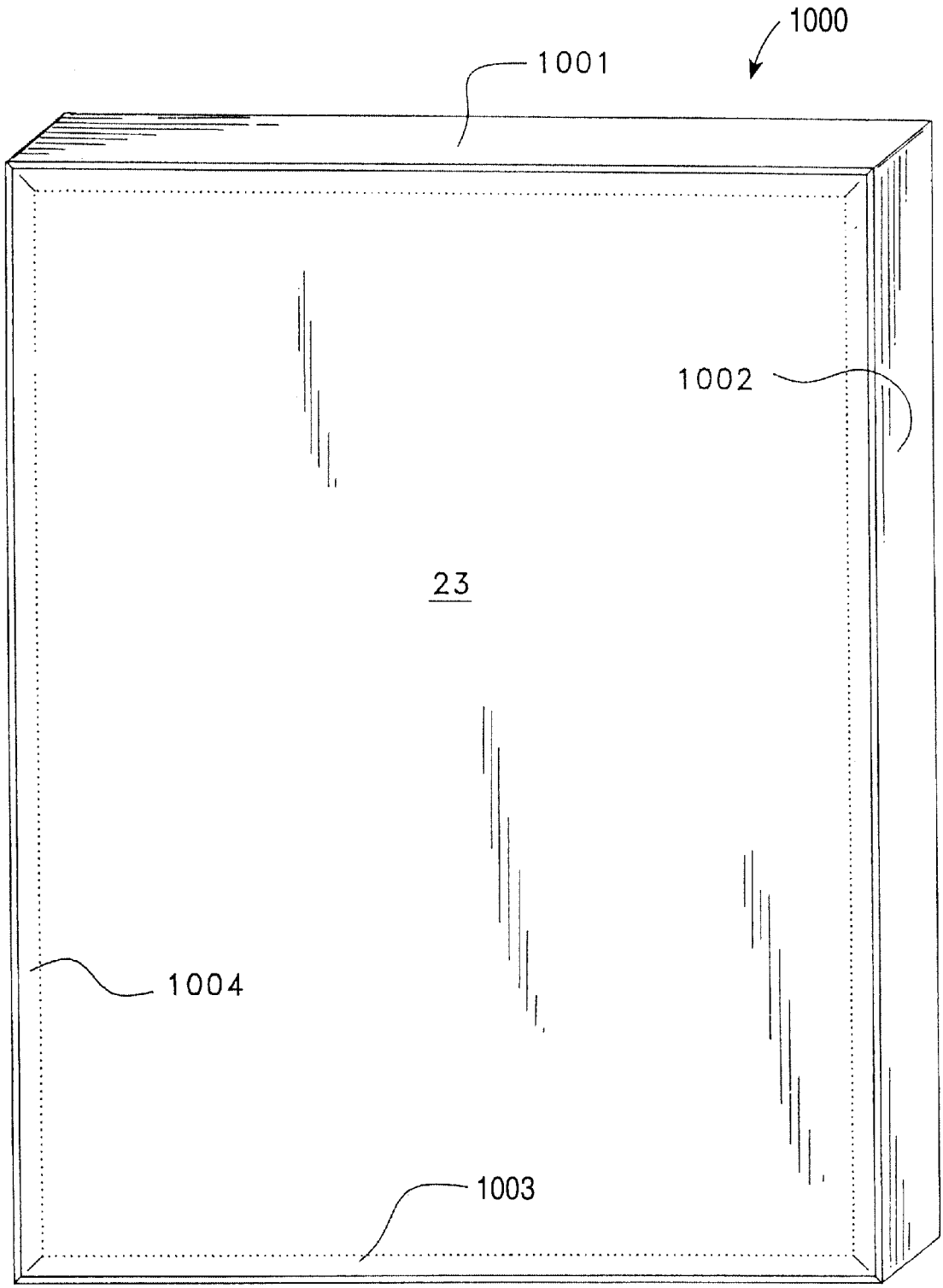
FIG. 9 is a top perspective view of a curtain wall panel of the preferred embodiment.
Figure 15:
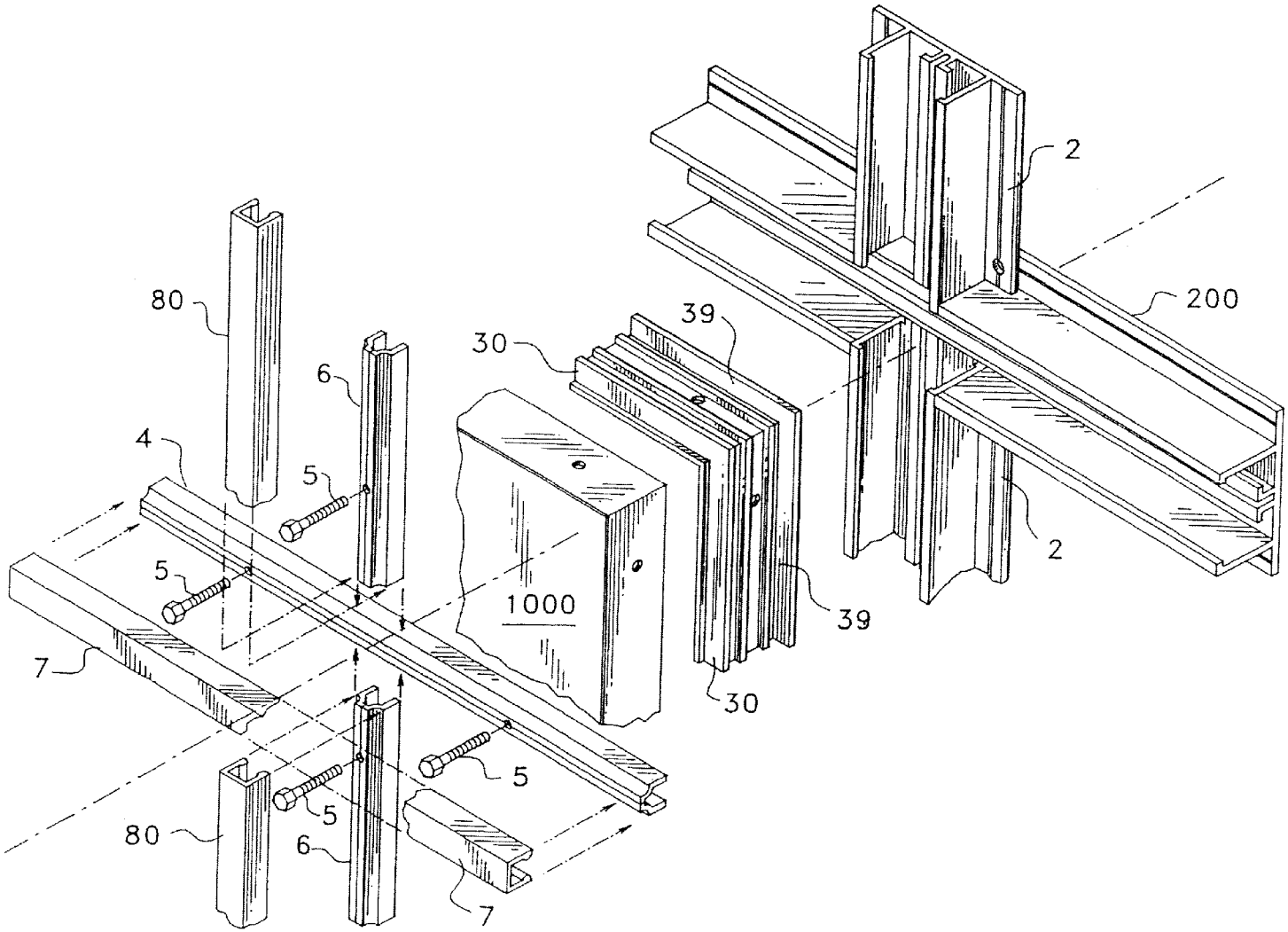
FIG. 15 is an exploded view of the preferred embodiment of the gutters (DPS 4000™) system at one joint.

Referring to FIGS. 9 and 15, the curtain wall panel(s) is not "handed" rather it is symmetrical from side to side and from top to bottom and fully symmetrical if the curtain wall panel is square. The curtain wall panel 1000 has a face 23 and route and return edges 1001, 1002, 1003, 1004. As shown in FIG. 15, the perimeter corner braces 3 have a face member 30 which adds strength to the relatively weak face 23 of the curtain wall panel 1000.

Figure 11:
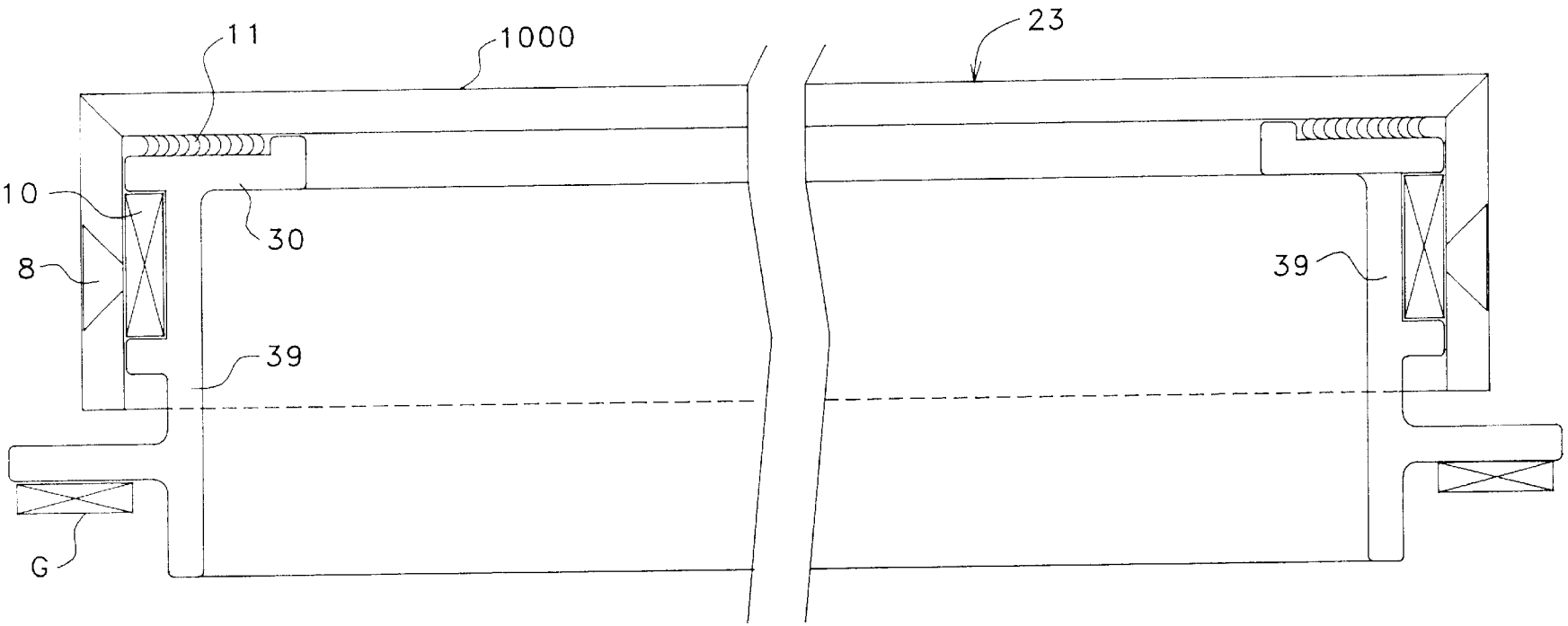
FIG. 11 is a sectional view of the curtain wall panel taken along line 11—11 of FIG. 10.

As shown in FIG. 11, corner sealant 11 is applied for air/water integrity. A recessed positive return attachment screw 8 screws into a self sealing gasket (butyl tape) 10 to secure the corner brace 3 to the curtain wall 1000. The curtain wall 1000 floats on gaskets G which are supported against flanges 2005 and 4021 (see FIGS. 7 and 8) to provide for movement in thermal expansion and construction. Machine screw 5 holds the continuous support panel 6 against the screw boss 4020. A continuous snap cover 80 provides an aesthetic outside appearance over the screws 5.

Referring to FIGS. 10, 13, 14, and 15, the preferred embodiment curtain wall apparatus (DPS4000™) is shown partly erected. For alignment integrity among the curtain wall panels 1000, the builder will normally erect by rows of contiguous panels. A slotted hole 4024 of the vertical gutters allows for additional expansion and contraction.

Figure 12:
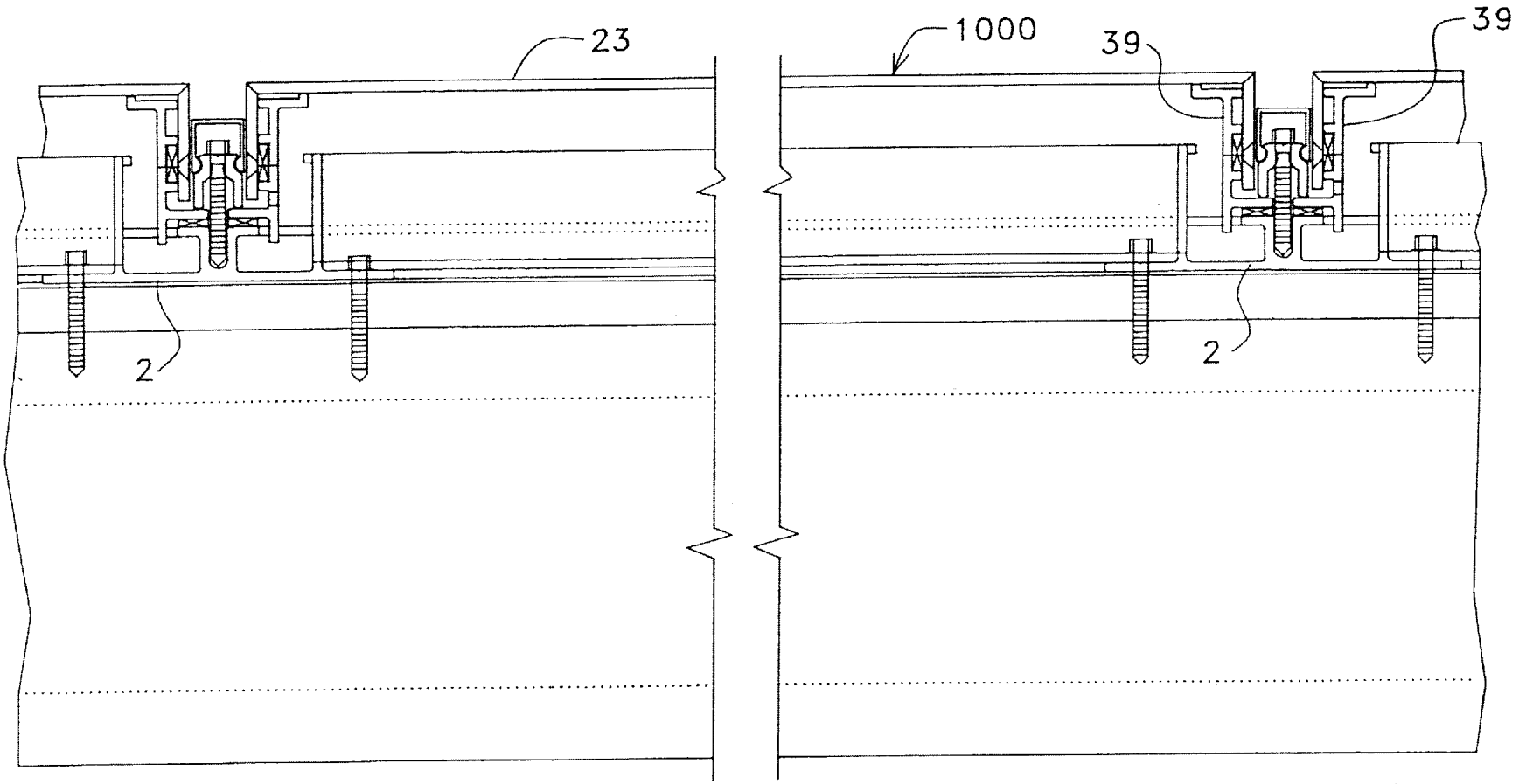
FIG. 12 is a cross sectional view taken along line 12—12 of FIG. 10.

Referring to FIGS. 11 and 12, the various system components are shown in a sectional view.

Figure 18:
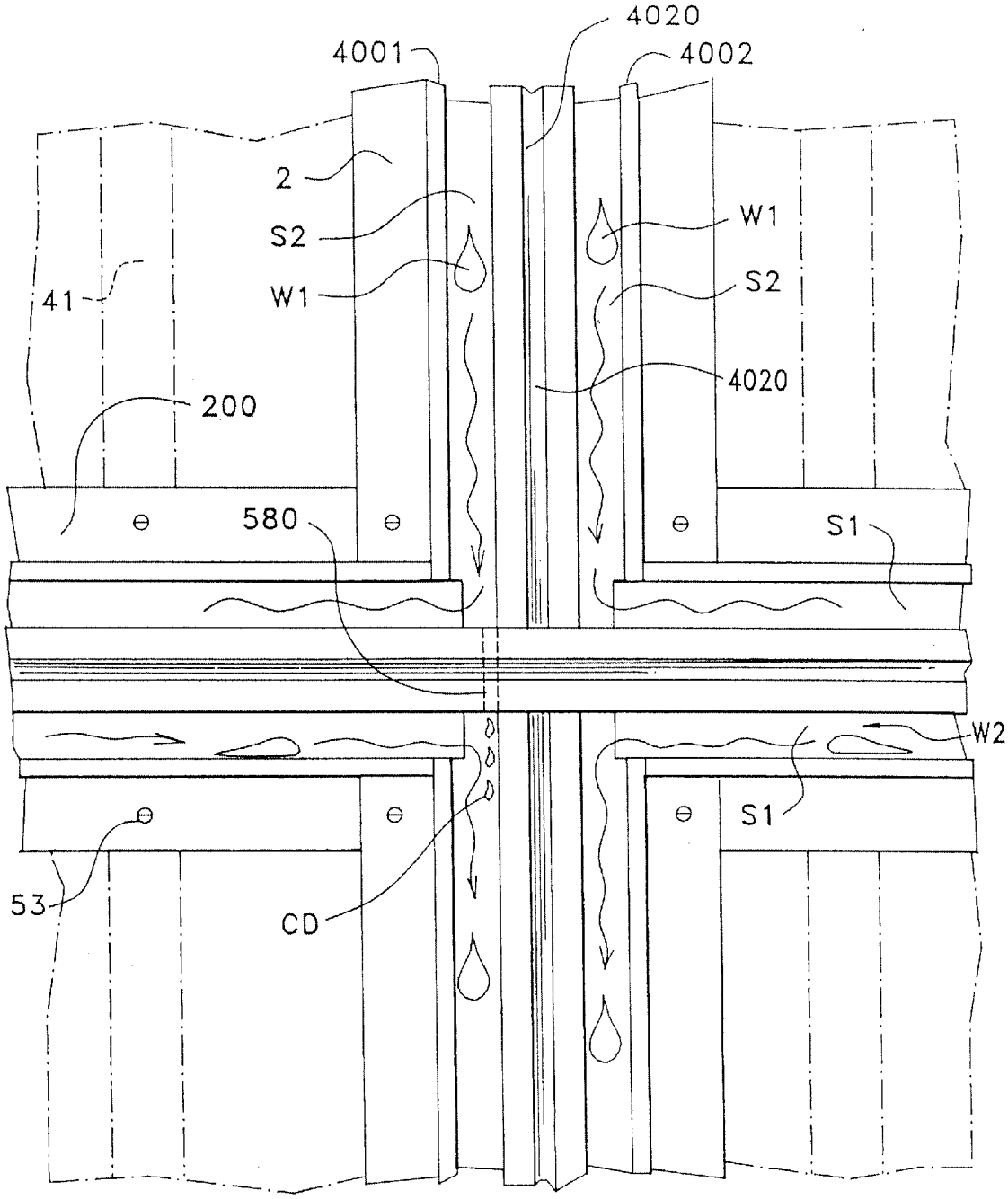
FIG. 18 is a front plan view of the framework showing the operation of the built in gutter system.
Figure 19:
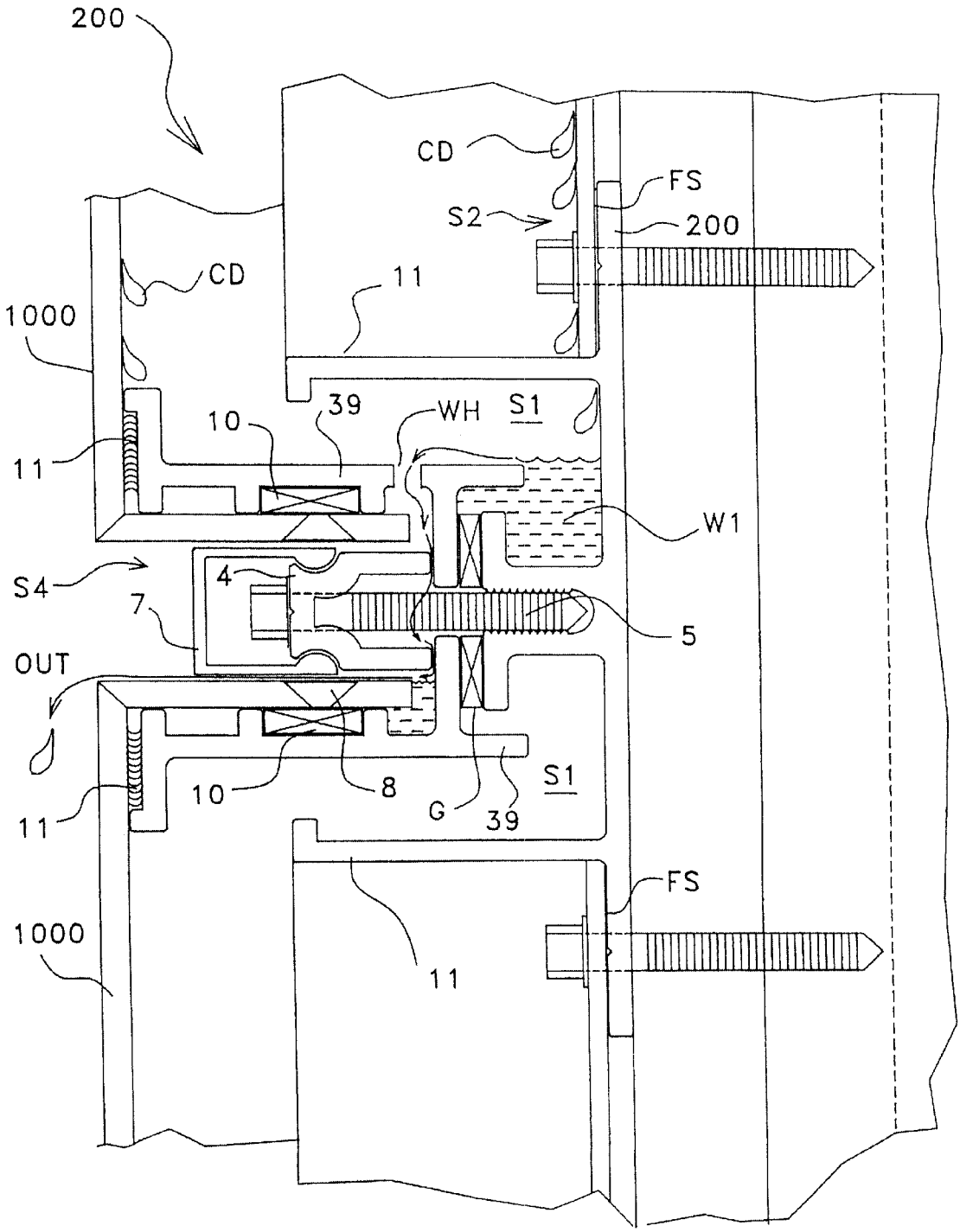
FIG. 19 is the same view as FIG. 16 showing the operation of the built in gutter system.

Referring to FIGS. 18 and 19, the rain water W1 runs down the gutter S2 to the horizontal support 200, and then weeps out through the face up 80 (known as a pressure equalized system). A relief cut 1580 cuts through the gutter walls 2002,2003 of the horizontal support 200, thereby allowing condensate drops CD to drain. Water W2 runs along gutter S1 to gutter S2 to the sill flashing or to the next gutter and exits through the weep hole WH and then the joints in the face cap 7.

Referring to FIG. 19, condensate drops CD (and/or water from the primary seal) flow down the vertical support 2 gutter S2 into the horizontal support 200 gutter S1, and then out weep hole WH to the space S4 between the curtain wall panels 1000, as shown by arrow out. Sealant FS is provided between the vertical support 2 flange 61 and the horizontal support 200 notch 54.

Figure 20:
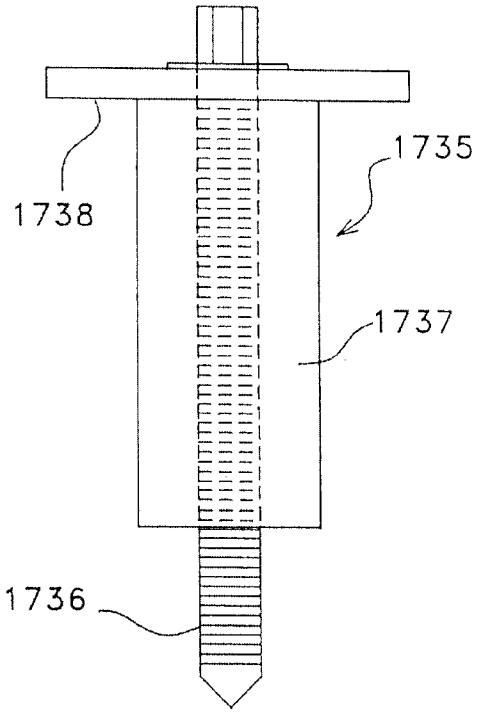
FIG. 20 is a side plan view of the alignment fastener.

Referring to FIG. 20, an alignment fastener 1735 is shown to have a cylindrical body 1737 ¾ inch in diameter, and preferably made of ABS plastic. A hex washer head machine screw 1736 is threaded through the body 1737. A stop 1738 is ⅛ inch by 1½ inch diameter, ABS plastic.

Figure 21:
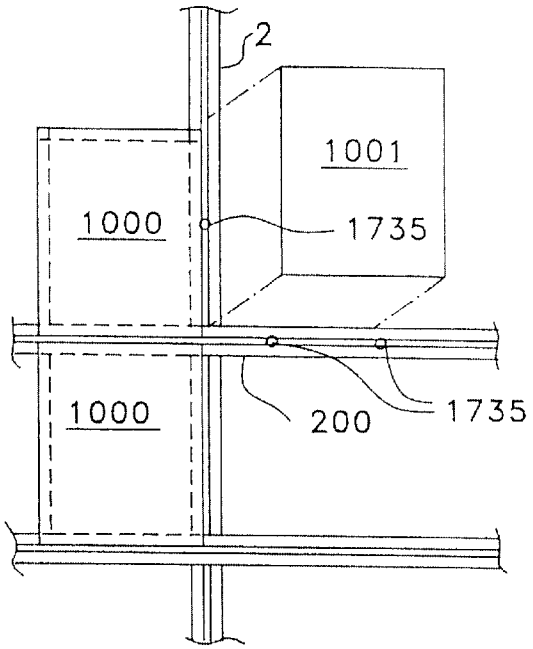
FIG. 21 is a front plan view of a panel being installed using an alignment fastener.
Figure 22:
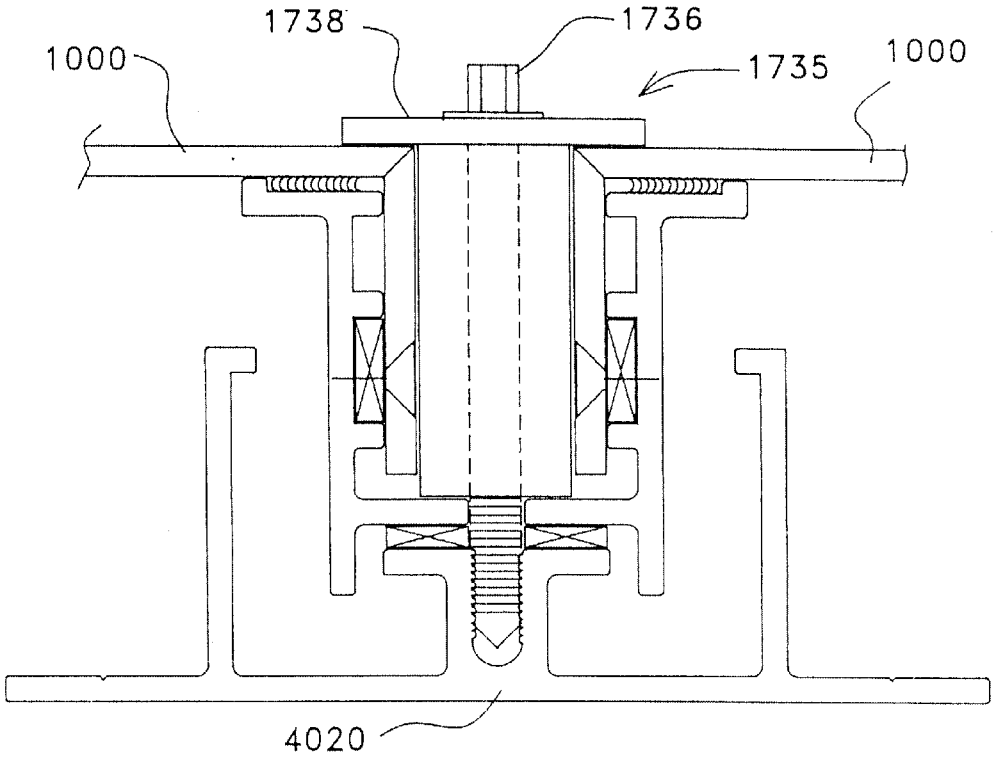
FIG. 22 is a cross sectional view of the alignment fastener is use.

FIGS. 21 and 22 show a method for installing a panel 1001 in proper alignment: at least one alignment fastener is secured into an adjoining vertical support screw boss 4020; at least two alignment fasteners are secured into an adjoining lower horizontal support screw boss or bosses; the panel 1001 is placed down on the lower alignment fasteners and against the vertical support alignment fastener; the panel is aligned and the alignment fasteners are fastened; the vertical support alignment fastener is removed; the permanent continuous support panel is installed; the lower alignment fasteners are removed; and the horizontal permanent continuous support panel is installed.

Figure 23:
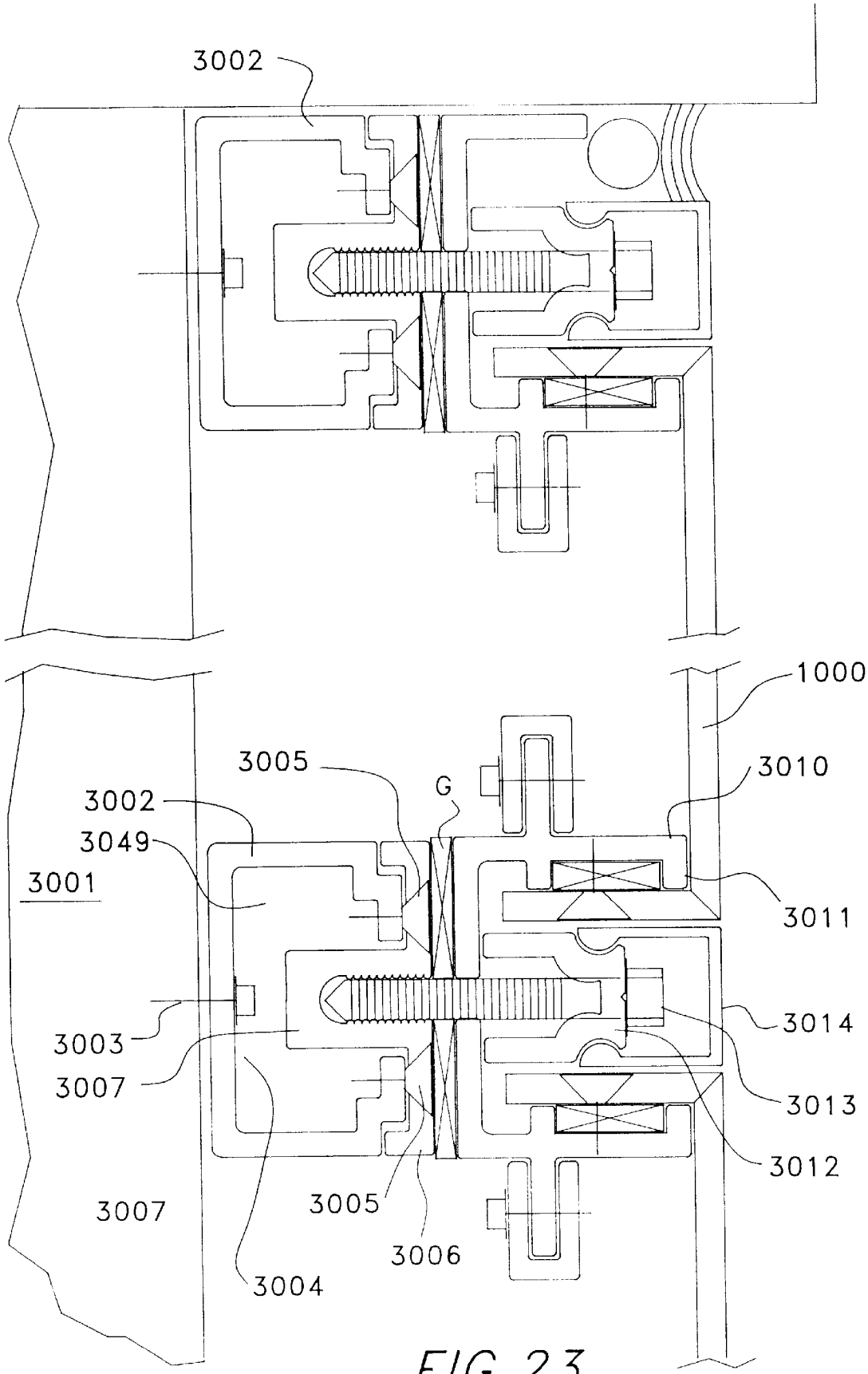
FIG. 23 is a vertical sectional view of an alternate embodiment (DPS 3000™) system.

Referring to FIG. 23, an alternate embodiment system is shown to have no internal gutters, but offers lower costs. The building 3001 supports a symmetrical vertical and horizontal channel 3002 as part of a dry, non-directional system. An optional gutter OG is shown in dots. The channel 3002 is fastened by fastener 3003, and sealant 3004 may be used to protect the building 3001 from moisture. Countersunk fasteners 3005 secure a plate 3006 having a screw boss 3007 to the channel 3002, after the channel 3002 is attached to the building 3001. The curtain wall panel 1000 has a corner brace 3010 with a smaller face segment 3011 than the preferred embodiment (DPS4000™). A gasket G is placed between the channel 3002 and the corner brackets 3010. The continuous channel 3012 secures the corner brackets 3010 via fastener 3013. A facial clip 3014 provides an aesthetic appearance over the fasteners 3013. It is not a failsafe water prevention system because a failure of G could allow water into space 3049 which would attack sealant 3004.

Figure 24:
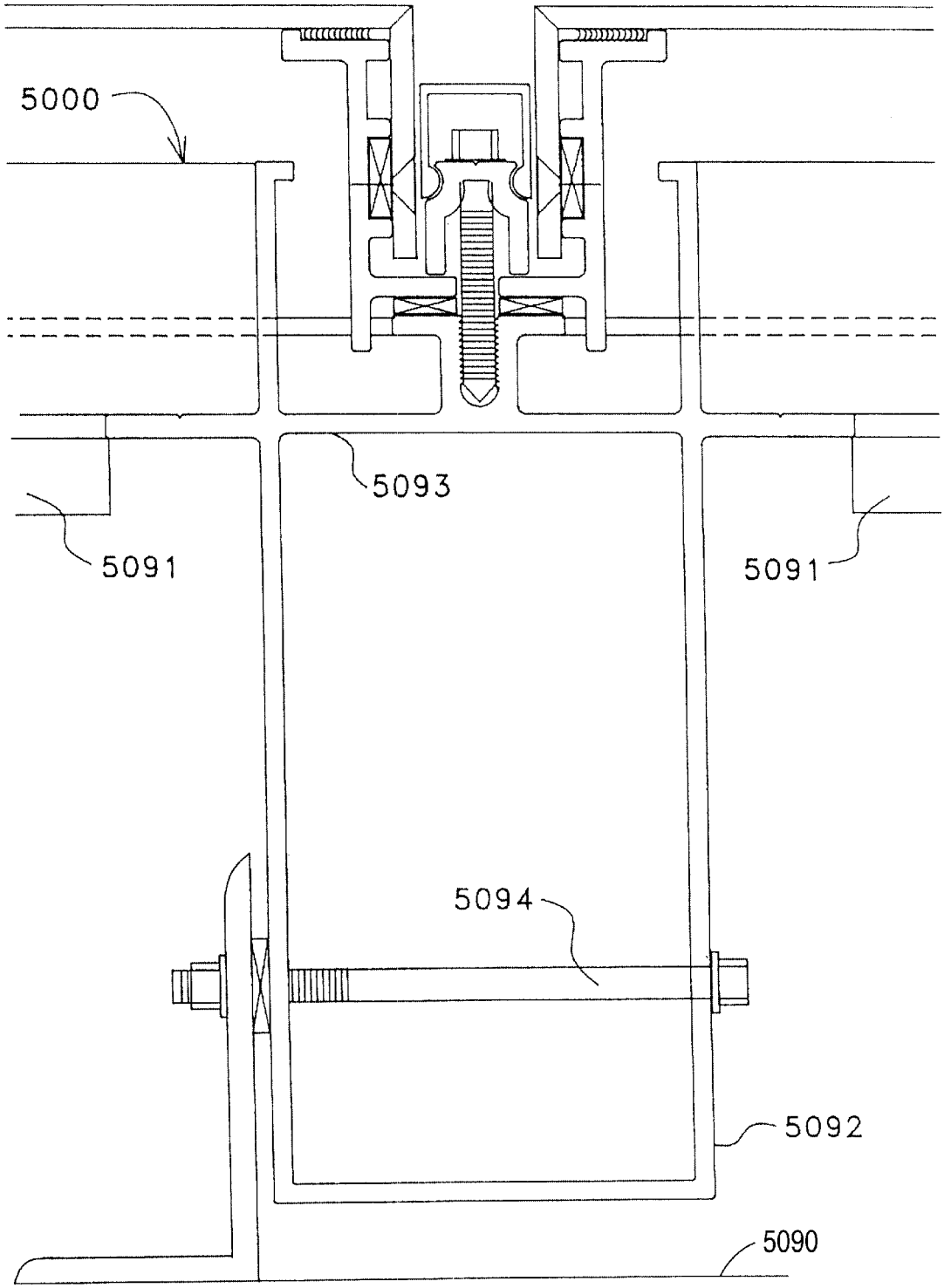
FIG. 24 is a horizontal sectional view of an alternate embodiment (DPS 5000 CW™) system.

Referring to FIG. 24, a horizontal support 5000 CW is designed to attach to a steel angle SA which protrudes from the building slab 5090. This embodiment is similar to the preferred embodiment (DPS4000™). However, longer fins 5091 are needed for strength on the horizontal supports; and an integrated tube 5092 is formed as part of the base for the horizontal support 5093. A bolt 5094 using a shim G secures the integrated tube 5092 to the steel angle SA. Member 5092 is known in the prior art in curtain wall systems, but not in combination with an assembly like the DPS4000™.

Figure 25:
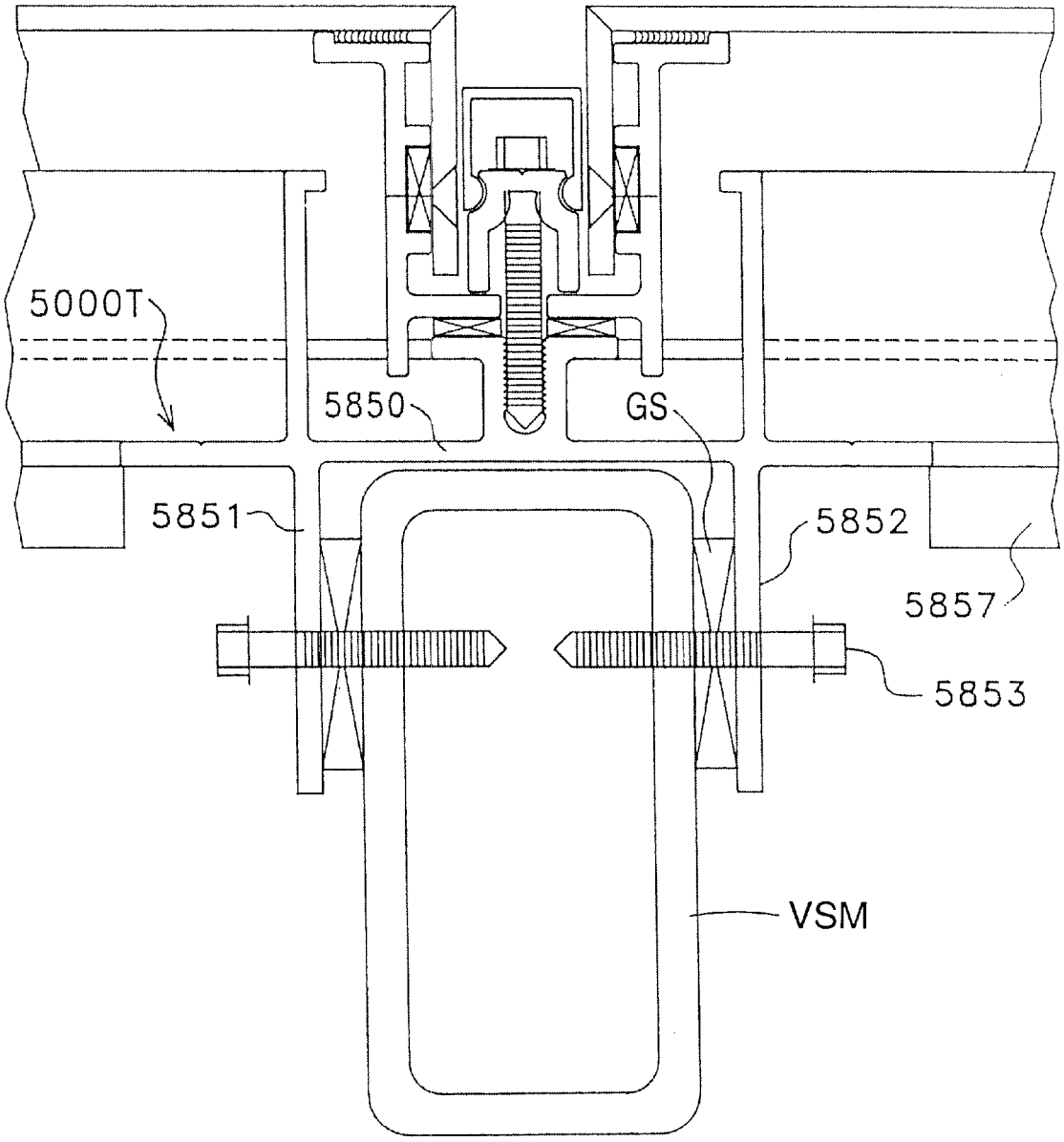
FIG. 25 is a horizontal sectional view of an alternate embodiment (DPS 5000 T™) system.

Referring to FIG. 25, an alternate embodiment (referred to as DPS5000T™) is shown to have a horizontal support 5850 wherein the support assembly is the same as the DPS4000™ preferred embodiment (see FIGS. 16 and 17). However, for the first time ever an exterior building structure vertical member VSM can be used to support a curtain wall as shown. The horizontal support base 5850 has (preferably aluminum) fins 5851, 5852 extending from the building side of the base 5850. Fasteners (machine screws) 5853 secure the fins 5851,5852 to the VSM using a shim GS. No sheath exists on this building. Optional legs 5857 may be used to strengthen the vertical supports.

Figure 26:
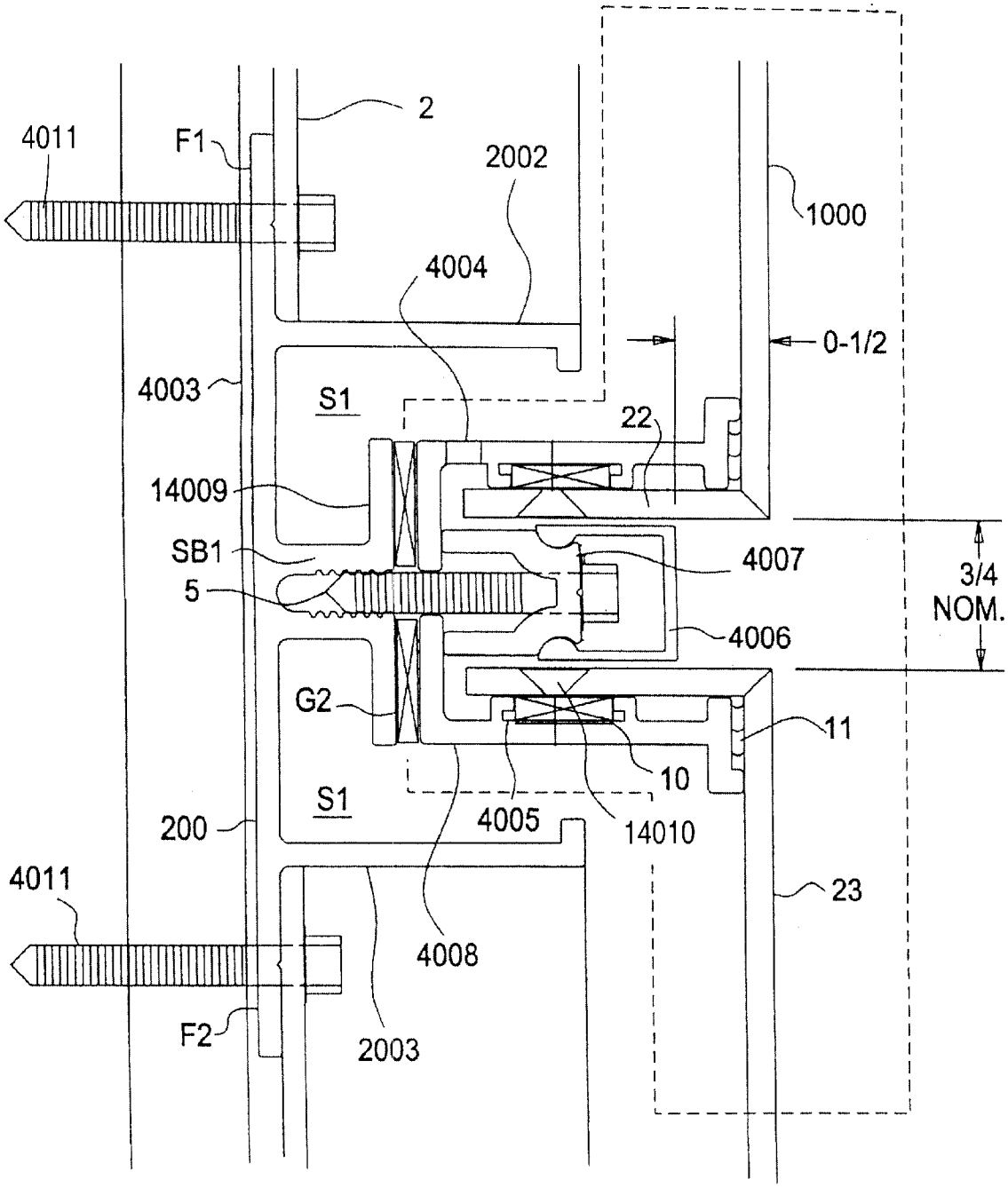
FIG. 26 is an identical view as shown in FIG. 16, but with the preferred embodiment of the gutter and the curtain wall composite assembly.

FIG. 26 is a vertical sectional view of the preferred embodiment (DPS4000™) (see also FIGS. 16 and 17). The lower gutter 200 is attached to the upper gutter 2 at right angles through the flanges F1, F2 outside of gutter legs 2002 and 2003. A continuous X-Y gutter is formed on which the curtain wall composite assembly attaches to the building structure 4003 using fastener 4011 or a similar fastener (see FIG. 53). The curtain wall panel 1000 is supported by symmetrical recessed perimeter extrusion 4008 which acts as a corner brace around all four sides of the curtain wall panel 1000 and seals the corners with corner sealant 11. It is positively attached to return leg 22 by countersunk fastener 14010, which penetrates recessed perimeter extrusion 4008, and is sealed by butyl tape 10. The recessed perimeter extrusion 4008 is held together at the four corners by the corner reglet clip 4005 providing a framework without the use of fasteners (see FIG. 52). The curtain wall panel 1000 is attached to the continuous gutter created by lower gutter 200 and upper gutter 2 by machine screw 5 into the integral screw boss of the gutter members. A continuous gasket G2 which is applied to the bottom of recessed perimeter extrusion 4008 provides a thermal break between the curtain wall composite assembly (FIG. 53). The curtain wall composite assembly rests upon 14009 lower gutter bearing leg which provides compression and the primary seal. Continuous pressure channel 4007 attaches the curtain wall panel to lower gutter 200 and upper gutter 2 through the screw bosses SB1 located in the gutters S1, S2. Continuous snap cover 4006 covers pressure channel 4007 covering machine screw 5. Any water that would penetrate the primary seal would flow into lower gutter 200 and upper gutter 2 into space S1 and drain to the bottom of the building elevation. Air pressure equalization is achieved through weep hole 4004 which allows the pressure within the curtain wall composite assembly to equalize with the pressures outside of the curtain wall face 23.

Figure 27:
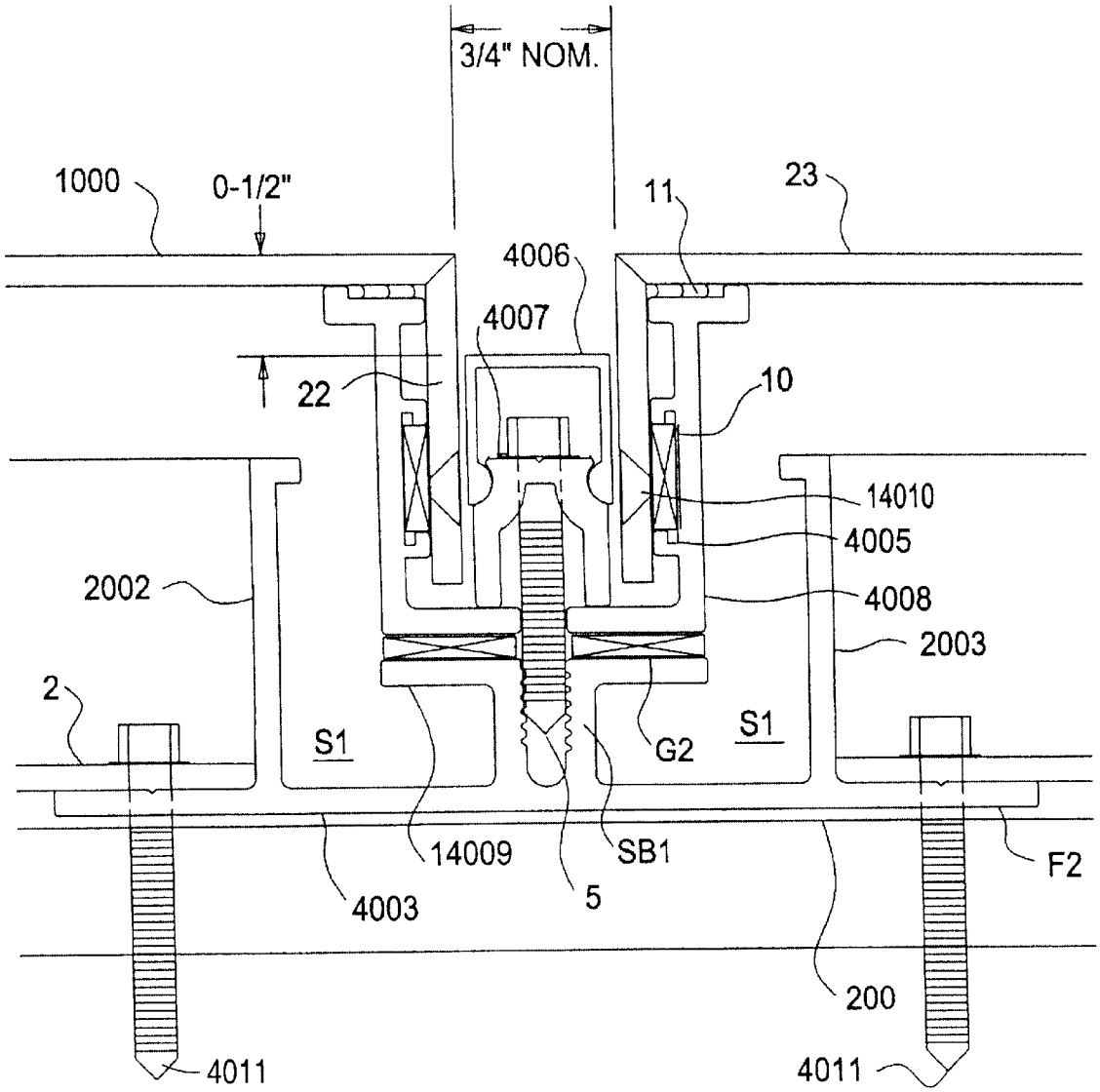
FIG. 27 is an identical view as shown in FIG. 17, but using the preferred embodiment components shown in FIG. 26, which are shown mounted as vertical gutters.

FIG. 27 is vertical sectional view of the preferred embodiment without a weep hole. The lower gutter 200 is attached to the upper gutter 2 at right angles through the flanges F1, F2 outside of gutter legs 2002 and 2003 to form a continuous gutter on which the curtain wall composite assembly attaches to the building structure 4003 using fastener 4011 (see FIG. 53). The curtain wall panel 1000 is supported by symmetrical recessed perimeter extrusion 4008 which acts as a corner brace around all four sides of the curtain wall panel 1000 and seals the corners with corner sealant 11. It is positively attached to return leg 22 by countersunk fastener 14010, which penetrates recessed perimeter extrusion 4008, and is sealed by butyl tape 10. The recessed perimeter extrusion 4008 is held together at the four corners by the corner reglet clip 4005 providing a framework without the use of fasteners. The curtain wall panel 1000 is attached to the continuous gutter created by lower gutter 200 and upper gutter 2 by machine screw 5 into the integral screw boss SB1 of the gutter members. A continuous gasket G2 which is applied to the bottom of recessed perimeter extrusion 4008 provides a thermal break between the curtain wall composite assembly, FIG. 53. The curtain wall composite assembly rests upon 14009 lower gutter bearing leg which provides compression and the primary seal. Continuous pressure channel 4007 attaches the curtain wall panel to lower gutter 200 and upper gutter 2 through the screw bosses SB1 located in the gutters. Continuous snap cover 4006 covers pressure channel 4007 covering machine screw 5. Any water that would penetrate the primary seal would flow into lower gutter 200 and upper gutter 2 into space S1 and drain to the bottom of the building elevation.

Figure 28:
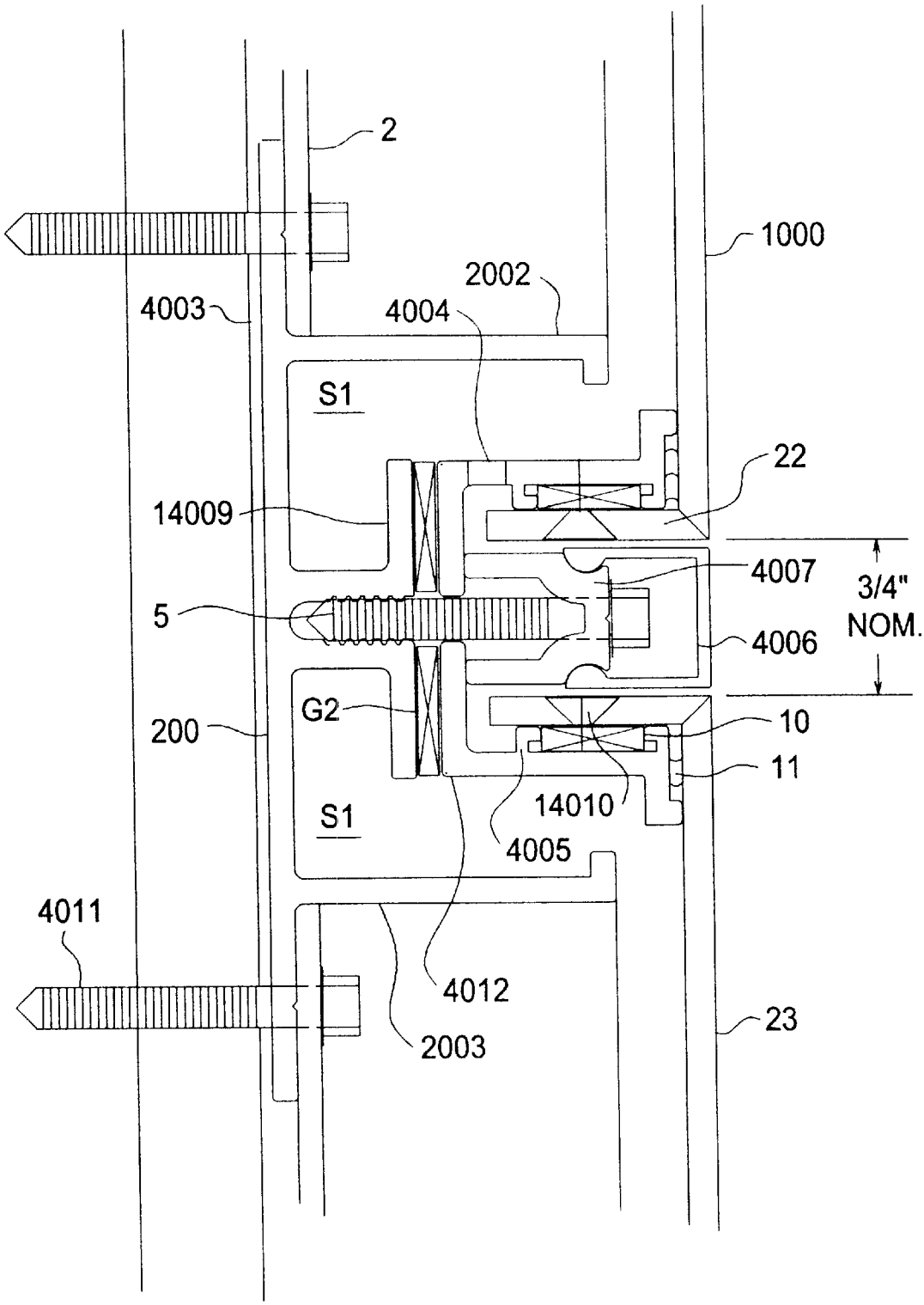
FIG. 28 is an identical view as shown in FIG. 26, but using a flush joint embodiment.

FIG. 28 is an identical view as shown in FIG. 26, but utilizing a flush joint embodiment which varies from FIG. 26 by using flush perimeter extrusion 4012.

Figure 29:
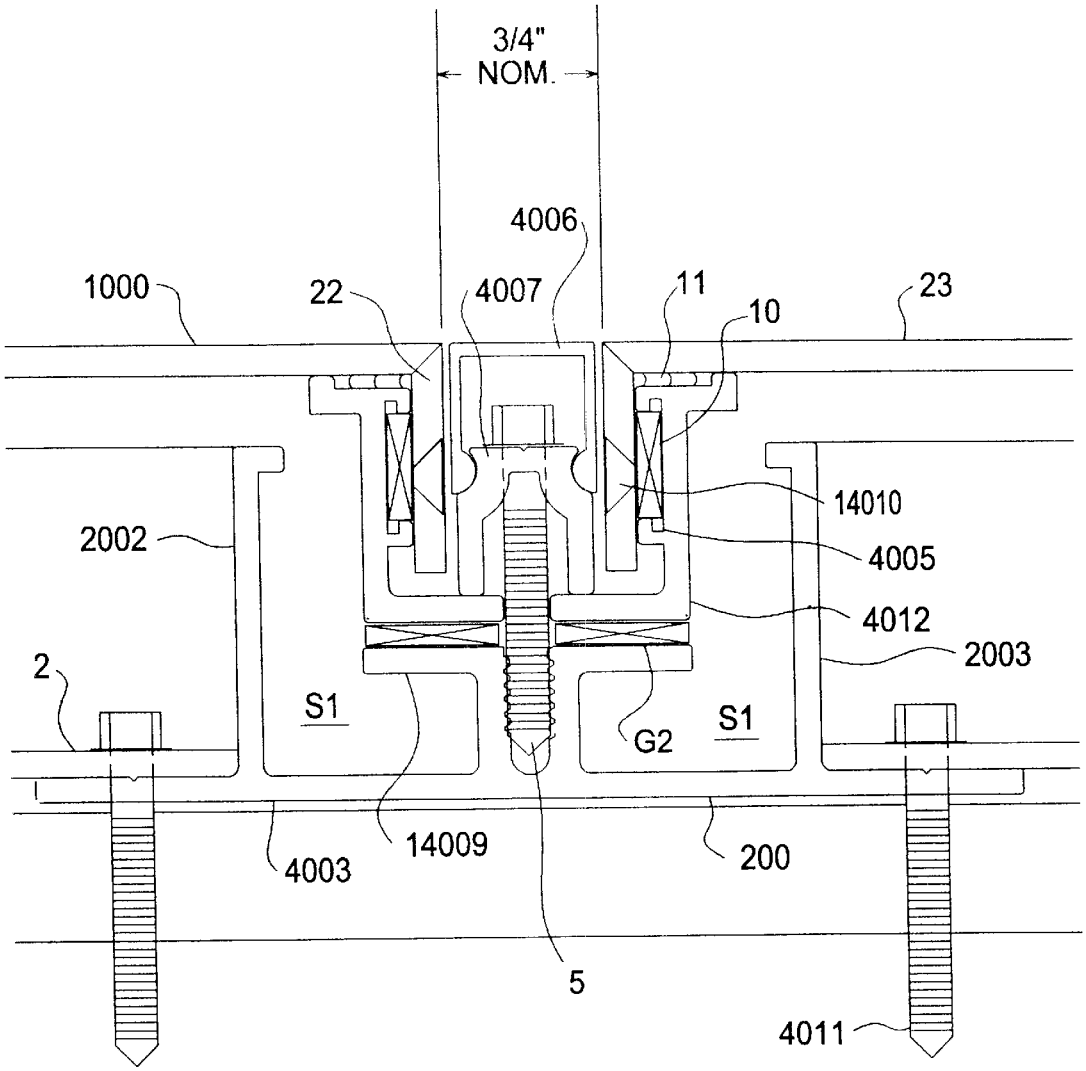
FIG. 29 is an identical view as FIG. 27, but using a flush joint embodiment.

FIG. 29 is an identical view as shown in FIG. 27, but utilizing a flush joint embodiment which varies from FIG. 27 by using flush perimeter extrusion 4012.

Figure 30:
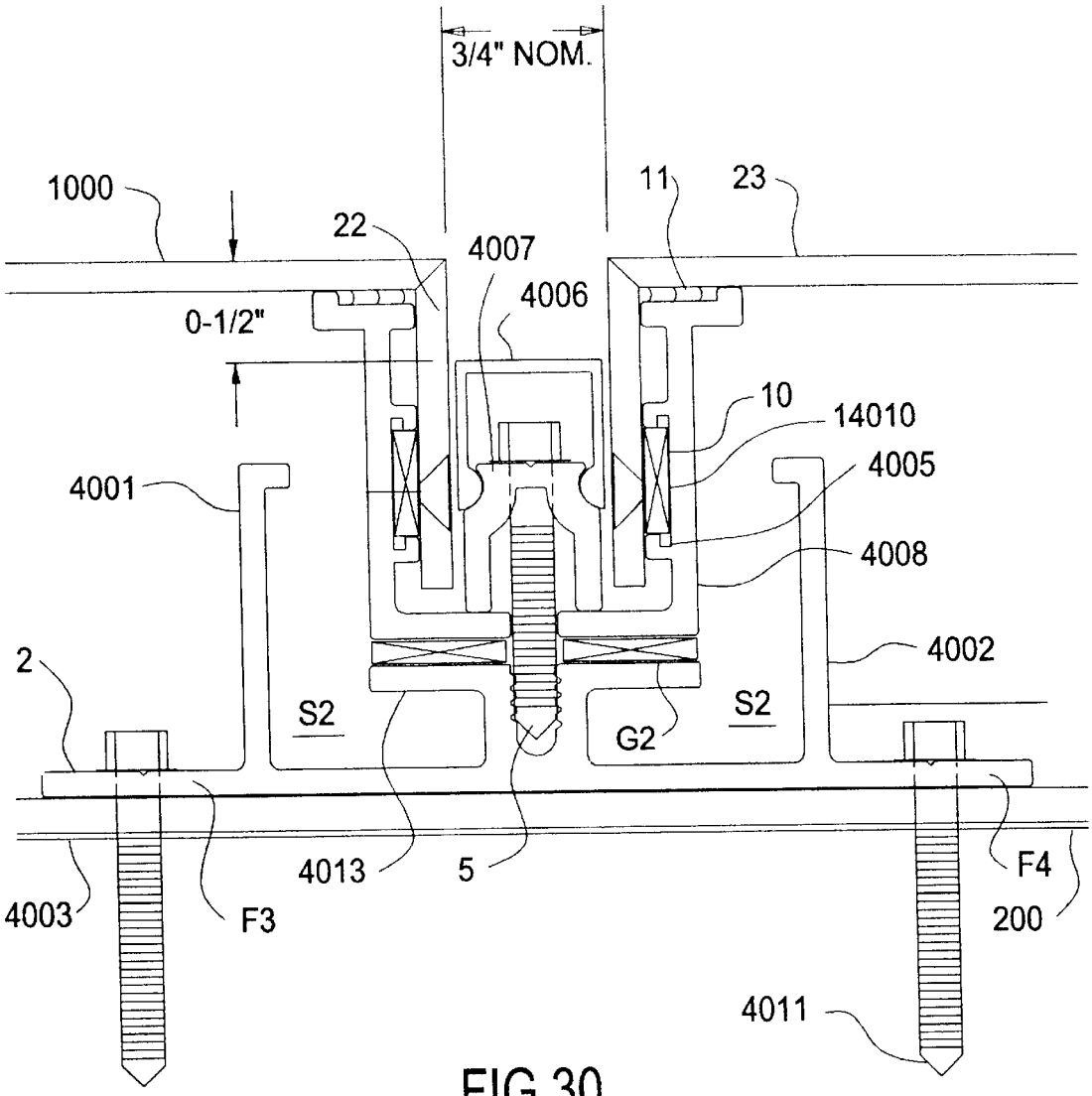
FIG. 30 is an identical view as FIG. 17, but with the preferred embodiment of the gutter and the curtain wall composite assembly.

FIG. 30 is a horizontal sectional view of the preferred embodiment. The upper gutter 2 is attached to the lower gutter 200 at right angles through the flanges F3, F4 outside of gutter legs 4001 and 4002 which forms a continuous gutter on which the curtain wall composite assembly makes attachment to the building structure 4003 using fastener 4011 (see FIG. 53). The curtain wall panel 1000 is supported by symmetrical recessed perimeter extrusion 4008 which acts as a corner brace around all four sides of the curtain wall panel 1000 and seals the corners with corner sealant 11. It is positively attached to return leg 22 by countersunk fastener 14010, which penetrates recessed perimeter extrusion 4008, and is sealed by butyl tape 10. The recessed perimeter extrusion 4008 is held together at the four corners by the corner reglet clip 4005 providing a framework without the use of fasteners. The curtain wall panel 1000 is attached to the continuous gutter created by lower gutter 200 and upper gutter 2 by machine screw 5 into the integral screw boss of the gutter members. A continuous gasket G2 which is applied to the bottom of recessed perimeter extrusion 4008 provides a thermal break between the curtain wall composite assembly, FIG. 53. The curtain wall composite assembly rests upon 4013 upper gutter bearing leg which provides compression and the primary seal. Continuous pressure channel 4007 attaches the curtain wall panel to lower gutter 200 and upper gutter 2 through the screw bosses located in the gutters. Continuous snap cover 4006 covers pressure channel 4007 covering machine screw 5. Any water that would penetrate the primary seal would flow into lower gutter 200 and upper gutter 2 into space S1 and drain to the bottom of the building elevation.

Figure 31:
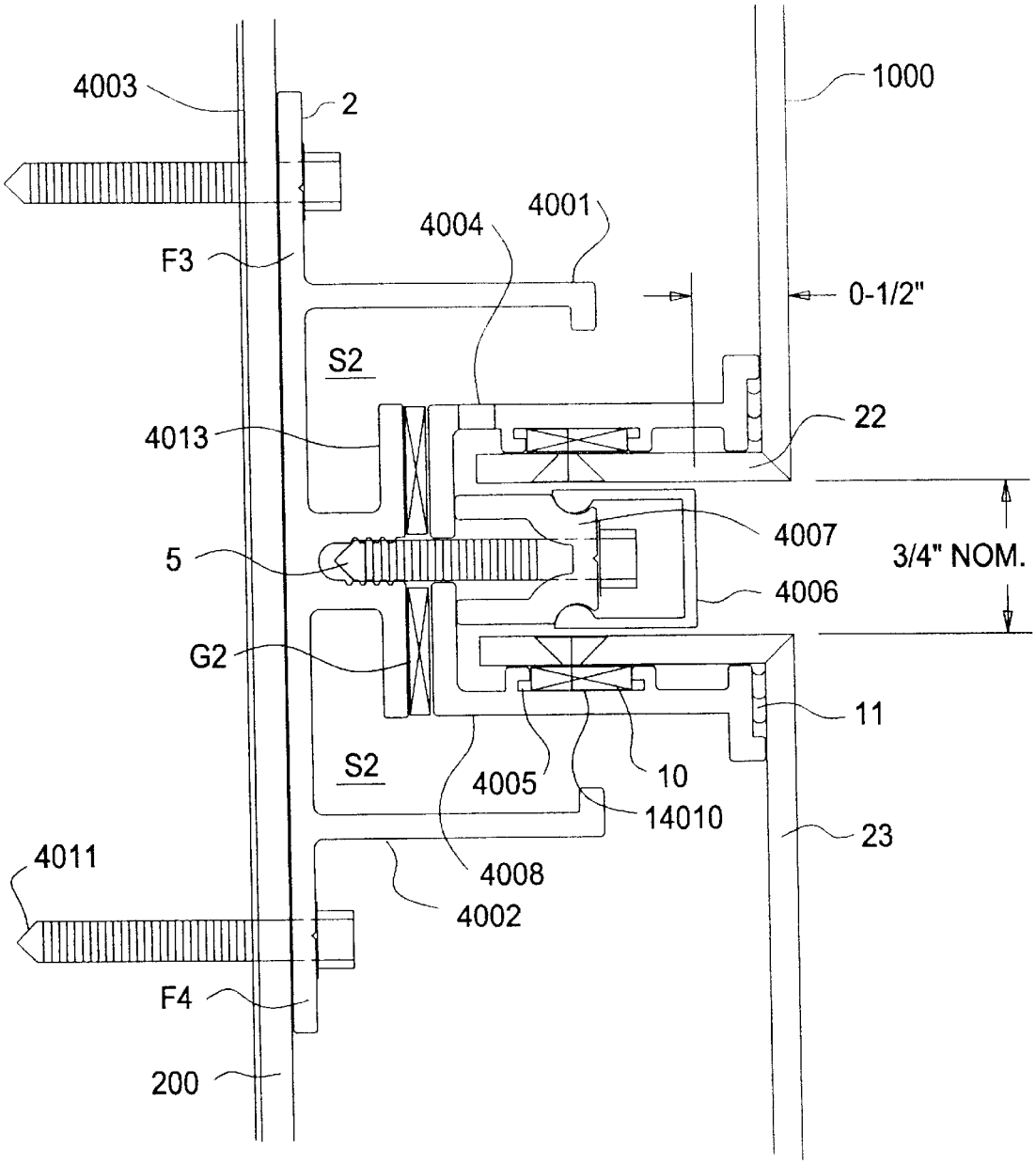
FIG. 31 is an identical view as FIG. 16, but with the preferred embodiment components shown in FIG. 30.

FIG. 31 is a horizontal sectional view of the preferred embodiment. The upper gutter 2 is attached to the lower gutter 200 at right angles through the flanges outside of gutter legs 4001 and 4002 which forms a continuous gutter on which the curtain wall composite assembly makes attachment to the building structure 4003 using fastener 4011 (see FIG. 53). The curtain wall panel 1000 is supported by symmetrical recessed perimeter extrusion 4008 which acts as a corner brace around all four sides of the curtain wall panel 1000 and seals the corners with corner sealant 11. It is positively attached to return leg 22 by countersunk fastener 14010, which penetrates recessed perimeter extrusion 4008, and is sealed by butyl tape 10. The recessed perimeter extrusion 4008 is held together at the four corners by the corner reglet clip 4005 providing a framework without the use of fasteners. The curtain wall panel 1000 is attached to the continuous gutter created by lower gutter 200 and upper gutter 2 by machine screw 5 into the integral screw boss of the gutter members. A continuous gasket G2 which is applied to the bottom of recessed perimeter extrusion 4008 provides a thermal break between the curtain wall composite assembly (see FIG. 53). The curtain wall composite assembly rests upon 4013 upper gutter bearing leg which provides compression and the primary seal. Continuous pressure channel 4007 attaches the curtain wall panel to lower gutter 200 and upper gutter 2 through the screw bosses located in the gutters. Continuous snap cover 4006 covers pressure channel 4007 covering machine screw 5. Any water that would penetrate the primary seal would flow into lower gutter 200 and upper gutter 2 into space S1 and drain to the bottom of the building elevation. Air pressure equalization is achieved through weep hole 4004 which allows the pressure within the curtain wall composite assembly to equalize with the pressures outside of the curtain wall face 23.

Figure 32:
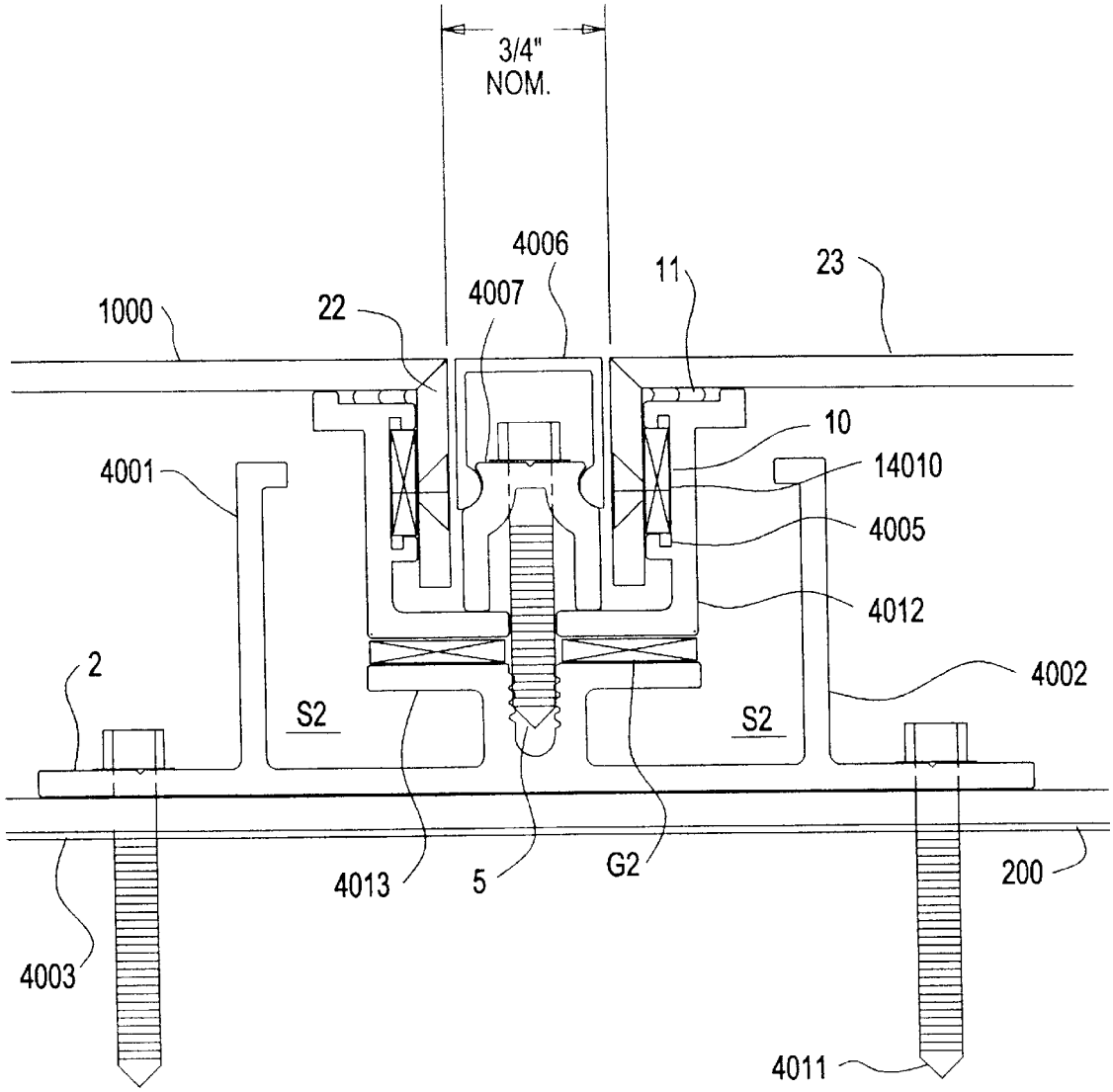
FIG. 32 is an identical view as shown in FIG. 30, but with a flush joint embodiment.

FIG. 32 is an identical view as shown in FIG. 30, but utilizing a flush joint embodiment which varies from FIG. 30 by utilizing flush perimeter extrusion 4012.

Figure 33:
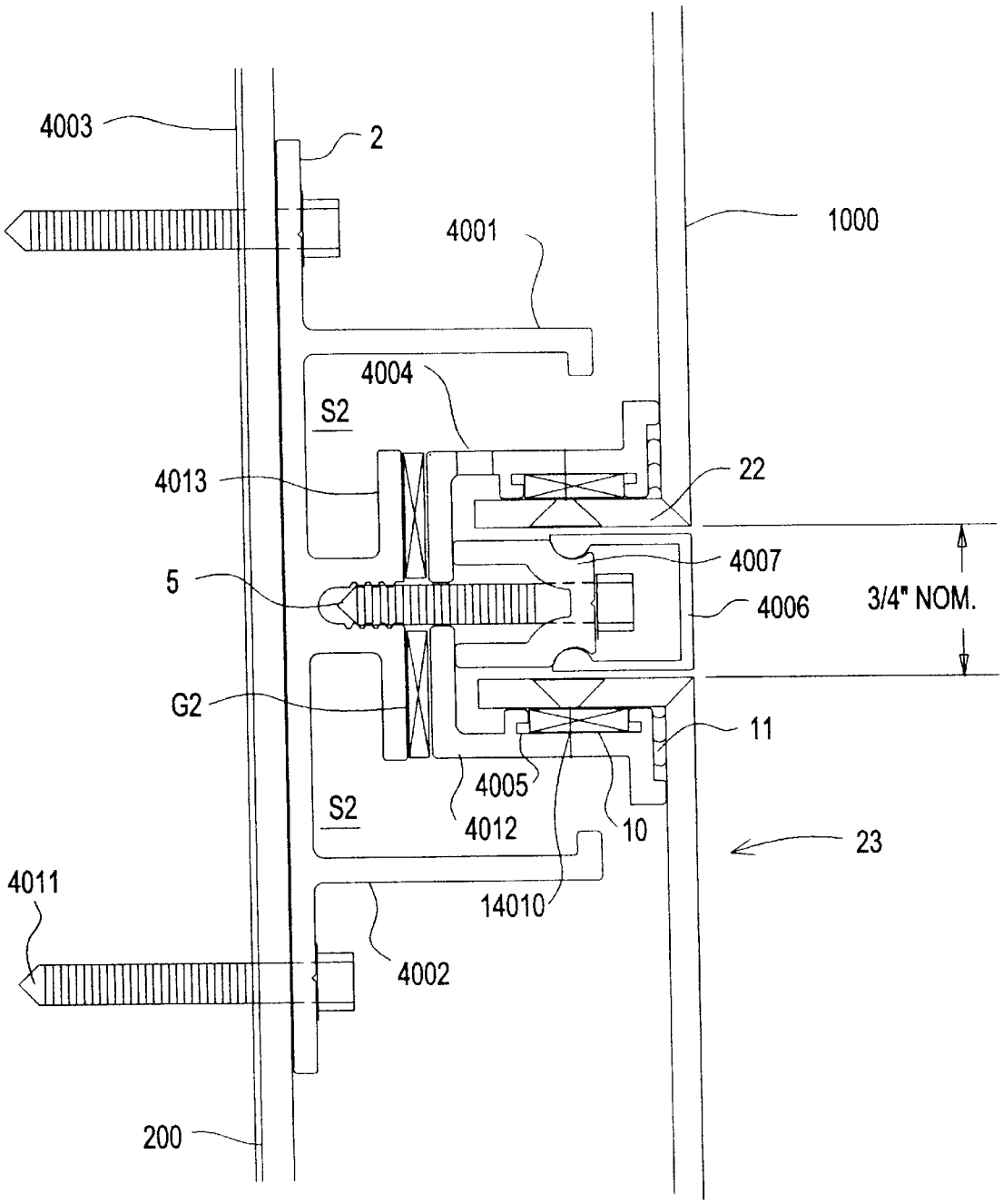
FIG. 33 is an identical view as shown in FIG. 31, but with a flush joint embodiment.

FIG. 33 is an identical view as shown in FIG. 31, but utilizing a flush joint embodiment which varies from FIG. 31 by utilizing flush perimeter extrusion 4012.

Figure 34:
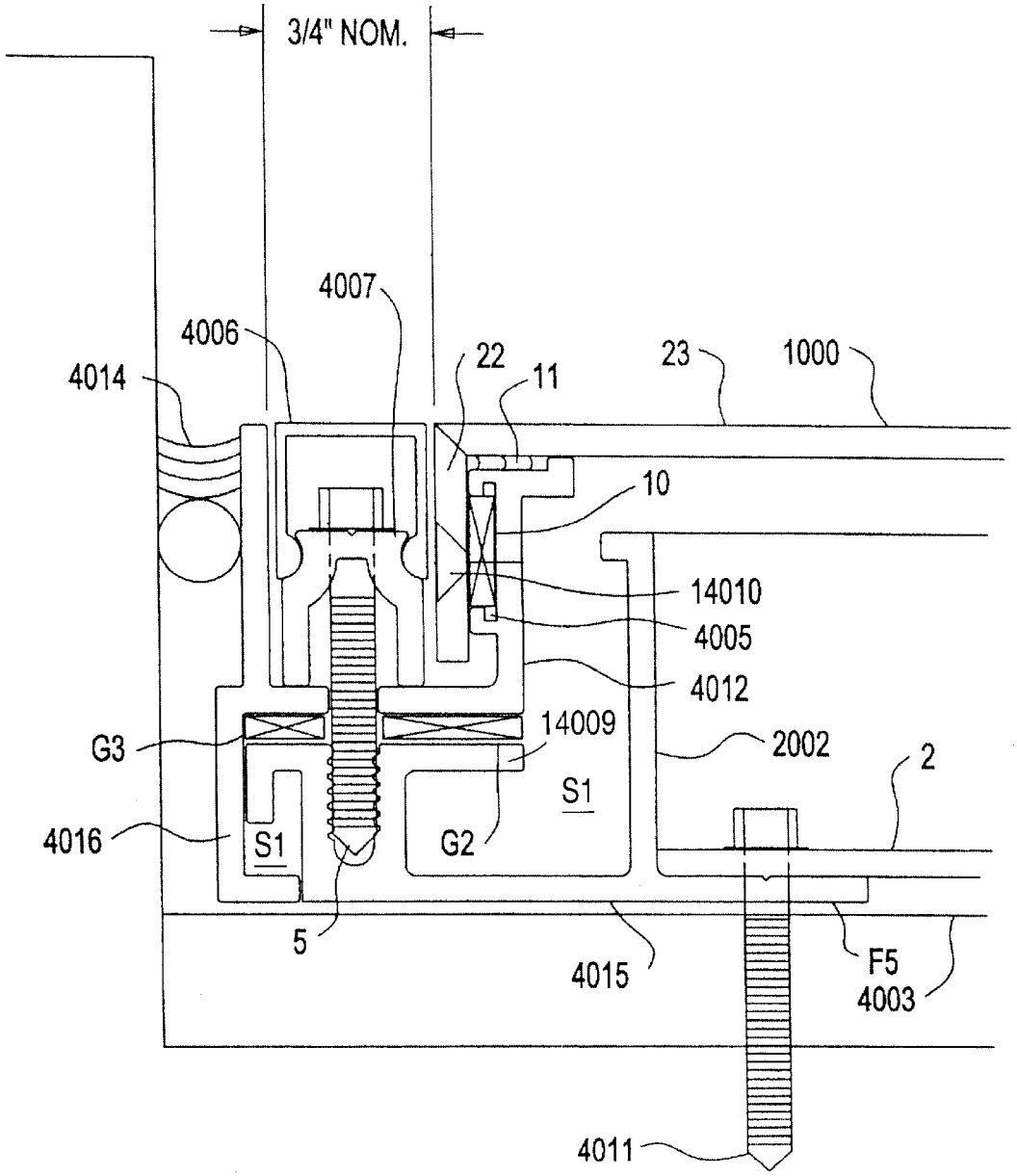
FIG. 34 is a vertical sectional view of a lower termination segment of the preferred embodiment, as illustrated in FIG. 53.

FIG. 34 is a vertical sectional view of lower termination gutter 4015 attached to upper gutter 2 at right angles through the flanges outside of gutter leg 2002 which forms a continuous gutter on which the curtain wall composite assembly makes attachment to the building structure 4003 using fastener 4011 or similar (see FIG. 53). The curtain wall panel 1000 is supported by symmetrical flush perimeter extrusion 4012 which acts as a corner brace around all four sides of the curtain wall panel 1000 and seals the corners with corner sealant 11. It is positively attached to return leg 22 by countersunk fastener 14010, which penetrates flush perimeter extrusion 4012, and is sealed by butyl tape 10. The flush perimeter extrusion 4012 is held together at the four corners by the corner reglet clip 4005 providing a framework without the use of fasteners. The curtain wall panel 1000 is attached to the continuous gutter created by lower gutter 4015 and upper gutter 2 by machine screw 5 into the integral screw boss of the gutter members. A continuous gasket G2 which is applied to the bottom of flush perimeter extrusion 4012 provides a thermal break between the curtain wall composite assembly, FIG. 53. The curtain wall composite assembly rests upon 14009 lower gutter bearing leg which provides compression and the primary seal. Continuous pressure channel 4007 attaches the curtain wall panel to lower gutter 4015 and upper gutter 2 through the screw bosses located in the gutters. Continuous snap cover 4006 covers pressure channel 4007 covering machine screw 5. Any water that would penetrate the primary seal would flow into lower gutter 4015 and upper gutter 2 into space S1 and drain to the bottom of the building elevation. The continuous pressure channel 4006 rests upon termination closure 4016 and gasket spacer G3. The system is sealed to adjacent materials by perimeter sealant 4014.

Figure 35:
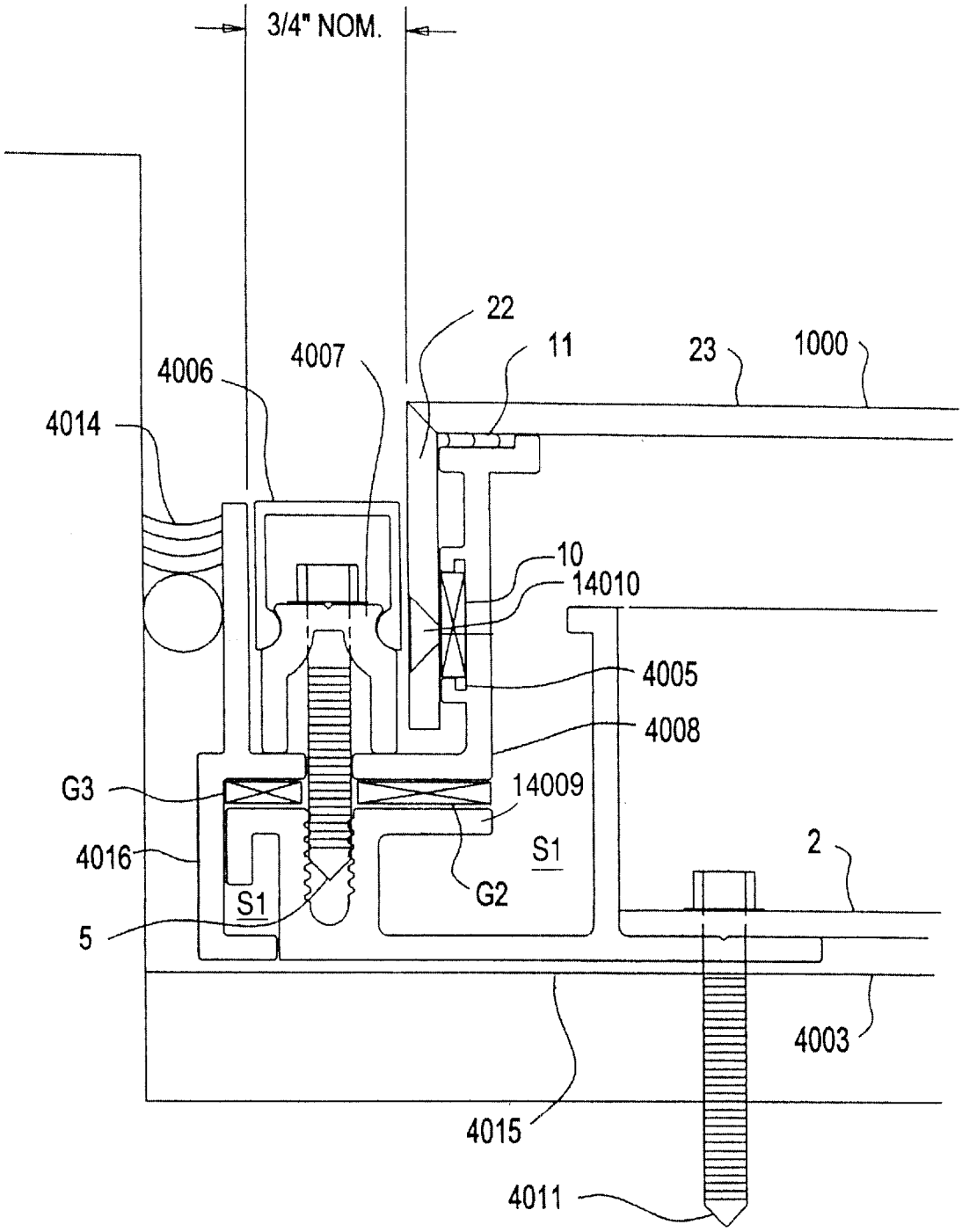
FIG. 35 is a horizontal sectional view of a lower termination segment of the preferred embodiment, as illustrated in FIG. 53.

FIG. 35 is an identical view as shown in FIG. 34, but utilizing a recessed joint embodiment which varies from FIG. 34 by utilizing recessed perimeter extrusion 4008.

Figure 36:
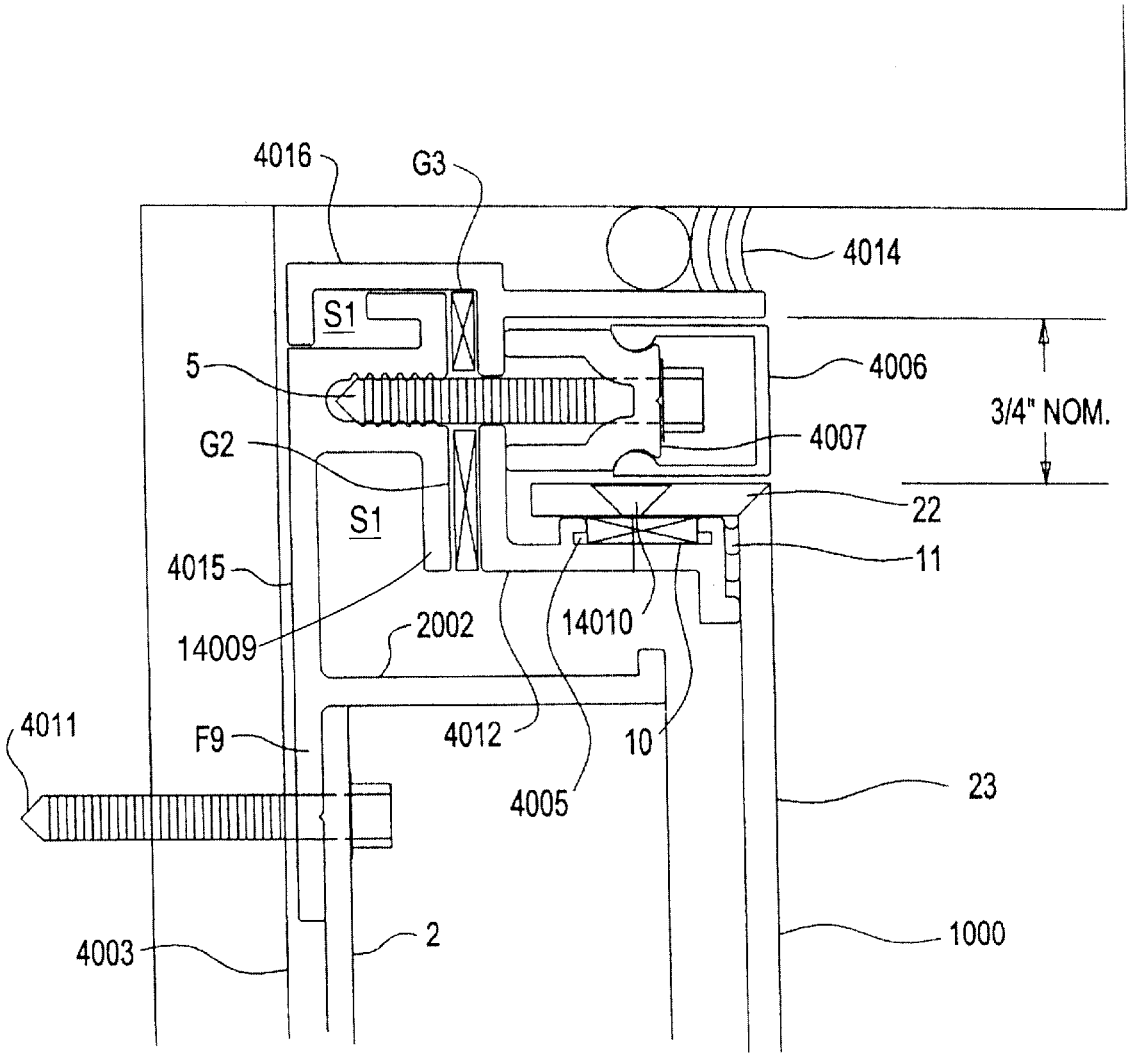
FIG. 36 is vertical sectional view of a lower termination segment(s) of the preferred embodiment, as illustrated in FIG. 53.

FIG. 36 is a vertical sectional view of lower termination gutter 4015 attached to upper gutter 2 at right angles through the flanges F9 outside of gutter leg 2002 which forms a continuous gutter on which the curtain wall composite assembly, FIG. 53, makes attachment to the building structure 4003 using fastener 4011. The curtain wall panel 1000 is supported by symmetrical flush perimeter extrusion 4012 which acts as a corner brace around all four sides of the curtain wall panel 1000 and seals the corners with corner sealant 11. It is positively attached to return leg 22 by countersunk fastener 14010, which penetrates flush perimeter extrusion 4012, and is sealed by butyl tape 10. The flush perimeter extrusion 4012 is held together at the four corners by the corner reglet clip 4005 providing a framework without the use of fasteners. The curtain wall panel 1000 is attached to the continuous gutter created by lower gutter 4015 and upper gutter 2 by machine screw 5 into the integral screw boss of the gutter members. A continuous gasket G2 which is applied to the bottom of flush perimeter extrusion 4012 provides a thermal break between the curtain wall composite assembly, FIG. 53. The curtain wall composite assembly rests upon 14009 lower gutter bearing leg which provides compression and the primary seal. Continuous pressure channel 4007 attaches the curtain wall panel to lower gutter 4015 and upper gutter 2 through the screw bosses located in the gutters. Continuous snap cover 4006 covers pressure channel 4007 covering machine screw 5. Any water that would penetrate the primary seal would flow into lower gutter 4015 and upper gutter 2 into space S1 and drain to the bottom of the building elevation. Air pressure equalization is achieved through weep hole 4004 which allows the pressure within the curtain wall composite assembly to equalize with the pressures outside of the curtain wall face 23. The continuous pressure channel 4007 rests upon termination closure 4016 and gasket spacer G3. The system is sealed to adjacent materials by perimeter sealant 4014.

Figure 37:
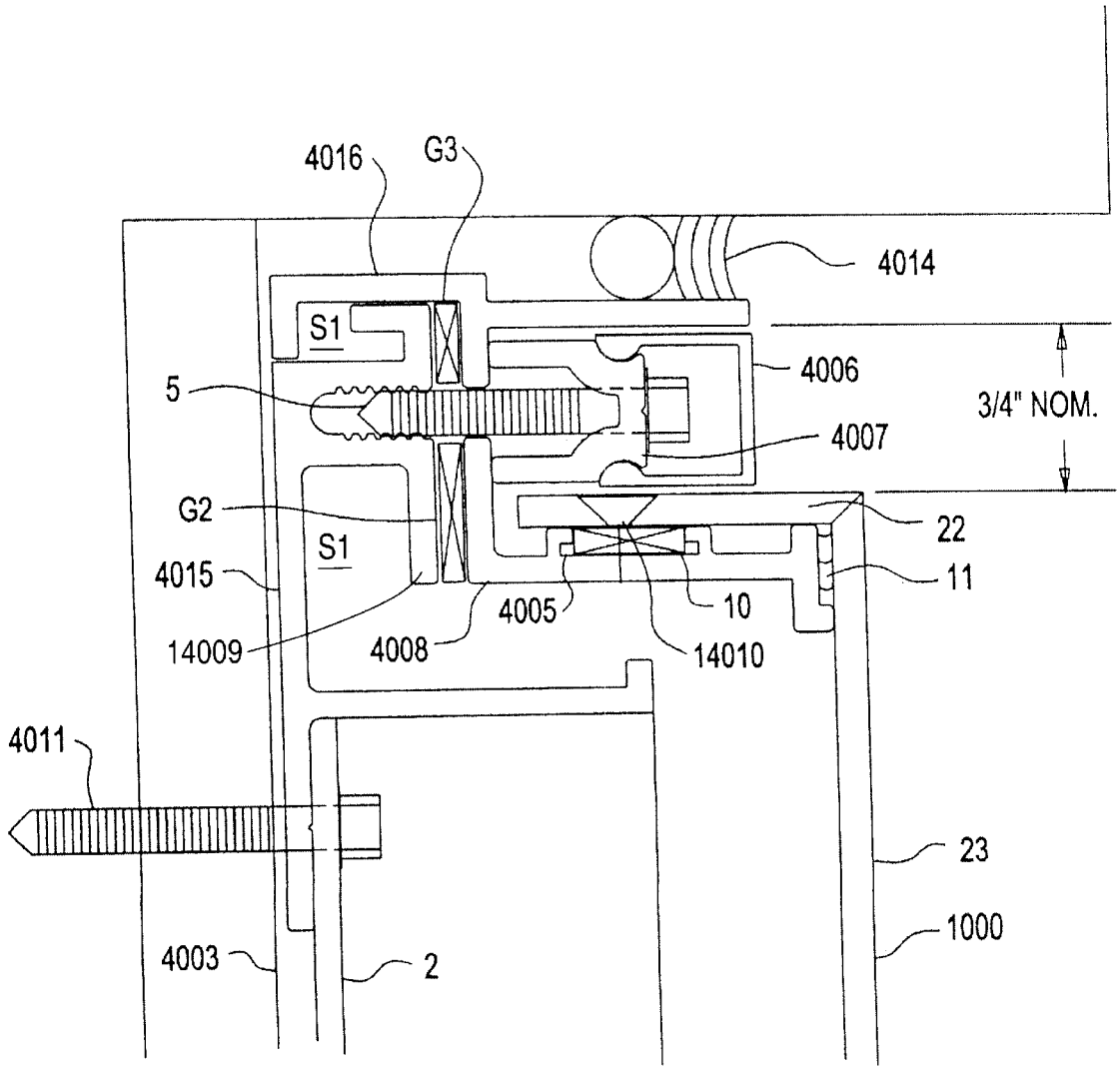
FIG. 37 is an identical view as shown in FIG. 36, but using a recessed joint embodiment.

FIG. 37 is an identical view as shown in FIG. 36, but utilizing a recessed joint embodiment which varies from FIG. 36 by utilizing recessed perimeter extrusion 4008.

Figure 38:
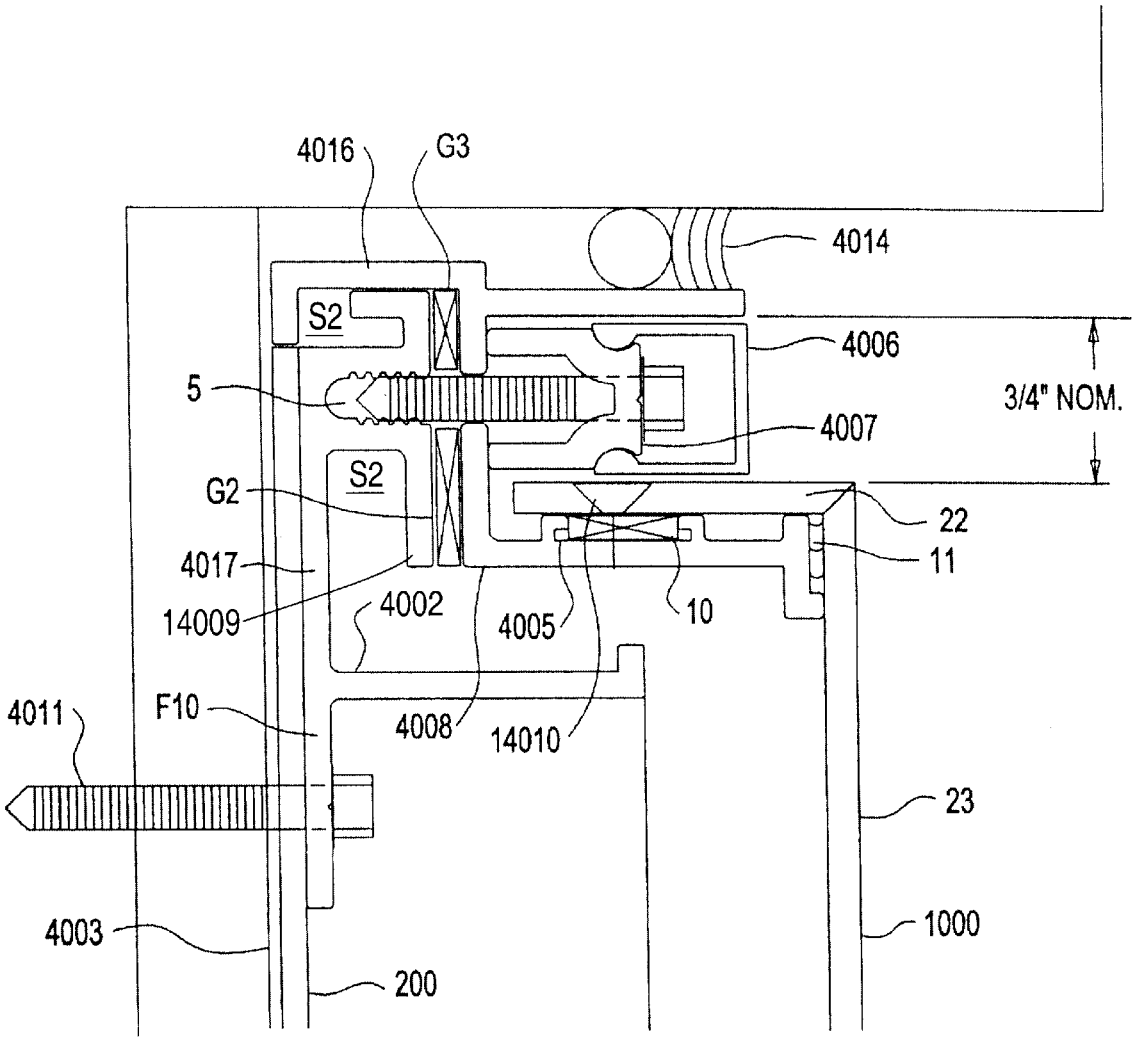
FIG. 38 is a vertical sectional view of an upper termination segment of the preferred embodiment, as illustrated in FIG. 53.

FIG. 38 is a vertical sectional view of upper termination gutter 4017 attached to lower gutter 200 at right angles through the flanges F10 outside of gutter leg 4002 which forms a continuous gutter on which the curtain wall composite assembly, FIG. 53, makes attachment to the building structure 4003 using fastener 4011. The curtain wall panel 1000 is supported by a recessed perimeter extrusion 4008 which acts as a corner brace around all four sides of the curtain wall panel 1000 and seals the corners with corner sealant 11. It is positively attached to return leg 22 by countersunk fastener 14010, which penetrates flush perimeter extrusion 4012, and is sealed by butyl tape 10. The flush perimeter extrusion 4012 is held together at the four corners by the corner reglet clip 4005 providing a framework without the use of fasteners. The curtain wall panel 1000 is attached to the continuous gutter created by lower gutter 200 and upper gutter 4017 by machine screw 5 into the integral screw boss of the gutter members. A continuous gasket G2 which is applied to the bottom of recessed perimeter extrusion 4008 provides a thermal break between the curtain wall composite assembly (see FIG. 53). The curtain wall composite assembly rests upon 14009 lower gutter bearing leg which provides compression and the primary seal. Continuous pressure channel 4007 attaches the curtain wall panel to lower gutter 200 and upper gutter 4017 through the screw bosses located in the gutters. Continuous snap cover 4006 covers pressure channel 4007 covering machine screw 5. Any water that would penetrate the primary seal would flow into lower gutter 200 and upper gutter 4017 into space S2 and drain to the bottom of the building elevation. The continuous pressure channel 4006 rests upon termination closure 4016 and gasket spacer G3. The system is sealed to adjacent materials by perimeter sealant 4014.

Figure 39:
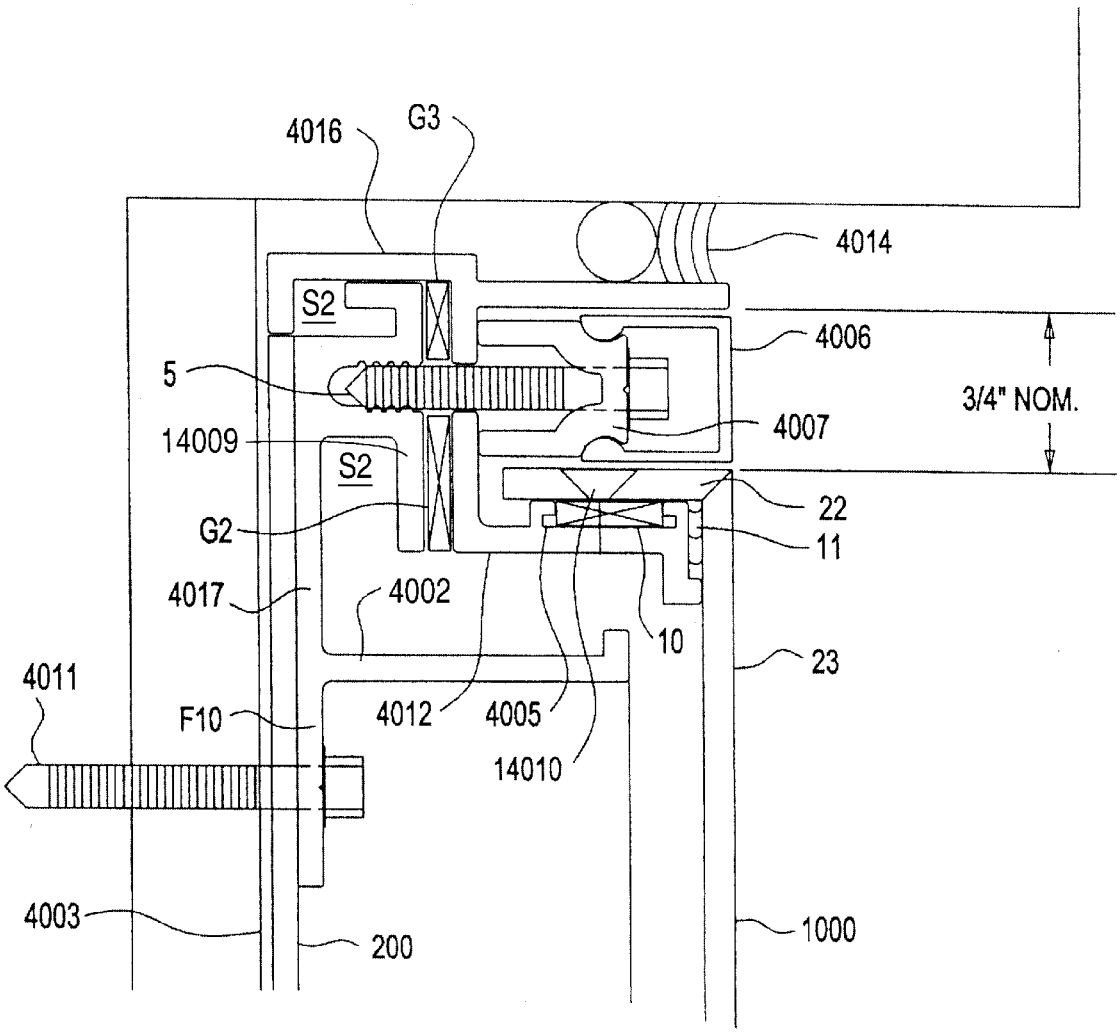
FIG. 39 is an identical view as shown in FIG. 38, but using a flush joint embodiment.

FIG. 39 is an identical view as shown in FIG. 38, but utilizes a flush joint embodiment which varies from FIG. 38 by utilizing flush perimeter extrusion 4012.

Figure 40:
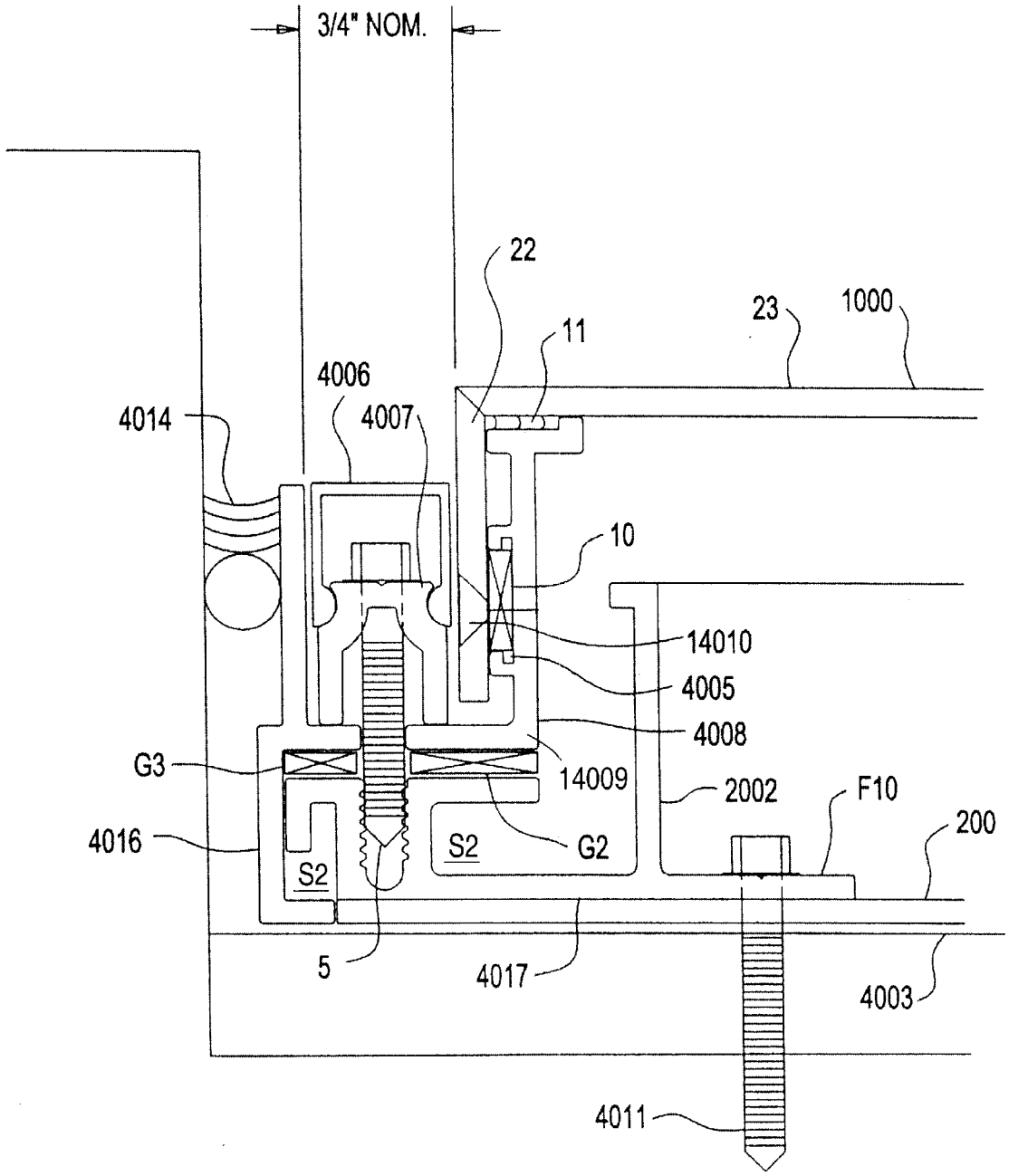
FIG. 40 is a horizontal sectional view of an upper termination segment of the preferred embodiment, as illustrated in FIG. 53.

FIG. 40 is a horizontal sectional view of upper termination gutter 4017 attached to lower gutter 200 at right angles through the flanges F10 outside of gutter legs 2002 and 2003 which forms a continuous gutter on which the curtain wall composite assembly (see FIG. 53) makes attachment to the building structure 4003 using fastener 4011. The curtain wall panel 1000 is supported by recessed perimeter extrusion 4008 which acts as a corner brace around all four sides of the curtain wall panel 1000 and seals the corners with corner sealant 11. It is positively attached to return leg 22 by countersunk fastener 14010, which penetrates recessed perimeter extrusion 4008, and is sealed by butyl tape 10. The recessed perimeter extrusion 4008 is held together at the four corners by the corner reglet clip 4005 providing a framework without the use of fasteners. The curtain wall panel 1000 is attached to the continuous gutter created by lower gutter 200 and upper gutter 4017 by machine screw 5 into the integral screw boss of the gutter members. A continuous gasket G2 which is applied to the bottom of flush perimeter extrusion 4012 provides a thermal break between the curtain wall composite assembly (see FIG. 53). The curtain wall composite assembly rests upon 14009 lower gutter bearing leg, which provides compression and the primary seal. Continuous pressure channel 4007 attaches the curtain wall panel to lower gutter 200 and upper gutter 4017 through the screw bosses located in the gutters. Continuous snap cover 4006 covers pressure channel 4007 covering machine screw 5. Any water that would penetrate the primary seal would flow into lower gutter 200 and upper gutter 4017 into space S2 and drain to the bottom of the building elevation. The continuous pressure channel 4006 rests upon termination closure 4016 and gasket spacer G3. The system is sealed to adjacent materials by perimeter sealant 4014.

Figure 41:
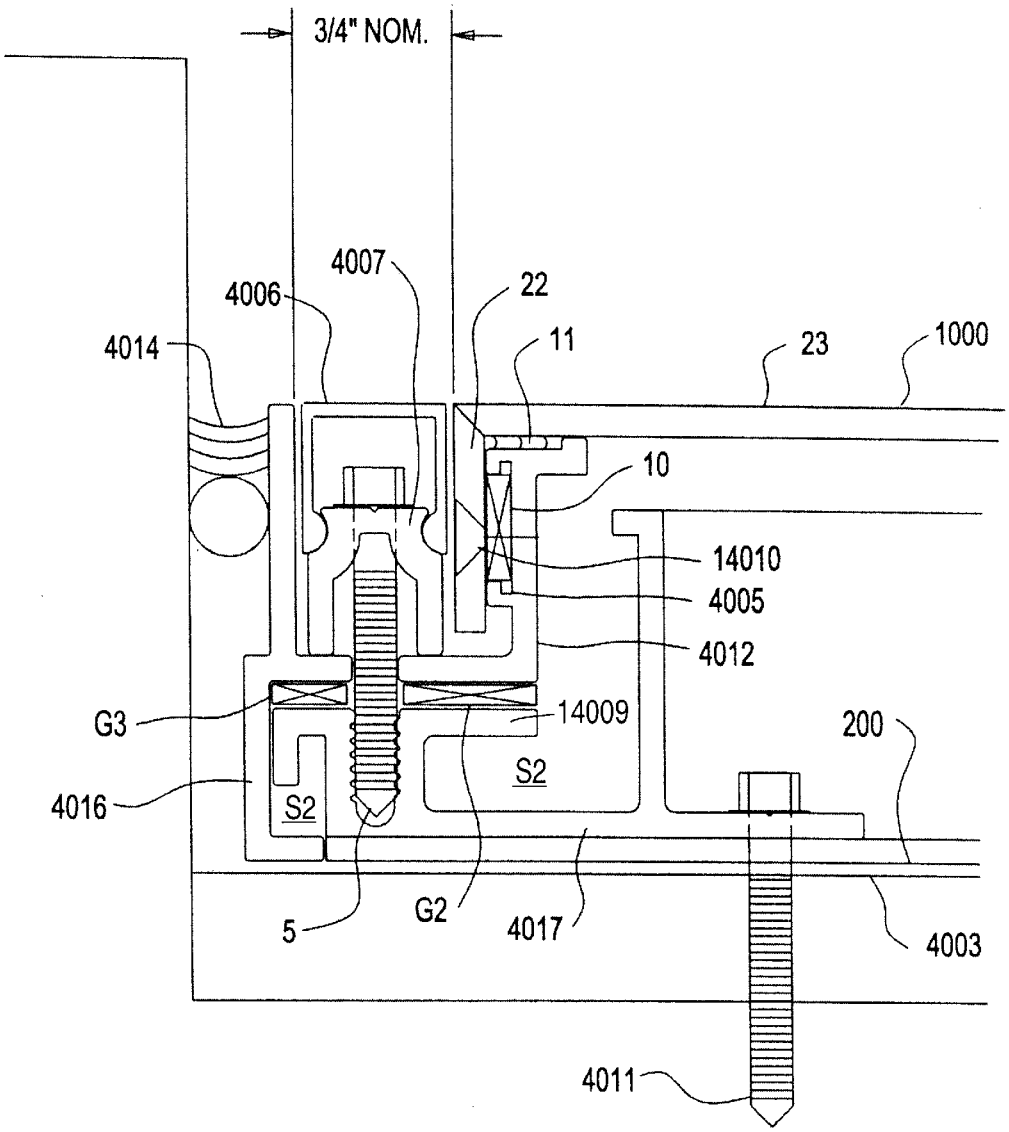
FIG. 41 is an identical view as shown in FIG. 40, but using a flush joint embodiment.

FIG. 41 is an identical view as shown in FIG. 40, but utilizing a flush joint embodiment which varies from FIG. 40 by utilizing flush perimeter extrusion 4012.

Figure 42A:
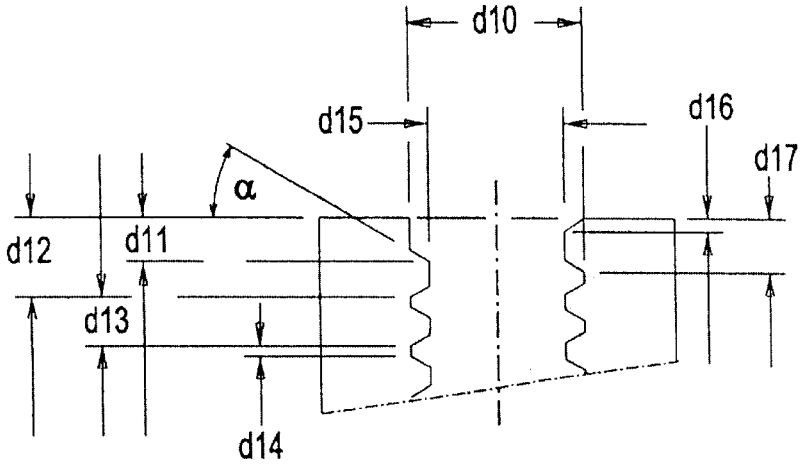
FIGS. 42 and 42A are a cross sectional view of gutter 200 showing nominal dimensions.
Figure 42:
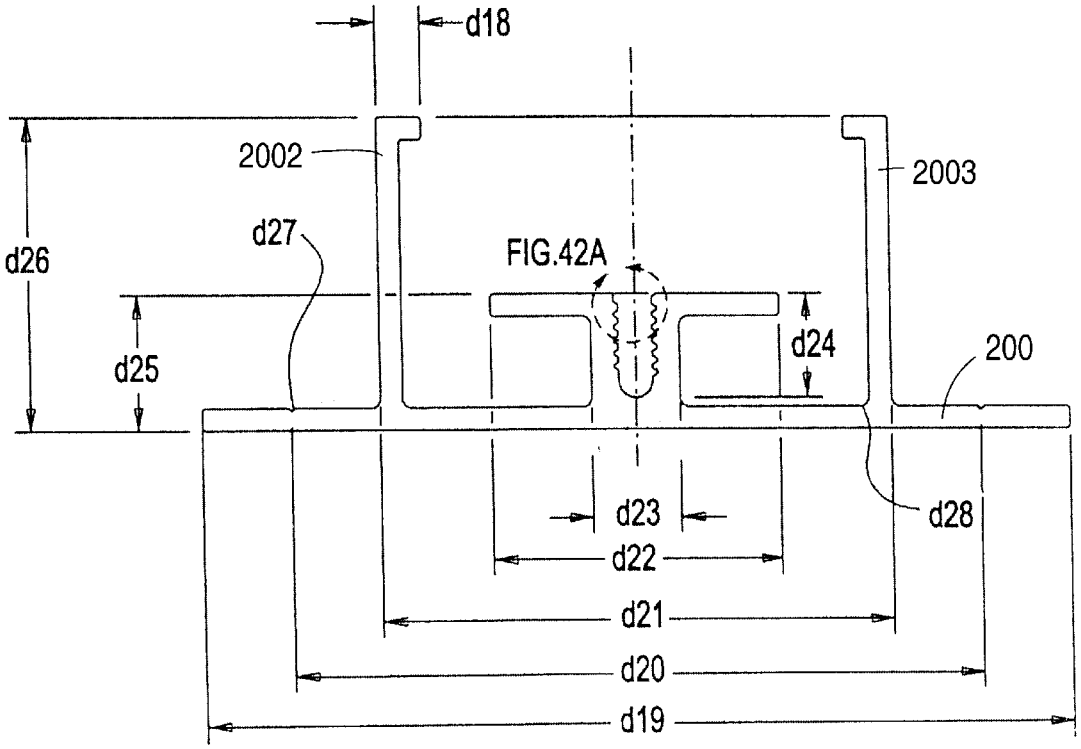

FIG. 42 shows lower gutter 200 nominal dimensions:

| | |
|---|---|
| d10 = .246 | |
| d11 = .060 | |
| d12 = .110 | |
| d13 = .071 | |
| d14 = .015 | |
| d15 = .192 | |
| d16 = .018 | |
| d17 = .074 | |
| d18 = .250 | |
| d19 = 4.877 | |
| d20 = 3.877 | |
| d21 = 2.877 | |
| d22 = 1.624 | |
| d23 = .500 | |
| d24 = .575 | d27 = .020 × 90° |
| d25 = .750 | d28 = .050R |
| α = 30° | P.I. = Point in between |
| d26 = 1.750 | |

Figure 43A:
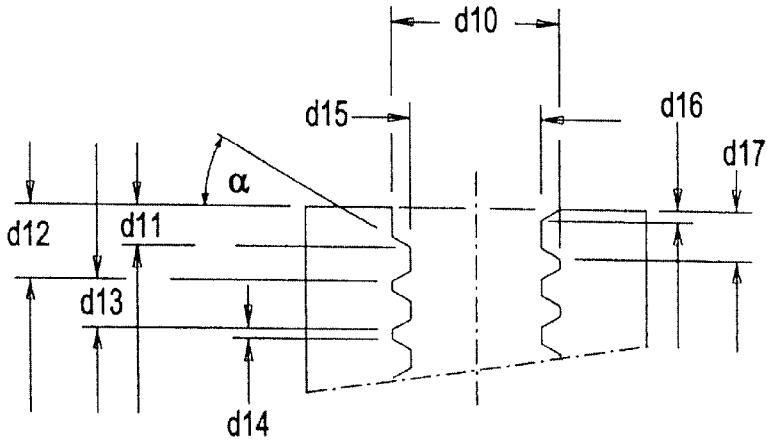
FIGS. 43 and 43A are a cross sectional view of gutter 2 showing nominal dimensions.
Figure 43:
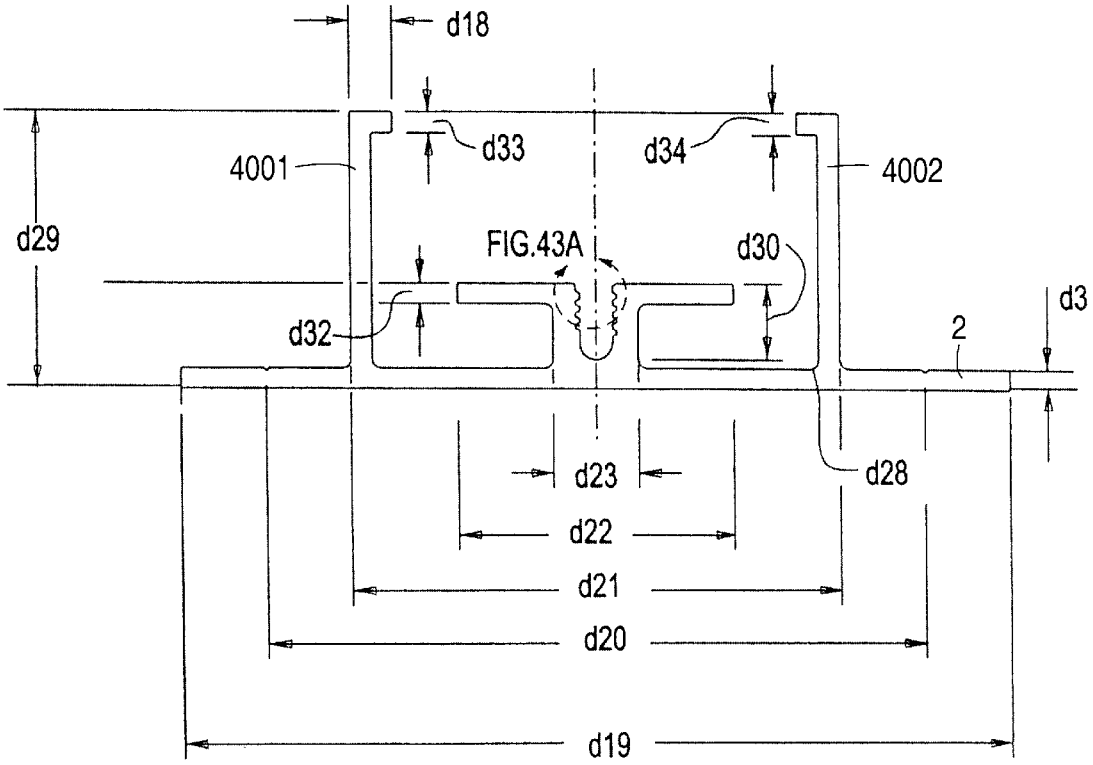

FIG. 43 shows upper gutter 2 nominal dimensions:

| | |
|---|---|
| d10–d23 are same as FIG. 42 | |
| d29 = 1.625 | |
| d30 = .450 | |
| d34 = .125 | |
| d27 = .020 X 90° | |
| d28 = .050R | P.I. = Point in between |
| d31 = .125 | α = 30° |
| d32 = .125 | |
| d33 = .125 | |

Figure 44:
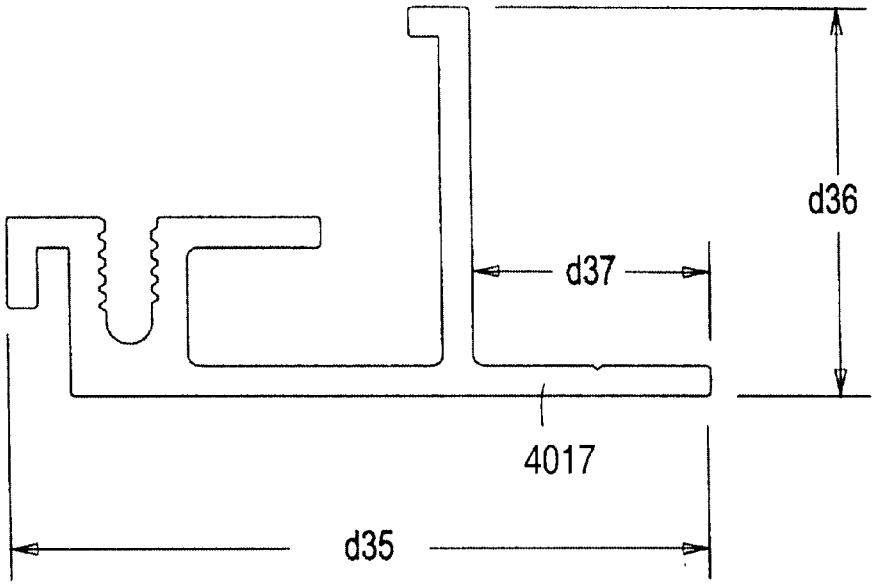
FIG. 44 is a cross sectional view of termination gutter 4017 showing nominal dimensions.

FIG. 44 shows upper termination 4017 nominal dimensions:

d35=2.909 d36=1.625 d37=1.000

Figure 45:
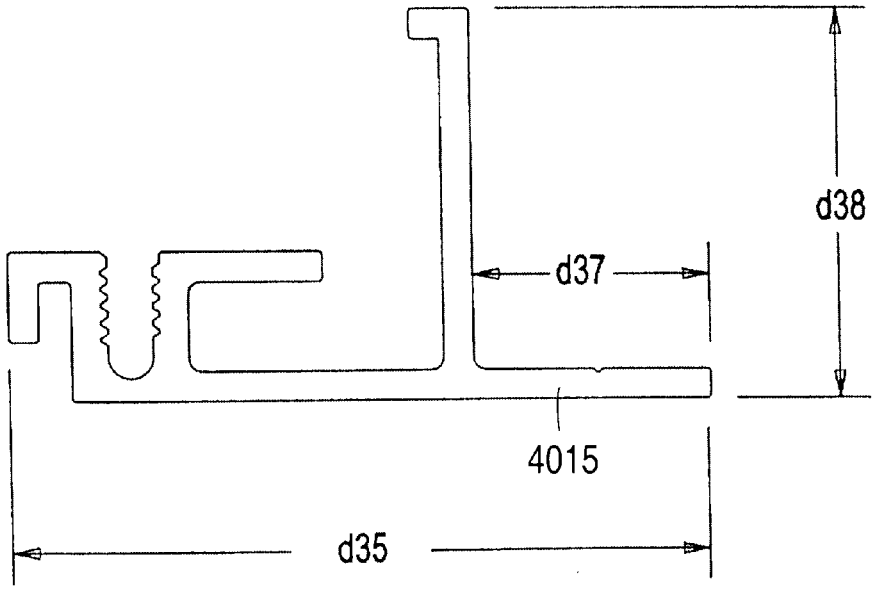
FIG. 45 is a cross sectional view of termination gutter 4015 showing nominal dimensions.

FIG. 45 shows lower termination 4015 nominal dimensions:

d35=2.909 d37=1.000 d38=1.750

Figure 46:
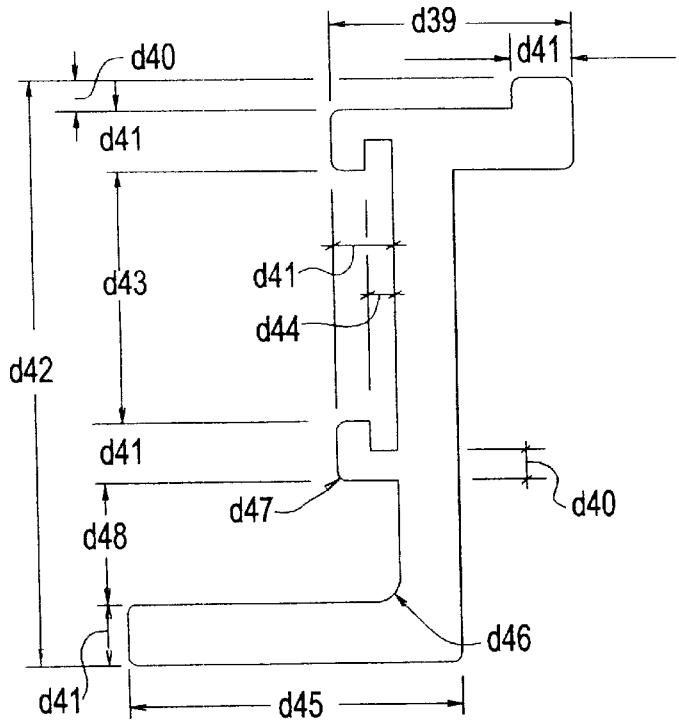
FIG. 46 is a cross sectional view of flush perimeter extrusion 4012 showing nominal dimensions.

FIG. 46 shows flush perimeter extension 4012 nominal dimensions:

d39=0.500 d40=0.063 d41=0.125 d42=1.214 d43=0.526 d44=0.060 d45=0.689 d46=0.050R d47=0.020R d48=0.250

Figure 47:
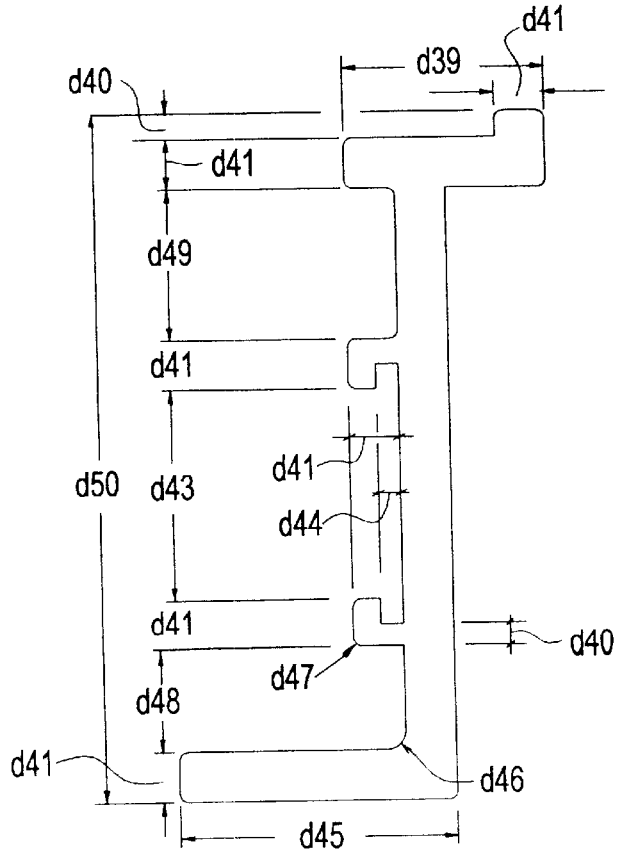
FIG. 47 is a cross sectional view of recessed perimeter extrusion 4008 showing nominal dimensions.

FIG. 47 shows Recessed Perimeter Extension 4008 nominal dimensions:

d39=0.500 d40=0.063 d41=0.125 d43=0.526 d44=0.060 d45=0.689 d46=0.050R d47=0.020R d48=0.250 d49=0.375 d50=1.714

Figure 48:
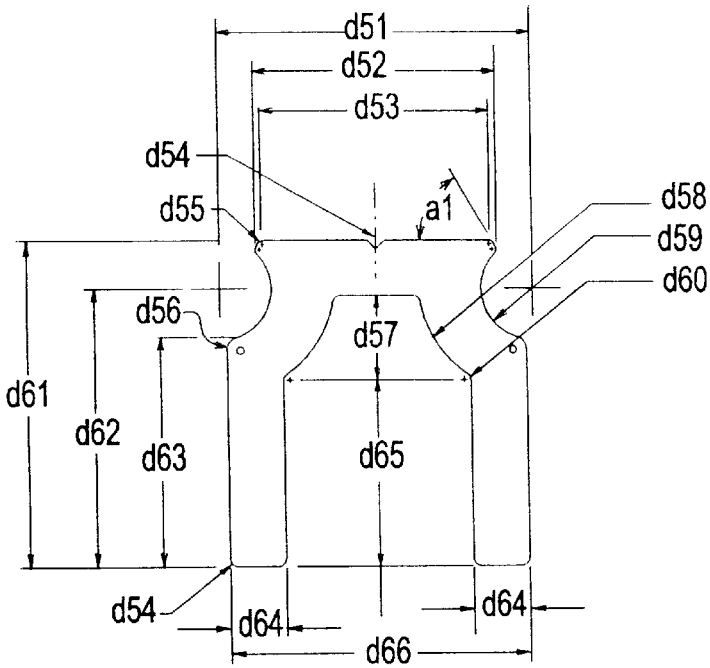
FIG. 48 is a cross sectional view of a pressure channel 4007 showing nominal dimensions.

FIG. 48 shows pressure channel 4007 nominal dimensions:

| | |
|---|---|
| d51 = .696 | PT = Point |
| d52 = .537 | PI = Point in between |
| d53 = .508 | |
| d54 = .020 × 90° | d64 = .125 |
| d55 = .010R | d65 = .417 |
| a1 = 60° | d66 = .666 |
| d56 = .030R | Sym = Symmetrical |
| d57 = .188 | |
| d58 = .249R | |
| d59 = .115R | |
| d60 = .015R | |
| d61 = .730 | |
| d62 = .622 | |
| d63 = .513 | |

Figure 49:
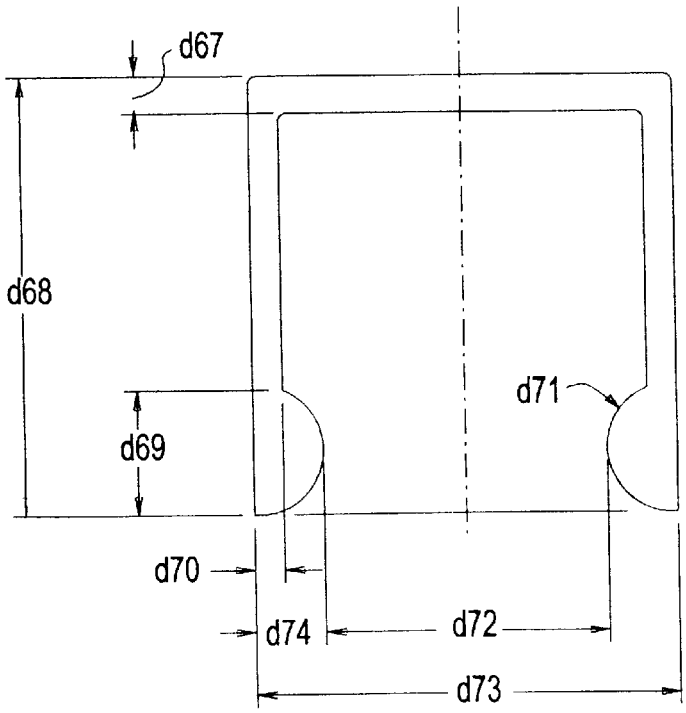
FIG. 49 is a cross sectional view of a snap cover 4006 showing nominal dimensions.

FIG. 49 shows Snap Cover 4006 nominal dimensions:

d67=0.063 d68=0.738 d69=0.211 d70=0.050 d71=0.109R d72=0.477 d73=0.713

PT=Point

D74=0.118

Figure 50:
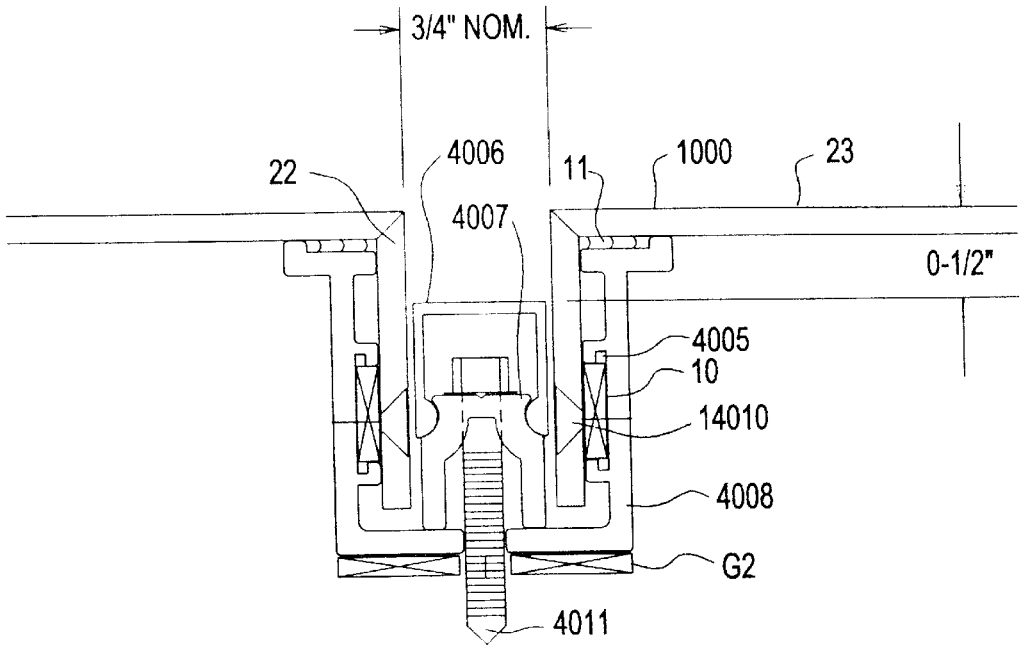
FIG. 50 is a cross sectional view of a curtain wall composite assembly with a recessed joint embodiment.
Figure 51:
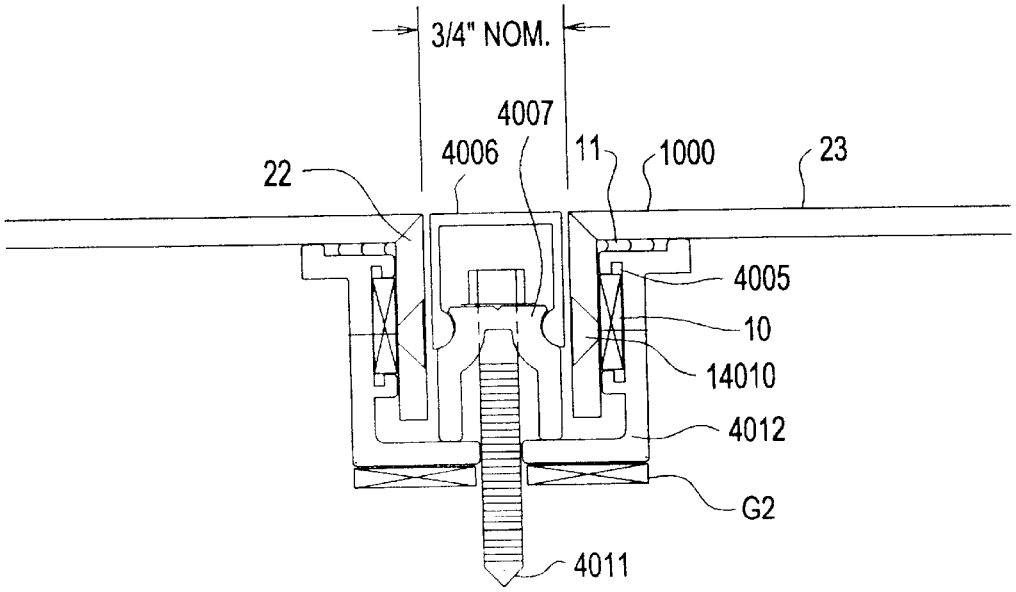
FIG. 51 is the identical view as shown in FIG. 50, but using a flush joint embodiment.
Figure 54:
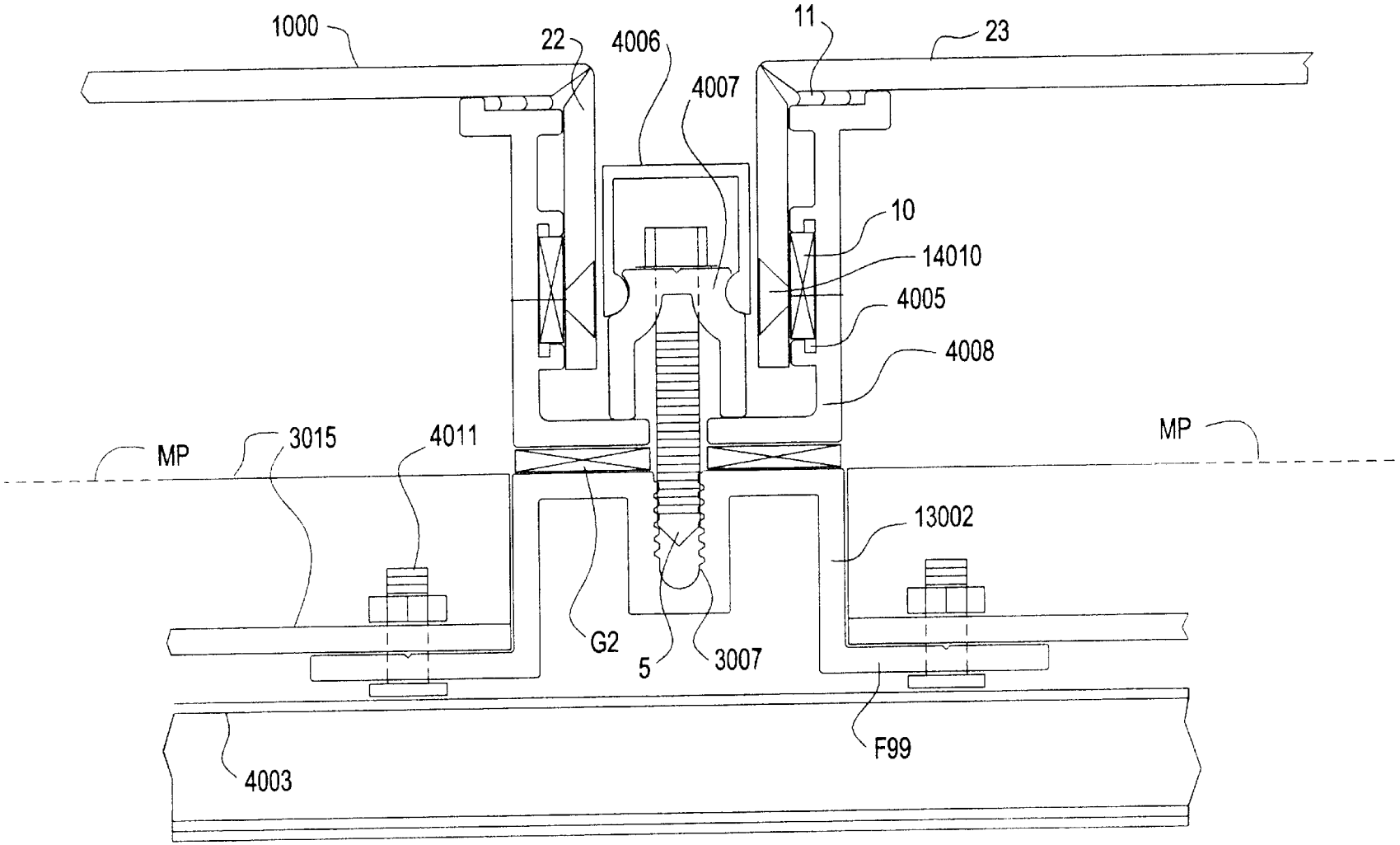
FIG. 54 is a cross sectional view of an alternate embodiment (DPS 3000™) system, using the same curtain wall composite assembly as used in the FIG. 30 embodiment.
Figure 55:
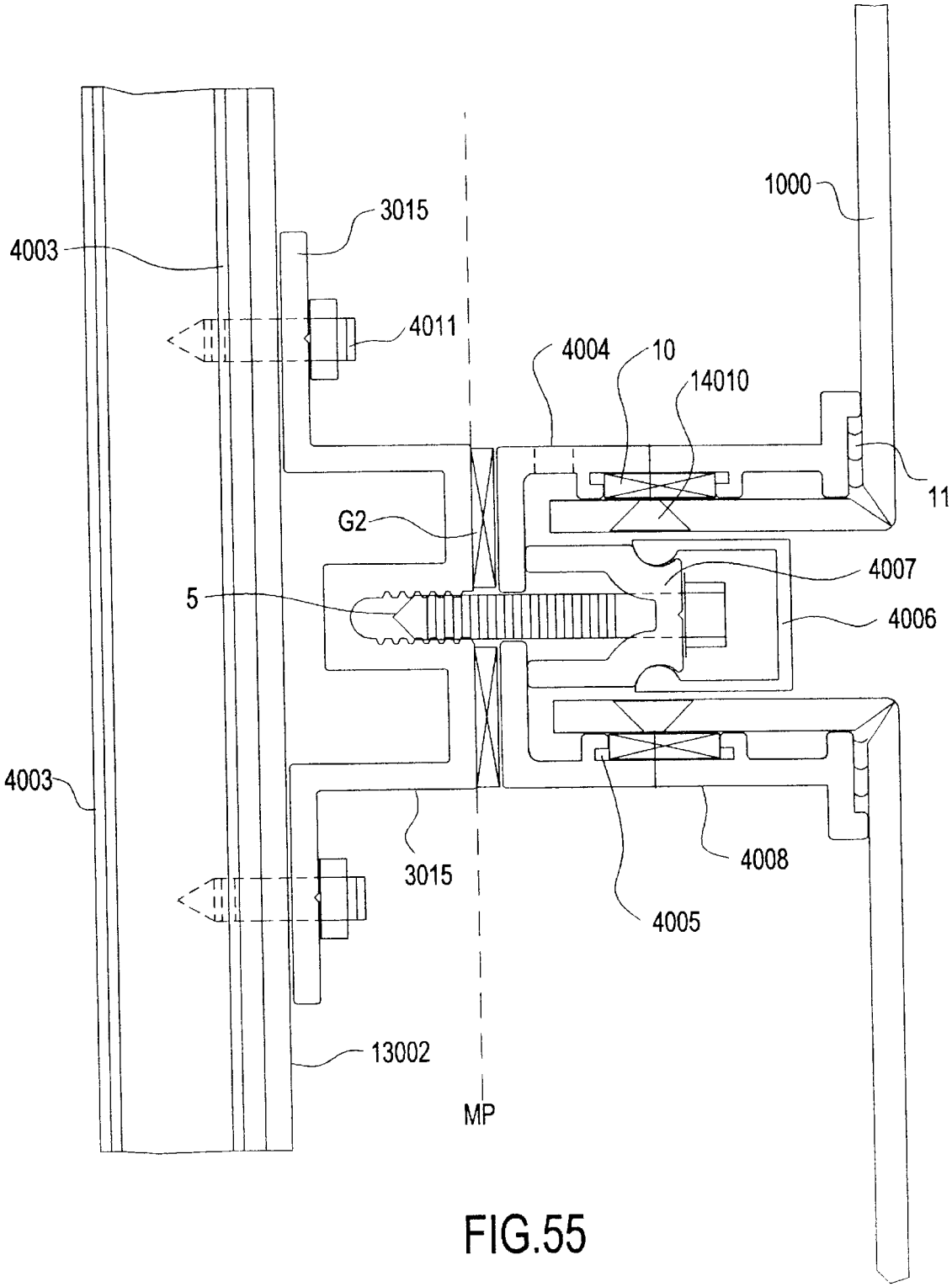
FIG. 55 is a cross sectional view of an alternate embodiment (DPS 3000™) system, using the same curtain wall composite assembly as used in the FIG. 31 embodiment.

FIGS. 50 and 51 show the common gasket to curtain wall parts which are used interchangeably between the guttered systems shown in FIGS. 27 and 29 respectively, and the non-guttered systems shown in FIGS. 54 and 55. The recessed systems shown in FIGS. 54 and 55 could be interchanged to a flush system as shown in FIG. 51.

Figure 52:
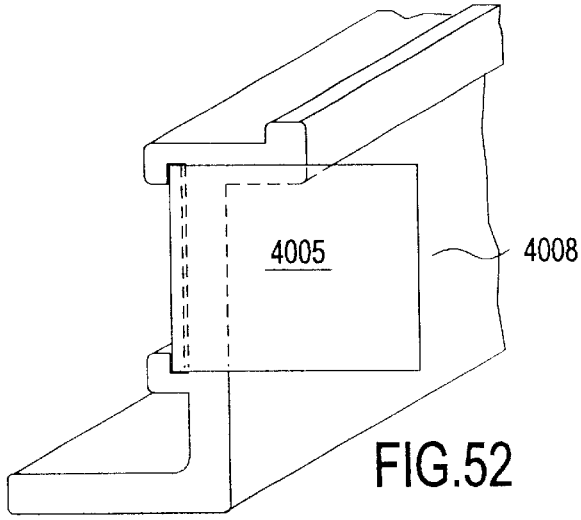
FIG. 52 is a perspective view showing the reglet corner clip attached to one member of a pair of perimeter extrusions.
Figure 53:
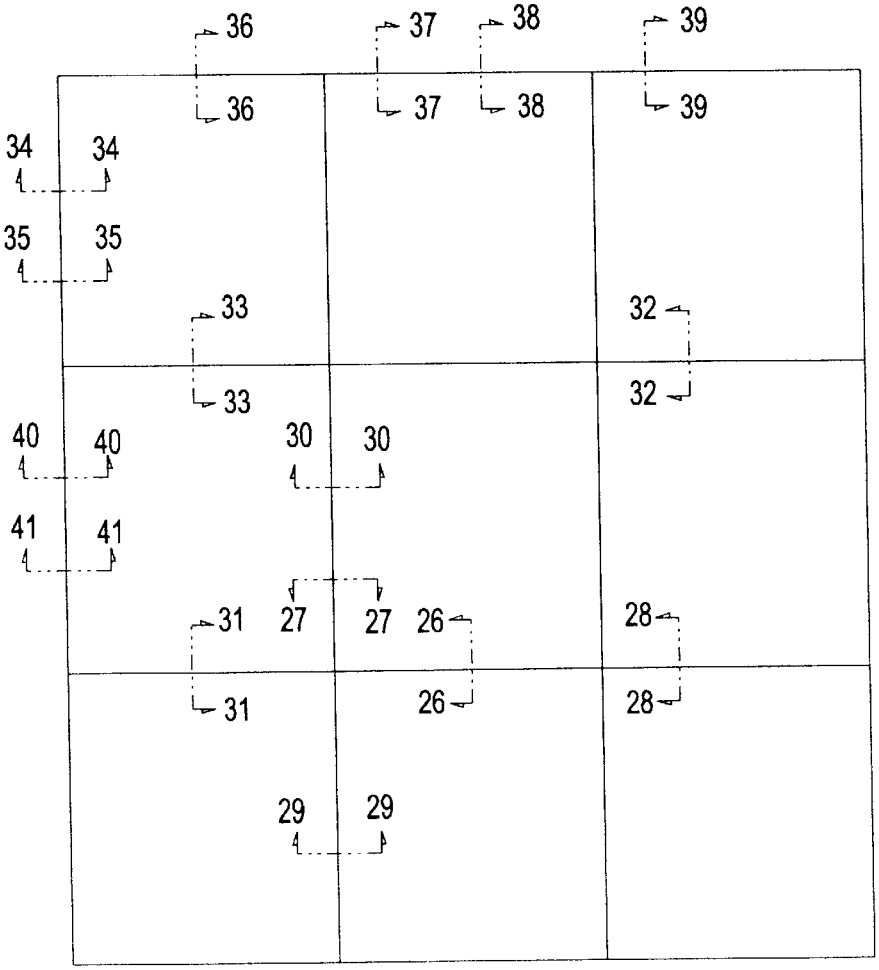
FIG. 53 is a schematic of an imaginary building face showing the locations of components keyed to the above numbered figures.

Referring to FIG. 52, a reglet 4005 is a metal clip that adds structural rigidity to corner joints of corner braces 4008 and/or 4112, where they meet at the inside corners of the curtain wall panels 1000.

An alternate embodiment of the system (referred to as DPS3000™) is shown in FIGS. 54 and 55 that has no internal gutters (e.g., S1 and S2 in FIGS. 16 and 17), but offers many of the same features of the preferred embodiment, as well as lower costs. The building 4003 supports a symmetric lower base member 13002 and upper base member 3015 as part of a dry, non-directional system. The lower base member 13002 and upper base member 3015 join at right angles and overlap to create a sub-system framework through the use of fastener 4011 which penetrates the flange legs. The curtain wall panel 1000 has a corner brace 4008 exactly as the preferred embodiment. The corner brace 4008 is comprised of four symmetric extrusions which are joined at the corners with a corner reglet clip 4005. Prior to corner 4008 being inserted into curtain wall panel 1000, corner sealant 3117 is applied to all inside corners and butyl sealant 10 is applied in corner brace 4008 at the location of the drilled holes for fastener 1401. Countersunk fasteners 14010 are inserted through the drilled hole in the curtain wall panel 1000 and through the butyl sealant 10 into corner brace 4008 forming a watertight rigid panel assembly. A gasket G2 is factory-applied to the bottom of corner brace 4008. The continuous channel 4007 secures the corner braces 4008 via fastener 53 into screw boss 3007. A facial clip 4006 provides an aesthetic appearance over the fasteners 53. The facial clip 4006 can be flush with the face of the curtain wall panel 1000 or recessed ½' from the face of the curtain wall panel 1000.

Figure 56A:
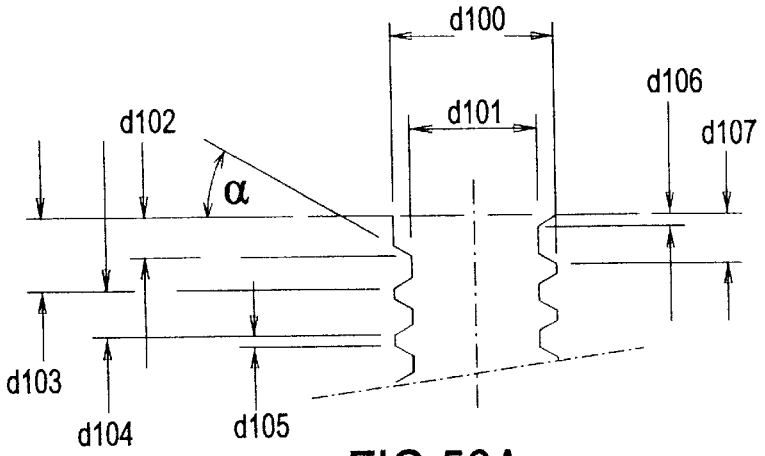
FIGS. 56 and 56A are a cross sectional view of a lower base 13002 of the DPS3000™ embodiment showing nominal dimensions.
Figure 56:
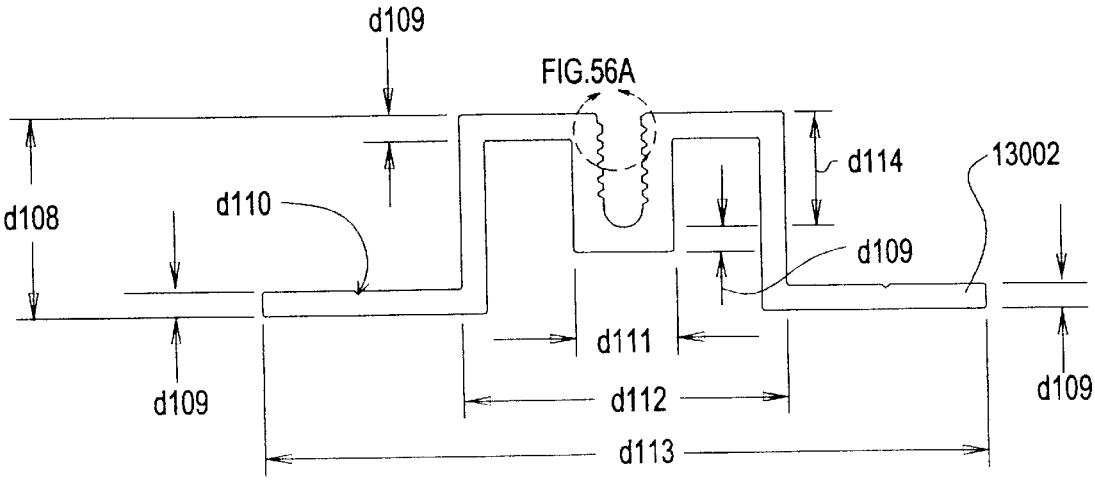
Figure 57A:
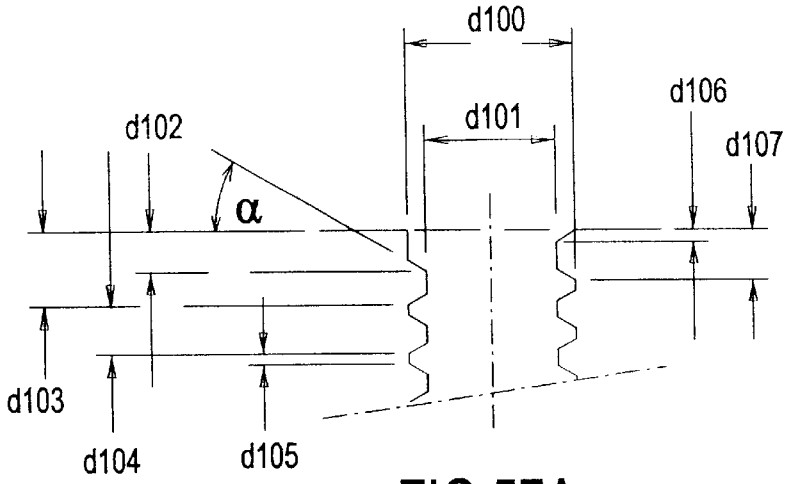
FIGS. 57 and 57A are a cross sectional view of an upper base 3015 of the DPS3000™ embodiment showing nominal dimensions.
Figure 57:
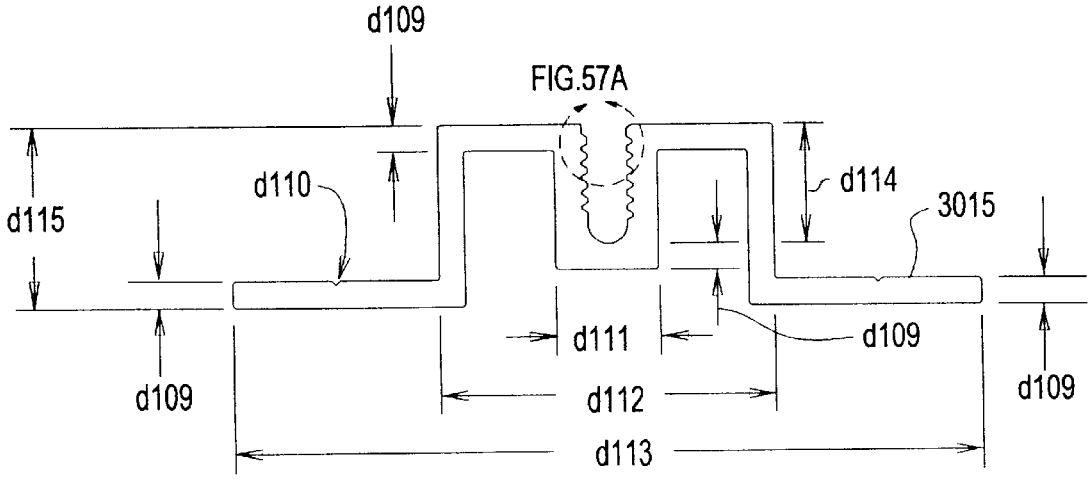

In FIGS. 56 and 57 the nominal dimensions of lower base 13002 and upper base 3015 are:

| | |
|---|---|
| d100 = .246" | |
| d101 = .192 + .000/− .024" | |
| d102 = .060" | |
| d103 = .110" | |
| d104 = .071" | |
| d105 = .015" | |
| d106 = .018" | |
| d107 = .074" | |
| d108 = 1.000" | $\alpha = 30°$ |
| d109 = .125" | |
| d110 = .020 × 90° | |
| d111 = .500" | |
| d112 = 1.624" | |
| d113 = 3.624 | |
| d114 = .575" | |
| d115 = .875" | |

It can be seen that d115+d109=d108 to allow the upper base 3015 to sit atop the flanges F99 of the lower base 13002 as shown in FIG. 54, and result in a single plane mounting platform shown by dotted lines MP.

Figure 58:
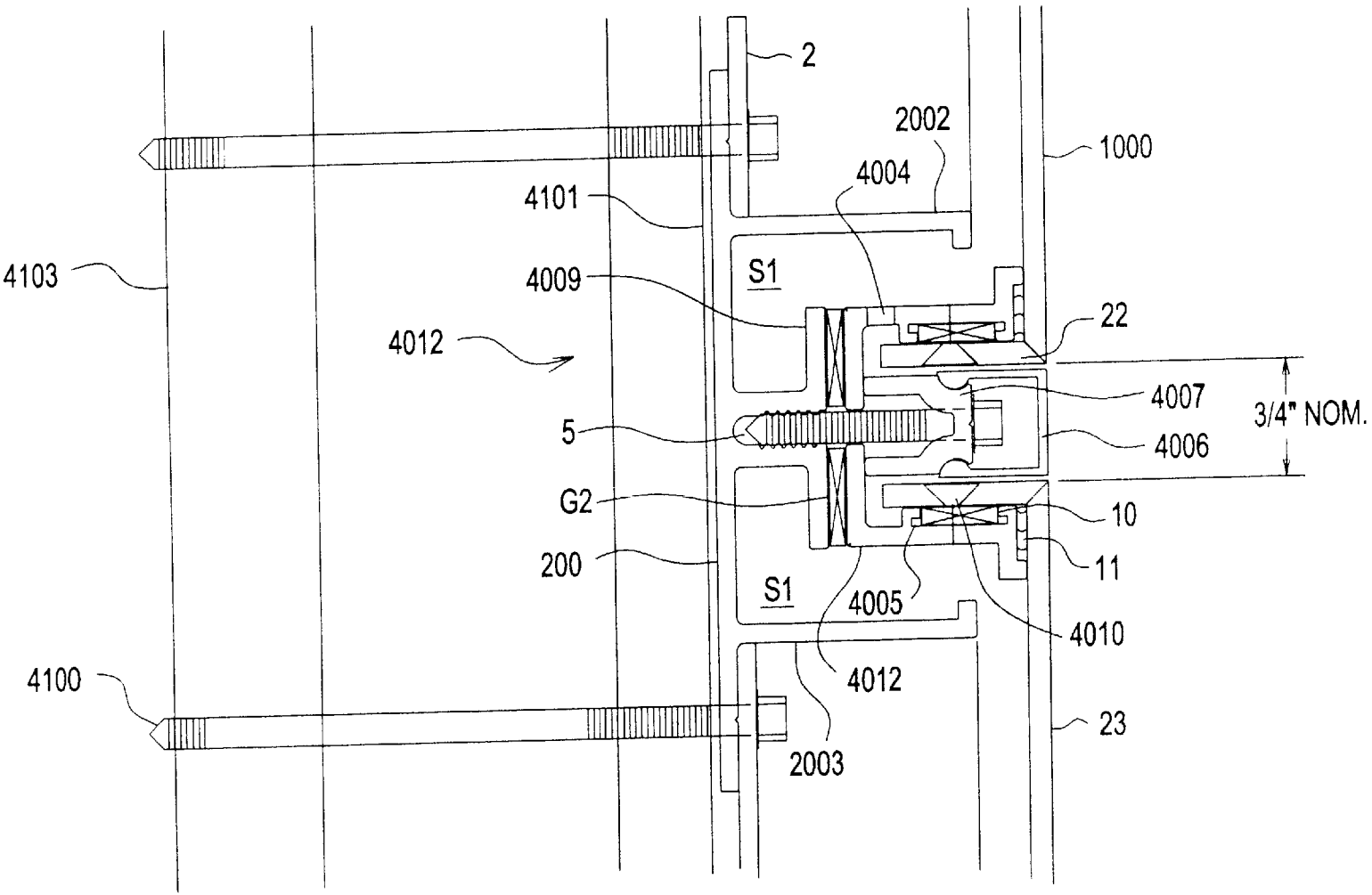
FIG. 58 is a vertical cross section of the lower gutter of the preferred embodiment (DPS4000™) with the curtain wall composite assembly shown attached over and through modern stucco known as exterior insulated finish systems (EIFS).

FIG. 58 is a vertical cross sectional view of the preferred embodiment (DPS4000™) as shown in FIG. 26, but with varying building structure components and attachment fastener. Sheathing known as exterior insulated finish system (EIFS/Stucco) 4101 is applied to insulation 4102 which is attached to the structural studs 4103 comprises an alternate composite building structure. The framework of lower gutter 200 and upper gutter 2 are attached to the structural studs 4103 using long structural fastener 4100 without crushing the composite building structure comprised of exterior insulated finish system (EIFS) 4101 and inslation 4102.

Figure 59:
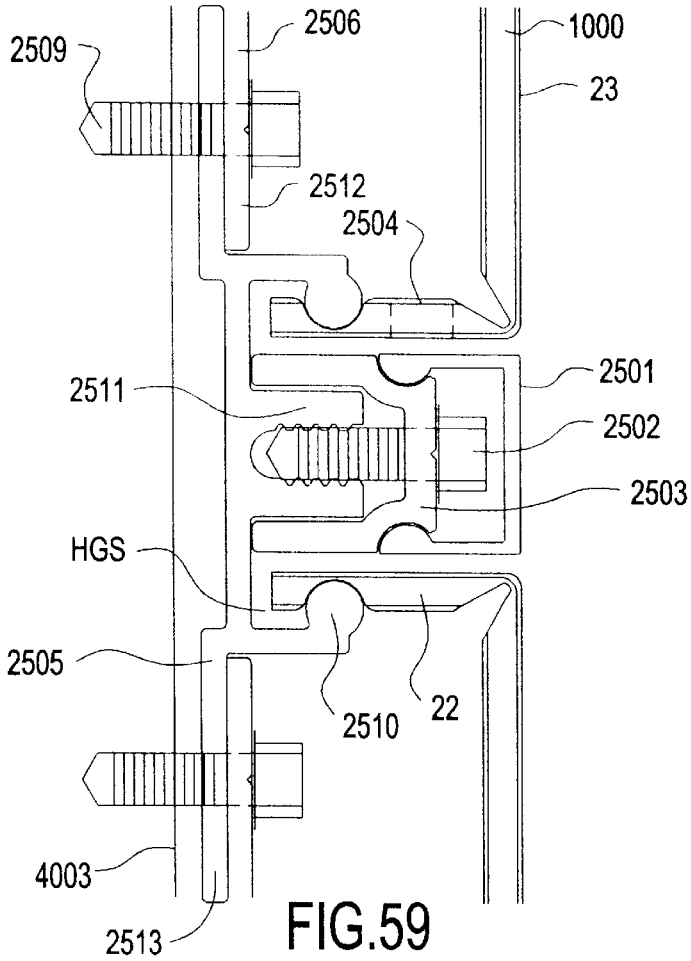
FIG. 59 is a vertical cross section of a horizontal gutter for an alternate embodiment (DPS2500™) incorporating a continuous guttered sub-system.

FIG. 59 is a vertical cross sectional view of an alternate embodiment (referred to as DPS2500™). Horizontal gutter 2505 is joined with vertical gutter 2506 at right angles and connected through vertical flange leg 2512 and horizontal flange leg 2513 using flange bolt attachment screw 2509. The pivot point leg 2510 on each side of the horizontal gutter space HGS is milled out at the location of the intersection of the vertical gutter 2505 which forms a continuous guttered framework. The ACM curtain wall panel 1000 has an additional rout 2500 in return leg 22 which fits over pivot point 2510 allowing curtain wall panel face 23 to flex. The curtain wall panel 1000 does not have a corner brace as in the preferred embodiment, but incorporates the framework and continuous gutter embodiments of such. The framework of horizontal gutter 2505 and vertical gutter 2506 is attached to the building structure 4003 using attachment screw 2509. The curtain wall panel 1000 is placed on the framework and held in place by pressure to the return leg 22 over the pivot point 2510 by pressure channel 2503 which is attached to the gutters 2505 and 2506 by machine screw 2502 into screw boss 2511. Snap cover 2501 covers machine screw 2502 and pressure channel 2503. The bottom horizontal return leg 22 of the curtain wall panel 1000 incorporates a weep hole 2504 used to remove moisture from condensation and act as a failsafe against water that may have traveled outside of horizontal gutter space HGS. Water within the horizontal gutter space HGS travels to the vertical gutter space VGS and then downward to the bottom of the framework and out the building.

Figure 60:
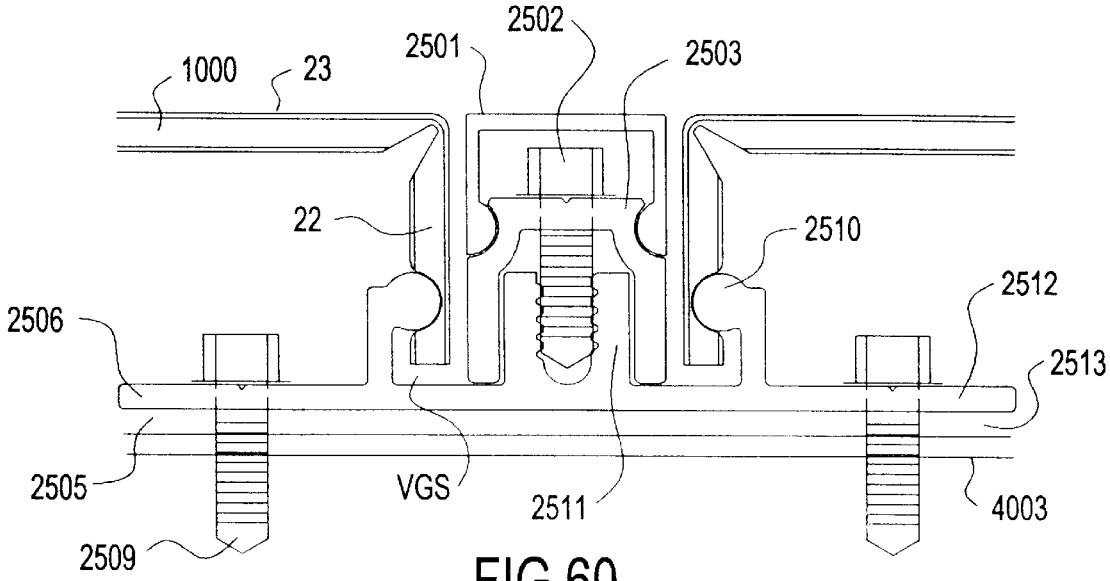
FIG. 60 is a horizontal cross section of a vertical gutter for an alternate embodiment (DPS2500™) incorporating a continuous guttered sub-system.

FIG. 60 is a horizontal cross sectional view of vertical gutter 2506 which is joined with horizontal gutter 2505 at right angles and connected through vertical flange leg 2412 and horizontal flange leg 2513 using flange bolt attachment screw 2509. The ACM curtain wall panel 1000 has an additional rout 2500 in return leg 22 which fits over pivot point 2510 allowing curtain wall panel face 23 to flex. The curtain wall panel 1000 does not have a corner brace as in the preferred embodiment, but incorporates the framework and continuous gutter embodiments of such. The framework of horizontal gutter 2505 and vertical gutter 2506 is attached to the building structure 4003 using attachment screw 2509. The curtain wall panel 1000 is placed on the framework and held in place by pressure to the return leg 22 over the pivot point 2510 by pressure channel 2503 which is attached to the gutters 2505 and 2506 by machine screw 2502 into screw boss 2511. Snap cover 2501 covers machine screw 2502 and pressure channel 2503. Water that enters the vertical gutter space VGS travels downward to horizontal gutter space HGS and weeps to the face of the curtain wall panel face 23 through weep hole 2504.

Figure 61:
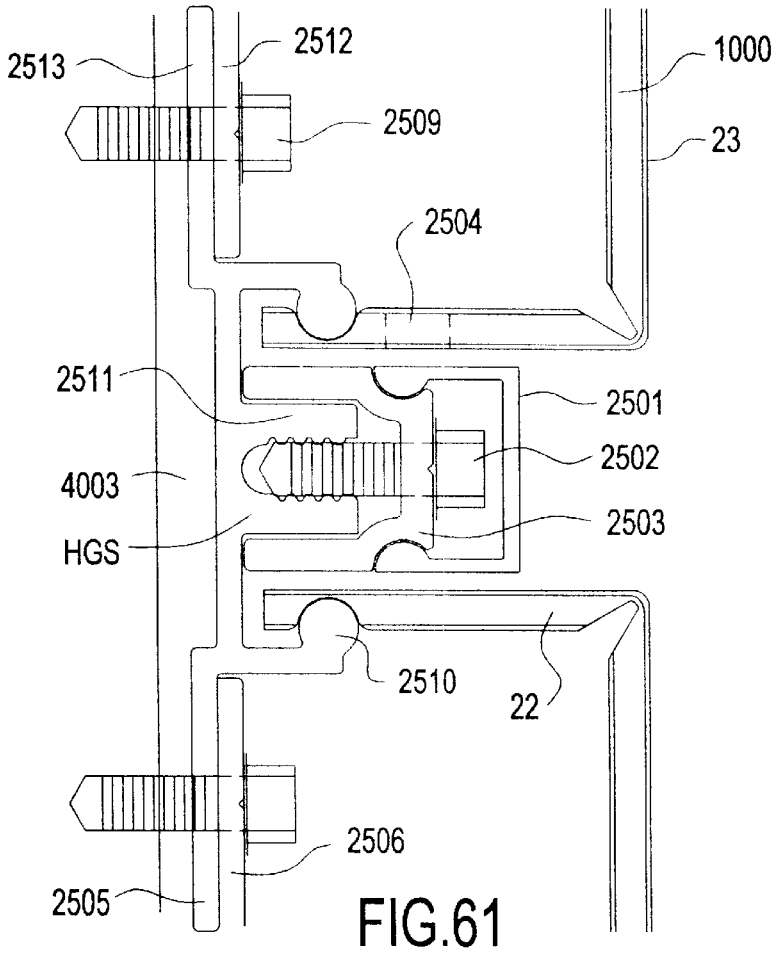
FIG. 61 is an identical view as shown in FIG. 59, but utilizing a recessed joint embodiment.

FIG. 61 is an identical view as shown in FIG. 59, but varies by having a recessed joint embodiment whereby the face of the panel 23 extends beyond snap cover 2501.

Figure 62:
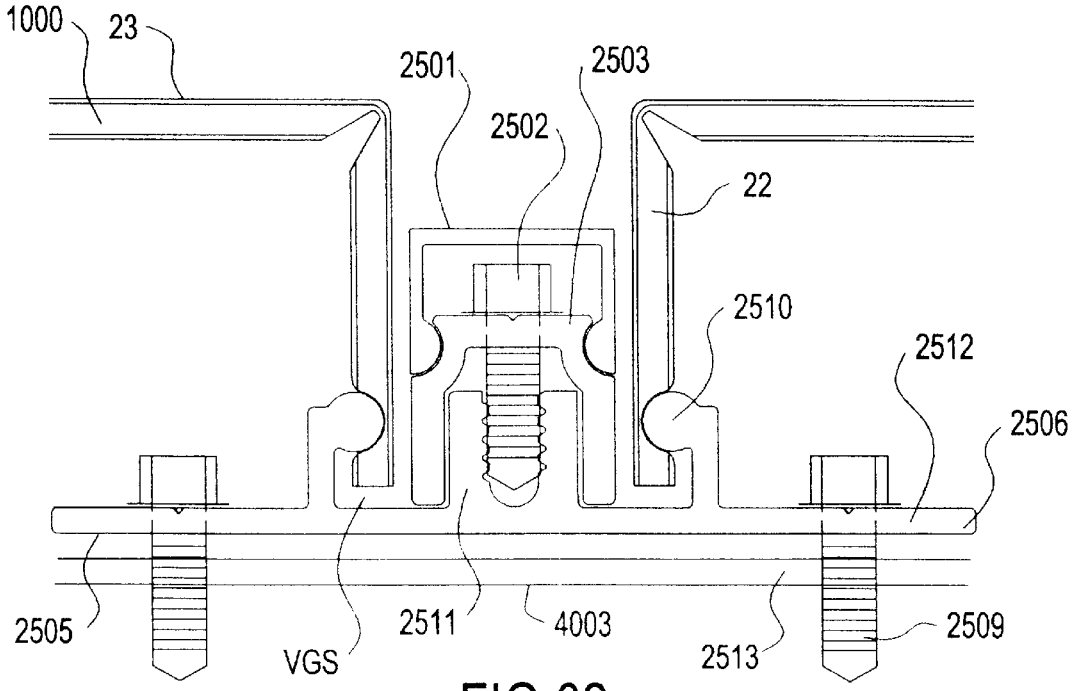
FIG. 62 is an identical view as shown in FIG. 60, but utilizing a recessed joint embodiment.

FIG. 62 is an identical view as shown in FIG. 60, but varies by having a recessed joint embodiment whereby the face of the panel 23 extends beyond snap hover 2501.

Figure 63:
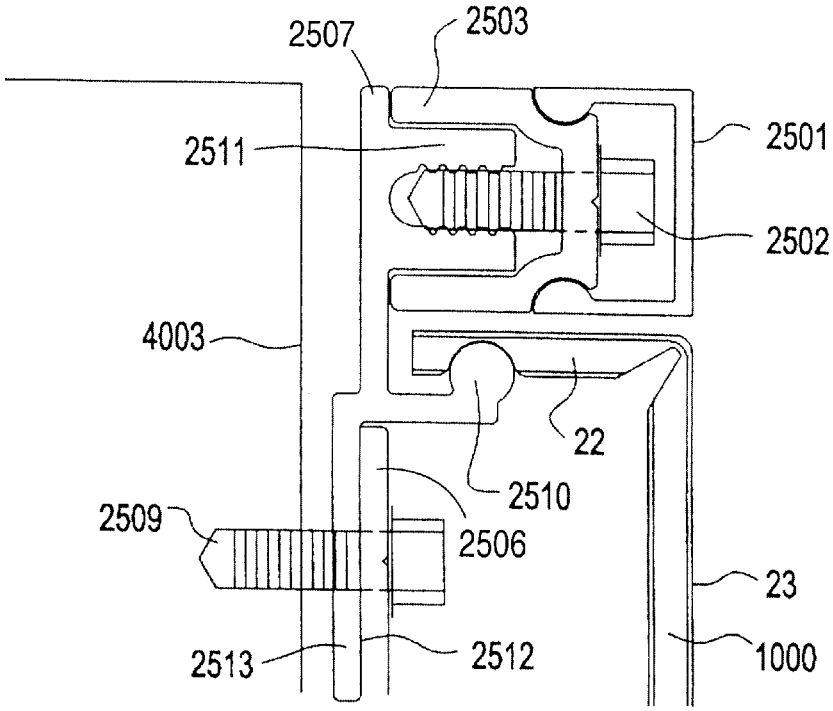
FIG. 63 is a vertical cross section of a horizontal termination gutter for an alternate embodiment (DPS2500™) incorporating a continuous guttered sub-system.

FIG. 63 is a vertical cross sectional view of the horizontal termination cutter 2507 which connects to vertical gutter 2506 at right angles forming a continuous gutter framework. The pivot leg 2510 is milled out at the location of the vertical gutters to allow water to drain down vertical gutter 2506 to the bottom of the building structure and out the building. The guttered framework is attached to the building structure 4003 using attachment screw 2509. The curtain wall panel 1000 is placed on the framework and held in place by pressure to the return leg 22 over the pivot point 2510 by pressure channel 2503, which is attached to the gutters 2506 and 2507 by machine screw 2502 into screw boss 2511. Snap cover 2501 covers machine screw 2502 and pressure channel 2503.

Figure 64:
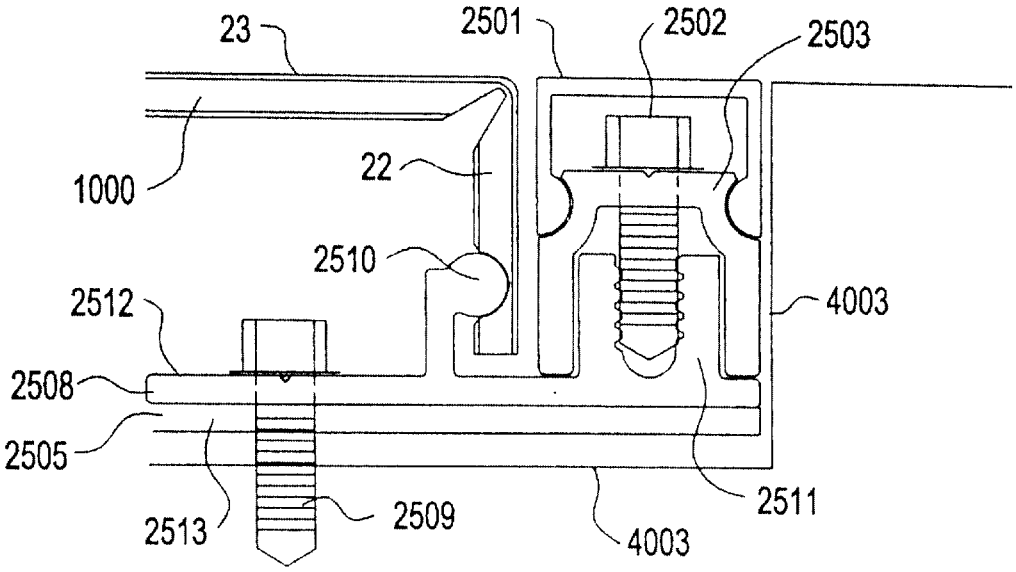
FIG. 64 is a horizontal cross section of a vertical termination gutter for an alternate embodiment (DPS2500™) incorporating a continuous guttered sub-system.

FIG. 64 is a horizontal cross sectional view of the vertical termination gutter 2508 which connects to horizontal gutter 2505 at right angles forming a continuous gutter framework. Water that enters the gutter travels downward to the bottom of the building structure and out the building. The guttered framework is attached to the building structure 4003 using attachment screw 2509. The curtain wall panel 1000 is place on the framework and held in place by pressure to the return leg 22 over the pivot point 2510 by pressure channel 2503 which is attached to the gutters 2505 and 2508 by machine screw 2502 into screw boss 2511. Snap cover 2501 covers machine screw 2502 and pressure channel 2503.

Figure 65:
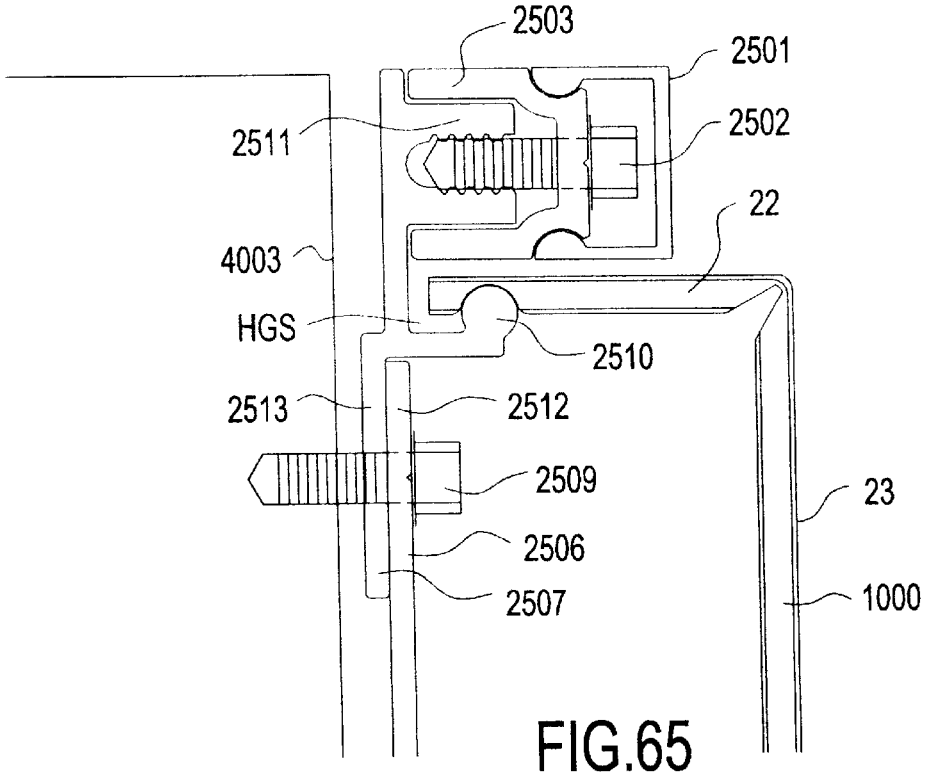
FIG. 65 is an identical view as shown in FIG. 63, but utilizing a recessed joint embodiment.

FIG. 65 is an identical view as shown in FIG. 63, but varies by having a recessed joint embodiment whereby the face of the panel 23 extends beyond snap cover 2501.

Figure 66:
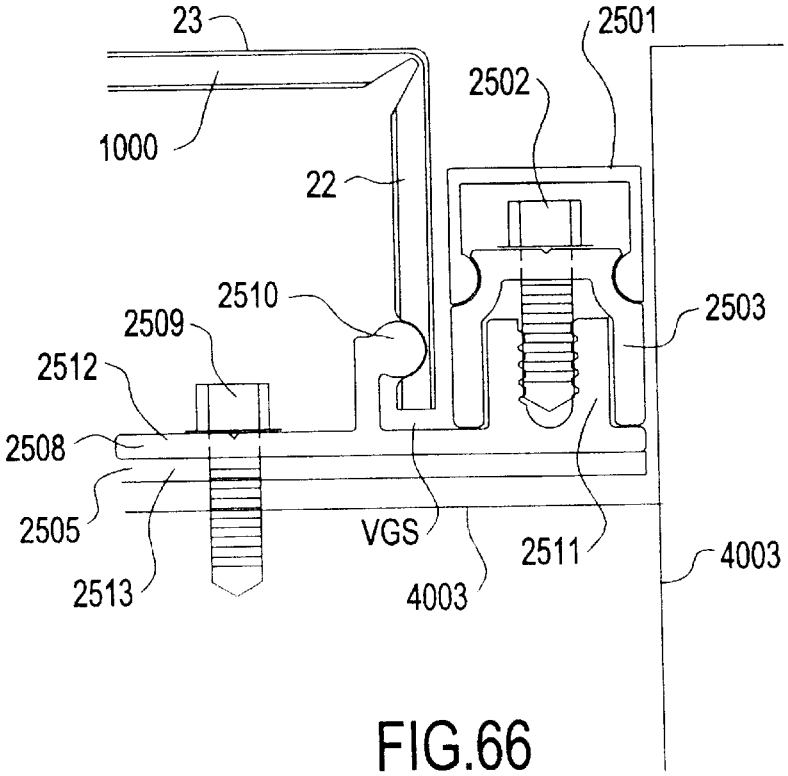
FIG. 66 is an identical view as shown in FIG. 64, but utilizing a recessed joint embodiment.

FIG. 66 is an identical view as shown in FIG. 64, but varies by having a recessed joint embodiment whereby the face of the panel 23 extends beyond snap cover 2501.

Figure 67:
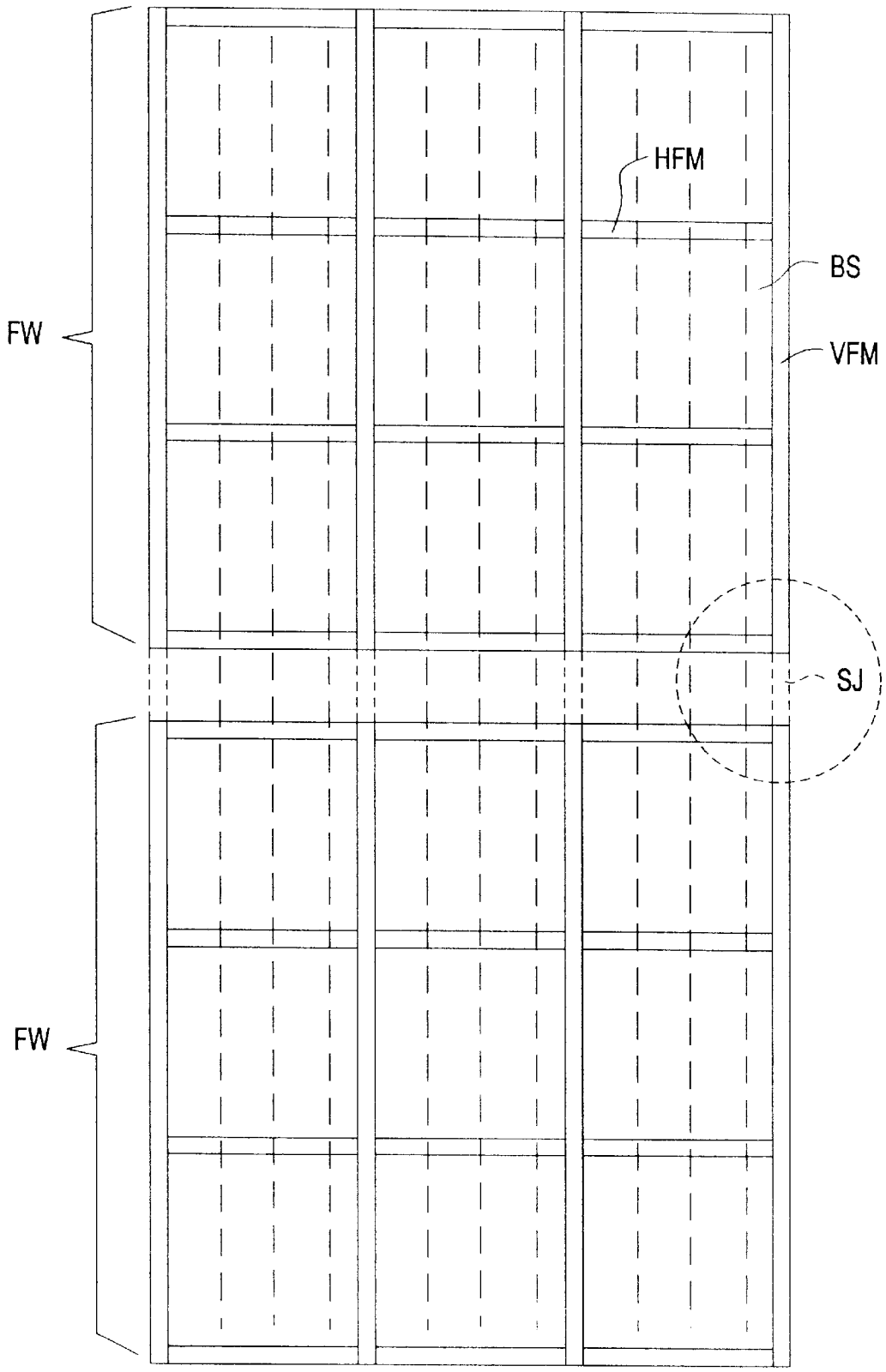
FIG. 67 is a frontal view of the preferred embodiment illustrating the assembly method of installing framework units.

FIG. 67 is a frontal view of the assembly of vertical frame members VFM and horizontal frame members HFM at right angle to create a framework FW. It illustrates the ability to stack one framework FW on top of another against the building structure BS and to join them using a splice joint SJ.

Figure 68:
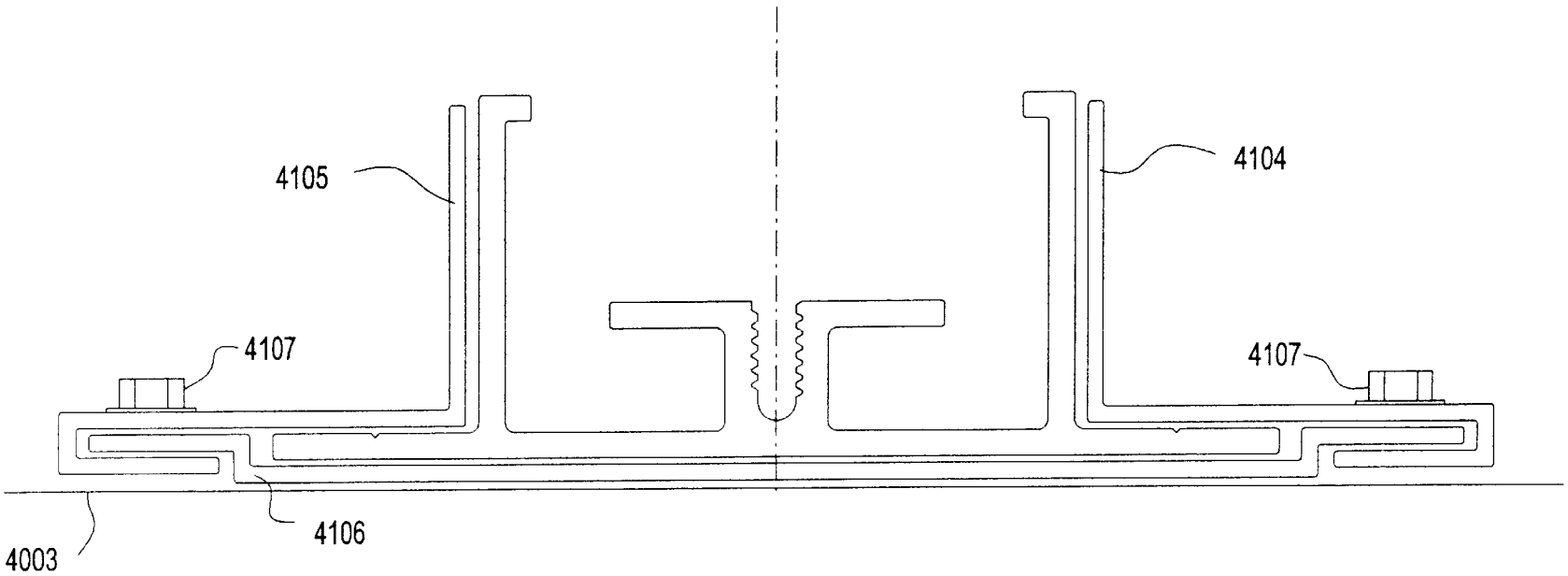
FIG. 68 is a cross sectional view of a splice joint assembly used for joining the framework units of the preferred embodiment.

FIG. 68 is a horizontal cross sectional view of splice joint assembly which connects the gutter of one framework to the gutter of another framework by attaching the left splice plate 4105 and right splice plate 4104 to the lower splice plate 4106 to the gutters utilizing splice fastener 4107. The composite assembly keeps the gutter intact while providing structural support to the framework.

Figure 69:
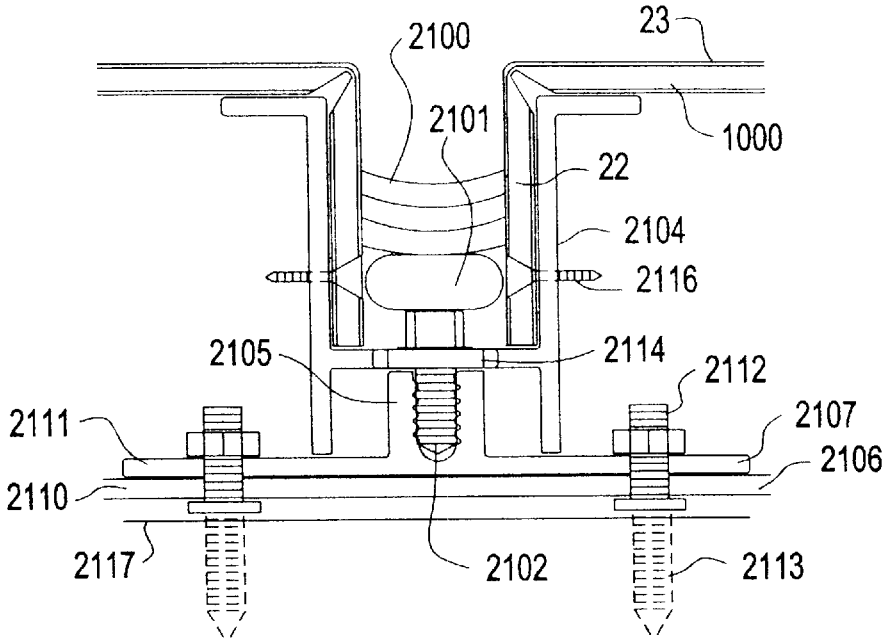
FIG. 69 is a horizontal cross sectional view of a vertical joint of an alternate embodiment (DPS2000™) illustrating an integrated framework which supports an ACM curtain wall panel that attached to a building structure.

FIG. 69 is a horizontal cross sectional view of the vertical frame member 2107 of an alternate embodiment (referred to as DPS2000™) which is joined at right angles to the horizontal frame member 2106 through the horizontal flange leg 2110 and the vertical flange leg 2111 utilizing flange attachment bolt 2112. A framework is formed that attaches to building structure 2117 utilizing attachment screw 2113. The curtain wall panel 1000 is attached to the framework comprised of horizontal frame member 2106 and vertical frame member 2107 by machine screw 2102 which slips through clip slot 2114 in recessed joint corner brace clip 2104 which attaches to return leg 22 and panel stiffener 2115 by clip fastener 2116. The machine screw 2102 is fastened into screw boss 2105. Clip slot 2114 allows the curtain wall panel 1000 to float on top of the framework. The primary seal of the system is achieved by the application of backer rod 2101 and sealant 2100 in the recessed joint.

Figure 70:
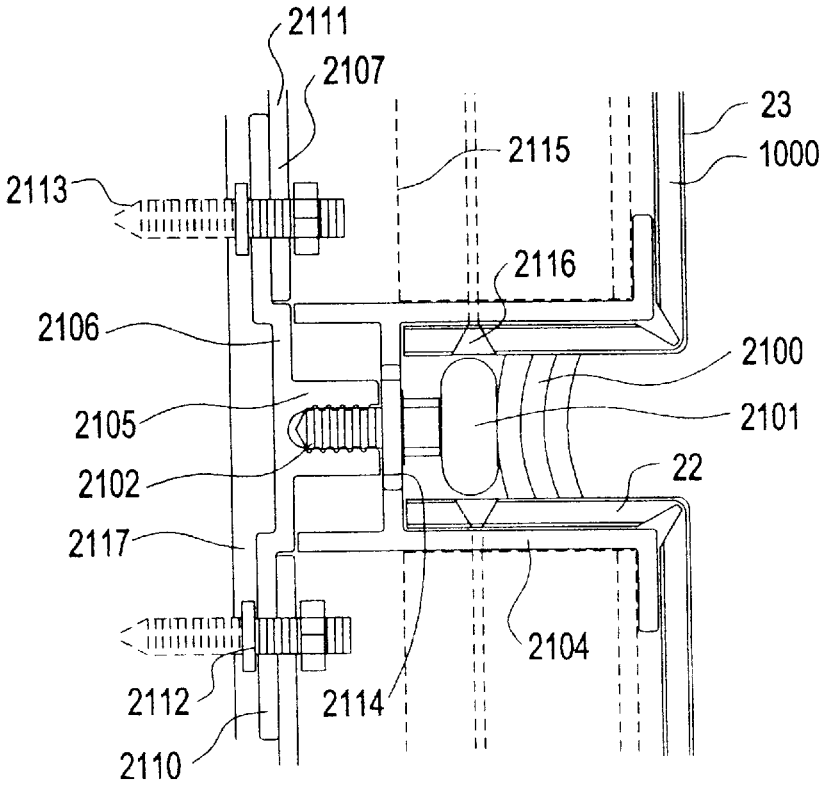
FIG. 70 is a vertical cross sectional view of a horizontal joint of an alternate embodiment (DPS2000™) illustrating an integrated framework which supports an ACM curtain wall panel that attaches to a building structure.

FIG. 70 is a vertical cross sectional view of the horizontal frame member 2106 which is joined at right angles to the vertical frame member 2107 through the horizontal flange leg 2110 and the vertical flange leg 2111 utilizing flange attachment bolt 2112. They make a framework that is attached to building structure 2117 utilizing attachment screw 2113. The curtain wall panel 1000 is attached to the framework comprised of horizontal frame member 2106 and vertical frame member 2107 by machine screw 2102 which slips through clip slot 2114 in recessed joint corner brace clip 2104 which attaches to return leg 22 by clip fastener 2116. Clip slot 2114 allows the curtain wall panel 1000 to float on top of the framework. The primary seal of the system is achieved by the application of backer rod 2101 and sealant 2100 in the recessed joint.

Figure 71:
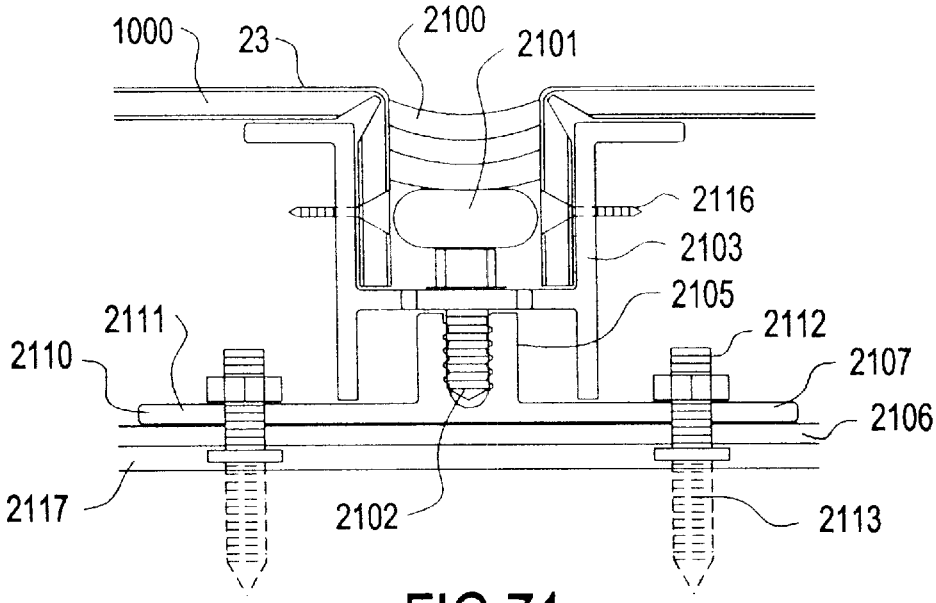
FIG. 71 is an identical view as shown in FIG. 69, but with a flush joint embodiment.

FIG. 71 is an identical view as shown in FIG. 69, but varies by having a flush joint embodiment utilizing flush joint corner brace 2103 whereby the face of the panel 23 is flush with the sealant 2100.

Figure 72:
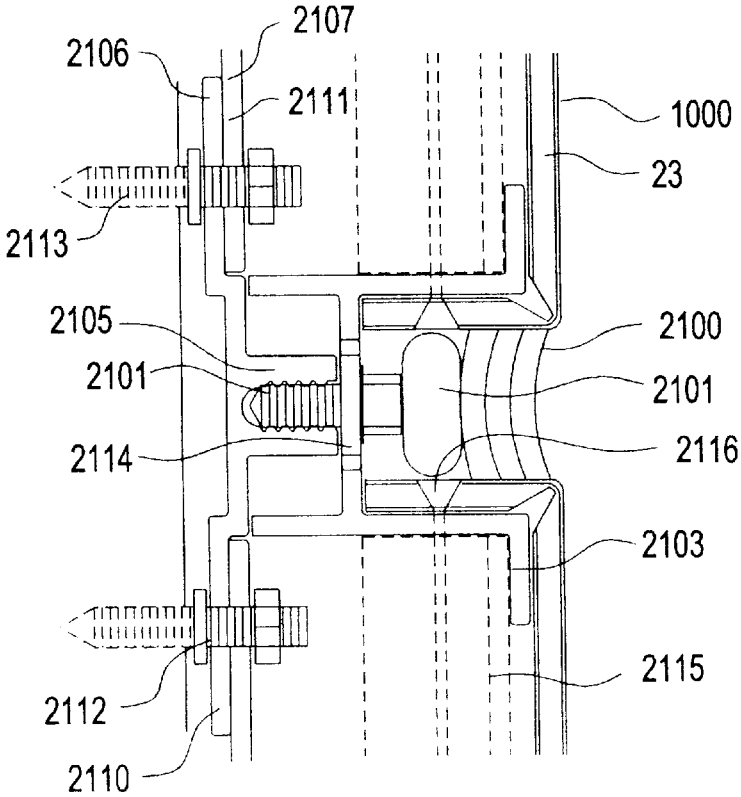
FIG. 72 is an identical view as shown is FIG. 70, but with a flush joint embodiment.

FIG. 72 is an identical view as shown in FIG. 70, but varies by having a flush joint embodiment whereby the face of the panel 23 is flush with the sealant 2100.

Figure 73:
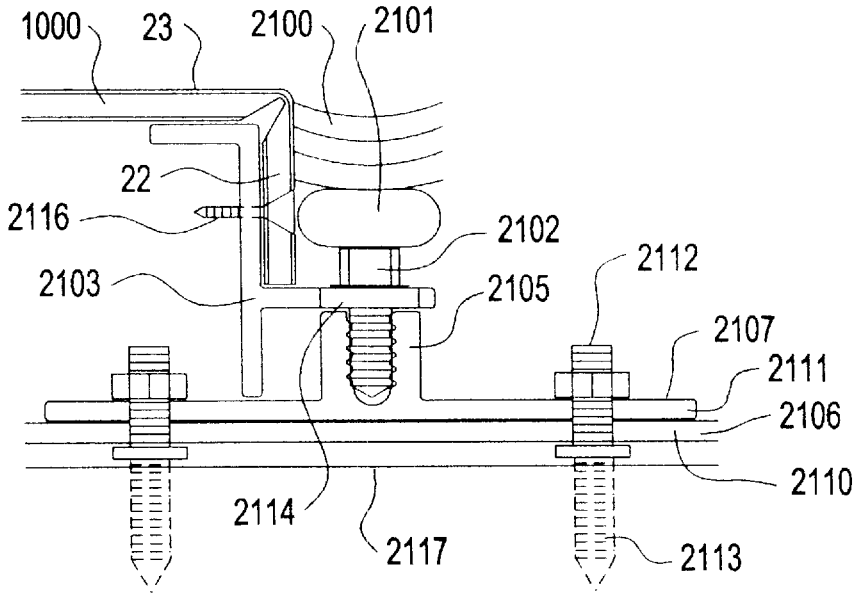
FIG. 73 is a horizontal cross sectional view of a vertical joint of an alternate embodiment (DPS2000™) illustrating clip attachment to the framework.

FIG. 73 is an identical view as shown in FIG. 69, but with one curtain wall panel 1000 eliminated for clarity to illustrate the flush corner brace clip 2103.

Figure 74:
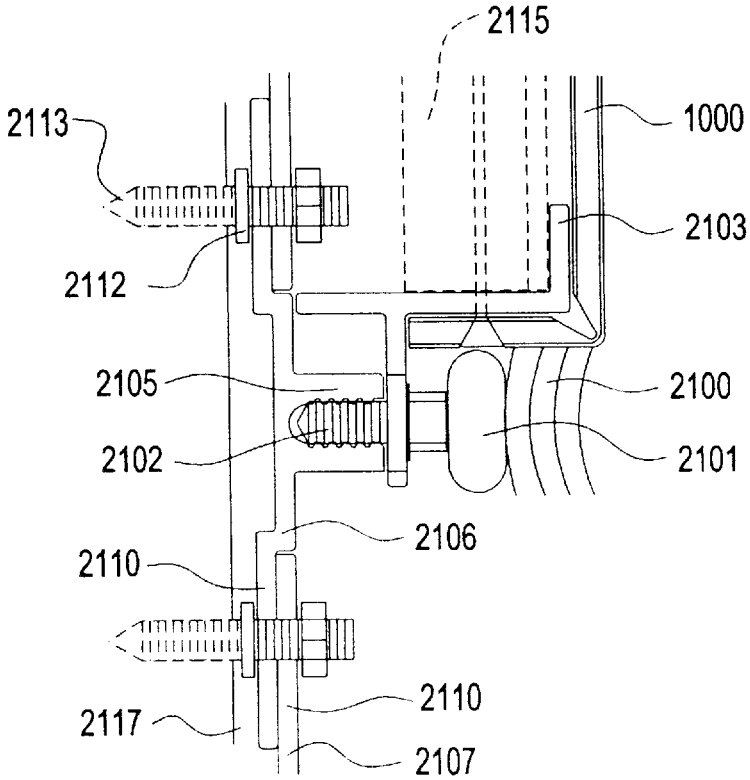
FIG. 74 is a vertical cross sectional view of a horizontal joint of an alternate embodiment (DPS2000™) illustrating clip attachment to the framework.

FIG. 74 is an identical view as shown in FIG. 70, but with one curtain wall panel 1000 eliminated for clarity to illustrate the flush corner brace clip 2103.

Figure 75:
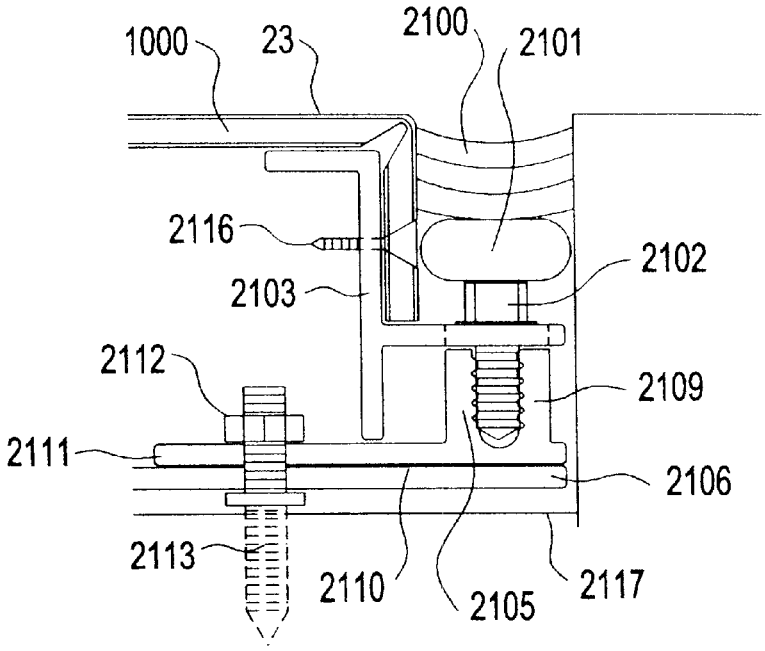
FIG. 75 is a horizontal cross sectional view of a vertical joint of an alternate embodiment (DPS2000 TM) illustrating a termination joint of the framework.

FIG. 75 is a horizontal cross sectional view of the vertical termination frame member 2109 which is joined at right angles to the horizontal frame member 2106 through the horizontal flange leg 2110 and the vertical flange leg 2111 utilizing flange attachment bolt 2112. They make a framework that is attached to building structure 2117 utilizing attachment screw 2113. The curtain wall panel 1000 is attached to the framework comprised of horizontal frame member 2106 and vertical termination member 2109 by machine screw 2102 which slips through clip slot 2114 in recessed joint corner brace clip 2104 which attaches to return leg 22 by clip fastener 2116. Clip slot 2114 allows the curtain wall panel 1000 to float on top of the framework. The primary seal of the system is achieved by the application of backer rod 2101 and sealant 2100 in the flush joint.

Figure 76:
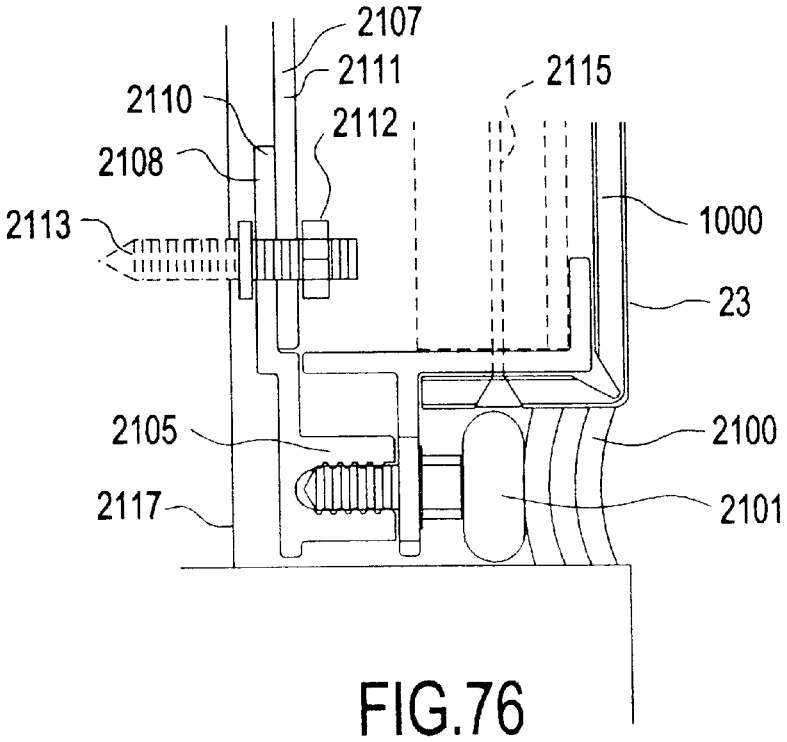
FIG. 76 is a vertical cross sectional view of a horizontal joint of an alternate embodiment (DPS2000™) illustrating a termination joint of the framework.

FIG. 76 is a vertical cross sectional view of the horizontal termination frame member 2108 which is joined at right angles to the vertical frame member 2107 through the horizontal flange leg 2110 and the vertical flange leg 2111 utilizing flange attachment bolt 2112. They make a framework that is attached to building structure 2117 utilizing attachment screw 2113. The curtain wall panel 1000 is attached to the framework comprised of horizontal termination member 2108 and vertical frame member 2107 by machine screw 2102 which slips through clip slot 2114 in recessed joint corner brace clip 2104 which attaches to return leg 22 by clip fastener 2116. Clip slot 2114 allows the curtain wall panel 1000 to float on top of the framework. The primary seal of the system is achieved by the application of backer rod 2101 and sealant 2100 in the flush joint.

Figure 77:
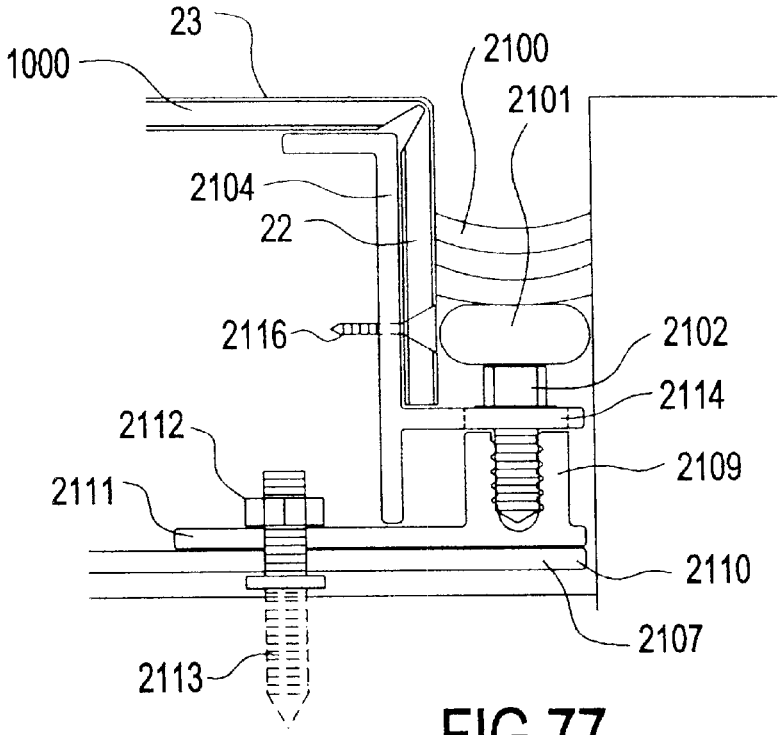
FIG. 77 is an identical view as shown in FIG. 75, but with a recessed joint embodiment.

FIG. 77 is an identical view as shown in FIG. 75, but varies by having a recessed joint embodiment utilizing recessed joint corner brace 2104 whereby the sealant 2100 is recessed with respect to the face of the panel 23.

Figure 78:
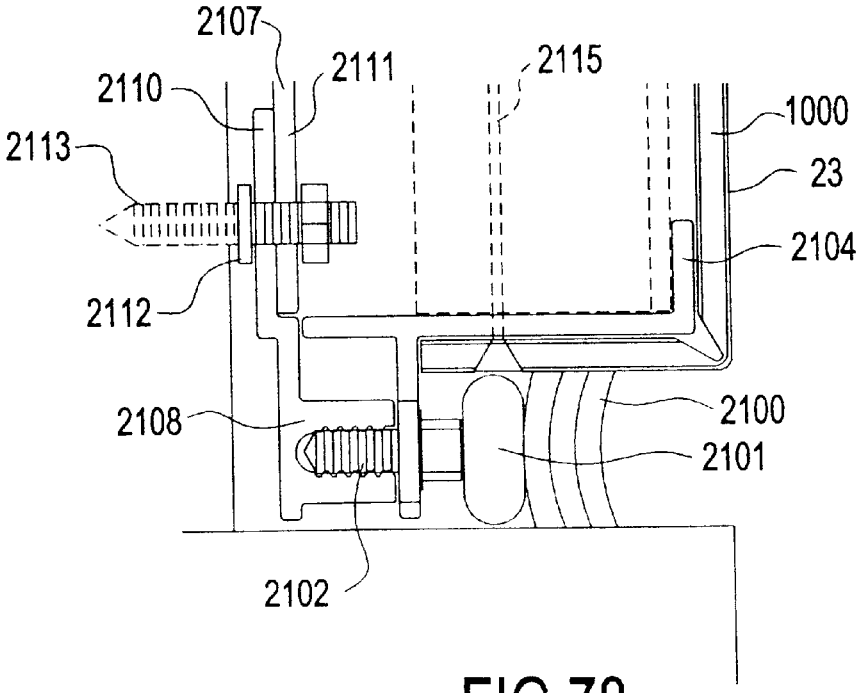
FIG. 78 is an identical view as shown in FIG. 76, but with a recessed joint embodiment.

FIG. 78 is an identical view as shown in FIG. 74, but varies by having a recessed joint embodiment utilizing recessed joint corner brace 2104 whereby the sealant 2100 is recessed with respect to the face of the panel 23.

Figure 79:
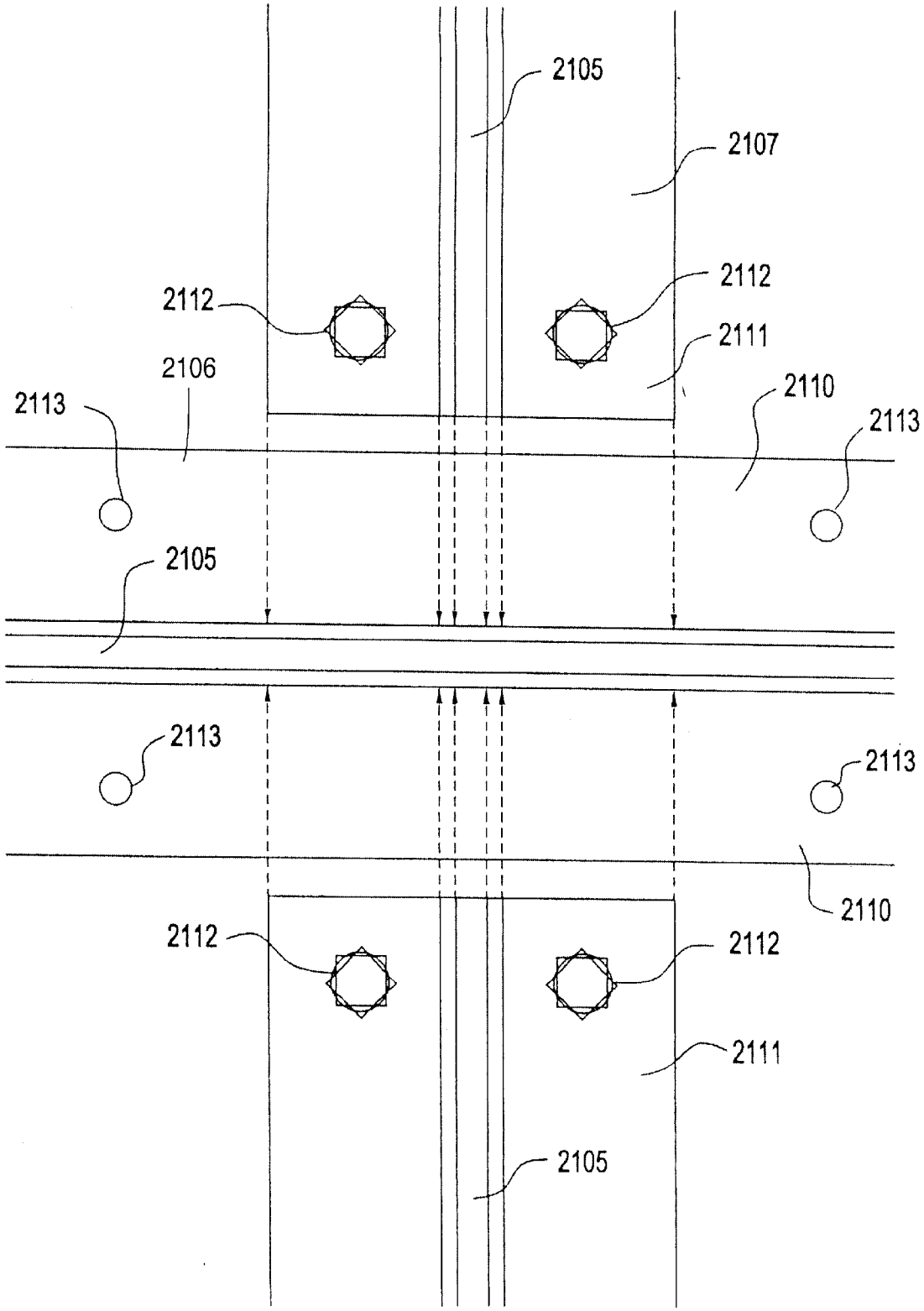
FIG. 79 is a frontal exploded view of a 4-way intersection of the vertical and horizontal frame members illustration connection methods of the framing members.

FIG. 79 is an exploded frontal view showing vertical frame member 2107 and horizontal frame member 2106 illustrating connection of flange bolts 2112 from vertical flange leg 2111 and horizontal flange leg 2110. Fastener 2113 illustrates connection of the framework comprised of vertical frame member 2107 and horizontal frame member 2106 to the building structure.

Figure 80:
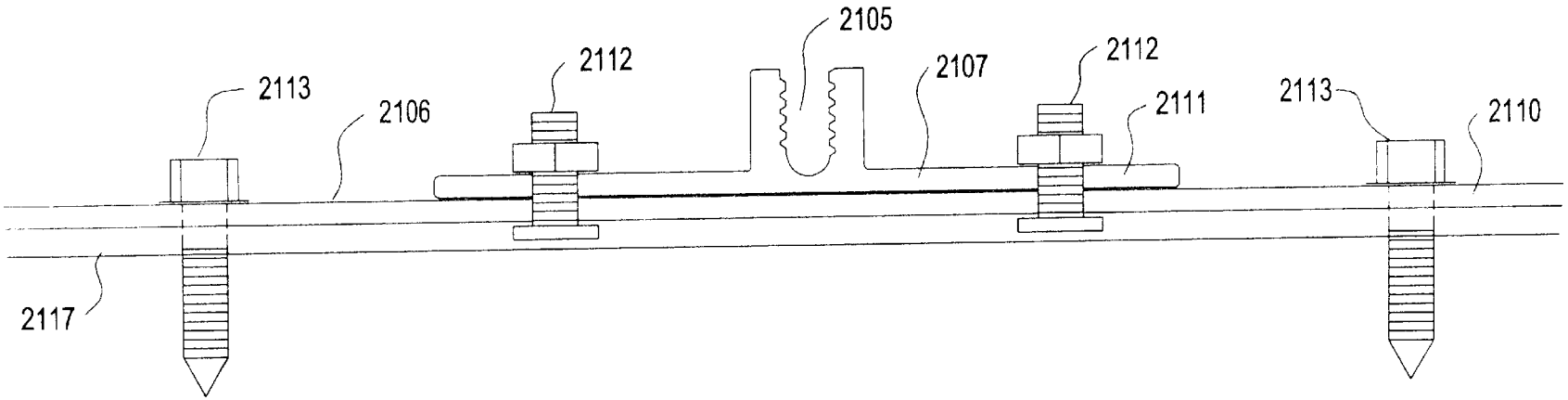
FIG. 80 is a horizontal cross sectional view illustrating member connections, and framework attachment to the building structure.

FIG. 80 is a cross sectional view of framework comprised of vertical frame member 2107 and horizontal frame member 2106 illustrating frame connection using flange bolt 2112 and frame to building structure 2117 attachment utilizing fastener 2113.

Figure 81:
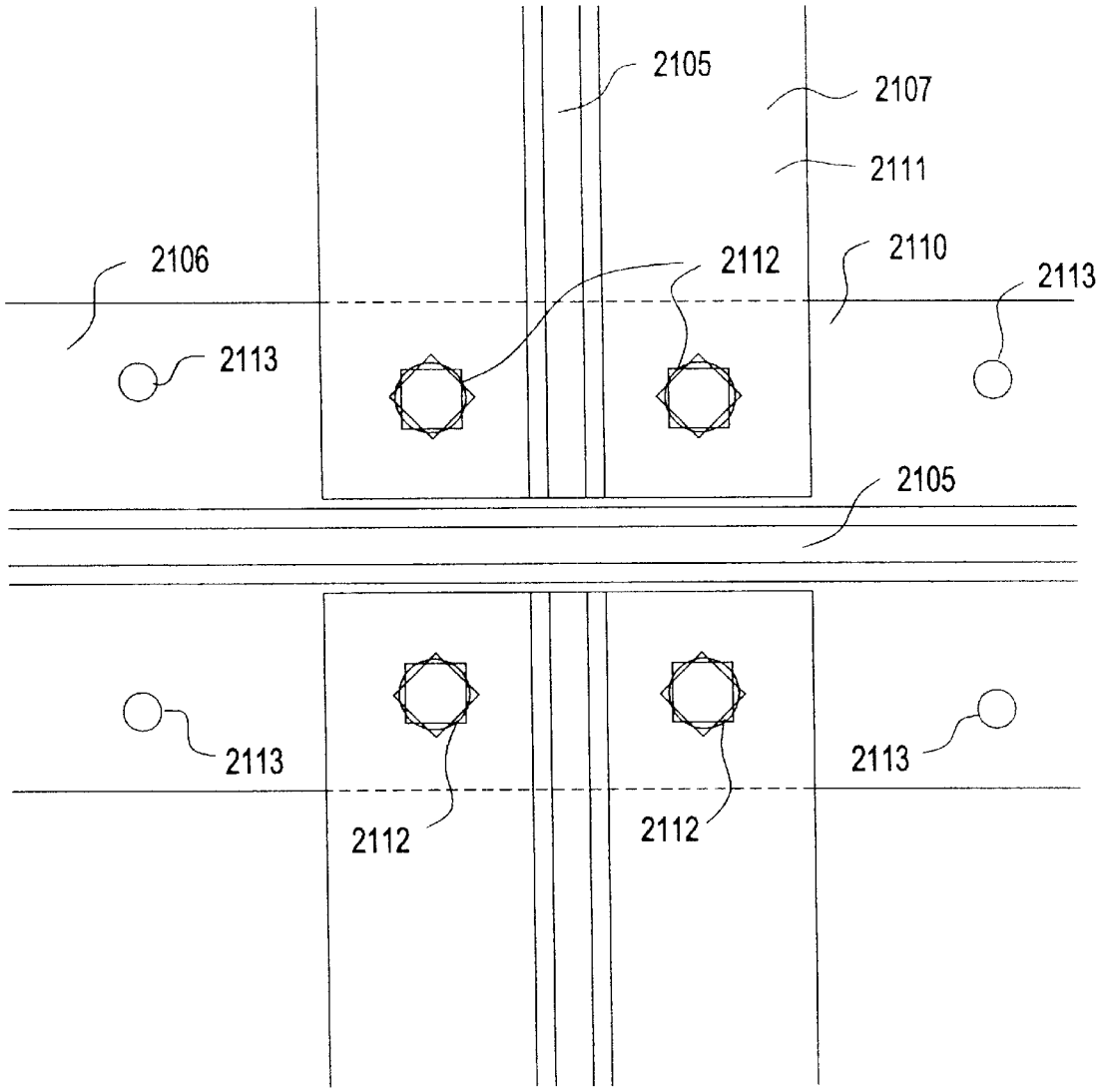
FIG. 81 is an identical view as shown in FIG. 79, but exploded.

FIG. 81 is an frontal view showing vertical frame member 2107 and horizontal frame member 2106 illustrating connection of flange bolts 2112 from vertical flange leg 2111 and horizontal flange leg 2110. Fastener 2113 illustrates connection of the framework comprised of vertical frame member 2107 and horizontal frame member 2106 to the building structure.

Figure 82:
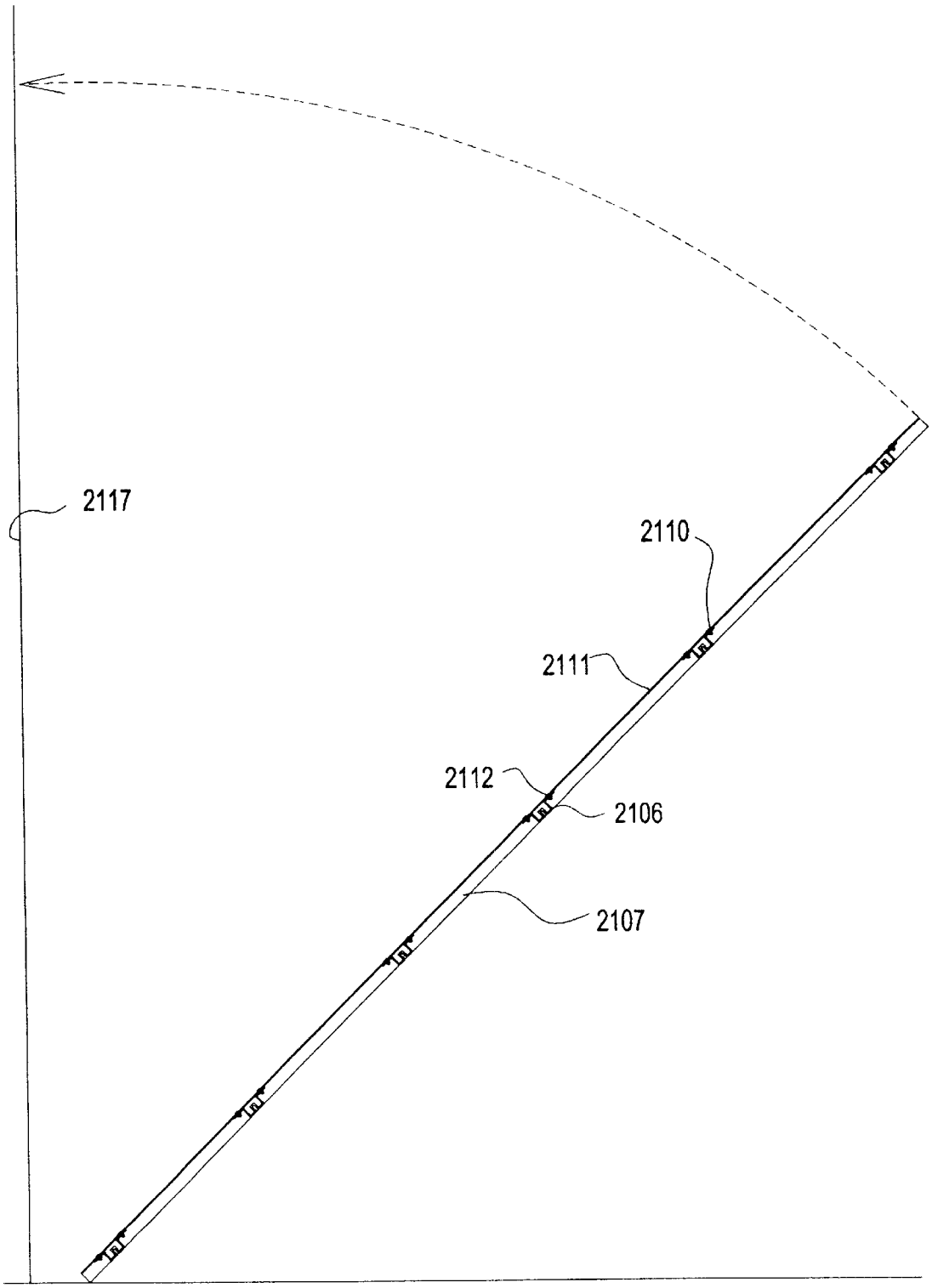
FIG. 82 is a vertical cross sectional view of a framework assembly illustrating one method of raising it to the building structure.

FIG. 82 is a vertical cross sectional view of a framework assembly consisting of vertical frame member 2107 and horizontal frame member 2106 with flanges 2110 and 2111 illustrating one method of attaching a framework to the building structure 2117.

Figure 83:
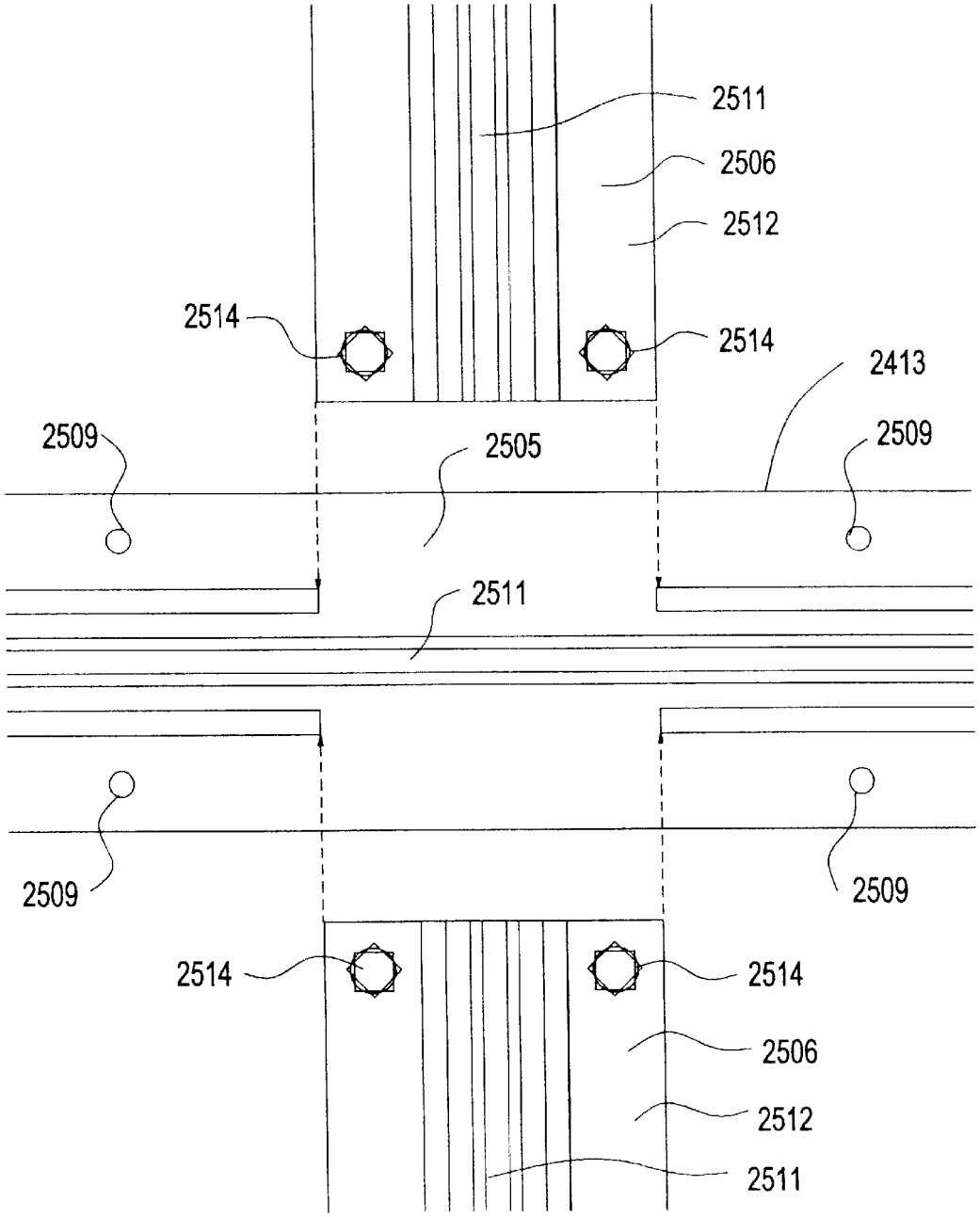
FIG. 83 is a frontal exploded view of a 4-way intersection of the vertical and horizontal frame members illustrating connection methods of the framing members.
Figure 84:
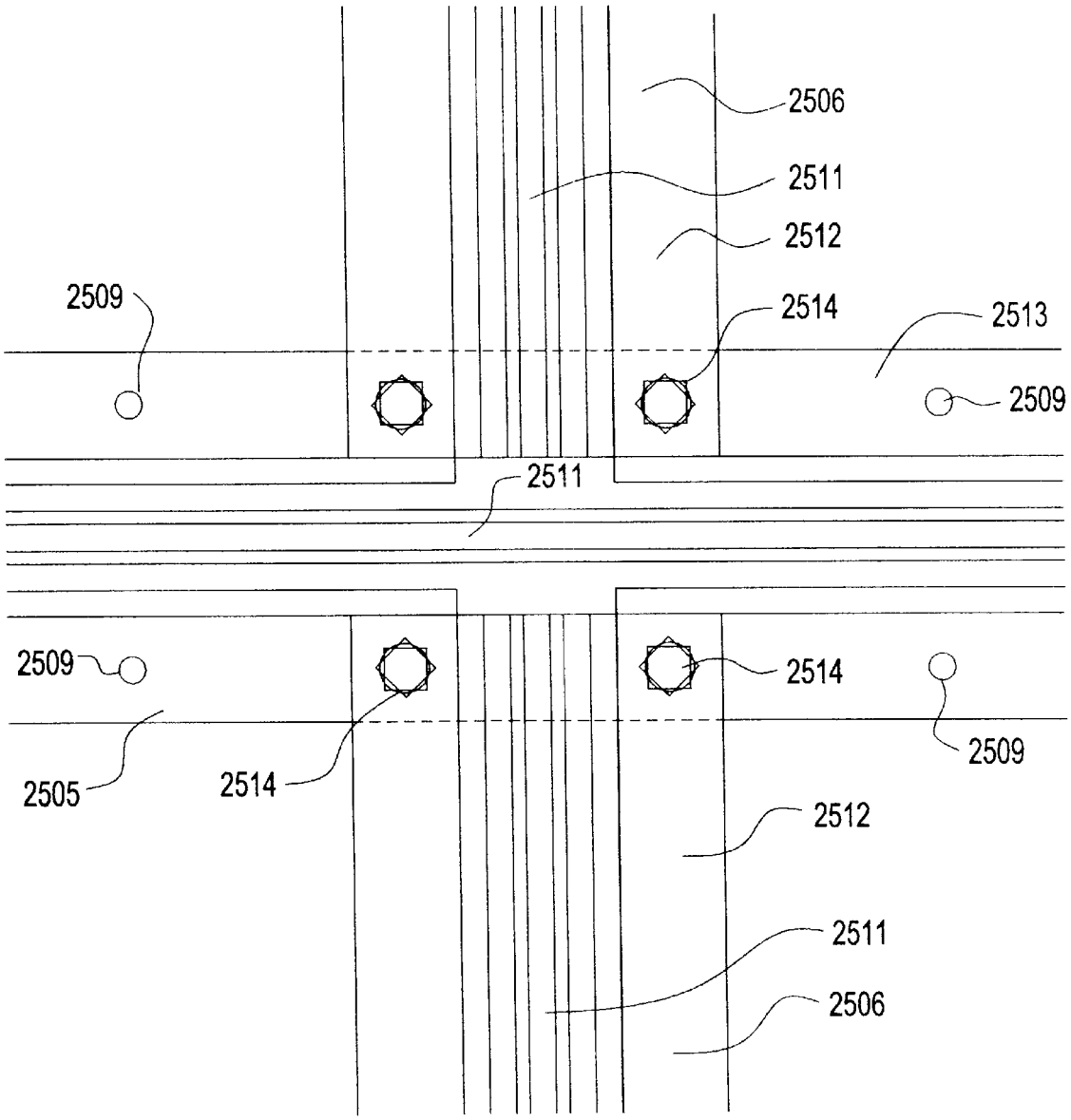
FIG. 84 is a frontal view of a 4-way intersection of the vertical and horizontal frame members illustrating connection methods of the framing members.

FIG. 83 is an exploded frontal view for alternate embodiment DPS2500™ of vertical frame member 2506 and horizontal frame member 2505 illustrating assembly connections through flanges 2512 and 2513 utilizing flange connection 2514. The assembled connection is attached to the building structure utilizing fastener 2509. Frame 84 is a frontal view of vertical frame member 2506 and horizontal frame member 2505 illustrating assembly connections through flanges 2512 and 2513 utilizing flange connection 2514. The assembled connection is attached to the building structure utilizing fastener 2509.

Figure 85:
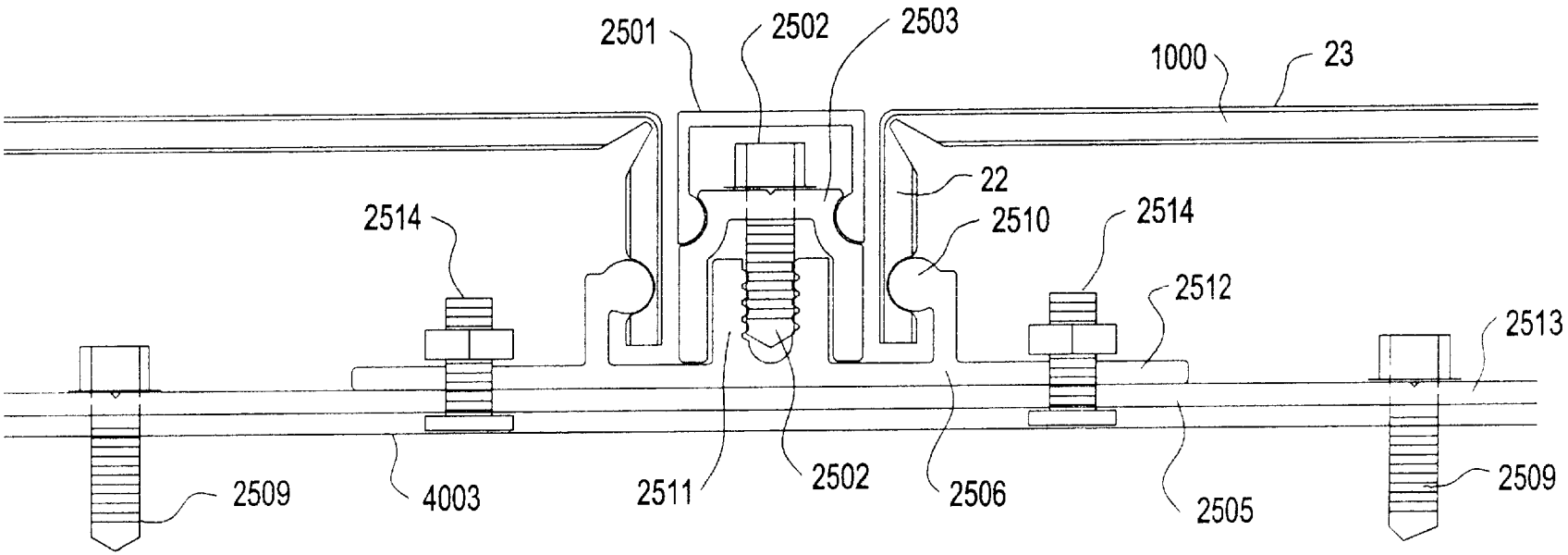
FIG. 85 is a cross sectional view of framework joinery illustration member to member connection and framework connection to the building structure.

FIG. 85 is a cross sectional view of framework consisting of vertical frame member 2506 and horizontal frame member 2505 illustrating connection through flange 2512 and flange 2511 with flange bolt 2514. The curtain wall panel 1000 is attached to the framework by attaching return leg 22 to pivot leg 2510 and held in place by pressure channel 2503 by fastener 2502 and covered by snap cover 2501. The frame assembly attaches to the building structure 4003.

Figure 86:
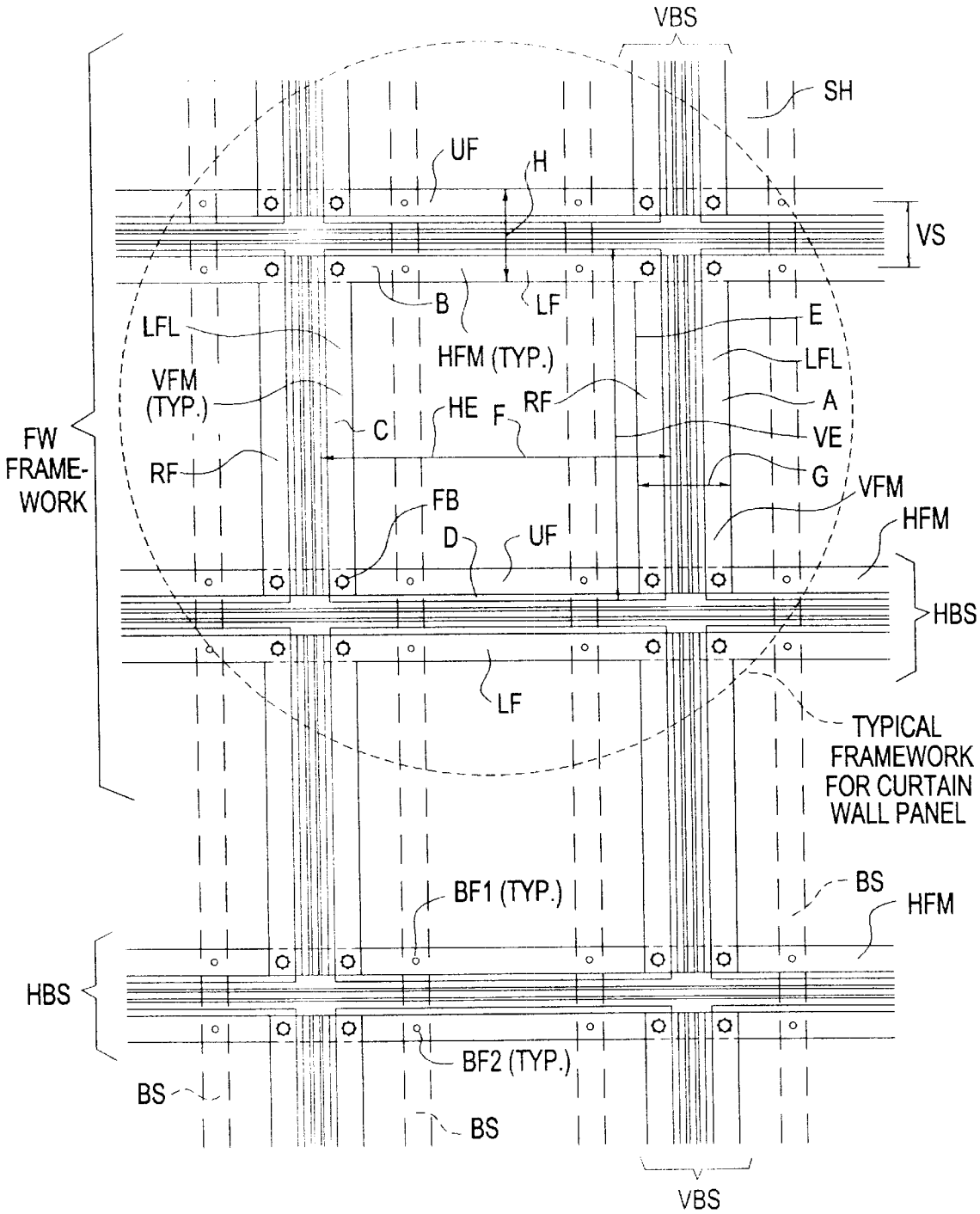
FIG. 86 is a frontal view of typical framework support of the preferred embodiment and all alternate embodiments. It illustrates four-point vertical frame member to horizontal frame member connections as well as two-point horizontal frame member connections to the building structure.

FIG. 86 shows horizontal frame members HFM joined to vertical frame members VFM at right angles. The left flange leg LFL and right flange leg RF of the vertical frame members VFM overlap the lower flange leg LF and the upper flange leg UF of the horizontal frame members HFM above and below the vertical extents VE of the curtain wall panel, and are connected utilizing bolts and nuts at the intersection. Upon the horizontal frame members HFM and vertical frame members VFM being bolted together, it comprises the framework FW. The framework FW is placed against the building structure BS and joined through the horizontal frame members HFM utilizing building fasteners BF1 in the upper flange leg UF and BF2 in the lower flange leg LF, as required by wind loading requirements, between the horizontal extents HE of the curtain wall panel. The vertical bearing surface VBS and horizontal bearing surface HBS prevent the framework FW from crushing any sheathing SH, such as gypsum board or insulation, which may be attached over the building structure BS. The vertical spacing VS of the building fasteners BF1 and BF2 provide constant force to the flanges UF, LF, RF, LFL of the framework FW to the building structure BS while also providing for two connection points in lieu of one. Nominal Dimensions are:

A1=4'×5'=20'

A2=2(4')×(0.40)+2(5')×(0.40)=7.12

A2 over A1=0.36

A=4'0

B=5'0

C=4'0

D=5'0

E=4'0

F=5'0

G=4.750"

H=4.750"

Figure 87:
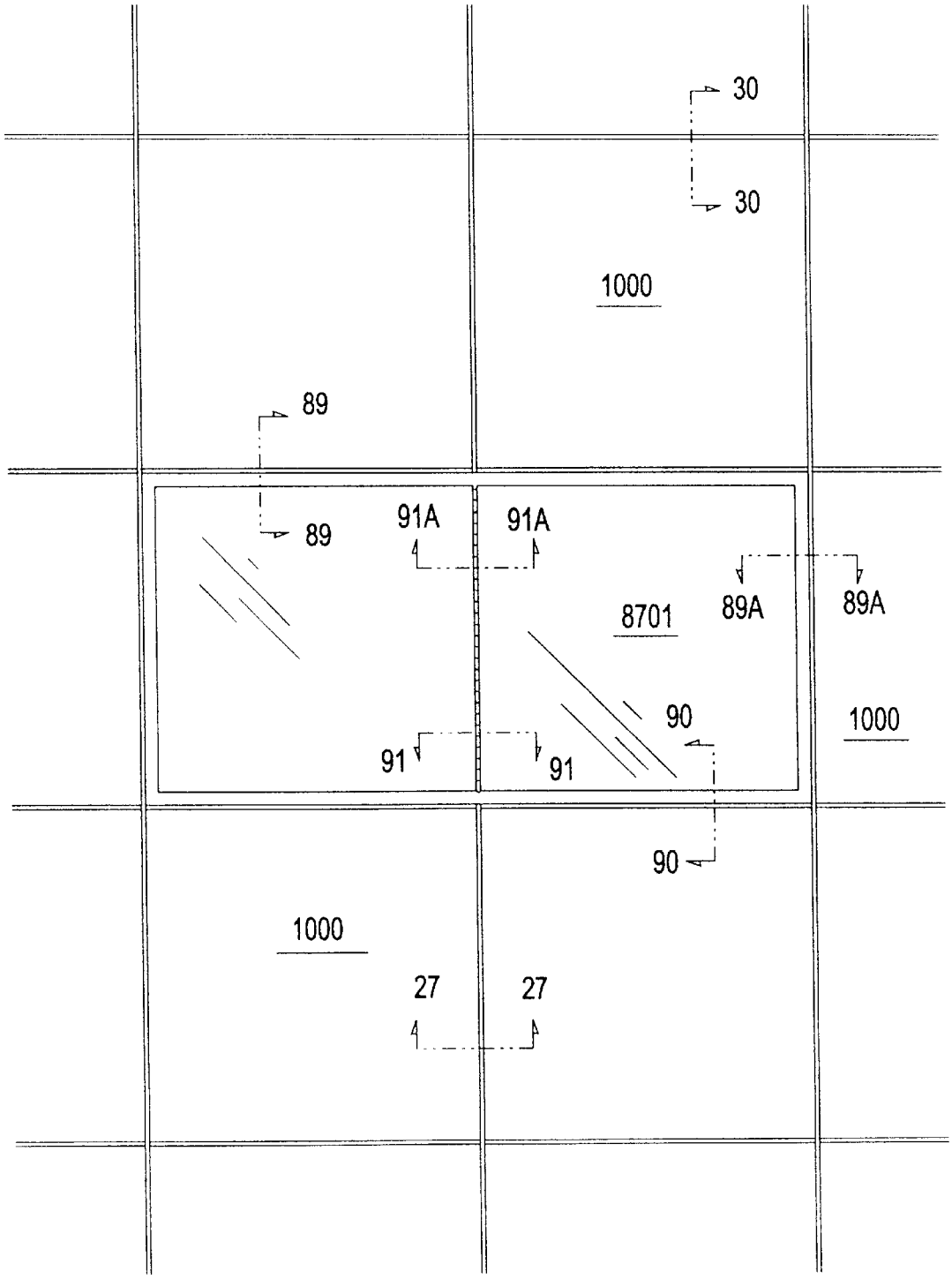
FIG. 87 is a frontal view of a partial building structure showing preferred embodiment DPS 4000™ guttered non-directional dry system per FIGS. 27 and 30, as well as, alternate embodiments for window glazing which include transitions from aluminum composite panel 1000 to glass panel 8701 to aluminum composite panel 1000.
Figure 89:
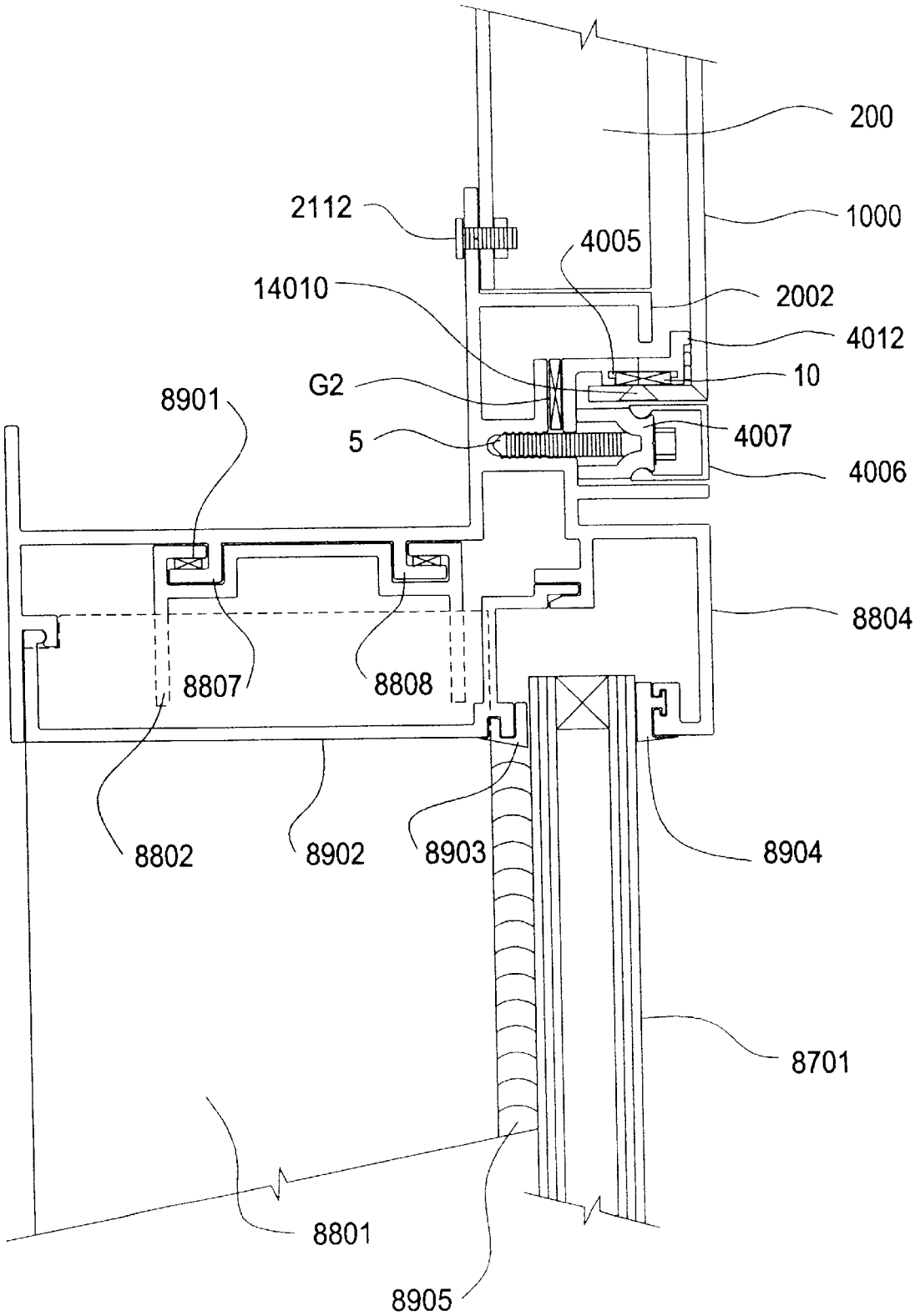
FIG. 89 is a vertical sectional view of the upper transition from glass panel 8701 to aluminum composite panel 1000.
Figure 89A:
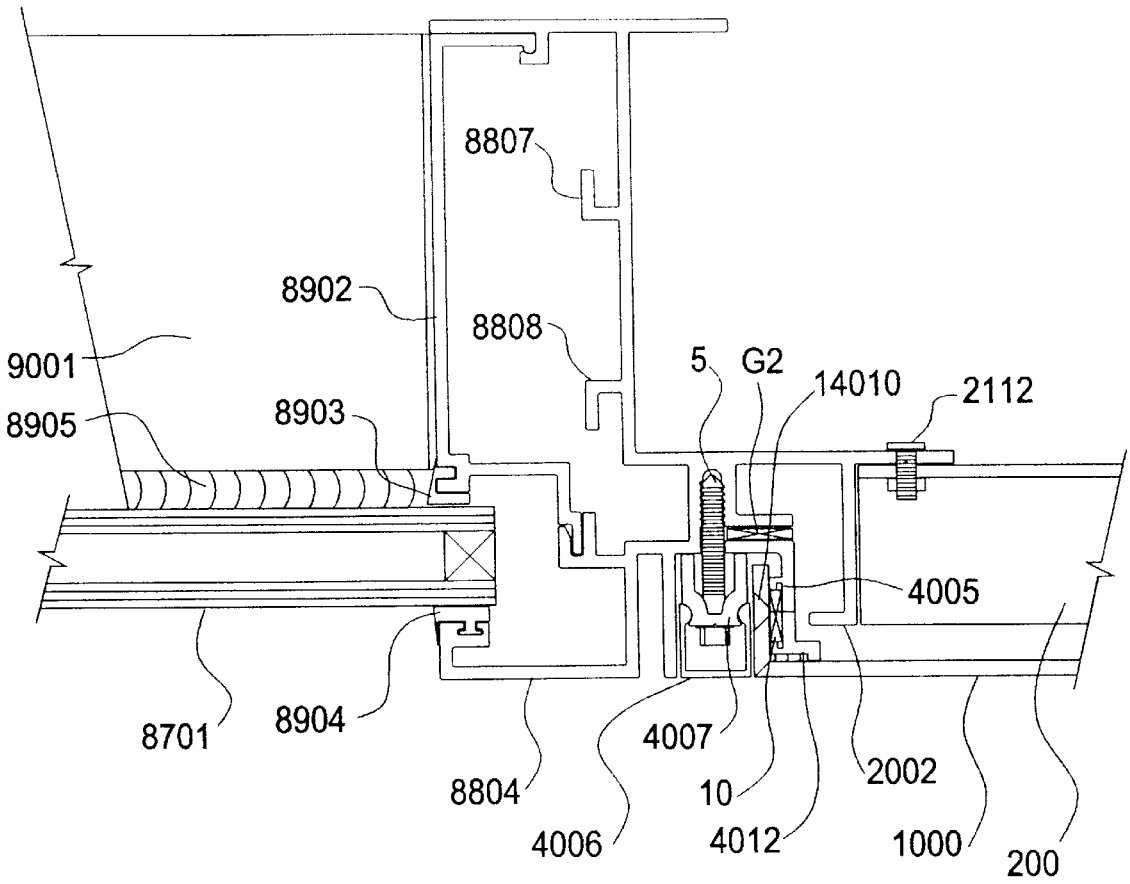
FIG. 89A is a horizontal sectional view of the side transition from glass panel 8701 to aluminum composite panel 1000.
Figure 90:
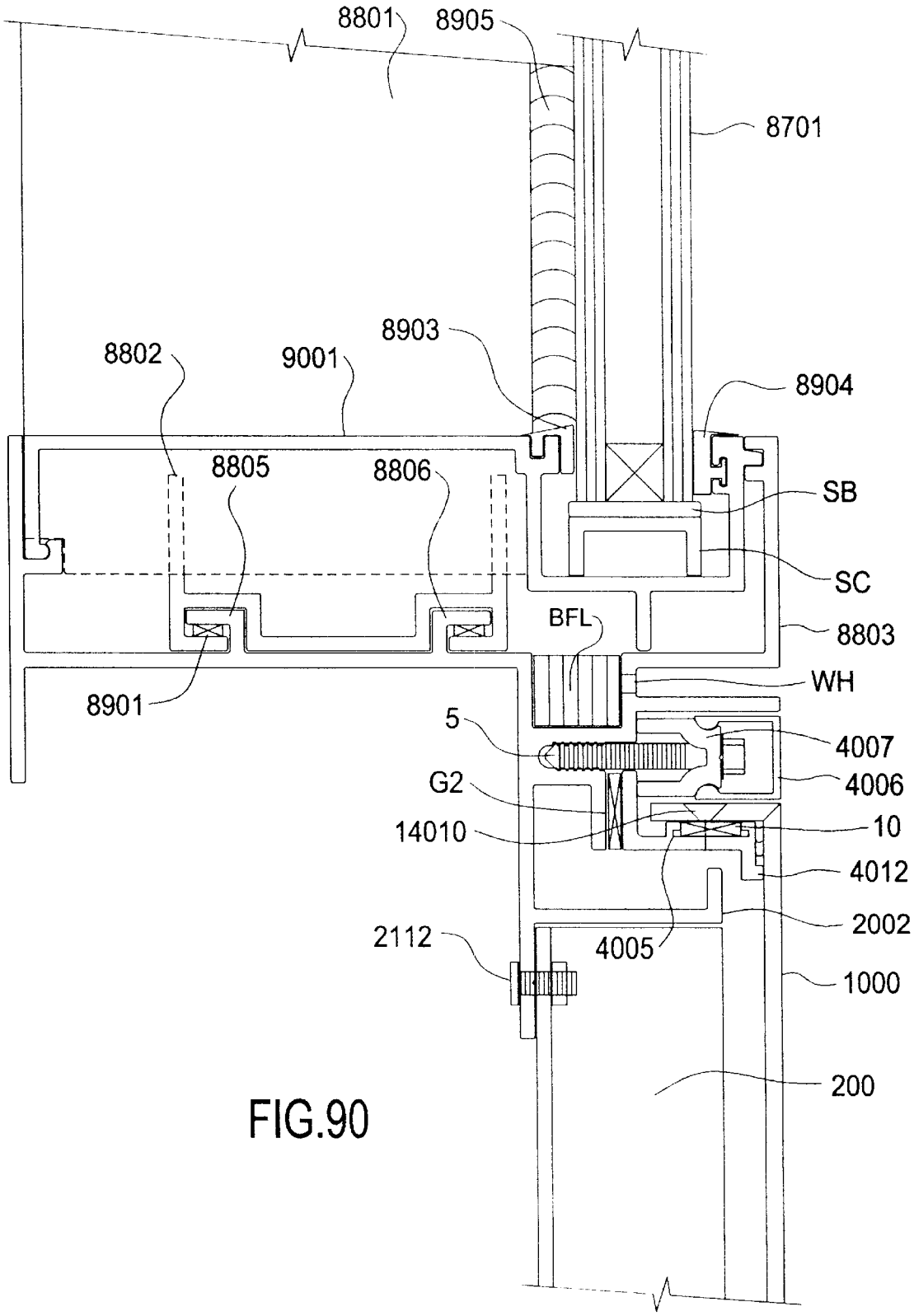
FIG. 90 is a vertical sectional view of the lower transition from glass panel 8701 to aluminum composite panel 1000.
Figure 91:
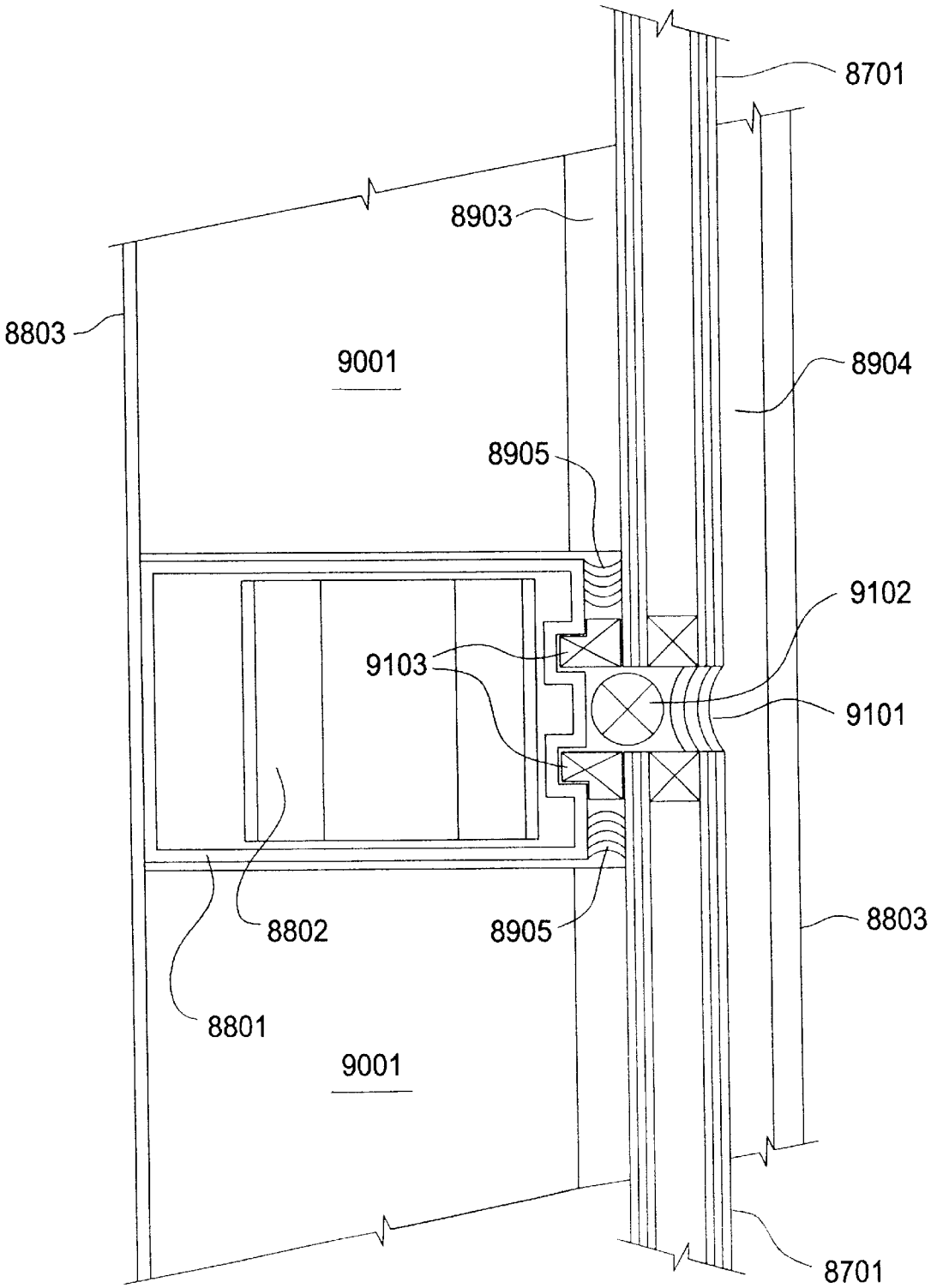
FIG. 91 is a horizontal sectional view of vertical window mullion 8801 looking down toward window sill 8803.
Figure 91A:
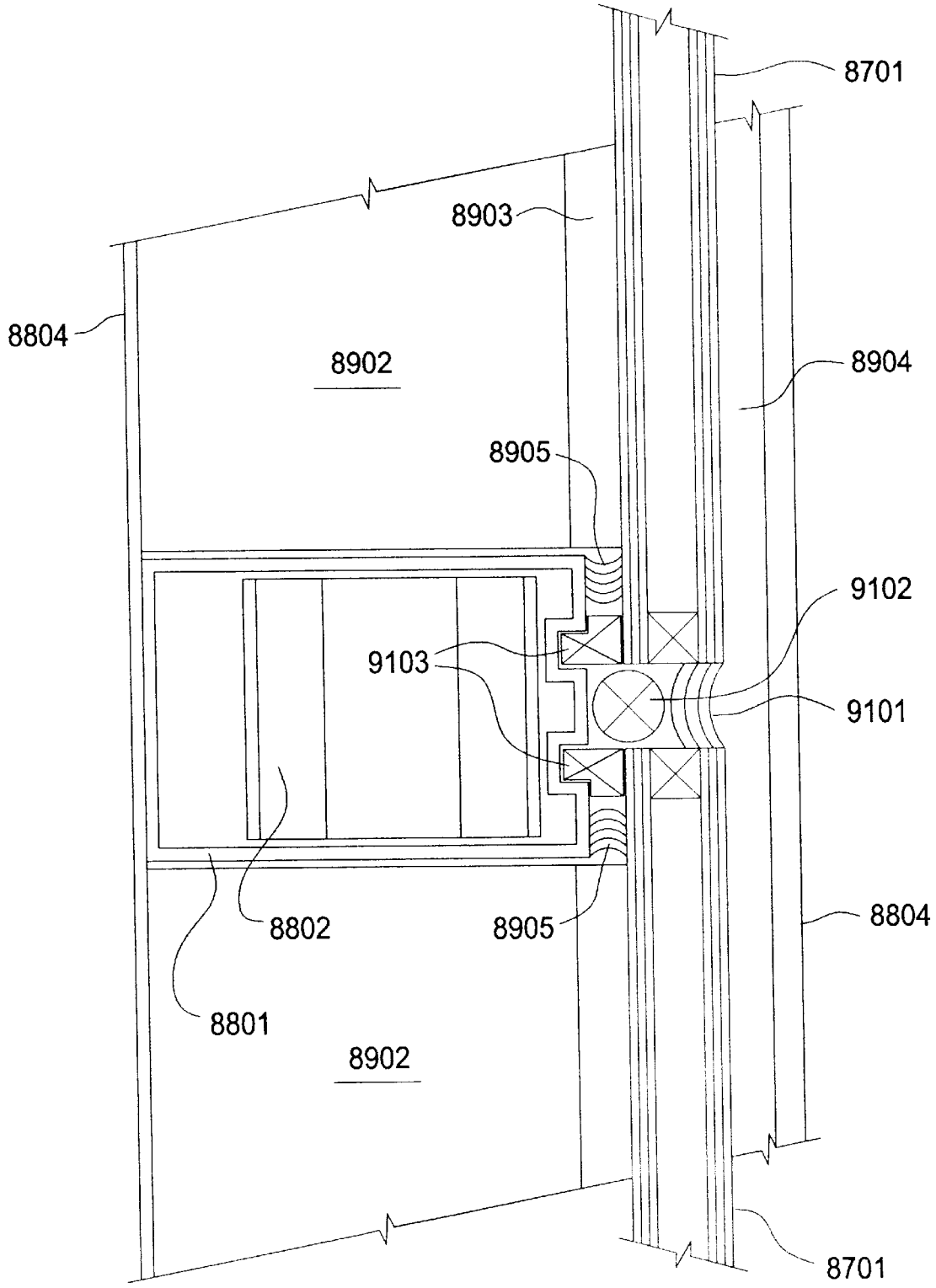
FIG. 91A is a horizontal sectional view of vertical window mullion 8801 looking up toward window head 8804.

FIG. 87 is a frontal view of a partial building structure showing preferred embodiment DPS4000™ guttered non-directional dry system per FIGS. 27 and 30, as well as, alternate embodiments for window glazing which include transitions from aluminum composite panel 1000 to glass panel 8701 to aluminum composite panel 1000 (see FIG. 90). Lower transition from aluminum composite panel 1000 to glass panel 8701 is accomplished using integrated window sill 8803 as shown in FIG. 90. Upper transition from glass panel 8701 to aluminum composite panel 1000 is accomplished using integrated window head 8804 as shown in FIG. 89. The end or jamb transition from glass panel 8701 to aluminum composite panel 1000 is accomplished using window head 8804, but rotated 90 degrees as shown in FIG. 89A. Glass panel 8701 to glass panel 8701 transition is made using vertical window mullion 8801 as shown in FIGS. 91 and 91A.

Figure 88:
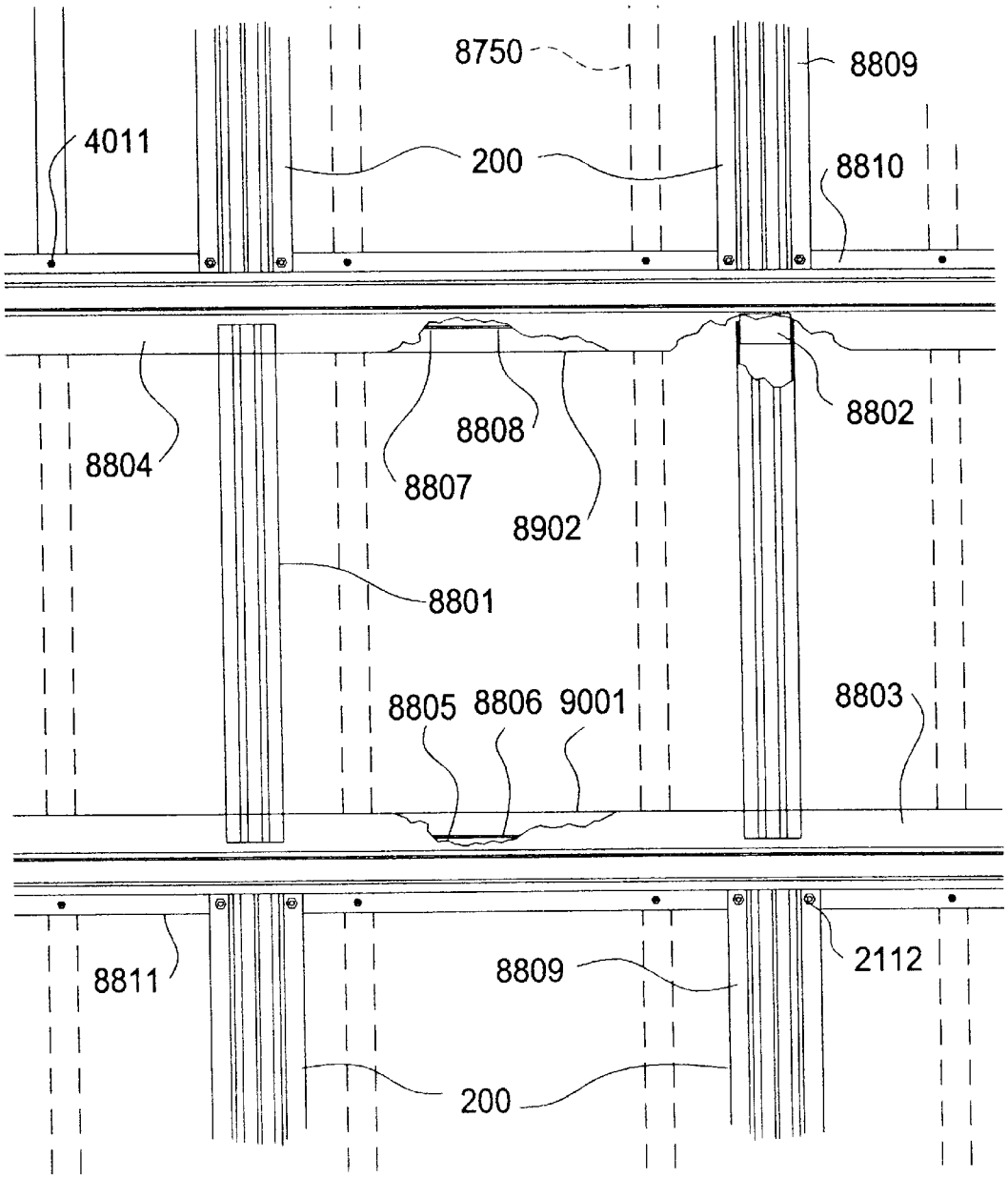
FIG. 88 is a frontal view of framework of preferred embodiment DPS 4000™ guttered non-directional dry system including alternate embodiments for window glazing shown in FIG. 87, with aluminum composite panels 1000 and glass panels 8701 removed.

FIG. 88 is a frontal view of framework of preferred embodiment DPS4000™ guttered non-directional dry system including alternate embodiments for window glazing shown in FIG. 87, with aluminum composite panels 1000 and glass panels 8701 removed. From top to bottom, the framework is comprised of lower gutter 200 vertically transitioning to horizontal window head 8804, and connected through overlapping flanges 8809 and 8810 using flange bolt 2112. Window head 8804 transitions to vertical window mullion 8801 and continues to window sill 8803. Window mullion 8801 is held static at both ends by sliding mullion clip 8802 which rides upon integrated clip rails 8805 and 8806 in window sill 8803, and integrated clip rails 8807 and 8808 in window head 8804. Between each vertical window mullion 8801 is a decorative snap insert; 8902 at window head 8804, and 9001 at window sill 8803. Window sill 8803 transitions to vertical lower gutter 200 and connects through overlapping flanges 8809 and 8811 using flange bolt 2112. Framework attachment to building structure 8750 is made using attachment screw 4011 through flanges 8810 and 8811.

FIG. 89 is a vertical sectional view of the upper transition from glass panel 8701 to aluminum composite panel 1000. Window head 8804 is connected to lower gutter 200 using flange bolt 2112. Lower gutter 200 rests upon gutter leg 2002 of window head 8804. Window head 8804 includes integrated clip rails 8807 and 8808 which form reglets or grooves upon which mullion clip 8802 slides. Vertical window mullion 8801 captures mullion clip 8802 and is made static using clip-stay 8901. Decorative snap cover 8902 fits between vertical window mullions 8801 into window head 8804. Glass panel 8701 is held in window head 8804 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head 8804 by pressure channel 4007 and machine screw 5. Decorative snap cap 4006 covers pressure channel 4007.

FIG. 89A is a horizontal sectional view of the side transition from glass panel 8701 to aluminum composite panel 1000. Window head 8804 is rotated 90 degrees and used as a window jamb to transition glass panel 8701 to aluminum composite panel 1000. Window head (jamb) insert 8902 snaps in between window head 8804 and window sill 8803. Window sill insert 9001 snaps into window sill 8803 between vertical window mullions 8801. Glass panel 8701 is held in window head jamb) 8804 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head (jamb) 8804 by pressure channel 4007 and machine screw 5. Decorative snap cap 4006 covers pressure channel 4007.

FIG. 90 is a vertical sectional view of the lower transition from glass panel 8701 to aluminum composite panel 1000. Window sill 8803 is connected to lower gutter 200 using flange bolt 2112. Lower gutter 200 rests against gutter leg 2002 of window sill 8803. Window sill 8803 includes integrated clip rails 8805 and 8806 which form reglets or grooves upon which mullion clip 8802 slides. Vertical window mullion 8801 captures mullion clip 8802 and is made static using clip-stay 8901. Decorative snap cover

9001 fits between vertical window mullions 8801 into window sill 8803. Glass panel 8701 is held in window sill 8803 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window sill 8803 by pressure channel 4007 and machine screw 5. Decorative snap cap 4006 covers pressure channel 4007. Baffle BFL prevents water blockage from debris and negative wind pressure. Weep hole WH allows water to exit to the face of aluminum composite panel 1000.

FIG. 91 is a horizontal sectional view of vertical window mullion 8801 looking down toward window sill 8803. Mullion clip 8802 holds vertical window mullion 8801 static within window sill 8803. Decorative insert 9001 snaps into window sill 8803 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

FIG. 91A is a horizontal sectional view of vertical window mullion 8801 looking up toward window head 8804. Mullion clip 8802 holds vertical window mullion 8801 static within window head 8804. Decorative insert 8902 snaps into window head 8804 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

Figures 89, 90, 92:
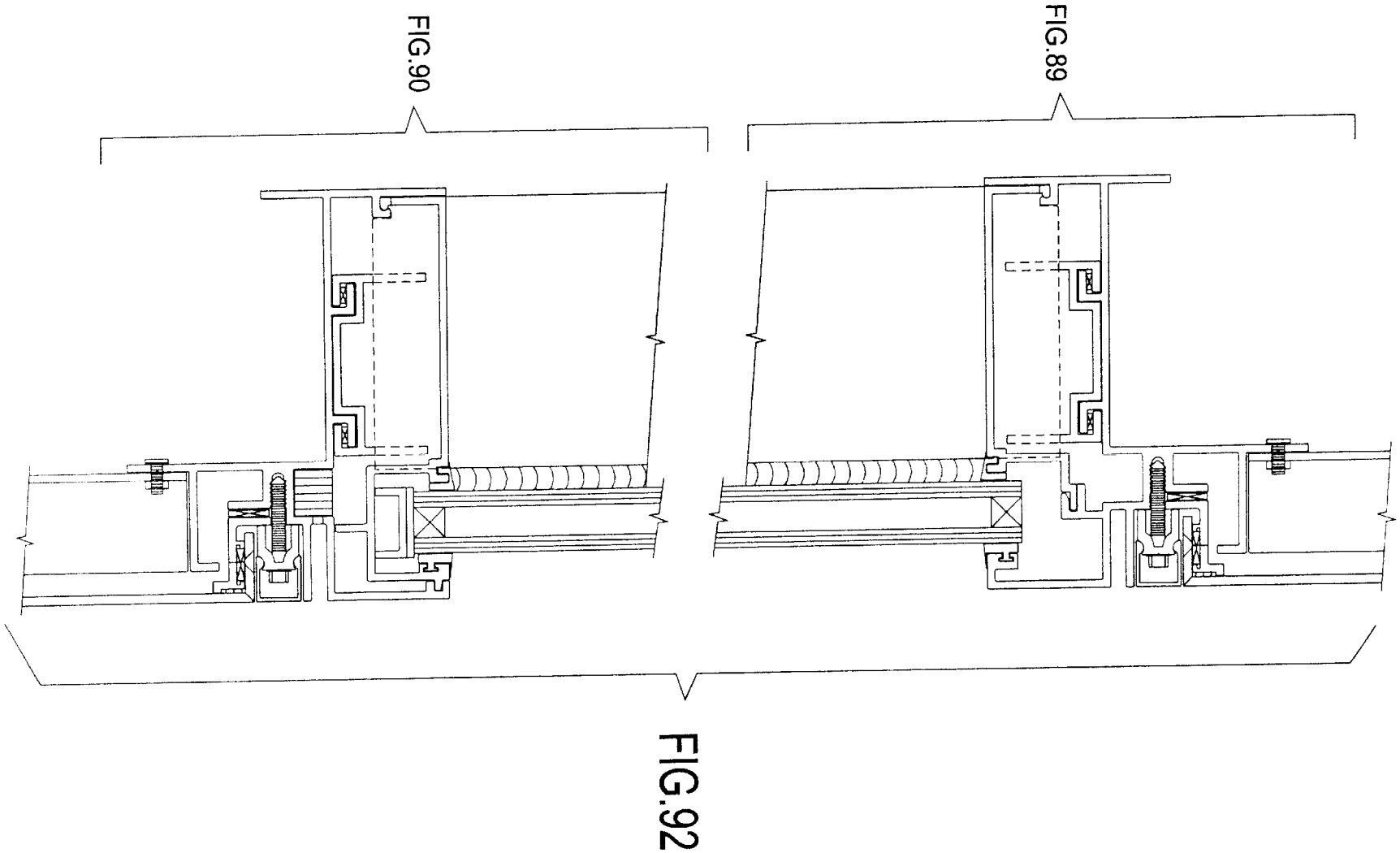
FIG. 92 is a vertical sectional view of a glass panel assembly using FIGS. 89 and 90.

FIG. 92 is a vertical sectional view of a glass panel assembly using FIGS. 89 and 90.

Figures 89, 90, 93:
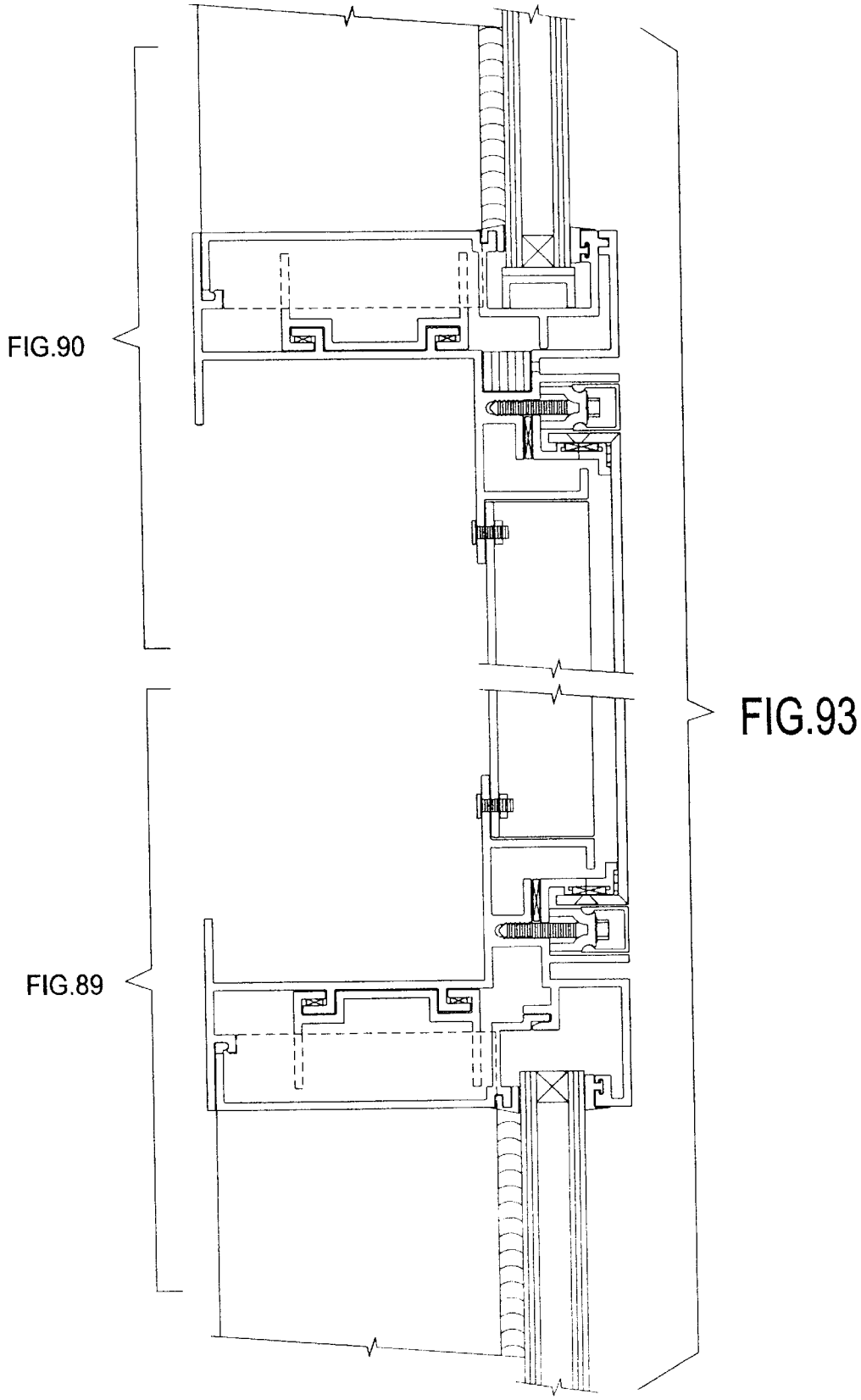
FIG. 93 is a vertical sectional view of a panel assembly using FIGS. 89 and 90.

FIG. 93 is a vertical sectional view of a panel assembly using FIGS. 89 and 90.

Figure 94:
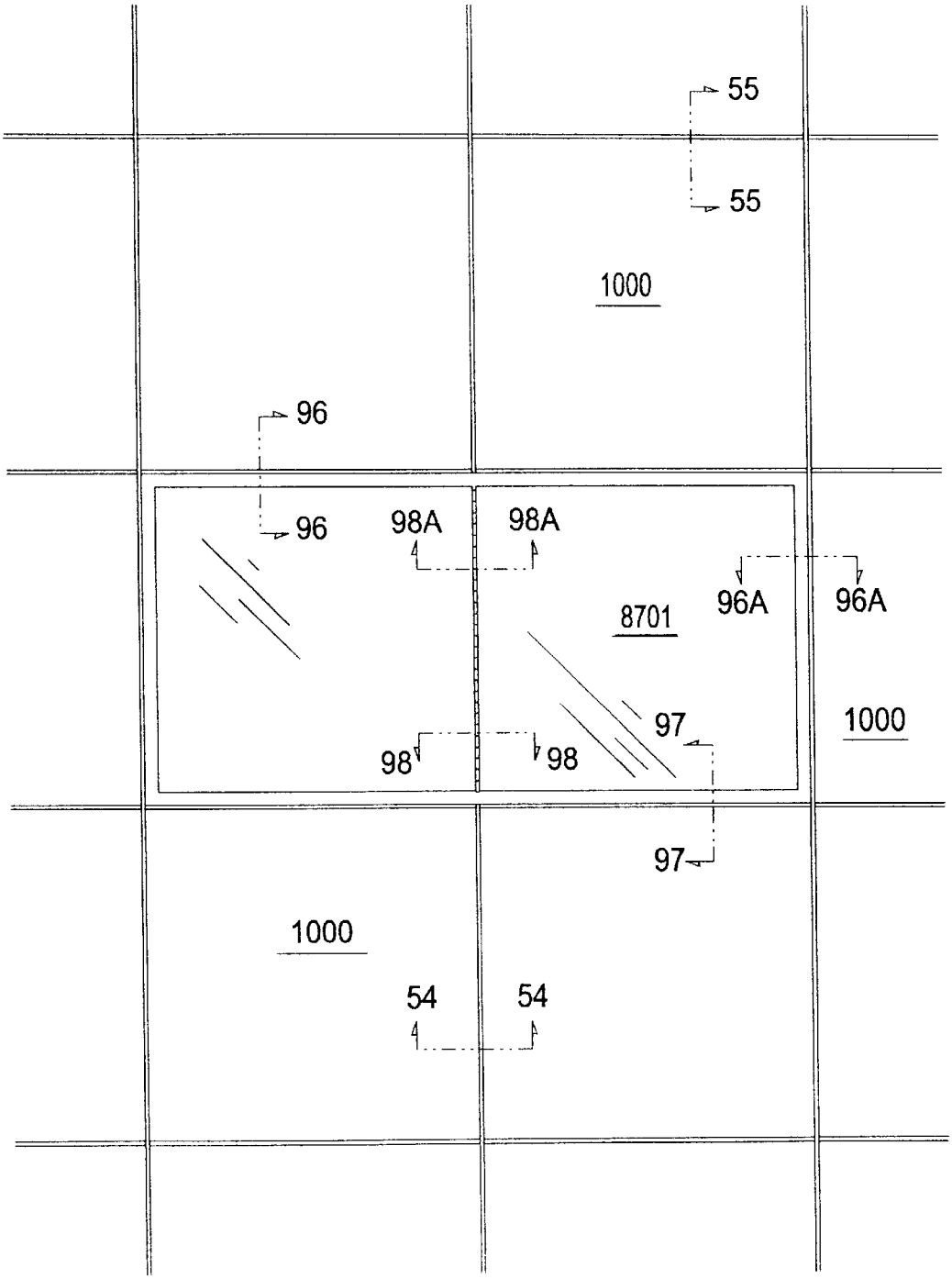
FIG. 94 is a frontal view of a partial building structure showing alternate embodiment DPS 3000 non-directional dry system per FIGS. 54 and 55, as well as, additional alternate embodiments for window glazing which include transitions from aluminum composite panel 1000 to glass panel 8701 to aluminum composite panel 1000.
Figure 96:
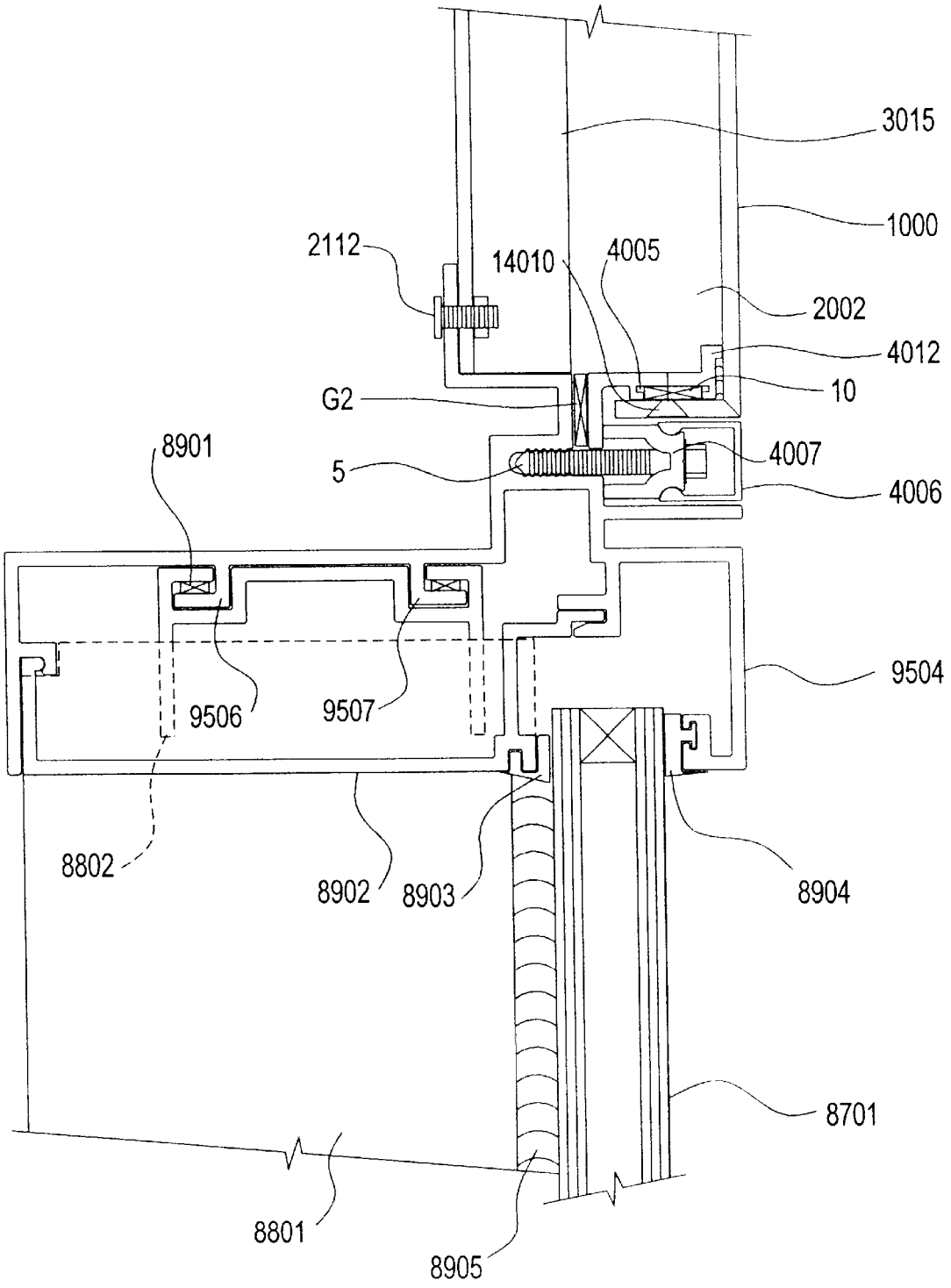
FIG. 96 is a vertical sectional view of the upper transition from glass panel 8701 to aluminum composite panel 1000.
Figure 96A:
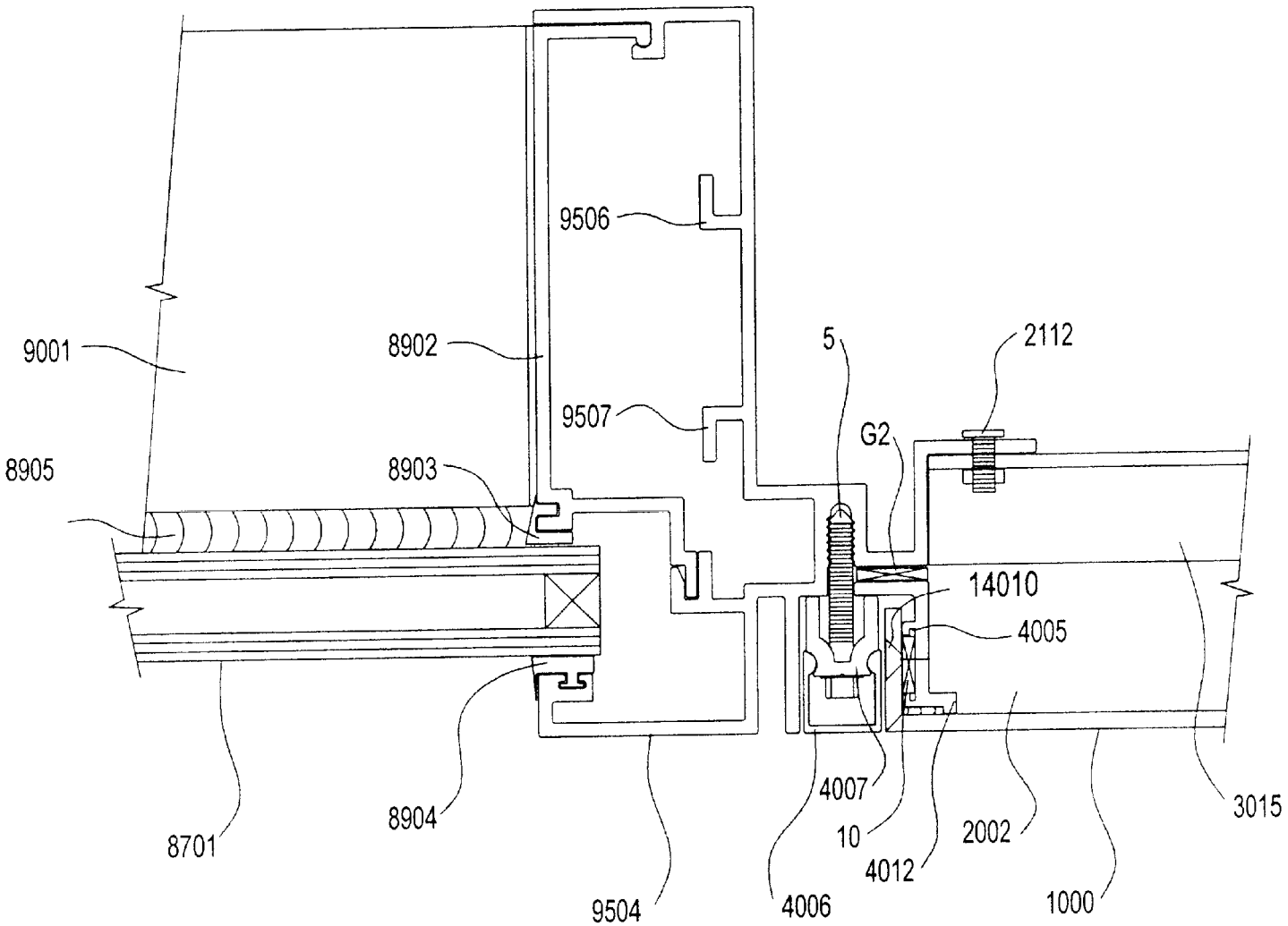
FIG. 96A is a horizontal sectional view of the side transition from glass panel 8701 to aluminum composite panel 1000.
Figure 97:
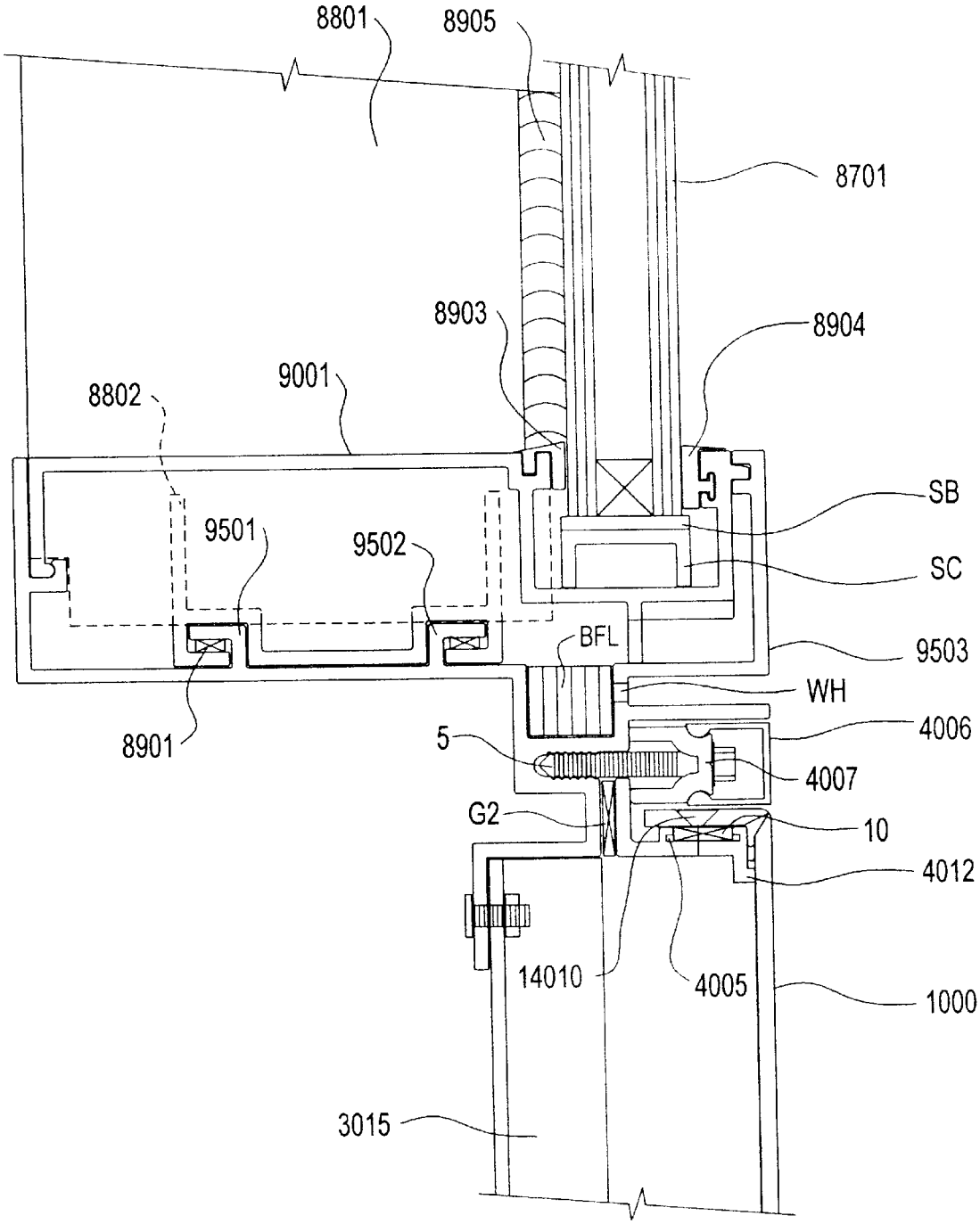
FIG. 97 is a vertical sectional view of the lower transition from glass panel 8701 to aluminum composite panel 1000.
Figure 98:
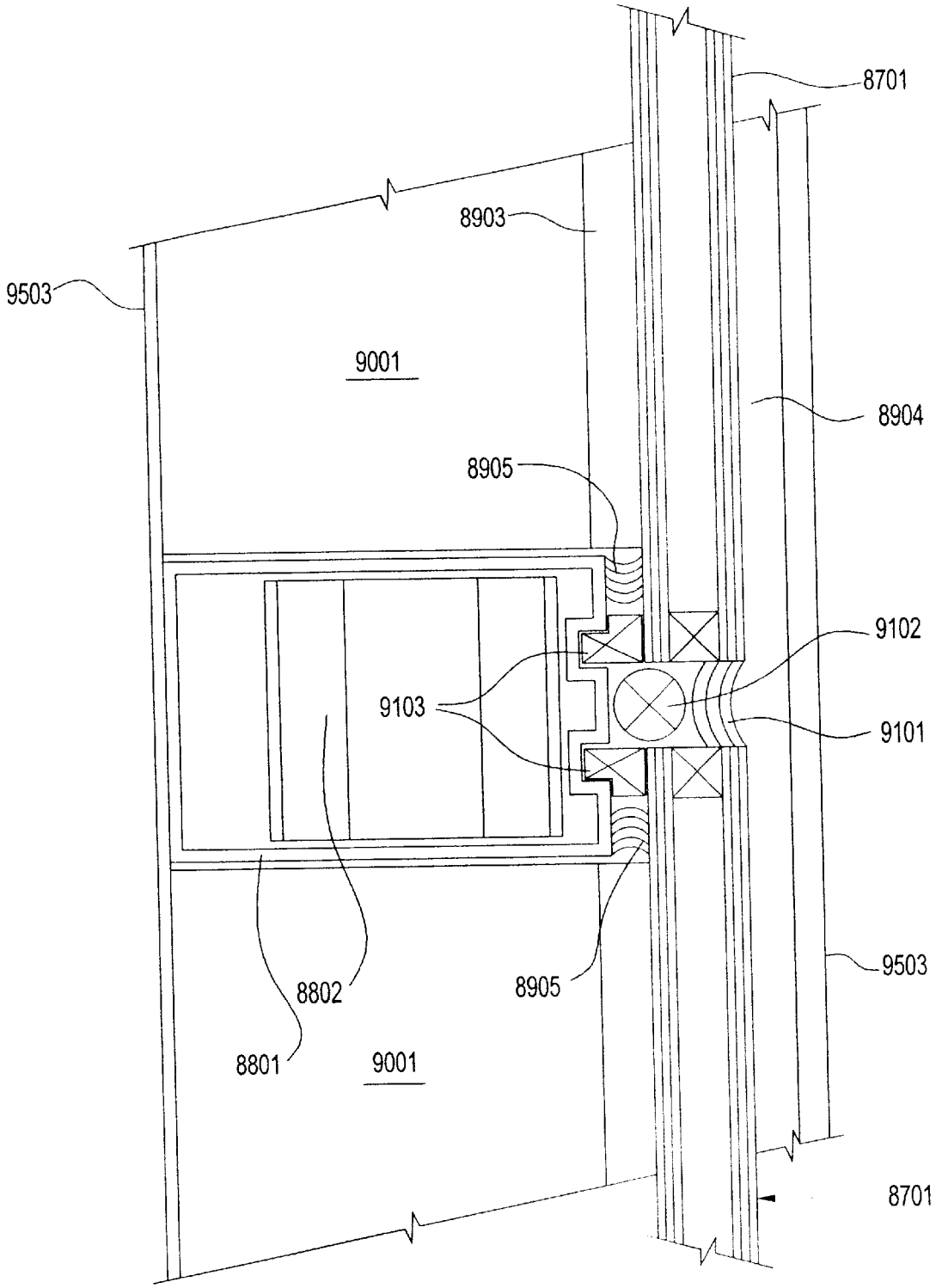
FIG. 98 is a horizontal sectional view of vertical window mullion 8801 looking down toward window sill 9503.
Figure 98A:
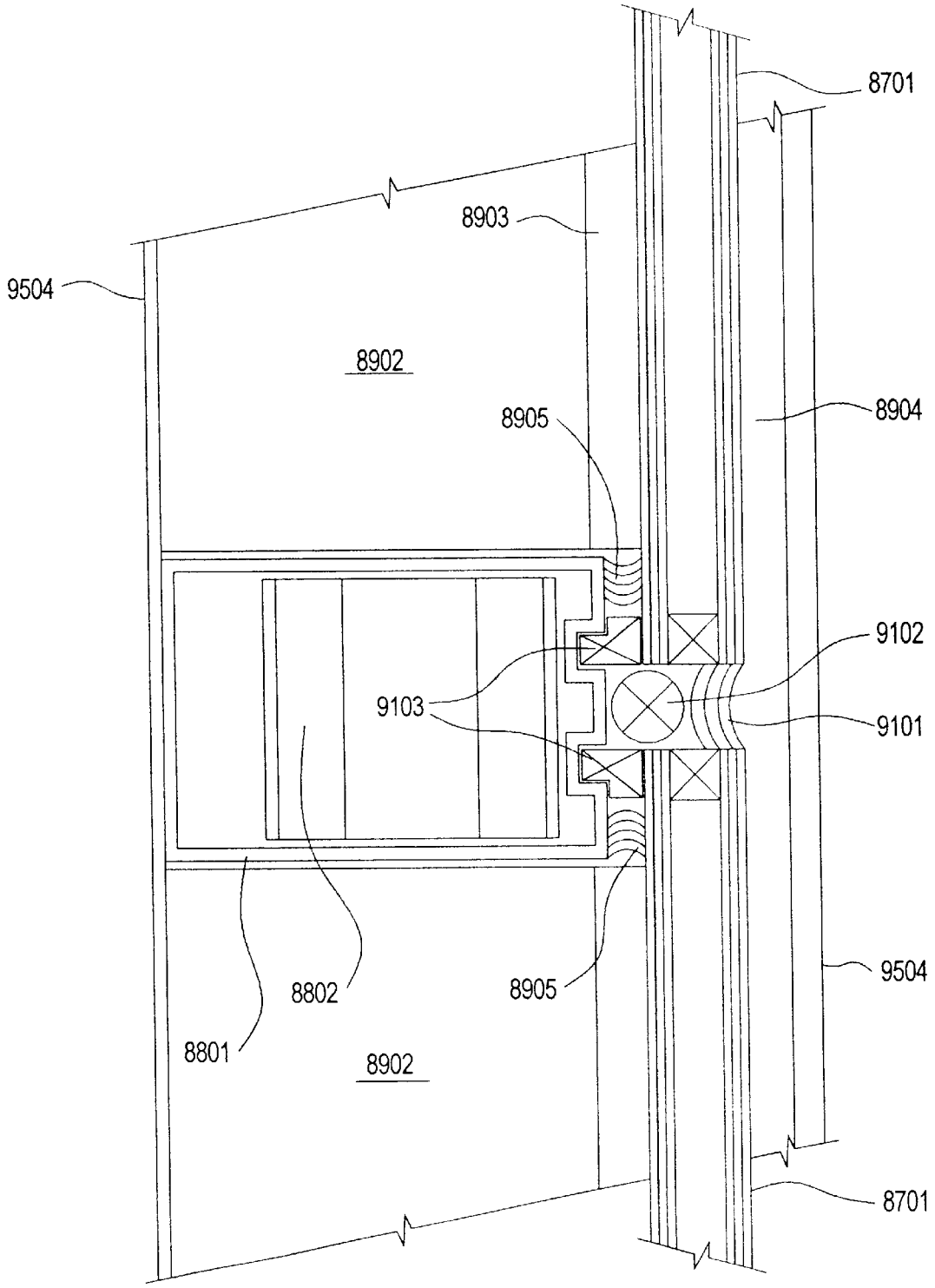
FIG. 98A is a horizontal sectional view of vertical window mullion 8801 looking up toward window head 9504.

FIG. 94 is a frontal view of a partial building structure showing alternate embodiment DPS 3000 non-directional dry system per FIGS. 54 and 55, as well as, additional alternate embodiments for window glazing which include transitions from aluminum composite panel 1000 to glass panel 8701 to aluminum composite panel 1000. Lower transition from aluminum composite panel 1000 to glass panel 8701 is accomplished using integrated window sill 9503 as shown in FIG. 97. Upper transition from glass panel 8701 to aluminum composite panel 1000 is accomplished using integrated window head 9504 as shown in FIG. 96. The end or jamb transition from glass panel 8701 to aluminum composite panel 1000 is accomplished using window head 9504, but rotated 90 degrees as shown in FIG. 96A. Glass panel 8701 to glass panel 8701 transition is made using vertical window mullion 8801 as shown in FIGS. 98 and 98A.

Figure 95:
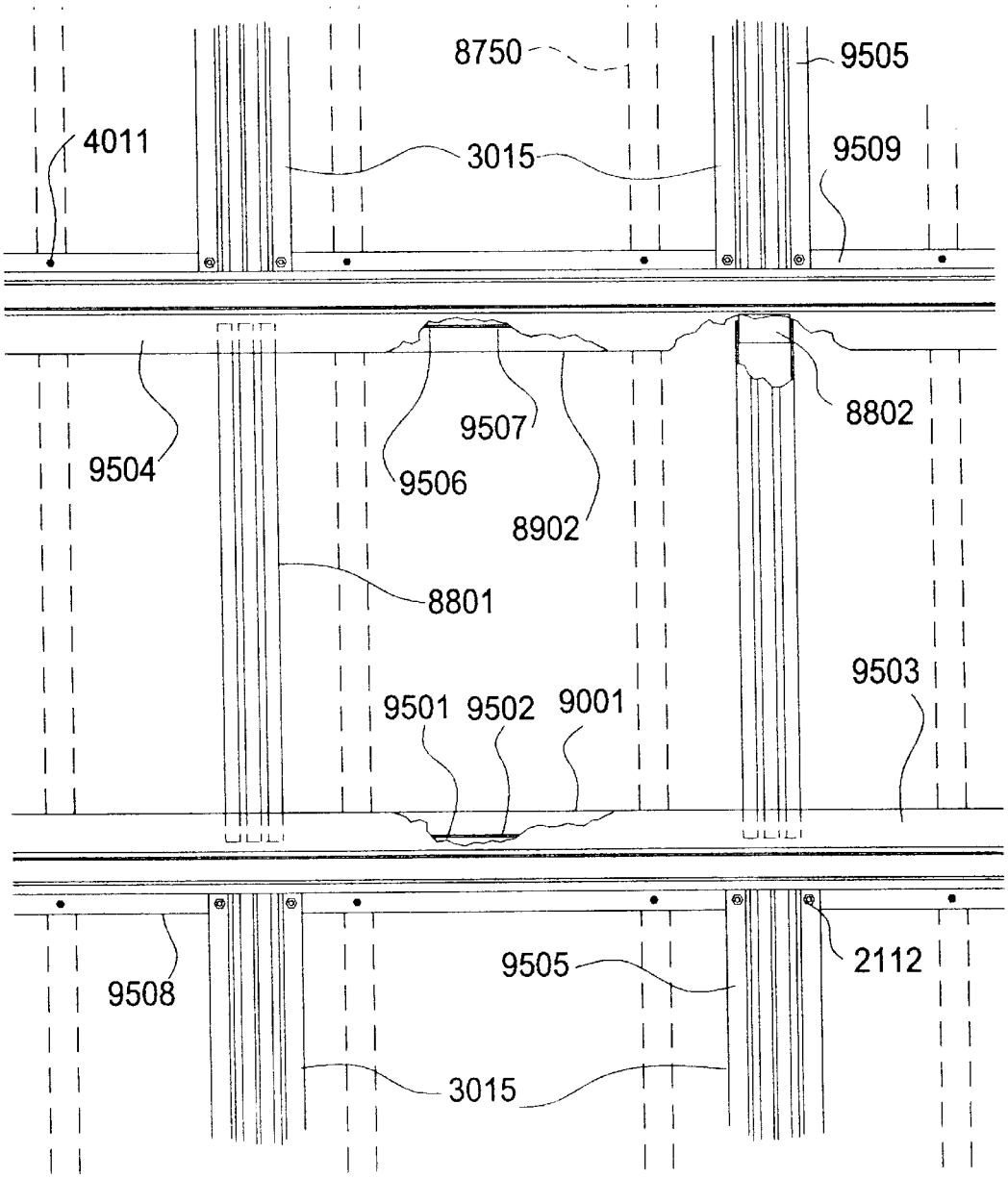
FIG. 95 is a frontal view of framework of alternate embodiment DPS 3000 non-directional dry system including additional alternate embodiments for window glazing shown in FIG. 94, with aluminum composite panels 1000 and glass panels 8701 removed. From top to bottom, the framework is comprised of lower base 3015 vertically transitioning to horizontal window head 9504, and connected through overlapping flanges 9509 and 9505 using flange bolt 2112.

FIG. 95 is a frontal view of framework of alternate embodiment DPS 3000 non-directional dry system including additional alternate embodiments for window glazing shown in FIG. 94, with aluminum composite panels 1000 and glass panels 8701 removed. From top to bottom, the framework is comprised of lower base 3015 vertically transitioning to horizontal window head 9504, and connected through overlapping flanges 9509 and 9505 using flange bolt 2112. Window head 9504 transitions to vertical window mullion 8801 and continues to window sill 9503. Window mullion 8801 is held static at both ends by sliding mullion clip 8802 which rides upon integrated clip rails 9501 and 9502 in window sill 9503, and integrated clip rails 9506 and 9507 in window head 9504. Between each vertical window mullion 8801 is a decorative snap insert; 8902 at window head 9504, and 9001 at window sill 9503. Window sill 9503 transitions to vertical lower base 3015 and connects through overlapping flanges 9505 and 9508 using flange bolt 2112. Framework attachment to building structure 8750 is made using attachment screw 4011 through flanges 9509 and 9508.

FIG. 96 is a vertical sectional view of the upper transition from glass panel 8701 to aluminum composite panel 1000. Window head 9504 is connected to lower base 3015 using flange bolt 2112. Lower base 3015 rests upon window head 9504. Window head 9504 includes integrated clip rails 9506 and 9507 which form reglets or grooves upon which mullion clip 8802 slides. Vertical window mullion 8801 captures mullion clip 8802 and is made static using clip-stay 8901. Decorative snap cover 8902 fits between vertical window mullions 8801 into window head 9504. Glass panel 8701 is held in window head 9504 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head 9504 by pressure channel 4007 and machine screw 5. Decorative snap cap 4006 covers pressure channel 4007.

FIG. 96A is a horizontal sectional view of the side transition from glass panel 8701 to aluminum composite panel 1000. Window head 9504 is rotated 90 degrees and used as a window jamb to transition glass panel 8701 to aluminum composite panel 1000. Window head (jamb) insert 8902 snaps in between window head 9504 and window sill 9503. Window sill insert 9001 snaps into window sill 9503 between vertical window mullions 8801. Glass panel 8701 is held in window head (jamb) 9504 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head (jamb) 9504 by pressure channel 4007 and machine screw 5. Decorative snap cap 4006 covers pressure channel 4007.

FIG. 97 is a vertical sectional view of the lower transition from glass panel 8701 to aluminum composite panel 1000. Window sill 9503 is connected to lower base 3015 using flange bolt 2112. Lower base 3015 rests against window sill 9503. Window sill 9503 includes integrated clip rails 9501 and 9502 which form reglets or grooves upon which mullion clip 8802 slides. Vertical window mullion 8801 captures mullion clip 8802 and is made static using clip-stay 8901. Decorative snap cover 9001 fits between vertical window mullions 8801 into window sill 9503. Glass panel 8701 is held in window sill 8803 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window sill 9503 by pressure channel 4007 and machine screw 5. Decorative snap cap 4006 covers pressure channel 4007. Baffle BFL prevents water blockage from debris and negative wind pressure. Weep hole WH allows water to exit to the face of aluminum composite panel 1000.

FIG. 98 is a horizontal sectional view of vertical window mullion 8801 looking down toward window sill 9503. Mullion clip 8802 holds vertical window mullion 8801 static within window sill 9503. Decorative insert 9001 snaps into window sill 9503 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

FIG. 98A is a horizontal sectional view of vertical window mullion 8801 looking up toward window head 9504. Mullion clip 8802 holds vertical window mullion 8801 static within window head 9504. Decorative insert 8902 snaps into window head 9504 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

Figures 96, 97, 99:
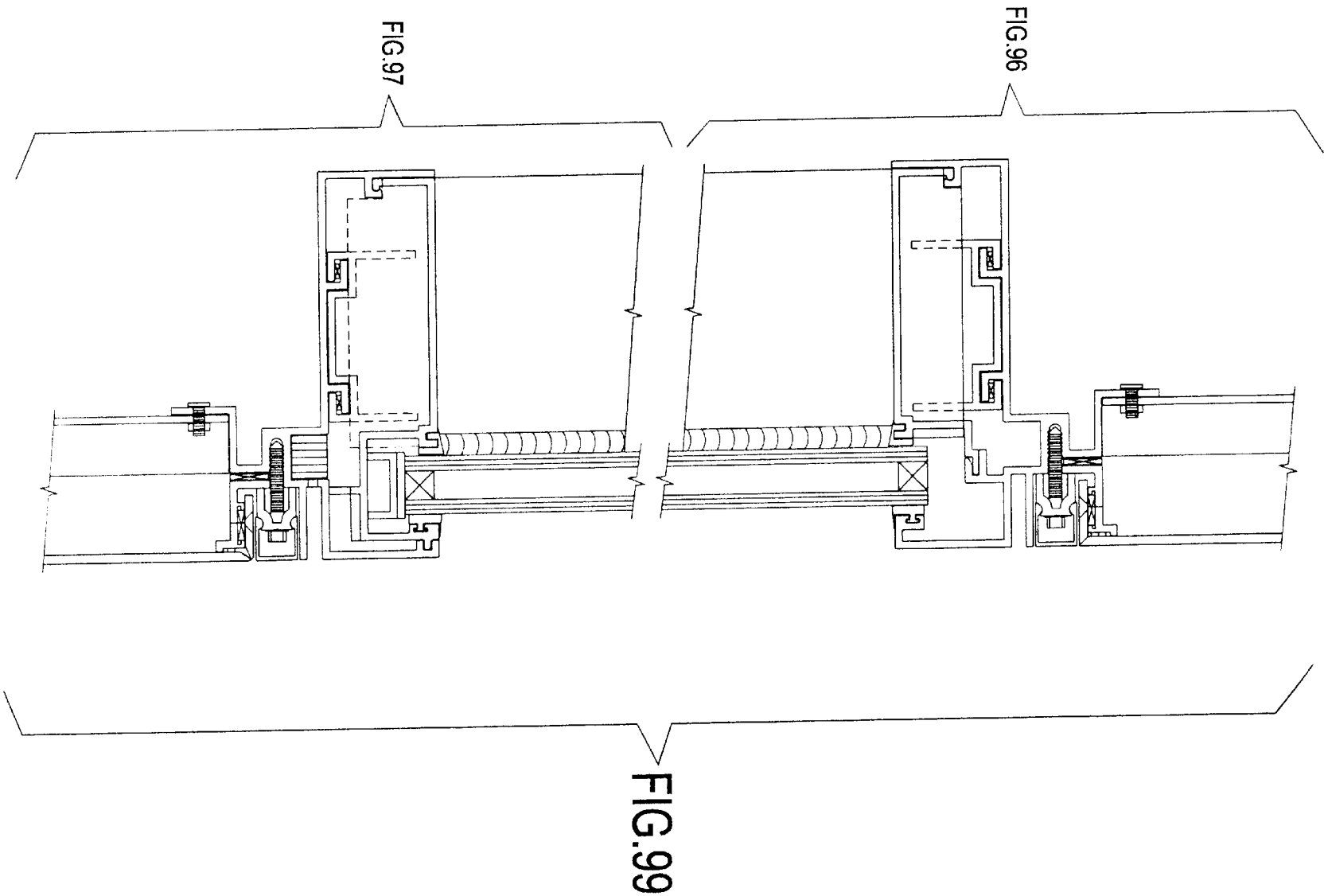
FIG. 99 is a vertical sectional view of a glass panel assembly using FIGS. 96 and 97.

FIG. 99 is a vertical sectional view of a glass panel assembly using FIGS. 96 and 97.

Figures 96, 97, 100:
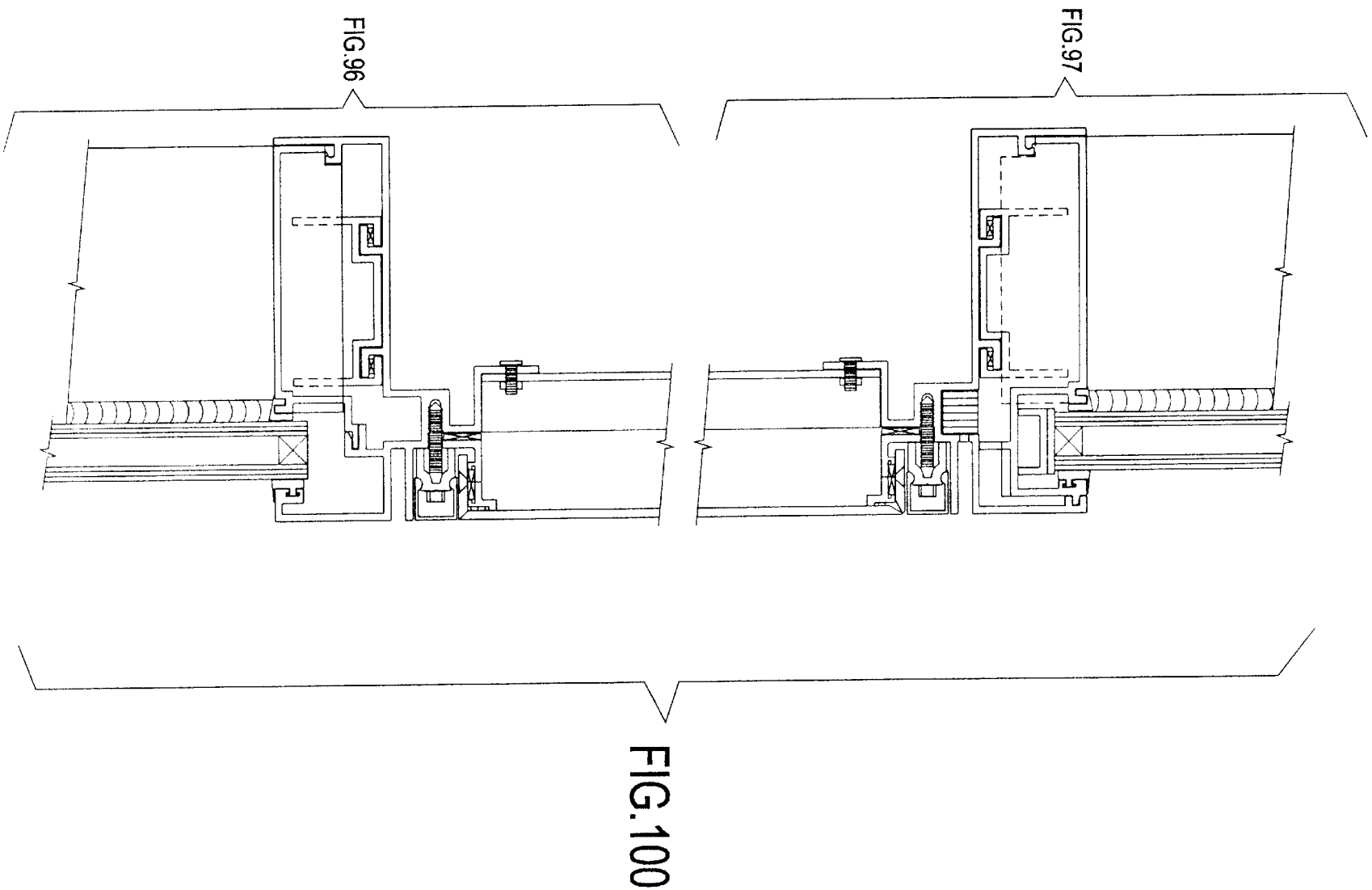
FIG. 100 is a vertical sectional view of a panel assembly using FIGS. 96 and 97.

FIG. 100 is a vertical sectional view of a panel assembly using FIGS. 96 and 97.

Figure 101:
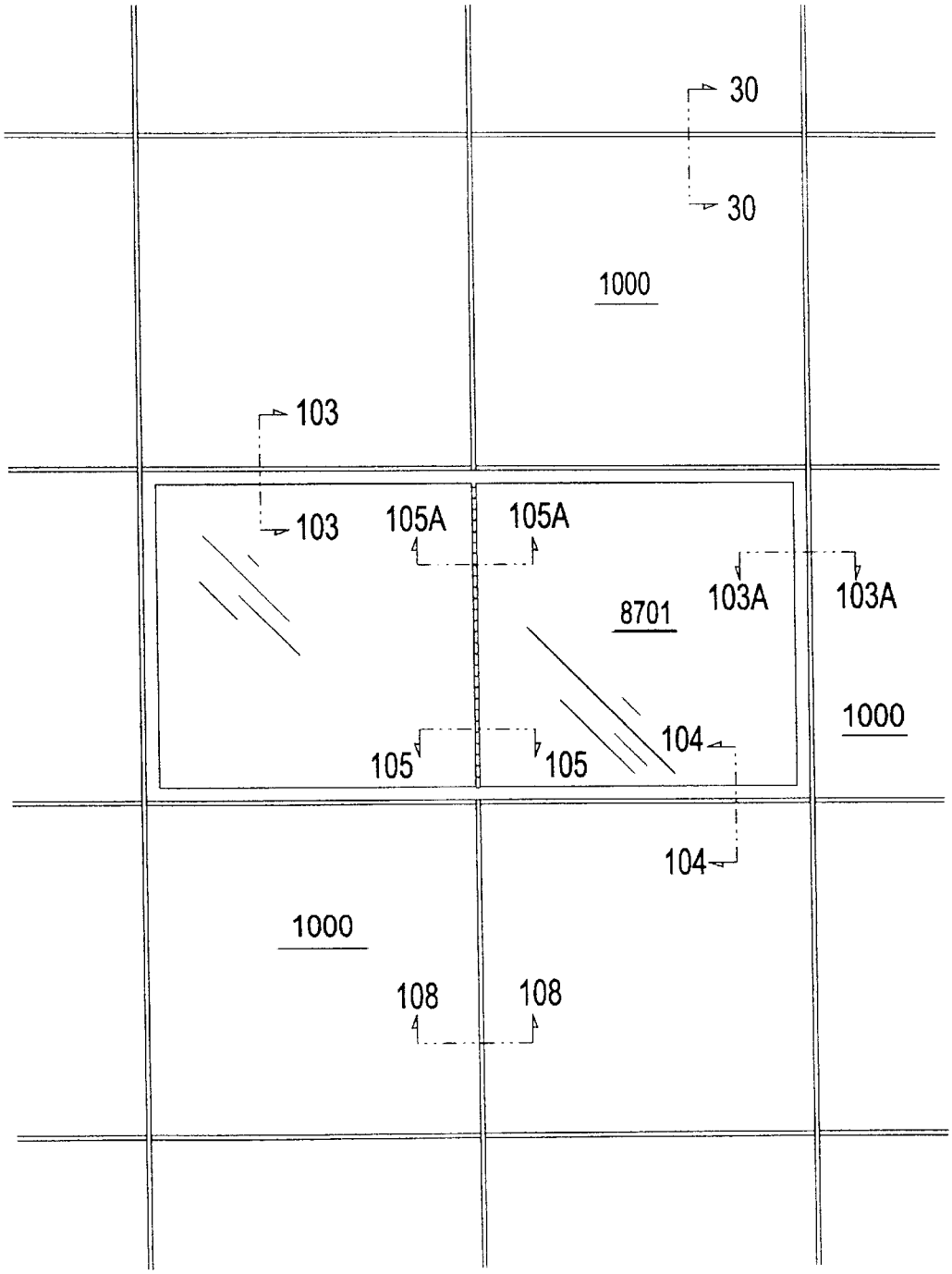
FIG. 101 is a frontal view of a partial building structure showing alternate embodiment DPS 5000CW incorporating structural vertical mullions per FIGS. 24 and 108, as well as, alternate embodiments for window glazing, which include transitions from aluminum composite panel 1000 to glass panel 8701 to aluminum composite panel 1000.
Figure 108:
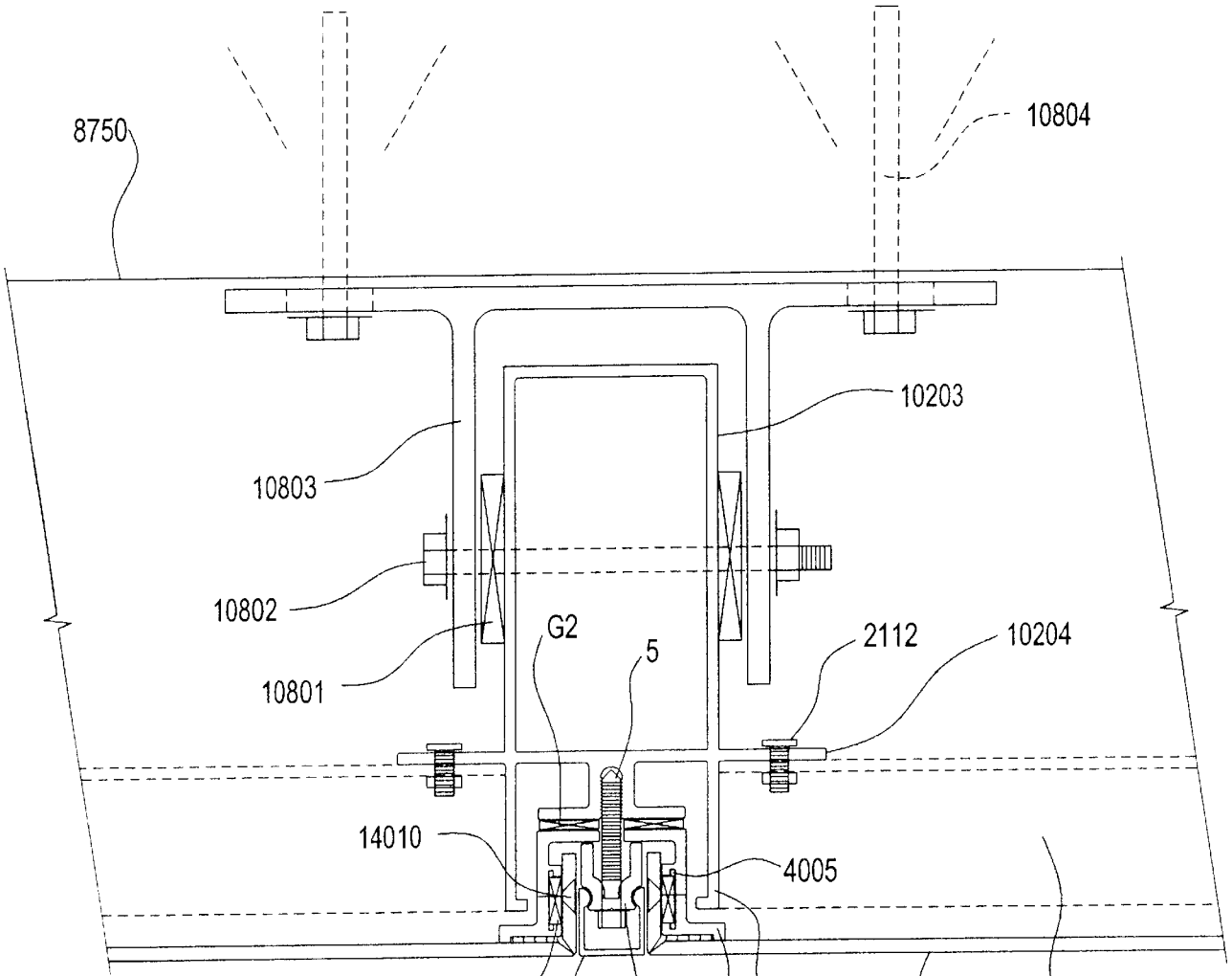
FIG. 108 is a structural vertical mullion 10203 of alternate embodiment DPS 5000CW which provides windload and deadload support for the preferred embodiment by using attachment clip 10803 to connect to building structure 8750 using bolts 10804.

FIG. 101 is a frontal view of a partial building structure showing alternate embodiment DPS 5000CW incorporating structural vertical mullions per FIGS. 24 and 108, as well as, alternate embodiments for window glazing, which include transitions from aluminum composite panel 1000 to glass panel 8701 to aluminum composite panel 1000. Lower transition from aluminum composite panel 1000 to glass panel 8701 is accomplished using integrated window sill 8803 as shown in FIG. 104. Upper transition from glass panel 8701 to aluminum composite panel 1000 is accomplished using integrated window head 8804 as shown in FIG. 103. The end or jamb transition from glass panel 8701 to aluminum composite panel 1000 is accomplished using window head 8804, but rotated 90 degrees as shown in FIG. 102A. Glass panel 8701 to glass panel 8701 transition is made using vertical window mullion 8801 as shown in FIGS. 105 and 105A.

Figure 102:
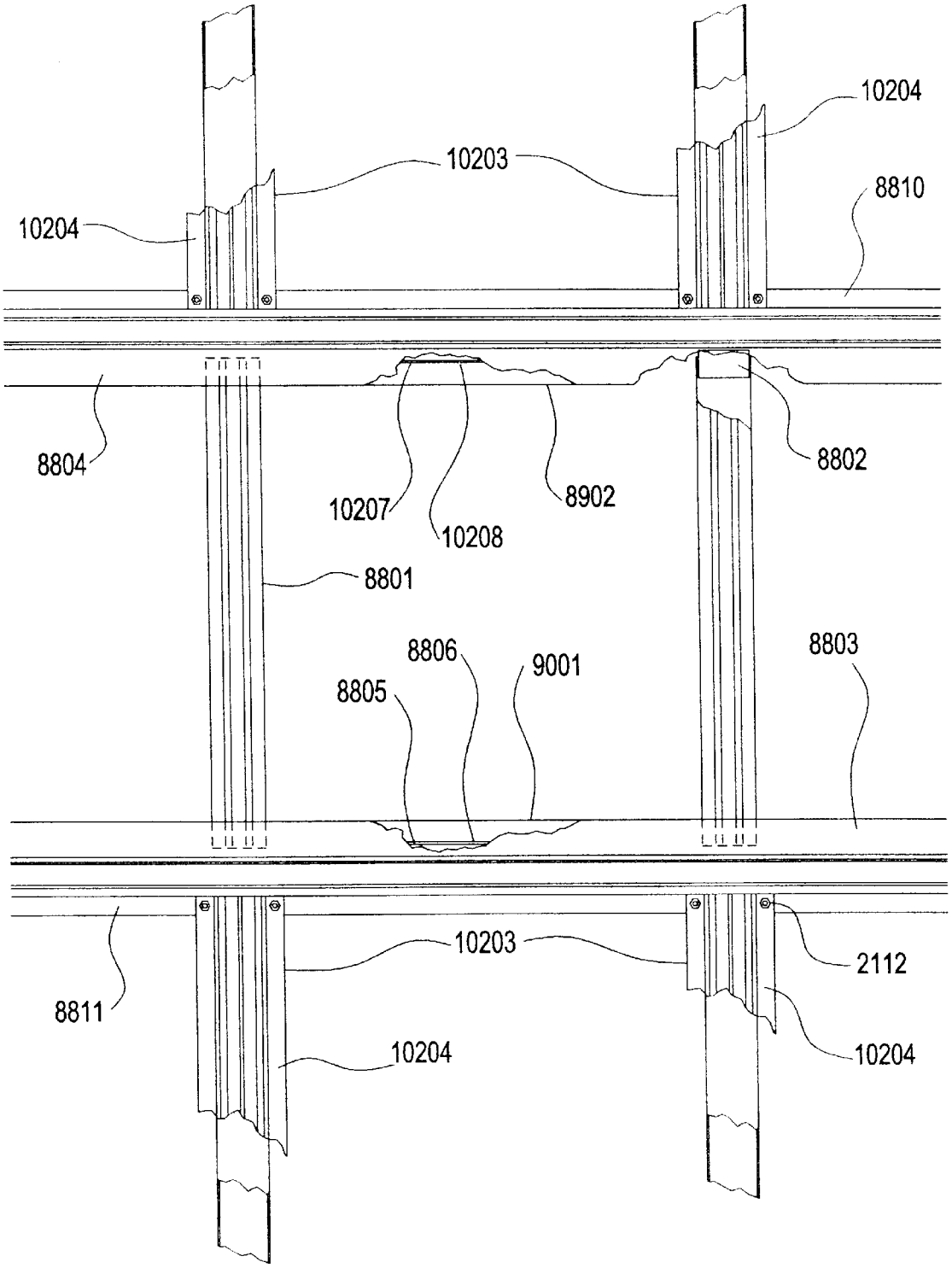
FIG. 102 is a frontal view of framework of alternate embodiment DPS 5000CW incorporating structural vertical mullions per FIGS. 24 and 108 including alternate embodiments for window glazing shown in FIGS. 103 and 104, with aluminum composite panels 1000 and glass panels 8701 removed.
Figure 103:
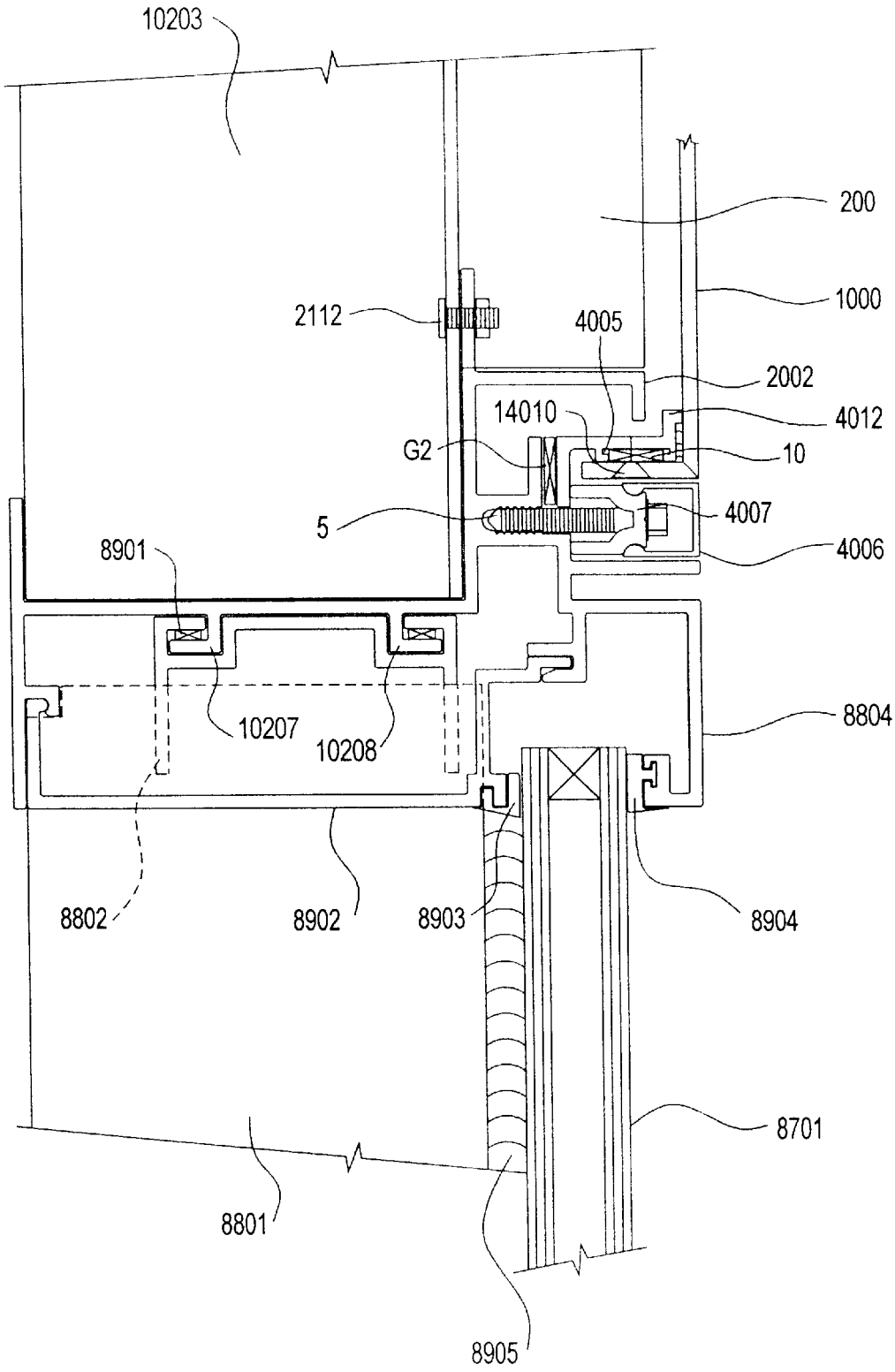
FIG. 103 is a vertical sectional view of the upper transition from glass panel 8701 to aluminum composite panel 1000.
Figure 104:
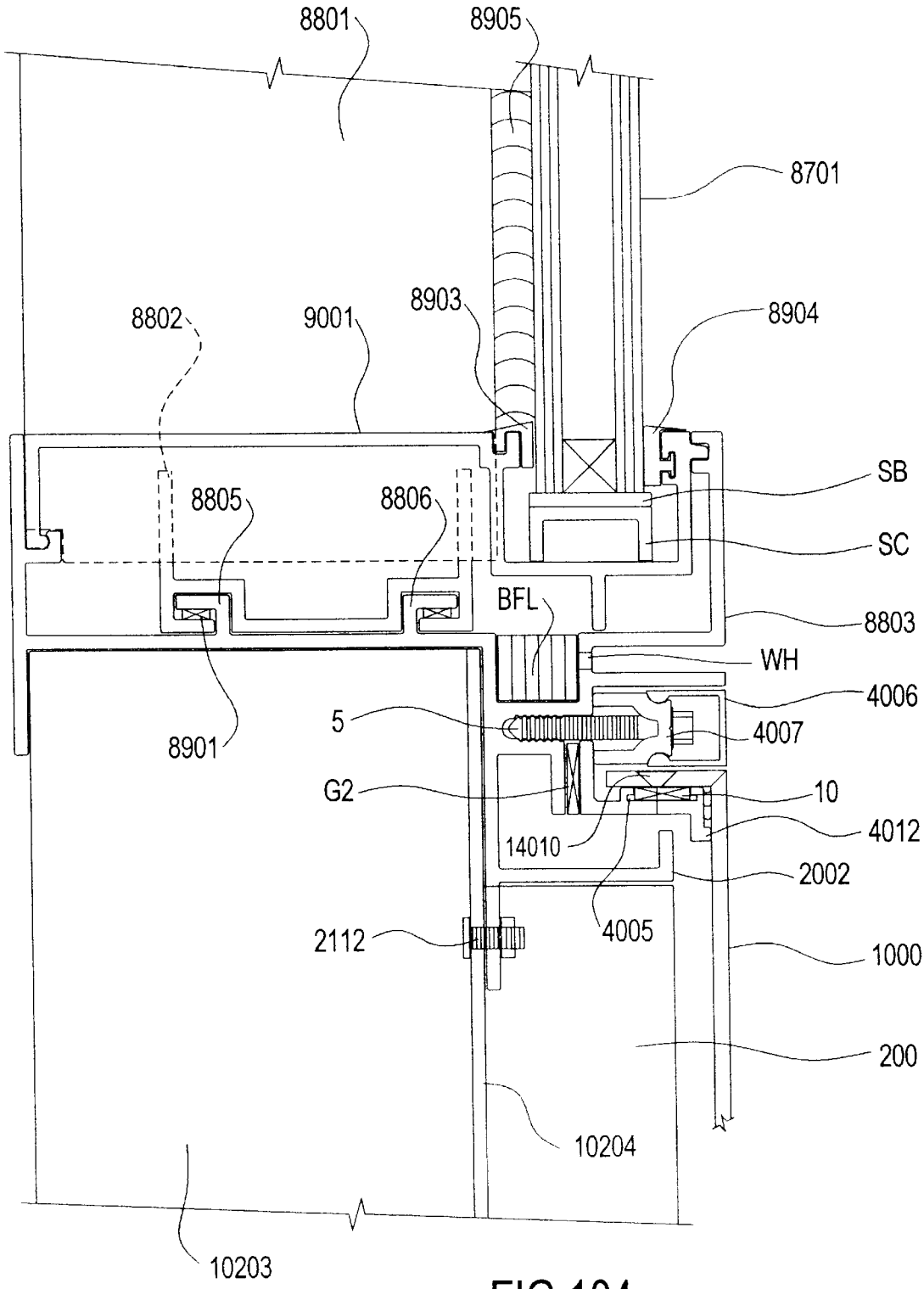
FIG. 104 is a vertical sectional view of the lower transition from glass panel 8701 to aluminum composite panel 1000.
Figure 105:
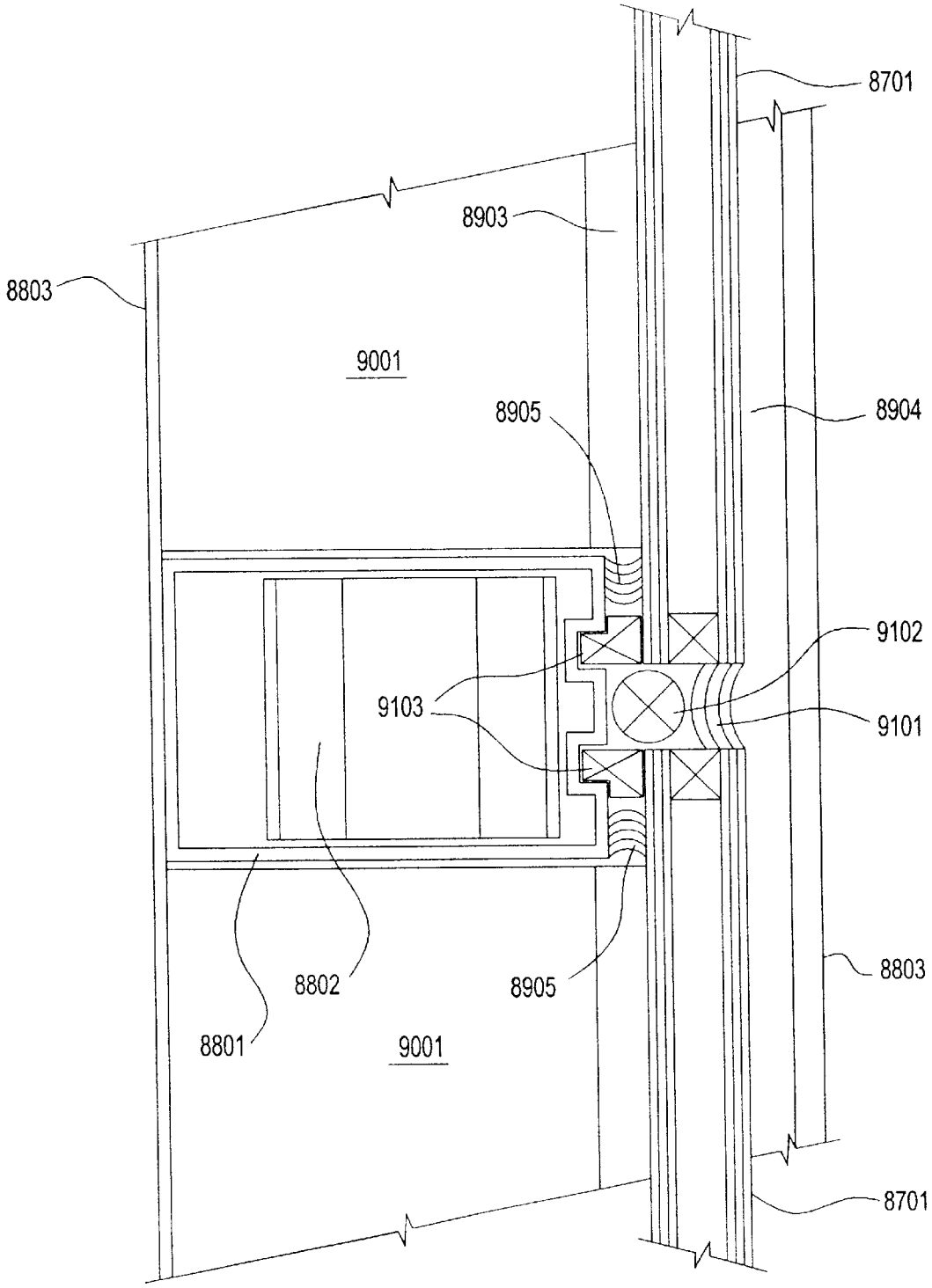
FIGS. 105 and 105A are a horizontal sectional view of vertical window mullion 8801 looking down toward window sill 8803.
Figure 105A:
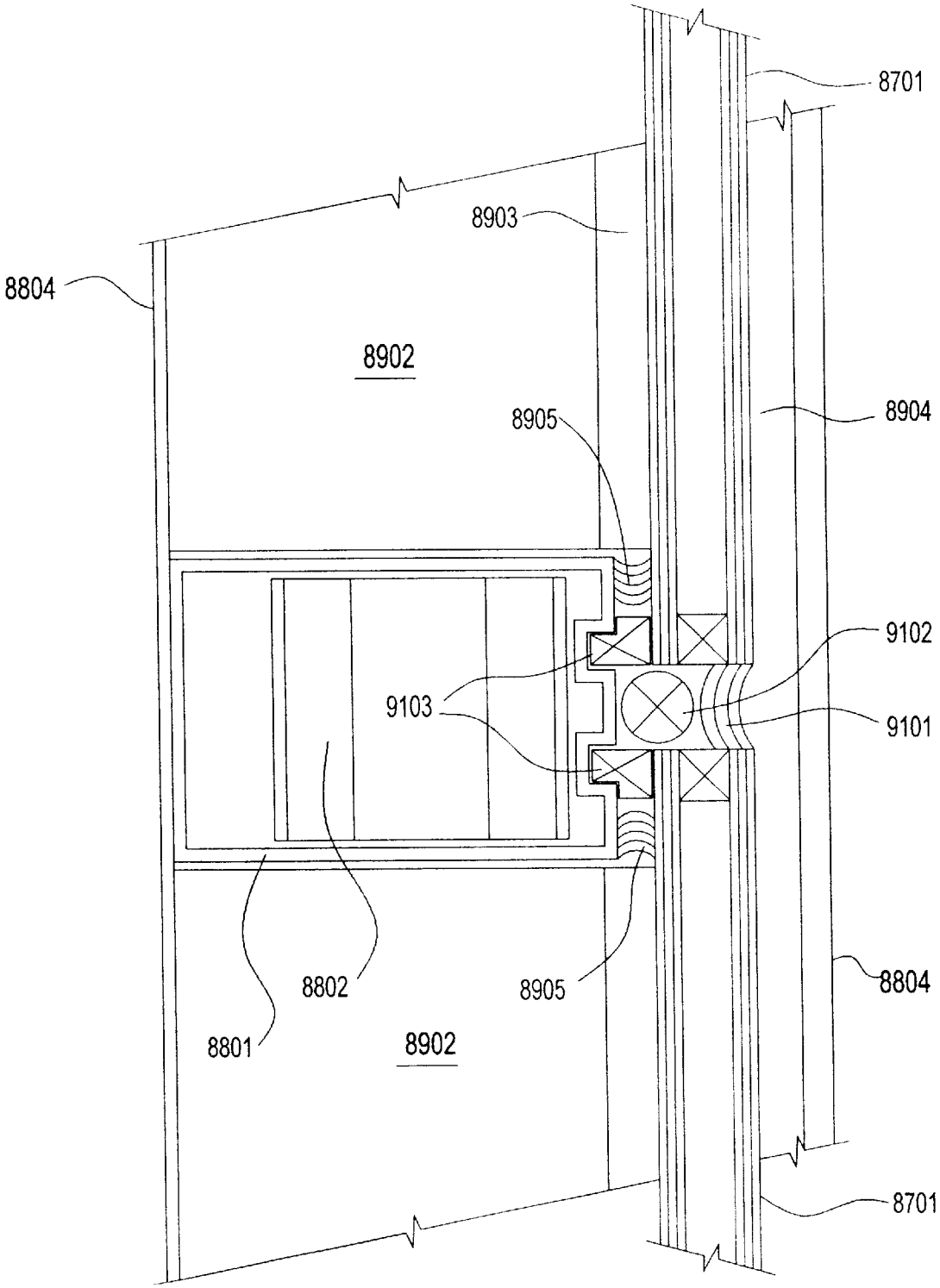

FIG. 102 is a frontal view of framework of alternate embodiment DPS 5000CW incorporating structural vertical mullions per FIGS. 24 and 108 including alternate embodiments for window glazing shown in FIGS. 103 and 104, with aluminum composite panels 1000 and glass panels 8701 removed. From top to bottom, the framework is comprised of structural vertical mullion 10203 vertically transitioning to horizontal window head 8804, and connected through overlapping flanges 10204 and 8810 using flange bolt 2112. Window head 8804 transitions to vertical window mullion 8801 and continues to window sill 8803. Window mullion 8801 is held static at both ends by sliding mullion clip 8802 which rides upon integrated clip rails 10201 and 10202 in window sill 8803, and integrated clip rails 10207 and 10208 in window head 8804. Between each vertical window mullion 8801 is a decorative snap insert; 8902 at window head 8804, and 9001 at window sill 8803. Window sill 8803 transitions to structural vertical mullion 10203 and connects through overlapping flanges 10204 and 8811 using flange bolt 2112. Framework attachment to building structure 8750 is made per FIG. 108.

FIG. 103 is a vertical sectional view of the upper transition from glass panel 8701 to aluminum composite panel 1000. Window head 8804 is connected to structural vertical mullion 10203 using flange bolt 2112. Structural vertical mullion 10203 rests upon gutter leg 2002 of window head 8804. Window head 8804 includes integrated clip rails 10207 and 10208 which form reglets or grooves upon which mullion clip 8802 slides. Vertical window mullion 8801 captures mullion clip 8802 and is made static using clip-stay 8901. Decorative snap cover 8902 fits between vertical window mullions 8801 into window head 8804. Glass panel 8701 is held in window head 8804 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head 8804 by pressure channel 4007 and machine screw 5. Decorative snap cap 4006 covers pressure channel 4007.

Figure 103A:
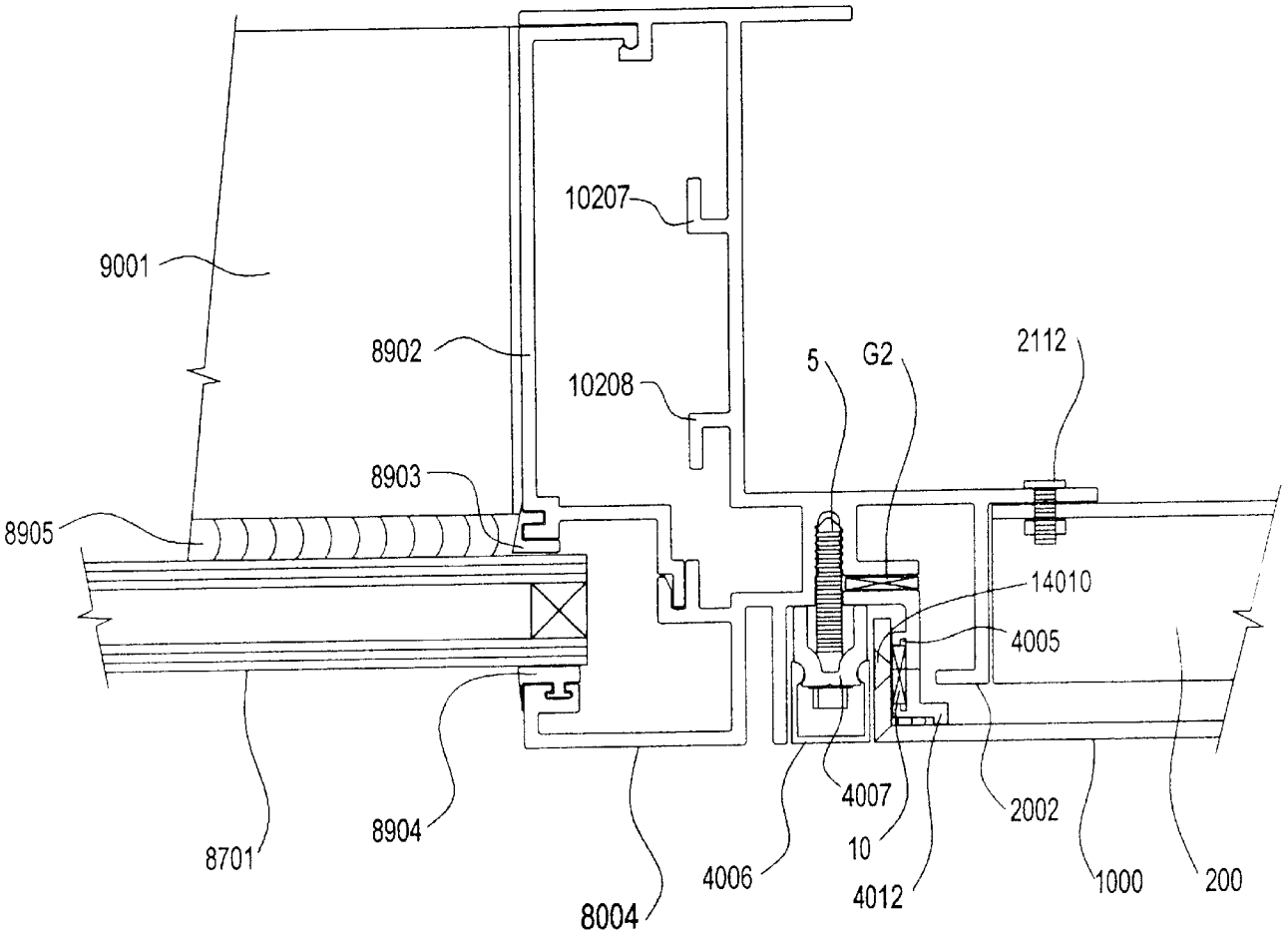
FIG. 103A is a horizontal sectional view of the side transition from glass panel 8701 to aluminum composite panel 1000.

FIG. 103A is a horizontal sectional view of the side transition from glass panel 8701 to aluminum composite panel 1000. Window head 8804 is rotated 90 degrees and used as a window jamb to transition glass panel 8701 to aluminum composite panel 1000. Window head (jamb) insert 8902 snaps in between window head 8804 and window sill 8803 covering slide rails 10207 and 10208. Window sill insert 9001 snaps into window sill 8803 between vertical window mullions 8801. Glass panel 8701 is held in window head (jamb) 8804 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window head (jamb) 8804 by pressure channel 4007 and machine screw 5. Decorative snap cap 4006 covers pressure channel 4007.

FIG. 104 is a vertical sectional view of the lower transition from glass panel 8701 to aluminum composite panel 1000. Window sill 8803 is connected to structural vertical mullion 10203 using flange bolt 2112. Structural vertical mullion 10203 rests against gutter leg 2002 of window sill 8803. Window sill 8803 includes integrated clip rails 8805 and 8806 which form reglets or grooves upon which mullion clip 8802 slides. Vertical window mullion 8801 captures mullion clip 8802 and is made static using clip-stay 8901. Decorative snap cover 9001 fits between vertical window mullions 8801 into window sill 8803. Glass panel 8701 is held in window sill 8803 using gaskets 8904 and 8903. Silicone 8905 provides waterproofing. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window sill 8803 by pressure channel 4007 and machine screw 5. Decorative snap cap 4006 covers pressure channel 4007. Baffle BFL prevents water blockage from debris and negative wind pressure. Weep hole WH allows water to exit to the face of aluminum composite panel 1000.

FIG. 105 is a horizontal sectional view of vertical window mullion 8801 looking down toward window sill 8803. Mullion clip 8802 holds vertical window mullion 8801 static within window sill 8803. Decorative insert 9001 snaps into window sill 8803 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

FIG. 105A is a horizontal sectional view of vertical window mullion 8801 looking up toward window head

8804. Mullion clip 8802 holds vertical window mullion 8801 static within window head 8804. Decorative insert 8902 snaps into window head 8804 in-between vertical window mullions 8801. Spacers 9103 provide cushion and gap for silicone 8905. Gaskets 8903 and 8904 hold glass panel 8701 in place. Backer rod 9102 and face sealant 9101 provide waterproofing.

Figure 106:
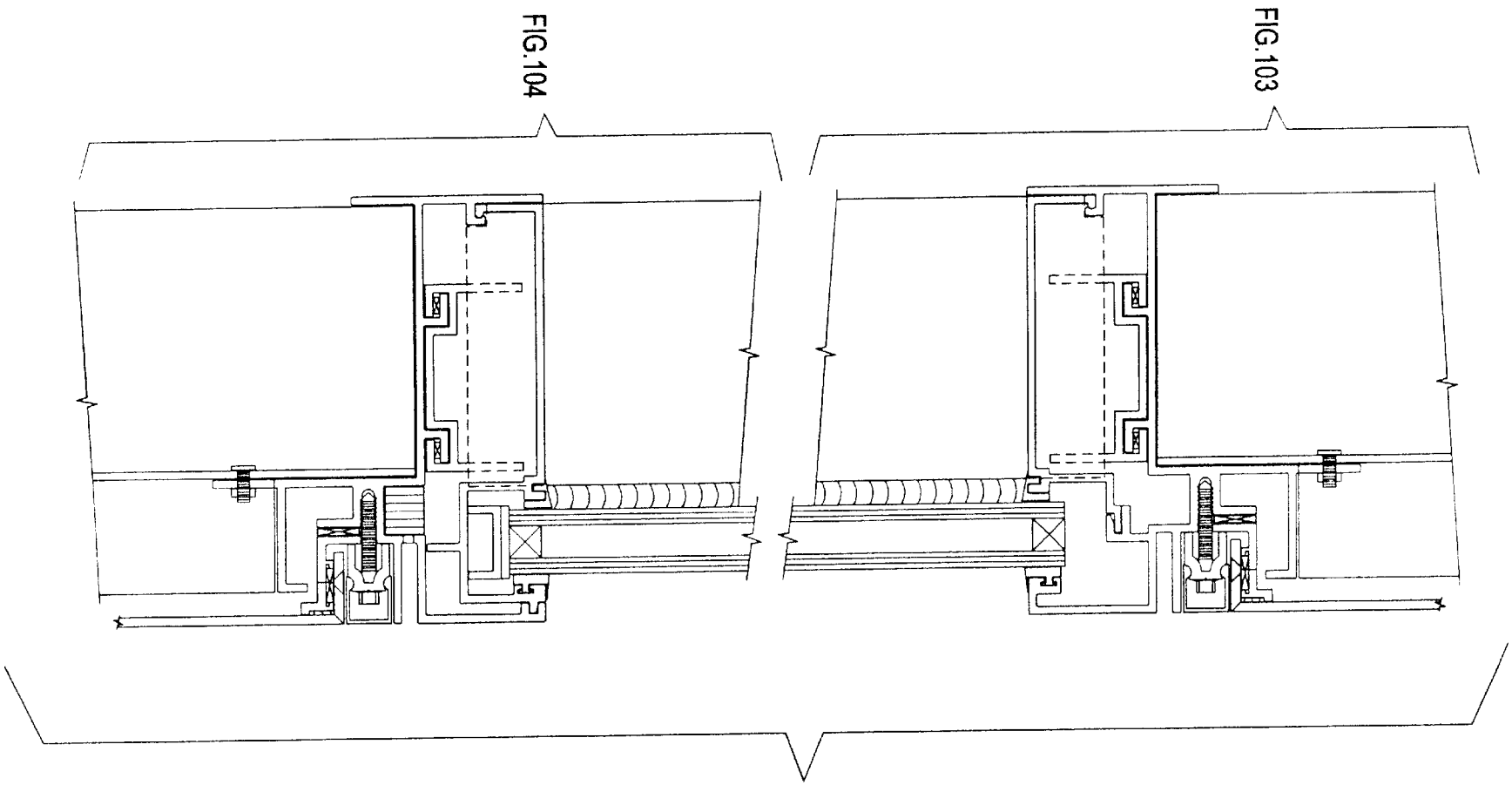
FIG. 106 is a vertical sectional view of a glass panel assembly using FIGS. 103 and 104.

FIG. 106 is a vertical sectional view of a glass panel assembly using FIGS. 103 and 104.

Figures 103, 104, 107:
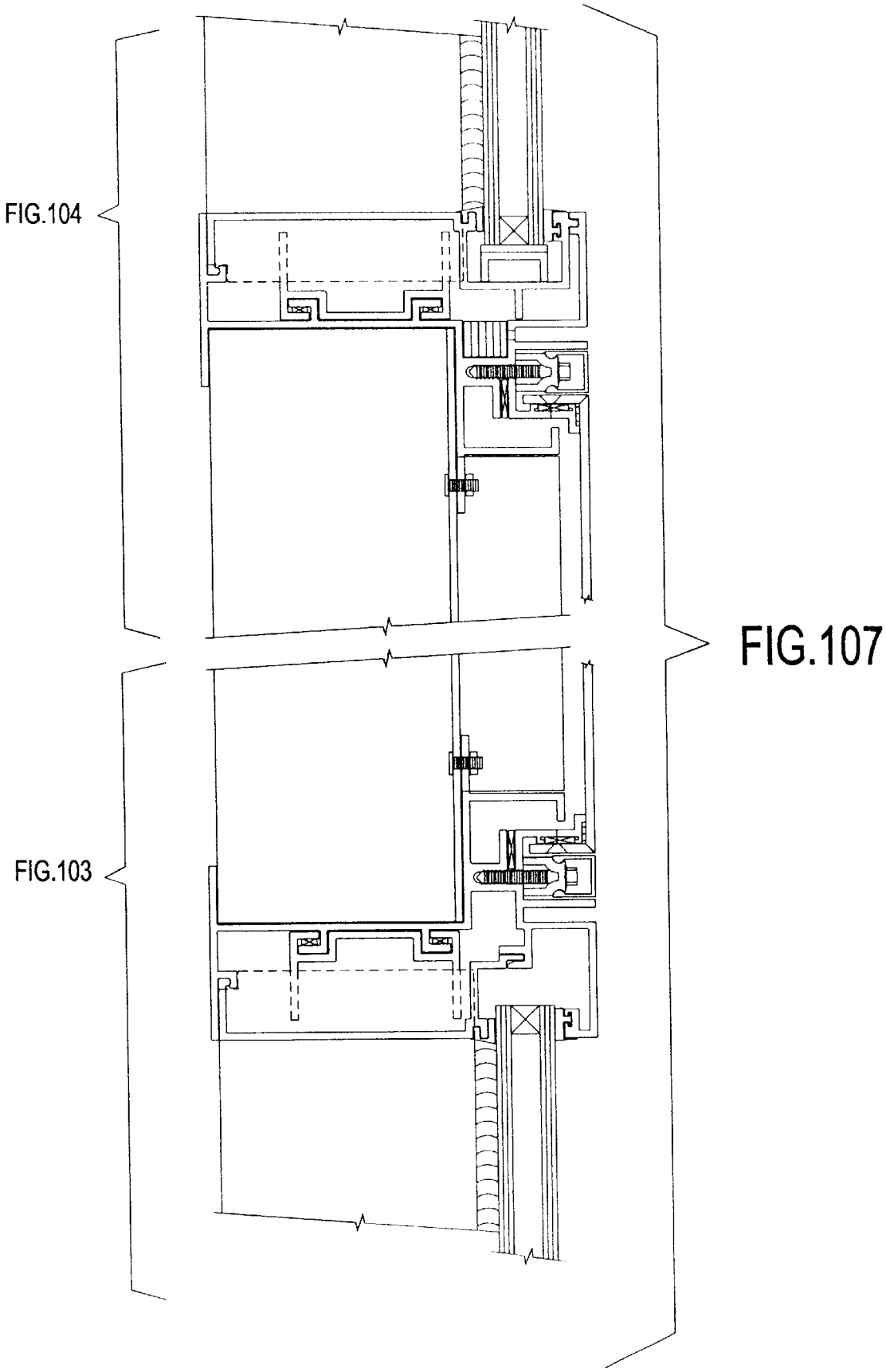
FIG. 107 is a vertical sectional view of a panel assembly using FIGS. 103 and 104.

FIG. 107 is a vertical sectional view of a panel assembly using FIGS. 103 and 104.

FIG. 108 is a structural vertical mullion 10203 of alternate embodiment DPS 5000CW which provides windload and deadload support for the preferred embodiment by using attachment clip 10803 to connect to building structure 8750 using bolts 10804. Assembly bolt 10802 connects structural vertical mullion 10203 to attachment clip 10803. Shim 10801 provides continuous support between structural vertical mullion 10203 and attachment clip 10803. Preferred embodiment attachments to structural vertical mullion 10203 are made to flange 10204. Aluminum composite panel 1000 is mechanically fastened to perimeter extrusion 4012 by fastener 14010. Gasket G2 is attached to the bottom of perimeter extrusion 4012. Panel 1000 corners are joined by integrated clip 4005. Sealant 10 provides water barrier around perimeter extrusion 4012 face and corners. Panel 1000 is attached to window sill 8803 by pressure channel 4007 and machine screw 5. Decorative snap cap 4006 covers pressure channel 4007.

Figure 109:
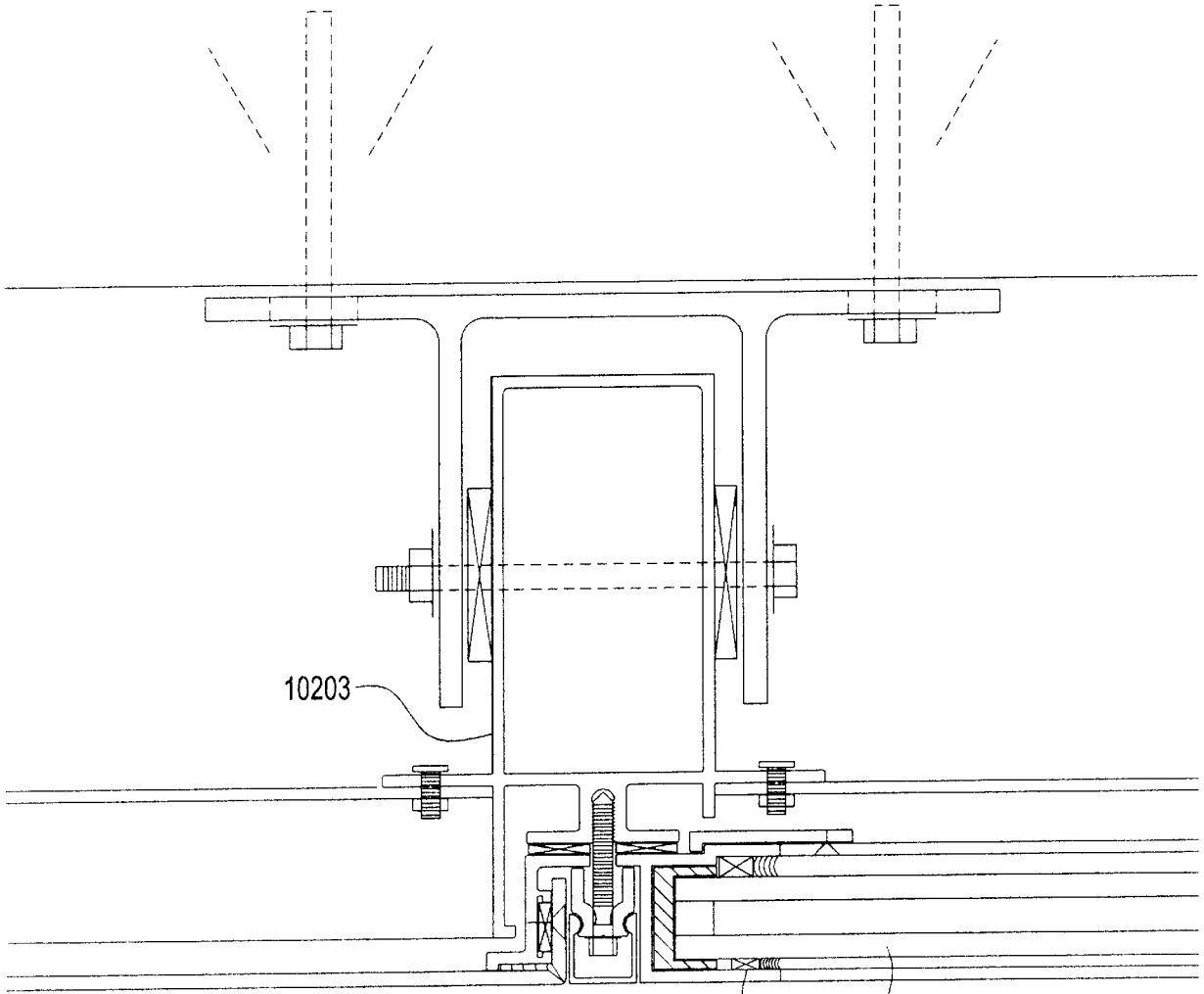
FIG. 109 is identical to FIG. 108, but shows glass panel 8701 integrated into structural vertical mullion 10203 using glazing channel 10901 in lieu of aluminum composite panel 1000.

FIG. 109 is identical to FIG. 108, but shows glass panel 8701 integrated into structural vertical mullion 10203 using glazing channel 10901 in lieu of aluminum composite panel 1000.

Figure 110:
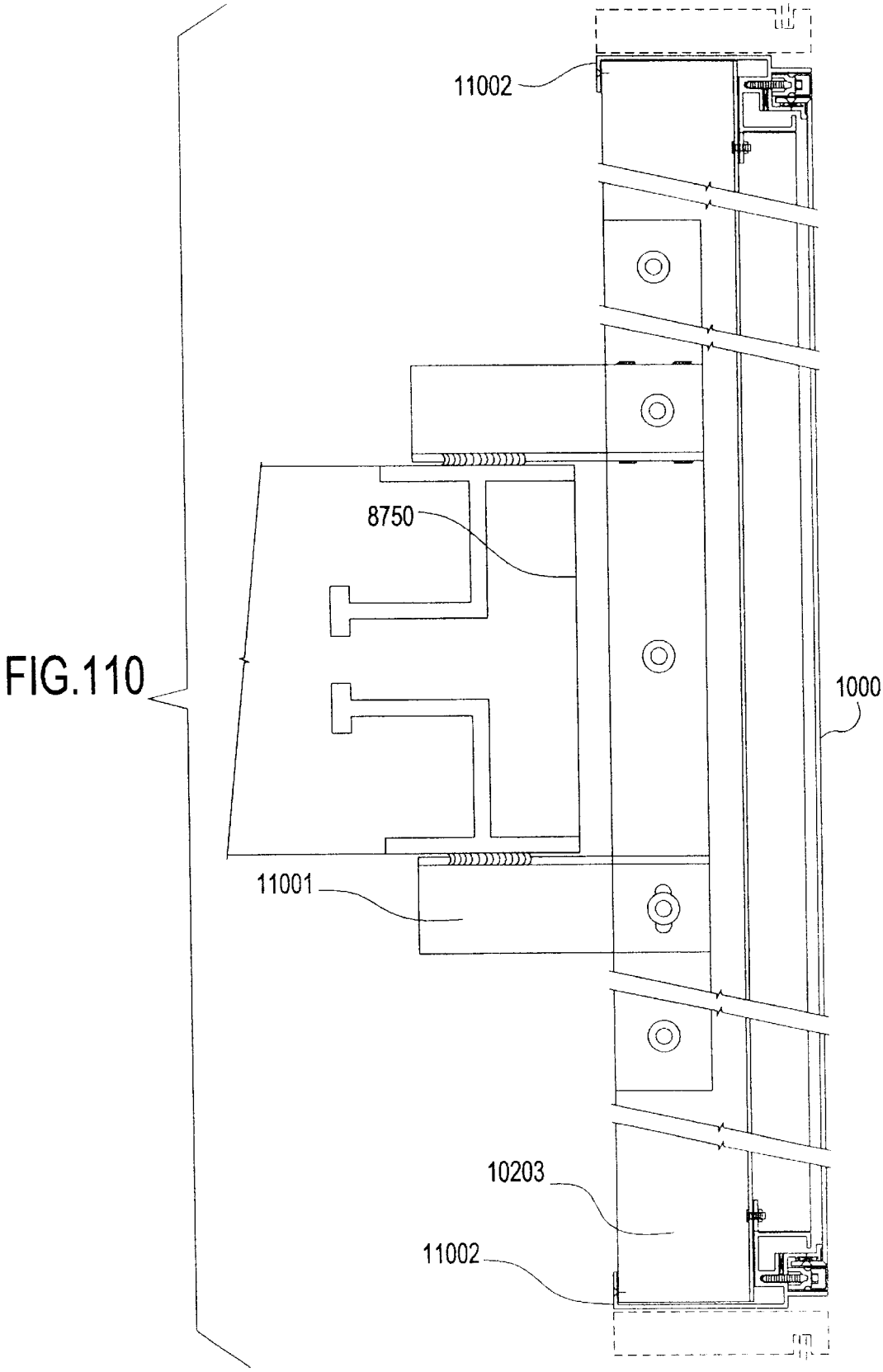
FIG. 110 is a vertical sectional view of alternate embodiment DPS 5000CW assembled as a unit incorporating structural vertical mullion 10203 and guttered end closure 11002.

FIG. 110 is a vertical sectional view of alternate embodiment DPS 5000CW assembled as a unit incorporating structural vertical mullion 10203 and guttered end closure 11002. The assembled unit is know in the industry as being unitized, and supports its own weight plus the aluminum composite panel 1000 by attachment to building structure 8750 using structural floor attachment assembly 11001.

Figure 111:
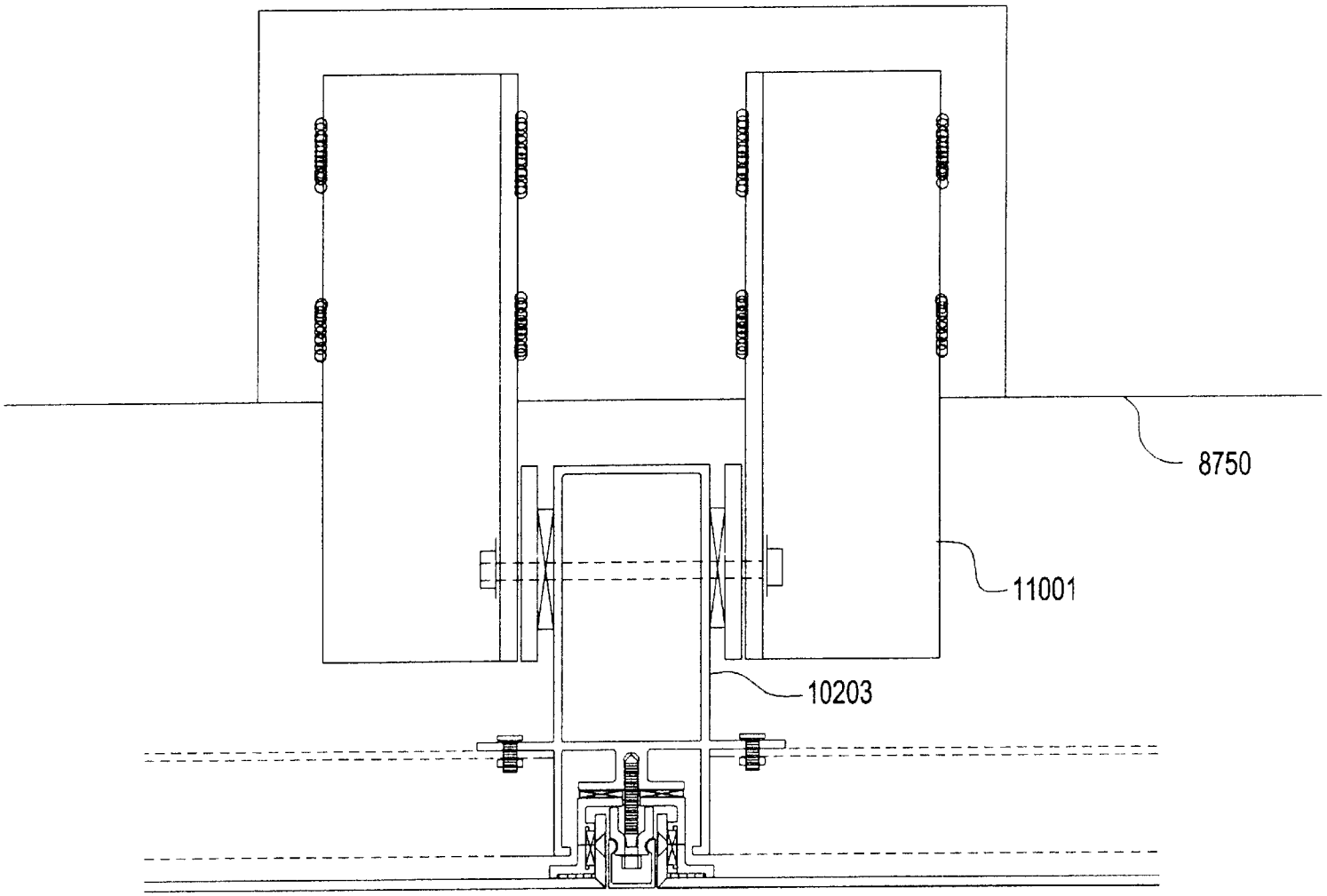
FIG. 111 is a horizontal sectional view of alternate embodiment DPS 5000CW showing top view of structural vertical mullion 10203 being supported by structural floor attachment assembly 11001 to building structure 8750.

FIG. 111 is a horizontal sectional view of alternate embodiment DPS 5000CW showing top view of structural vertical mullion 10203 being supported by structural floor attachment assembly 11001 to building structure 8750.

Figure 112:
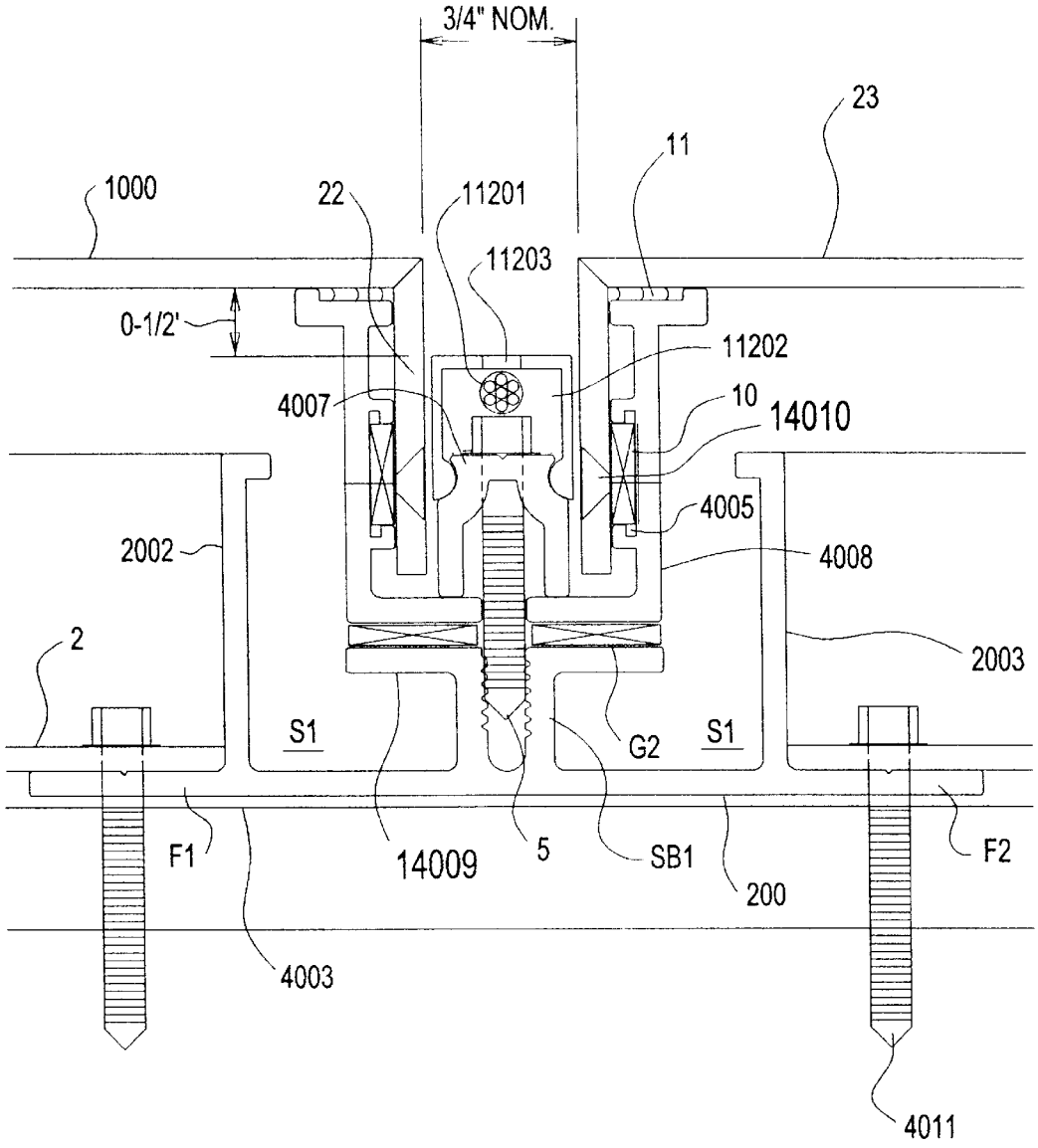
FIG. 112 is a horizontal sectional review or an alternate embodiment illustrating the use of a light source.

FIG. 112 is a horizontal sectional review or an alternate embodiment illustrating the use of a light source. The light source 11201 could be fiber optics, rope light, LED, hardwire with bulbs, located within the fastener channel 11202 and covered with light transmittable cover 11203 which could be perforated or translucent.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A curtain wall system comprising:

a plurality of first support members extending in a first direction, each of the first support members including:

a base portion extending in the first direction, a grooved channel extending substantially perpendicularly from the base portion, such that an opening of the grooved channel faces away from the base portion, two gutter walls, each of the gutter walls extending substantially perpendicularly from the base portion and extending along the base portion on a side of the grooved channel, and two edge portions that form part of the base portion and are configured to be fastened to a building structure, such that the gutter walls are between the edge portions and the grooved channel; and a plurality of second support members extending in a second direction substantially perpendicular to the first direction and being connected to the first support members, each of the second support members comprising:

a base portion extending in the first direction, a grooved channel extending substantially perpendicularly from the base portion, such that an opening of the grooved channel faces away from the base portion, two gutter walls, each of the gutter walls extending substantially perpendicularly from the base portion and extending along the base portion on a side of the grooved channel, and two edge portions forming part of the base portion that are configured to be fastened to the building structure, such that the gutter walls are between the edge portions and the grooved channel, wherein, at a connection between one of the first support members and one of the second support members, a gap is formed in the gutter walls of the connected first support member, and the gutter walls of the connected second support member meet the gutter walls of the connected first support member.

2. The curtain wall system of claim 1, wherein the first support members comprise extruded metal.

3. The curtain wall system of claim 1, wherein the second support members comprise extruded metal.

4. The curtain wall system of claim 1, wherein the edge portions of the connected second support member overlap the edge portions of the connected first support member so as to accept a fastener to structurally join the connected first support member and the connected second support member.

5. A curtain wall system comprising:

a plurality of support members, each of the support members including:

a base portion, a grooved channel extending substantially perpendicularly from the base portion, such that an opening of the grooved channel faces away from the base portion, two gutter walls, each of the gutter walls extending substantially perpendicularly from the base portion and extending along the base portion on a side of the grooved channel, two edge portions that form part of the base portion and are configured to be fastened to a building structure, such that the gutter walls are between the edge portions and the grooved channel, and two flange portions, each of the flange portions extending from a side of the grooved channel; and a plurality of perimeter brace members, each of the perimeter brace members including:

a lower edge extending along a length of the perimeter brace member and shaped for positioning on one of the flange portions of the support members, an extension portion extending perpendicularly from the lower edge, and a rim portion at a distal end of the extension portion, the rim portion being shaped to fit along and hold sealant against an inner edge of a right angle bend in a building panel.

6. The curtain wall system of claim 5, wherein the support members comprise extruded metal.

7. The curtain wall system of claim 5, further comprising a plurality of securing members configured to accept fasteners that extend into the grooved channel to secure the perimeter brace members to the support members.

8. A curtain wall system comprising:

a plurality of support members, each of the support members including:

a gutter extending along a length of the support member, the gutter having a base surface and two walls that extend substantially perpendicularly from the base surface, a fastener channel formed of two parallel surfaces each having a plurality of parallel grooves along an entire length thereof, the fastener channel extending along the base surface between the walls, such that an opening of the fastener channel faces away from the base surface, and the fastener channel having a flat surface extending along a length of the fastener channel, the flat surface being substantially parallel to the base surface, and edge portions extending along the length of the support member outside of the walls, the edge portions being configured for fastening to a building structure; and a plurality of brace members, each of the brace members including:

a first surface extending along a length of the brace member and configured for positioning on the flat surface of the fastener channel of one of the support members;

a second surface extending substantially perpendicularly from the first surface; and an L-shaped portion at a end of the second surface opposite to the first surface, the L-shaped portion being configured to fit along an inner edge of a right angle bend in a building panel so as to leave a rectangular volume between the L-shaped portion and the inner edge.

9. The curtain wall system of claim 8, wherein the edge portions are substantially parallel to the base surface.

10. A curtain wall system comprising:

a plurality of first support members extending in a first direction, each of the first support members including:

a base portion extending in the first direction, a grooved channel extending substantially perpendicularly from the base portion, such that an opening of the grooved channel faces away from the base portion, the grooved channel having two flange portions, each of the flange portions extending from a side of the grooved channel, two gutter walls, each of the gutter walls extending substantially perpendicularly from the base portion and extending along the base portion on a side of the grooved channel, and two edge portions that form part of the base portion and are configured to be fastened to a building structure, such that the gutter walls are between the edge portions and the grooved channel;

a plurality of second support members extending in a second direction substantially perpendicular to the first direction and being connected to the first support members, each of the second support members comprising:

a base portion extending in the first direction, a grooved channel extending substantially perpendicularly from the base portion, such that an opening of the grooved channel faces away from the base portion, the grooved channel having two flange portions, each of the flange portions extending from a side of the grooved channel, two gutter walls, each of the gutter walls extending substantially perpendicularly from the base portion and extending along the base portion on a side of the grooved channel, and two edge portions forming part of the base portion that are configured to be fastened to the building structure, such that the gutter walls are between the edge portions and the grooved channel; and a rectangular perimeter brace, the perimeter brace being fastened on the flange portions of two adjacent ones of the first support members and on the flange portions of two adjacent ones of the second support members with a gasket being positioned between the perimeter brace and the first and second support members, wherein the perimeter brace comprises:

a lower edge that is arranged to be positioned on the flange portions of the first and second support members, an extension portion that extends from the lower edge and is perpendicular to the lower edge, and a rim portion at a distal end of the extension portion, the rim portion being shaped to fit along and hold sealant against an inner edge of a right angle bend in a building panel.

11. The curtain wall system of claim 10, further comprising a plurality of third support members positioned on edges of the perimeter brace, wherein the perimeter brace is fastened to the first and second support members using fasteners that are secured through the third support members into the grooved channels of the first and second support members.

12. The curtain wall system of claim 10, wherein the perimeter brace comprises four similarly-shaped extruded members joined to form a rectangle.

13. The curtain wall system of claim 10, wherein the perimeter brace further comprises a bracketed portion on the extension portion of the perimeter brace, the bracketed portion being configured to hold sealing tape.

* * * * *